US011291293B2

(12) United States Patent
Jimenez et al.

(10) Patent No.: US 11,291,293 B2
(45) **Date of Patent: *Apr. 5, 2022**

(54) ORAL CARE IMPLEMENT

(71) Applicant: Colgate-Palmolive Company, New York, NY (US)

(72) Inventors: Eduardo Jimenez, Manalapan, NJ (US); Kenneth Waguespack, North Brunswick, NJ (US); Robert Moskovich, Manakin-Sabot, VA (US); Andreas Wechsler, Zell am See (AT); Joachim Storz, Zell am See (AT)

(73) Assignee: Colgate-Palmolive Company, New York, NY (US)

( * ) Notice: Subject to any disclaimer, the term of this patent is extended or adjusted under 35 U.S.C. 154(b) by 342 days.

This patent is subject to a terminal disclaimer.

(21) Appl. No.: 16/296,309

(22) Filed: Mar. 8, 2019

(65) Prior Publication Data

US 2019/0200744 A1 Jul. 4, 2019

Related U.S. Application Data

(63) Continuation-in-part of application No. 15/539,342, filed as application No. PCT/US2014/072036 on Dec.

(Continued)

(51) Int. Cl.

*A46B 9/04* (2006.01)
*A46B 9/06* (2006.01)

(Continued)

(52) U.S. Cl.

CPC ..... *A46B 9/04* (2013.01); *A46B 9/06* (2013.01); *A46B 9/025* (2013.01); *A46B 2200/1066* (2013.01); *A46D 3/045* (2013.01)

(58) Field of Classification Search

CPC ... A46B 9/04; A46B 2200/1066; A46B 9/025; A46B 9/026

(Continued)

(56) References Cited

U.S. PATENT DOCUMENTS 758,764 A 5/1904 MacLeod
846,900 A 3/1907 Bloom (Continued)

FOREIGN PATENT DOCUMENTS

AR 71556 10/2003
AR 80042 11/2009

(Continued)

OTHER PUBLICATIONS

International Search Report and the Written Opinion issued in International Application PCT/US2010/046806 dated Mar. 16, 2011.

(Continued)

*Primary Examiner* — Laura C Guidotti

(57) ABSTRACT

An oral care implement having tooth cleaning elements and an elastomeric soft tissue cleanser. In one aspect, the oral care implement has a handle and a head coupled to the handle, an elastomeric soft tissue cleanser having a plurality of protuberances extending from a rear surface of the head, and a plurality of tooth cleaning elements extending from a front surface of the head. The protuberances of the elastomeric soft tissue cleanser collectively define a convex longitudinal side profile and comprise at least one convex transverse top profile. The plurality of tooth cleaning elements collectively define a concave longitudinal side profile and comprise at least one concave transverse top profile.

12 Claims, 88 Drawing Sheets

Related U.S. Application Data

23, 2014, now Pat. No. 10,687,610, application No. 16/296,309, which is a continuation-in-part of application No. 16/217,836, filed on Dec. 12, 2018, now Pat. No. 10,835,026, which is a continuation of application No. 15/539,357, filed as application No. PCT/US2014/072038 on Dec. 23, 2014, now Pat. No. 10,182,644, application No. 16/296,309, which is a continuation-in-part of application No. 15/539,369, filed as application No. PCT/US2014/072048 on Dec. 23, 2014, now Pat. No. 10,743,646, application No. 16/296,309, which is a continuation-in-part of application No. 15/539,378, filed as application No. PCT/US2014/072052 on Dec. 23, 2014, now Pat. No. 10,426,250, application No. 16/296,309, which is a continuation-in-part of application No. 15/539,388, filed as application No. PCT/US2014/072057 on Dec. 23, 2014, now Pat. No. 10,660,430, application No. 16/296,309, which is a continuation-in-part of application No. 15/539,504, filed as application No. PCT/US2014/072063 on Dec. 23, 2014, now Pat. No. 10,226,118, application No. 16/296,309, which is a continuation-in-part of application No. 15/539,399, filed as application No. PCT/US2014/072066 on Dec. 23, 2014, now Pat. No. 10,455,931, application No. 16/296,309, which is a continuation-in-part of application No. 15/539,411, filed as application No. PCT/US2014/072073 on Dec. 23, 2014, now Pat. No. 10,595,628, application No. 16/296,309, which is a continuation-in-part of application No. 15/539,425, filed as application No. PCT/US2014/072075 on Dec. 23, 2014, now Pat. No. 11,229,281.

(51) Int. Cl.
*A46B 9/02* (2006.01)
*A46D 3/04* (2006.01)

(58) Field of Classification Search
USPC ..... D4/104
See application file for complete search history.

(56) References Cited

U.S. PATENT DOCUMENTS

| | | | |
|---|---|---|---|
| 1,125,532 | A | 1/1915 | Himmel |
| 1,369,966 | A | 3/1921 | Cosens et al. |
| 1,901,230 | A | 3/1933 | Palmer |
| 1,924,152 | A | 8/1933 | Coney et al. |
| 1,935,099 | A | 11/1933 | O'Donnell |
| 2,117,174 | A | 5/1938 | Jones |
| 2,161,349 | A | 6/1939 | Hadden |
| 2,186,005 | A | 1/1940 | Casto |
| 2,305,461 | A | 12/1942 | Spyra |
| 3,792,504 | A | 2/1974 | Smith |
| D273,635 | S | 5/1984 | Stocchi |
| 4,517,701 | A | 5/1985 | Stanford, Jr. |
| 4,958,402 | A | 9/1990 | Weihrauch |
| 5,144,712 | A | 9/1992 | Hansel et al. |
| 5,339,482 | A | 8/1994 | Desimone et al. |
| 5,392,483 | A | 2/1995 | Heinzelman et al. |
| 5,584,690 | A | 12/1996 | Maassarani |
| 5,604,951 | A | 2/1997 | Shipp |
| 5,628,082 | A | 5/1997 | Moskovich |
| 5,651,158 | A | 7/1997 | Halm |
| 5,655,249 | A | 8/1997 | Li |
| D390,706 | S | 2/1998 | Hohlbein et al. |
| 5,735,012 | A | 4/1998 | Heinzelman et al. |
| 5,746,532 | A | 5/1998 | Megill et al. |
| 5,758,383 | A | 6/1998 | Hohlbein |
| 5,781,958 | A | 7/1998 | Meessmann et al. |
| 5,799,353 | A | 9/1998 | Yamamoto et al. |
| 5,802,656 | A | 9/1998 | Dawson et al. |
| 5,839,149 | A | 11/1998 | Scheier et al. |
| D404,205 | S | 1/1999 | Hohlbein |
| D404,206 | S | 1/1999 | Hohlbein |
| 5,862,559 | A | 1/1999 | Hunter |
| 5,863,102 | A | 1/1999 | Waguespack et al. |
| 5,908,038 | A | 6/1999 | Bennett |
| 5,915,868 | A | 6/1999 | Frazell |
| 5,930,860 | A | 8/1999 | Shipp |
| 5,946,758 | A | 9/1999 | Hohlbein et al. |
| 5,967,152 | A | 10/1999 | Rimkus |
| 5,970,564 | A | 10/1999 | Inns et al. |
| 5,984,935 | A | 11/1999 | Budei et al. |
| 5,991,958 | A | 11/1999 | Hohlbein |
| 6,006,394 | A | 12/1999 | Bredall et al. |
| 6,015,293 | A | 1/2000 | Rimkus |
| 6,032,313 | A | 3/2000 | Tsang |
| 6,041,468 | A | 3/2000 | Chen et al. |
| 6,073,299 | A | 6/2000 | Hohlbein |
| 6,088,870 | A | 7/2000 | Hohlbein |
| D429,887 | S | 8/2000 | Hohlbein et al. |
| 6,099,780 | A | 8/2000 | Gellert |
| 6,131,228 | A | 10/2000 | Chen et al. |
| 6,178,583 | B1 | 1/2001 | Volpenhein |
| 6,202,241 | B1 | 3/2001 | Hassell et al. |
| 6,219,874 | B1 | 4/2001 | Van Gelder et al. |
| 6,234,798 | B1 | 5/2001 | Salazar et al. |
| 6,272,714 | B2 | 6/2001 | Beals |
| 6,276,021 | B1 | 8/2001 | Hohlbein |
| 6,292,973 | B1 | 9/2001 | Moskovich et al. |
| D450,457 | S | 11/2001 | Hohlbein |
| D450,929 | S | 11/2001 | Angelini et al. |
| 6,314,606 | B1 | 11/2001 | Hohlbein |
| D451,286 | S | 12/2001 | Hohlbein |
| D456,138 | S | 4/2002 | Hohlbein |
| D456,139 | S | 4/2002 | Hohlbein |
| 6,370,726 | B1 | 4/2002 | Kini et al. |
| D457,323 | S | 5/2002 | Hohlbein |
| 6,397,425 | B1 | 6/2002 | Szczech et al. |
| 6,408,476 | B1 | 6/2002 | Cann |
| 6,421,867 | B1 | 7/2002 | Weihrauch |
| D461,313 | S | 8/2002 | Hohlbein |
| 6,442,786 | B2 | 9/2002 | Halm |
| 6,442,787 | B2 | 9/2002 | Hohlbein |
| D464,133 | S | 10/2002 | Barnett et al. |
| 6,463,618 | B1 | 10/2002 | Zimmer |
| D474,608 | S | 5/2003 | Hohlbein |
| 6,564,416 | B1 | 5/2003 | Claire et al. |
| 6,596,213 | B2 | 6/2003 | Swenson |
| 6,595,087 | B2 | 7/2003 | Whalen et al. |
| 6,599,048 | B2 | 7/2003 | Kuo |
| 6,601,272 | B2 | 8/2003 | Stvartak et al. |
| 6,658,688 | B2 | 12/2003 | Gavney, Jr. |
| D486,649 | S | 2/2004 | Sprosta et al. |
| 6,687,940 | B1 | 2/2004 | Gross et al. |
| 6,749,788 | B1 | 6/2004 | Holden et al. |
| 6,766,549 | B2 | 7/2004 | Klupt |
| 6,792,642 | B2 | 9/2004 | Wagstaff |
| 6,820,299 | B2 | 11/2004 | Gavney, Jr. |
| 6,820,300 | B2 | 11/2004 | Gavney, Jr. |
| 6,859,969 | B2 | 3/2005 | Gavney, Jr. et al. |
| D503,538 | S | 4/2005 | Desalvo |
| 6,886,207 | B1 | 5/2005 | Solanki |
| 6,889,405 | B2 | 5/2005 | Ritrovato et al. |
| 6,895,629 | B1 | 5/2005 | Wenzler |
| 6,919,038 | B2 | 7/2005 | Meyer et al. |
| 6,957,469 | B2 | 10/2005 | Davies |
| D511,249 | S | 11/2005 | Hohlbein |
| 6,972,106 | B2 | 12/2005 | Huber et al. |
| D513,882 | S | 1/2006 | Hohlbein et al. |
| 6,983,507 | B2 | 1/2006 | McDougall |
| 6,988,777 | B2 | 1/2006 | Pfenniger et al. |
| D514,320 | S | 2/2006 | Hohlbein |
| D514,812 | S | 2/2006 | Hohlbein et al. |
| 6,996,870 | B2 | 2/2006 | Hohlbein |
| D516,819 | S | 3/2006 | Hohlbein |
| D517,812 | S | 3/2006 | Hohlbein et al. |
| D517,813 | S | 3/2006 | Hohlbein et al. |

(56) References Cited

U.S. PATENT DOCUMENTS 7,007,332 B2 3/2006 Hohlbein
7,020,928 B2 4/2006 Hohlbein
D520,753 S 5/2006 Hohlbein
7,047,591 B2 5/2006 Hohlbein
7,069,615 B2 7/2006 Gavney, Jr.
7,073,225 B1 7/2006 Ford
D526,487 S 8/2006 Chenvainu et al.
7,083,756 B2 8/2006 Strahler
7,089,621 B2 8/2006 Hohlbein
D527,528 S 9/2006 Hohlbein
D528,803 S 9/2006 Hohlbein
D532,202 S 11/2006 Hohlbein
D532,607 S 11/2006 Hohlbein
7,143,462 B2 12/2006 Hohlbein
7,146,675 B2 12/2006 Ansari et al.
7,168,125 B2 1/2007 Hohlbein
7,181,799 B2 2/2007 Gavney, Jr. et al.
7,182,542 B2 2/2007 Hohlbein
7,213,288 B2 5/2007 Hohlbein
7,219,384 B2 5/2007 Hohlbein
7,273,327 B2 9/2007 Hohlbein et al.
D557,504 S 12/2007 Hohlbein
D557,505 S 12/2007 Hohlbein
7,322,067 B2 1/2008 Hohlbein
D562,560 S 2/2008 Hohlbein
7,331,731 B2 2/2008 Hohlbein et al.
7,354,112 B2 4/2008 Fischer et al.
7,383,619 B2 6/2008 Gross et al.
7,386,909 B2 6/2008 Hohlbein
7,415,788 B2 8/2008 Little
7,458,125 B2 12/2008 Hohlbein
7,472,448 B2 1/2009 Hohlbein et al.
7,478,959 B2 1/2009 Hohlbein
7,480,955 B2 1/2009 Hohlbein et al.
D589,260 S 3/2009 Hohlbein
7,540,844 B2 6/2009 Muser
D598,199 S 8/2009 Russell et al.
D598,654 S 8/2009 Huang
D599,556 S 9/2009 Russell et al.
7,607,189 B2 10/2009 Moskovich
7,614,111 B2 11/2009 Moskovich et al.
D609,915 S 2/2010 Erskine-Smith et al.
D612,611 S 3/2010 Brown, Jr. et al.
7,712,175 B2 5/2010 Blanchard et al.
7,721,376 B2 5/2010 Hohlbein et al.
7,722,274 B2 5/2010 Hohlbein et al.
7,735,174 B2 6/2010 Hohlbein et al.
D623,415 S 9/2010 Geiberger
7,788,756 B2 9/2010 Kraemer
7,836,539 B2 11/2010 Moskovich et al.
7,841,041 B2 11/2010 Moskovich et al.
7,845,042 B2 12/2010 Moskovich et al.
7,854,036 B2 12/2010 Georgi
7,930,792 B2 4/2011 Russell
7,937,794 B2 5/2011 Huber et al.
7,954,191 B2 6/2011 Hohlbein
7,958,589 B2 6/2011 Braun et al.
7,975,343 B2 7/2011 Hohlbein et al.
7,975,346 B2 7/2011 Moskovich et al.
7,979,947 B2 7/2011 Storkel et al.
8,032,991 B2 10/2011 Lawless
8,042,217 B2 10/2011 Sorrentino
8,046,864 B2 11/2011 Baertschi et al.
8,060,970 B2 11/2011 Solanki
8,060,972 B2 11/2011 Geiberger et al.
8,083,980 B2 12/2011 Huber et al.
8,151,397 B2 4/2012 Moskovich et al.
8,201,298 B2 6/2012 Blanchard
8,239,996 B2 8/2012 Garber et al.
8,240,936 B2 8/2012 Vazquez et al.
8,281,448 B2 10/2012 Waguespack et al.
8,307,488 B2 11/2012 Pfenniger et al.
8,327,492 B2 12/2012 Cann
8,332,982 B2 12/2012 Braun et al.
8,332,985 B2 12/2012 Solanki
8,382,208 B2 2/2013 Baertschi et al.
8,448,284 B2 5/2013 Gross et al.
8,448,287 B2 5/2013 Ponzini et al.
8,458,846 B2 6/2013 Schamberg et al.
8,484,789 B2 7/2013 Claire-Zimmet et al.
8,500,766 B2 8/2013 Jimenez et al.
8,528,148 B2 9/2013 Brown, Jr. et al.
8,549,691 B2 10/2013 Moskovich
8,561,247 B2 10/2013 Russell
8,595,886 B2 12/2013 Edelstein et al.
8,601,635 B2 12/2013 Goldman et al.
8,608,251 B2 12/2013 Nirwing et al.
8,621,698 B2 1/2014 Chenvainu et al.
8,631,534 B2 1/2014 Blanchard et al.
8,732,890 B2 5/2014 Mohr et al.
8,739,351 B2 6/2014 Kling et al.
8,776,302 B2 7/2014 Baertschi et al.
8,806,695 B2 8/2014 Moskovich et al.
8,813,292 B2 8/2014 Driesen et al.
8,813,296 B2 8/2014 Rooney
8,876,221 B2 11/2014 Jimenez et al.
8,990,995 B2 3/2015 Jimenez
9,398,802 B2 7/2016 Moskovich et al.
9,462,877 B2 10/2016 Xi et al.
9,526,324 B2 12/2016 Lee
9,585,464 B2 3/2017 Moskovich
9,681,740 B2 6/2017 Lee
9,723,912 B2 8/2017 Chun et al.
D808,659 S 1/2018 Ballmaier et al.
9,855,692 B2 1/2018 Rooney
10,010,164 B2 7/2018 Rooney
10,039,370 B2 8/2018 Norris
10,238,204 B2 3/2019 Lee et al.
10,455,931 B2 10/2019 Jimenez et al.
10,743,646 B2 * 8/2020 Jimenez ..... A46B 9/04
2002/0017003 A1 2/2002 Kramer et al.
2002/0138928 A1 10/2002 Calabrese
2003/0163881 A1 9/2003 Driesen et al.
2003/0178745 A1 9/2003 Scarabelli et al.
2003/0178885 A1 9/2003 Weihrauch
2004/0025275 A1 2/2004 Moskovich et al.
2004/0107521 A1 6/2004 Chan et al.
2004/0117934 A1 6/2004 Pfenniger et al.
2004/0134004 A1 7/2004 Kaleta
2004/0134007 A1 7/2004 Davies
2005/0000048 A1 1/2005 Hohlbein
2005/0166343 A1 8/2005 Gavney, Jr.
2005/0210612 A1 9/2005 Hohlbein et al.
2006/0026784 A1 2/2006 Moskovich et al.
2006/0048314 A1 3/2006 Kressner
2006/0048323 A1 3/2006 Rueb
2006/0064827 A1 3/2006 Chan
2006/0123574 A1 6/2006 Storkel et al.
2006/0236477 A1 10/2006 Gavney, Jr.
2006/0236478 A1 10/2006 Hohlbein et al.
2006/0248667 A1 11/2006 Kraemer
2007/0151058 A1 7/2007 Kraemer et al.
2007/0169295 A1 7/2007 Winter et al.
2007/0265555 A1 11/2007 Deng
2007/0283517 A1 12/2007 Blanchard et al.
2007/0283518 A1 12/2007 Blanchard et al.
2009/0007357 A1 1/2009 Meadows et al.
2009/0025165 A1 1/2009 Moskovich et al.
2009/0038097 A1 2/2009 Geiberger
2009/0158543 A1 6/2009 Lee
2009/0255077 A1 10/2009 Mori et al.
2010/0043162 A1 2/2010 Kling et al.
2010/0058550 A1 3/2010 Ballmaier et al.
2010/0088836 A1 4/2010 Kirchhofer et al.
2010/0101037 A1 4/2010 Hilfiker et al.
2010/0115724 A1 5/2010 Huang
2010/0180392 A1 7/2010 Binet et al.
2010/0223746 A1 9/2010 Mueller
2010/0263149 A1 10/2010 Ballmaier et al.
2010/0306941 A1 12/2010 Erskine-Smith et al.
2011/0030160 A1 2/2011 Knutzen et al.
2011/0047736 A1 3/2011 Jimenez et al.
2011/0138560 A1 6/2011 Vitt et al.
2011/0152909 A1 6/2011 Jimenez et al.

(56) References Cited

U.S. PATENT DOCUMENTS

| | | | | |
|---|---|---|---|---|
| 2011/0219558 | A1 | 9/2011 | Vitt et al. | |
| 2011/0109149 | A1 | 12/2011 | Loetscher et al. | |
| 2012/0034576 | A1 | 2/2012 | Mostafa | |
| 2012/0192369 | A1 | 8/2012 | Mohr et al. | |
| 2012/0255136 | A1 | 10/2012 | Jimenez et al. | |
| 2013/0007968 | A1 | 1/2013 | Driesen et al. | |
| 2013/0036566 | A1 | 2/2013 | Schlatter | |
| 2013/0139338 | A1 | 6/2013 | Hess et al. | |
| 2013/0139339 | A1* | 6/2013 | Hess | A61C 17/3445 15/167.1 |
| 2013/0269128 | A1 | 10/2013 | Jimenez | |
| 2013/0291320 | A1 | 11/2013 | Kirchhofer et al. | |
| 2013/0333126 | A1 | 12/2013 | Miller | |
| 2014/0047656 | A1 | 2/2014 | Newman et al. | |
| 2014/0158152 | A1 | 6/2014 | Kirchhofer et al. | |
| 2014/0173838 | A1 | 6/2014 | Dickie et al. | |
| 2014/0173853 | A1 | 6/2014 | Kirchhofer et al. | |
| 2014/0298605 | A1 | 10/2014 | Ivory | |
| 2014/0310901 | A1 | 10/2014 | Geiberger et al. | |
| 2014/0359959 | A1* | 12/2014 | Jungnickel | A46B 9/06 15/167.1 |
| 2015/0327665 | A1 | 11/2015 | Hohlbein | |
| 2015/0327666 | A1 | 11/2015 | Hohlbein | |
| 2017/0007284 | A1 | 1/2017 | Georgi et al. | |

FOREIGN PATENT DOCUMENTS

| | | | |
|---|---|---|---|
| BR | 7900283 | | 8/2000 |
| BR | DI 6601454-9 | | 4/2006 |
| BR | DI 6702593 | | 8/2007 |
| BR | DI 6805210-3 | | 11/2008 |
| BR | DI 6902120-1 | | 5/2009 |
| BR | DI 6903329-3 | | 8/2009 |
| BR | DI 6903330-7 | | 8/2009 |
| BR | DI 6904386 | | 11/2009 |
| BR | DI 7102178-7 | | 4/2011 |
| BR | 30 2013 000448-1 | | 2/2013 |
| BR | DI 6401609-9 | | 5/2014 |
| CH | 215110 | | 6/1941 |
| CN | 3372860D | | 6/2004 |
| CN | 3372861D | | 6/2004 |
| CN | 2732059 | | 10/2005 |
| CN | 300704339 | | 10/2007 |
| CN | 201157105 | Y | 12/2008 |
| CN | 201294969 | | 8/2009 |
| CN | 201518676 | | 7/2010 |
| CN | 201518877 | | 7/2010 |
| CN | 201518880 | | 7/2010 |
| CN | 201526796 | | 7/2010 |
| CN | 201541995 | | 8/2010 |
| CN | 201541996 | | 8/2010 |
| CN | 201541997 | | 8/2010 |
| CN | 201550827 | | 8/2010 |
| CN | 301406316 | S | 12/2010 |
| CN | 301421505 | S | 12/2010 |
| CN | 201814085 | | 5/2011 |
| CN | 201986933 | | 9/2011 |
| CN | 301763519 | | 12/2011 |
| CN | 30198826 | | 5/2012 |
| CN | 302058056 | | 9/2012 |
| CN | 302225957 | S | 12/2012 |
| CN | 302328863 | S | 2/2013 |
| CN | 202800555 | | 3/2013 |
| CN | 103005839 | | 4/2013 |
| CN | 203194906 | | 9/2013 |
| CN | 203220069 | | 10/2013 |
| CN | 203220073 | | 10/2013 |
| CN | 203252150 | | 10/2013 |
| CN | 302956580 | S | 10/2014 |
| DE | 19858102 | | 6/2000 |
| DE | 202005009026 | | 10/2005 |
| DE | 102006016939 | | 5/2007 |
| DE | 102006005616 | | 8/2007 |
| DE | 102006024874 | | 11/2007 |
| DE | 202008016004 | | 2/2009 |
| DE | 102014002960 | | 9/2014 |
| EM | 000366984-0001 | | 7/2005 |
| EM | 000638028-0002 | | 12/2006 |
| EM | 001975079-0005 | | 1/2012 |
| EM | 002163675-0002 | | 1/2013 |
| EM | 002163675-0003 | | 1/2013 |
| EM | 002212522-0004 | | 4/2013 |
| EM | 002212522-0012 | | 4/2013 |
| EM | 002424069-0001 | | 3/2014 |
| EP | 0716821 | | 6/1996 |
| EP | 0769920 | | 9/2003 |
| EP | 2011416 | | 1/2009 |
| EP | 2810581 | | 12/2014 |
| ES | 1063617 | | 11/2006 |
| IT | 2010PDO000035-0019 | | 10/2010 |
| JP | H08164025 | | 6/1996 |
| JP | 10042957 | | 8/1996 |
| JP | D1314270 | | 10/2007 |
| JP | 2007289265 | A | 11/2007 |
| JP | 2014087475 | A | 5/2014 |
| KR | 20040032038 | | 4/2004 |
| KR | 838174 | | 6/2007 |
| KR | 20-2012-0005449 | | 7/2012 |
| MX | 32553 | | 11/2009 |
| MX | 36113 | | 4/2011 |
| MX | 36650 | | 4/2011 |
| RU | 55985 | | 1/2005 |
| RU | 79787 | | 10/2011 |
| RU | 80086 | | 11/2011 |
| RU | 81915 | | 6/2012 |
| WO | WO1995/06420 | | 3/1995 |
| WO | WO1995/10959 | | 4/1995 |
| WO | WO1999/023910 | | 5/1999 |
| WO | WO1999/55514 | | 11/1999 |
| WO | WO1999/65358 | | 12/1999 |
| WO | WO2000/49911 | | 8/2000 |
| WO | WO2001/17392 | | 3/2001 |
| WO | WO2001/29128 | | 4/2001 |
| WO | WO2001/45573 | | 6/2001 |
| WO | WO2001/182741 | | 11/2001 |
| WO | WO2004/043669 | | 5/2004 |
| WO | WO2005/122827 | | 12/2005 |
| WO | WO2008/017996 | | 2/2008 |
| WO | 2008/064873 | | 6/2008 |
| WO | WO2011/070549 | | 6/2011 |
| WO | WO2011/075133 | | 6/2011 |
| WO | WO2012/017923 | | 2/2012 |
| WO | WO2012/115035 | | 8/2012 |
| WO | WO2012/176741 | | 12/2012 |
| WO | WO2013/031685 | | 3/2013 |
| WO | 2014/098854 | | 6/2014 |
| WO | WO 2014/098853 | A1 * | 6/2014 ..... A46B 3/06 |

OTHER PUBLICATIONS

International Search Report and the Written Opinion issued in International Application PCT/US2012/070760 dated Oct. 14, 2013.
International Search Report and the Written Opinion issued in International Application PCT/US2014/072075 dated Sep. 15, 2015.
International Search Report and the Written Opinion issued in International Application PCT/US2014/072063 dated Oct. 1, 2015.

* cited by examiner

ORAL CARE IMPLEMENT

CROSS-REFERENCE TO RELATED PATENT APPLICATIONS

The present application is a continuation-in-part of U.S. patent application Ser. No. 15/539,342, filed Jun. 23, 2017, which is a U.S. National Stage Application under 35 U.S.C. § 371 of PCT Application No. PCT/US2014/072036, filed Dec. 23, 2014.

The present application is also a continuation-in-part of U.S. patent application Ser. No. 16/217,836, filed Dec. 12, 2018, which is a continuation of U.S. patent application Ser. No. 15/539,357, filed Jun. 23, 2017 (now U.S. Pat. No. 10,182,644), which is a U.S. National Stage Application under 35 U.S.C. § 371 of PCT Application No. PCT/US2014/072038, filed Dec. 23, 2014.

The present application is also a continuation-in-part of U.S. patent application Ser. No. 15/539,369, filed Jun. 23, 2017, which is a U.S. National Stage Application under 35 U.S.C. § 371 of PCT Application No. PCT/US2014/072048, filed Dec. 23, 2014.

The present application is also a continuation-in-part of U.S. patent application Ser. No. 15/539,378, filed Jun. 23, 2017, which is a U.S. National Stage Application under 35 U.S.C. § 371 of PCT Application No. PCT/US2014/072052, filed Dec. 23, 2014.

The present application is also a continuation-in-part of U.S. patent application Ser. No. 15/539,388, filed Jun. 23, 2017, which is a U.S. National Stage Application under 35 U.S.C. § 371 of PCT Application No. PCT/US2014/072057, filed Dec. 23, 2014.

The present application is also a continuation-in-part of U.S. patent application Ser. No. 15/539,504, filed Jun. 23, 2017, which is a U.S. National Stage Application under 35 U.S.C. § 371 of PCT Application No. PCT/US2014/072063, filed Dec. 23, 2014.

The present application is also a continuation-in-part of U.S. patent application Ser. No. 15/539,399, filed Jun. 23, 2017, which is a U.S. National Stage Application under 35 U.S.C. § 371 of PCT Application No. PCT/US2014/072066, filed Dec. 23, 2014.

The present application is also a continuation-in-part of U.S. patent application Ser. No. 15/539,411, filed Jun. 23, 2017, which is a U.S. National Stage Application under 35 U.S.C. § 371 of PCT Application No. PCT/US2014/072073, filed Dec. 23, 2014.

The present application is also a continuation-in-part of U.S. patent application Ser. No. 15/539,425, filed Jun. 23, 2017, which is a U.S. National Stage Application under 35 U.S.C. § 371 of PCT Application No. PCT/US2014/072075, filed Dec. 23, 2014.

Each of the above-referenced applications is incorporated herein by reference in its entirety.

BACKGROUND

A toothbrush is used to clean the teeth by removing plaque and debris from the tooth surfaces. Conventional toothbrushes having a flat bristle trim are limited in their ability to conform to the curvature of the teeth, to penetrate into the interproximal areas between the teeth, to sweep away the plaque and debris, and to clean along the gum line. Additionally, such toothbrushes have a limited ability to retain dentifrice for cleaning the teeth. During the brushing process, the dentifrice typically slips through the tufts of bristles and away from the contact between the bristles and the teeth.

As a result, the dentifrice is often spread around the mouth, rather than being concentrated on the contact of the bristles with the teeth. Therefore, the efficiency of the cleaning process is reduced.

While substantial efforts have been made to modify the cleaning elements of toothbrushes to improve the efficiency of the oral cleaning process, the industry continues to pursue arrangements of cleaning elements that will improve upon the existing technology. In typical oral care implements, bristles having circular transverse cross-sectional profiles are bundled together in a bristle tuft and mounted within tuft holes having circular transverse cross-sectional profiles. However, such a configuration results in gaps being present between adjacent bristles in the tuft and between the bristles of the tuft and the walls of the tuft holes, thereby resulting in a looser packing of the tuft hole and a less than optimal packing factor. These gaps can also reduce the effectiveness of the oral care implement and can cause the oral care implement to effectuate an uncomfortable feeling during brushing. Therefore, a need exists for an oral care implement having an improved arrangement of bristles.

BRIEF SUMMARY

The present invention is directed to an oral care implement that includes a handle and a head with a front surface. A plurality of tooth cleaning elements extend from the front surface. The plurality of tooth cleaning elements include a conical tuft that is formed by a continuous wall of bristles. The conical tuft has an inner surface that defines a cavity. The cavity has a transverse cross-sectional area that increases with distance from the front surface of the head. A central cleaning element may also be located within the cavity. The conical tuft may have an annular top surface that undulates in height relative to the front surface of the head. Furthermore, in some embodiments arcuate cleaning elements may be arranged in a loop that surrounds the conical tuft.

In one aspect, the invention can be an oral care implement comprising: a handle; a head coupled to the handle, the head comprising a front surface; a plurality of tooth cleaning elements extending from the front surface of the head; the plurality of tooth cleaning elements comprising a conical tuft comprising a continuous bristle wall having an inner surface defining a cavity along a cavity axis, the cavity having a transverse cross-sectional area that increases with distance from the front surface of the head; and the plurality of tooth cleaning elements comprising a central cleaning element located within the conical cavity.

In another aspect, the invention can be an oral care implement comprising: a handle; a head coupled to the handle, the head comprising a front surface; a plurality of tooth cleaning elements extending from the front surface of the head; the plurality of tooth cleaning elements comprising a conical tuft comprising a bristle wall having an inner surface defining a cavity along a cavity axis, the cavity having a transverse cross-sectional area that increases with distance from the front surface of the head; and wherein the bristle wall of the conical tuft terminates in an annular top surface that undulates in height relative to the front surface.

In another aspect, the invention can be an oral care implement comprising: a handle; a head coupled to the handle, the head comprising a front surface; a plurality of tooth cleaning elements extending from the front surface of the head; the plurality of tooth cleaning elements comprising a conical tuft comprising a bristle wall having an inner surface defining a cavity along a cavity axis, the cavity having a transverse cross-sectional area that increases with distance from the front surface of the head; and the plurality of tooth cleaning elements comprising a plurality of arcuate cleaning elements arranged in a spaced apart manner about a loop that surrounds the conical tuft.

In another aspect, the invention can be an oral care implement comprising: a handle; a head coupled to the handle, the head comprising a front surface and a longitudinal axis extending from a proximal end of the head to a distal end of the head; a plurality of tooth cleaning elements extending from the front surface of the head; the plurality of tooth cleaning elements comprising a conical tuft comprising a bristle wall having an inner surface defining a cavity along a cavity axis, the cavity having a transverse cross-sectional area that increases with distance from the front surface of the head, the conical tuft terminating in an annular top surface, the annular top surface being a first height from the front surface of the head; the plurality of tooth cleaning element further comprising: a first set of peripheral tooth cleaning elements located adjacent to a first lateral edge of the head; a second set of peripheral tooth cleaning elements located adjacent to a second lateral edge of the head; and each peripheral tooth cleaning element of the first and second sets comprising an elastomeric sleeve portion and a bristle tuft portion extending through a sleeve cavity of the elastomeric sleeve portion along a sleeve axis, the bristle tuft portion protruding from a distal end of the elastomeric sleeve portion.

In another aspect, the invention can be an oral care implement comprising: a handle; a head coupled to the handle and comprising a front surface; a plurality of tooth cleaning elements extending from the front surface of the head; the plurality of tooth cleaning elements comprising a first set of peripheral tooth cleaning elements located adjacent to a first lateral edge of the head, each of the peripheral tooth cleaning elements of the first set comprising an elastomeric sleeve portion and a bristle tuft portion protruding from the elastomeric sleeve portion; one or more first channels in the front surface of the head that extend between adjacent ones of the peripheral tooth cleaning elements of the first set; an integrally formed elastomeric component comprising: the elastomeric sleeve portions of the first set of the peripheral tooth cleaning elements; and one or more first elastomeric sleeve strips that extend between and connect the elastomeric sleeve portions of adjacent ones of the peripheral tooth cleaning elements of the first set, the one or more first elastomeric sleeve strips located within the one or more first channels.

In another aspect, the invention can be an oral care implement comprising: a handle; a head coupled to the handle and comprising a head plate, the head plate comprising a lower surface, an upper surface that forms a front surface of the head, and a plurality of through holes extending from the lower surface of the head plate to the upper surface of the head plate; one or more channels in the lower surface of the head plate; one or more channels in the upper surface of the head plate; a plurality of bristle tufts extending through the plurality of through holes, each of the plurality of bristle tufts comprising a cleaning portion protruding from the upper surface of the head plate and a melt matte located adjacent the lower surface of the head plate; an integrally formed elastomeric component comprising a plurality of elastomeric elements protruding from the upper surface of the head plate, one or more elastomeric strips disposed within the one or more channels in the lower surface of the head plate that connect at least two of the plurality of elastomeric elements, and one or more elastomeric strips disposed within the one or more channels in the upper surface of the head plate that connect at least two of the plurality of elastomeric elements.

In another aspect, the invention can be an oral care implement comprising: a handle; a head coupled to the handle, the head comprising a front surface and a longitudinal axis extending from a proximal end of the head to a distal end of the head; a plurality of tooth cleaning elements extending from the front surface of the head; the plurality of tooth cleaning elements comprising a conical tuft comprising a bristle wall having an inner surface defining a cavity along a cavity axis, the cavity having a transverse cross-sectional area that increases with distance from the front surface of the head, the conical tuft terminating in an annular top surface, the annular top surface being a first height from the front surface of the head; the plurality of tooth cleaning elements comprising an arcuate cleaning element at least partially surrounding the conical tuft, the arcuate cleaning element having a top surface having a high point being a second height from the front surface of the head and a first low point being a third height from the front surface of the head; and wherein the first height is greater than the third height and less than the second height.

In another aspect, the invention can be an oral care implement comprising: a handle; a head coupled to the handle, the head comprising a front surface and a longitudinal axis extending from a proximal end of the head to a distal end of the head; a plurality of tooth cleaning elements extending from the front surface of the head; the plurality of tooth cleaning elements comprising a conical tuft comprising a bristle wall having an inner surface defining a cavity along a cavity axis, the cavity having a transverse cross-sectional area that increases with distance from the front surface of the head; the plurality of tooth cleaning elements comprising an arcuate cleaning element at least partially surrounding the conical tuft; and wherein the arcuate cleaning element is either a distal-most tooth cleaning element on the head or a proximal-most tooth cleaning element on the head.

In another aspect, the invention can be an oral care implement comprising: a handle; a head coupled to the handle, the head comprising a front surface and a longitudinal axis extending from a proximal end of the head to a distal end of the head; a plurality of tooth cleaning elements extending from the front surface of the head; the plurality of tooth cleaning elements comprising a first conical tuft comprising a first bristle wall having an inner surface defining a first cavity along a first cavity axis, the first cavity having a first transverse cross-sectional area that increases with distance from the front surface of the head, the first bristle wall having an outer surface that forms a first acute angle with the front surface; the plurality of tooth cleaning elements comprising a second conical tuft comprising a second bristle wall having an inner surface defining a second cavity along a second cavity axis, the second cavity having a second transverse cross-sectional area that increases with distance from the front surface of the head, the second bristle wall having an outer surface that forms a second acute angle with the front surface; and wherein the first and second acute angles are different from one another.

In another embodiment, the invention can be an oral care implement comprising: a handle; a head coupled to the handle, the head comprising a front surface; a plurality of tooth cleaning elements extending from the front surface of the head; the plurality of tooth cleaning elements comprising a multi-height bristle tuft extending from a single tuft hole along a tuft axis, the multi-height bristle tuft comprising a first bristle tuft section formed by taller bristles and a second bristle tuft section formed by shorter bristles, the second bristle tuft section having a U-shaped transverse cross-section that partially surrounds a transverse cross-section of the first bristle tuft section, and the first bristle tuft section axially protrudes from an upper surface of the second bristle tuft section.

In another aspect, the invention can be an oral care implement comprising: a handle; a head coupled to the handle, the head comprising a front surface and a longitudinal axis that extends from a proximal end of the head to a distal end of the head; a plurality of tooth cleaning elements extending from the front surface of the head; the plurality of tooth cleaning elements comprising a first conical tuft comprising a first bristle wall having an inner surface defining a first cavity along a first cavity axis, the first cavity having a transverse cross-sectional area that increases with distance from the front surface of the head, wherein the first bristle wall of the first conical tuft terminates in a first annular top surface that is inclined relative to the front surface from a first high point to a first low point; the plurality of tooth cleaning elements comprising a second conical tuft comprising a second bristle wall having an inner surface defining a second cavity along a second cavity axis, the second cavity having a transverse cross-sectional area that increases with distance from the front surface of the head, wherein the second bristle wall of the second conical tuft terminates in a second annular top surface that is inclined relative to the front surface from a second high point to a second low point; and the first and second conical tufts arranged on the head such that the first and second high points are adjacent to one another.

In another aspect, the invention can be an oral care implement comprising: a handle; a head coupled to the handle, the head comprising a front surface and a longitudinal axis that extends from a proximal end of the head to a distal end of the head; a plurality of tooth cleaning elements extending from the front surface of the head; the plurality of tooth cleaning elements comprising a first conical tuft comprising a first bristle wall having an inner surface defining a first cavity along a first cavity axis, the first cavity having a transverse cross-sectional area that increases with distance from the front surface of the head; the plurality of tooth cleaning elements comprising a second conical tuft comprising a second bristle wall having an inner surface defining a second cavity along a second cavity axis, the second cavity having a transverse cross-sectional area that increases with distance from the front surface of the head; and the first and second conical tufts arranged on a transverse axis of the head that is perpendicular to the longitudinal axis; the plurality of tooth cleaning elements comprising a third conical tuft comprising a third bristle wall having an inner surface defining a third cavity along a third cavity axis, the third cavity having a transverse cross-sectional area that increases with distance from the front surface of the head; the plurality of tooth cleaning elements comprising a fourth conical tuft comprising a fourth bristle wall having an inner surface defining a fourth cavity along a fourth cavity axis, the fourth cavity having a transverse cross-sectional area that increases with distance from the front surface of the head; and the third and fourth conical tufts located on the longitudinal axis of the head.

In another aspect, the invention can be an oral care implement comprising: a handle; a head coupled to the handle, the head comprising a front surface and a longitudinal axis that extends from a proximal end of the head to a distal end of the head; a plurality of tooth cleaning elements extending from the front surface of the head; and the plurality of tooth cleaning elements comprising a first conical tuft comprising a first bristle wall having an inner surface defining a first cavity along a first cavity axis, the first cavity having a transverse cross-sectional area that increases with distance from the front surface of the head, wherein the first bristle wall of the first conical tuft terminates in a first annular top surface that is inclined relative to the front surface from a first high point to a first low point.

In another aspect, the invention can be an oral care implement comprising an oral care implement comprising: a handle extending along a longitudinal axis; a head at a distal end of the handle; at least one tooth cleaning element extending from the head; the handle comprising: a first component constructed of a first hard plastic, the first component comprising a first component aperture; a second component constructed of a second hard plastic, the second component comprising the head and an anchor, the anchor located within the first component aperture and comprising a second component aperture; and a third component constructed of a first elastomeric material, the third component located within the second component aperture.

In another aspect, the invention can be an oral care implement comprising: a handle extending along a longitudinal axis; a head coupled to the handle; at least one tooth cleaning element extending from the head; the handle comprising: a first component constructed of a first hard material, the first component comprising a first component aperture; a second component constructed of a second hard material, the second component comprising the head and an anchor, the anchor located within the first component aperture and comprising a second component aperture; and a third component disposed within the second component aperture.

In another aspect, the invention can be a method of forming an oral care implement comprising: forming a first component of a first hard plastic, the first component having a first component aperture; forming a second component of a second hard plastic on the first component so that an anchor of the second component is located within the first component aperture, the anchor comprising a second component aperture; and forming a third component of a first elastomeric material in the second component aperture.

In another aspect, the invention may be an oral care implement comprising: a handle extending along a longitudinal axis; a head at the distal end of the handle; at least one tooth cleaning element extending from the head; the handle comprising: a first component constructed of a first hard plastic; and a second component constructed of a second hard plastic, the second component comprising a body portion and a plurality of strips extending from the body portion and forming a strap network that wraps around the first component.

In another aspect, the invention can be an oral care implement comprising: a handle; a head coupled to the handle; at least one tooth cleaning element extending from the head; the handle comprising: a first component constructed of a first material; and a second component constructed of a second material, the second component comprising a plurality of strips that collectively form a strap network that wraps around the first component.

In another aspect, the invention can be a method of forming an oral care implement comprising: forming a first component of a first hard plastic; and forming a second component of a second hard plastic on the first component, the second component comprising: a plurality of strips that form a strap network that wraps around the first component;

and a portion extending from a distal end of the first component, the portion comprising a head of the oral care implement.

In another embodiment, the invention can be an oral care implement comprising: a handle extending from a proximal end to a distal end along a longitudinal axis; a head at the distal end of the handle; the handle comprising a first component constructed of a first material and a second component constructed of a second material; the first component comprising: first, second and third longitudinally elongated depressions formed into an outer surface of the first component, the first, second and third longitudinally elongated depressions circumferentially spaced-apart from one another about the longitudinal axis; and a first through-hole extending from the second longitudinally elongated depression to the third longitudinally elongated depression, the first through-hole extending through the first longitudinally elongated depression; and the second component comprising: a first lobe portion disposed within the first longitudinally elongated depression, a second lobe portion disposed within the second longitudinally elongated depression, and a third lobe portion disposed within the first longitudinally elongated depression; and the first, second and third lobe portions connected together to form an integral mass of the second material.

In another embodiment, the invention can be an oral care implement comprising: a handle extending from a proximal end to a distal end along a longitudinal axis; a head at the distal end of the handle; the handle comprising a first component constructed of a first material and a second component constructed of a second material; the first component comprising: a body portion; and first, second and third longitudinal ribs extending from the body portion toward the proximal end of the handle; and the second component comprising: a first portion disposed between the first and third longitudinal ribs, a second portion disposed between first and second longitudinal ribs, and a third portion disposed between the second and third ribs.

In another embodiment, the invention can be a method of forming an oral care implement comprising: a) forming a first component of a first material, the first component comprising first, second and third longitudinally elongated depressions formed into an outer surface of the first component, the first, second and third longitudinally elongated depressions circumferentially spaced-apart from one another about a longitudinal axis of the first component, and a first through-hole extending from a floor of the second longitudinally elongated depression to a floor of the third longitudinally elongated depression, the first through-hole extending through sidewalls of the first longitudinally elongated depression; and b) forming a second component of a second material on the first component, the second component comprising a first lobe portion disposed within the first longitudinally elongated depression, a second lobe portion disposed within the second longitudinally elongated depression, and a third lobe portion disposed within the first longitudinally elongated depression, the first, second and third lobe portions connected together to form an integral mass of the second material.

In another embodiment, the invention can be an oral care implement comprising: a handle comprising a first component constructed of a first material and a second component constructed of a second material; the first component comprising: first, second and third depressions formed into an outer surface of the first component; and a first through-hole extending from a floor of the second depression to a floor of the third depression, the first through-hole extending through sidewalls of the first depression; and the second component comprising: a first portion disposed within the first depression, a second portion disposed within the second depression, and a third portion disposed within the first depression; and the first, second and third portions connected together to form an integral mass of the second material.

In another aspect, the invention can be an oral care implement comprising: a handle and a head extending along a longitudinal axis from a proximal end to a distal end; the head comprising: a front surface, a rear surface opposite the front surface, a peripheral surface extending between the front and rear surfaces and defining a perimeter edge of the front surface, a plurality of tooth cleaning elements extending from the front surface, an elastomeric component including a bumper portion that forms a distal-most section of the peripheral surface and a wall portion located along a distal-most section of the perimeter edge and protruding above the front surface, the wall portion extending along the perimeter edge in a continuous manner from a first point of the perimeter edge to a second point of the perimeter edge, the first and second points located on opposite sides of the longitudinal axis, the wall portion comprises a first ramped portion, an apex portion, and a second ramped portion, the apex portion disposed between the first and second ramped portions.

In another aspect, the invention can be an oral care implement comprising: a handle and a head extending along a longitudinal axis from a proximal end to a distal end, the head comprising: a front surface, a rear surface opposite the front surface, a peripheral surface extending between the front and rear surfaces and defining a perimeter edge of the front face, a plurality of tooth cleaning elements extending from the front surface, an integrally formed elastomeric component including: a bumper portion that forms a distal-most section of the peripheral surface, a wall portion located along a distal-most section of the perimeter edge and protruding above the front surface, a plurality of spaced-apart ridges protruding from an outer surface of the bumper portion and an outer surface of the wall portion, and a soft tissue cleanser on the rear surface of the head, the soft tissue cleanser comprising a plurality of protuberances.

In another aspect, the invention can be an oral care implement comprising: a handle and a head extending along a longitudinal axis from a proximal end to a distal end, the head comprising: a front surface, a rear surface, a plurality of tooth cleaning elements extending from the front surface, and a soft tissue cleanser on the rear surface of the head; the soft tissue cleanser comprising: a plurality of first protuberances protruding from the rear surface of the head and arranged in a first annular zone on the rear surface, each of the first plurality of protuberances having a height between a first predetermined height and a second predetermined height, the second predetermined height being greater than the first predetermined height, a plurality of second protuberances protruding from the rear surface of the head and arranged in a second annular zone on the rear surface, the first annular zone surrounding the second annular zone, each of the second plurality of protuberances having a height between the second predetermined height and a third predetermined height, the third predetermined height being greater than the second predetermined height; and a plurality of third protuberances protruding from the rear surface of the head and arranged in a third zone on the rear surface, the second annular zone surrounding the third zone, each of the third plurality of protuberances having a height between the third predetermined height and a fourth predetermined height, the fourth predetermined height being greater than the third predetermined height.

In another aspect, the invention can be an oral care implement comprising: a handle, a head extending along a longitudinal axis from a proximal end to a distal end, the head comprising: a front surface, a rear surface, a plurality of tooth cleaning elements extending from the front surface, and a soft tissue cleanser on the rear surface of the head; the soft tissue cleanser comprising: a plurality of cylindrical nubs protruding from the rear surface of the head, wherein free ends of the plurality of protuberances collectively form a convex side profile and a convex top profile.

In another aspect, the invention can be an oral care implement comprising: a handle and a head extending along a longitudinal axis from a proximal end to a distal end, the head comprising: a front surface, a rear surface, a plurality of tooth cleaning elements extending from the front surface, and a soft tissue cleanser on the rear surface of the head; the soft tissue cleanser comprising: a plurality of first protuberances protruding from the rear surface of the head, each of the first plurality of protuberances having a height between a first predetermined height and a second predetermined height, the second predetermined height being greater than the first predetermined height; a plurality of second protuberances protruding from the rear surface of the head, each of the second plurality of protuberances having a height between the second predetermined height and a third predetermined height, the third predetermined height being greater than the second predetermined height; and a plurality of third protuberances protruding from the rear surface of the head, each of the third plurality of protuberances having a height between the third predetermined height and a fourth predetermined height, the fourth predetermined height being greater than the third predetermined height.

In another aspect, the invention can be an oral care implement comprising: a handle; and a head coupled to the handle, the head comprising: a front surface; a rear surface opposite the front surface; a peripheral surface extending between the rear surface and the front surface; a first elastomeric soft tissue cleanser comprising a bumper portion that extends along the peripheral surface, the bumper portion comprising an undulating upper edge that includes a plurality of high points protruding above the rear surface and a plurality of low points located at or below the rear surface; and a plurality of tooth cleaning elements extending from the front surface.

In another aspect, the invention can be an oral care implement comprising: a handle; a head coupled to the handle, the head comprising: a front surface; a rear surface opposite the front surface; a peripheral surface extending between the rear surface and the front surface, the peripheral surface and the rear surface intersecting to form a perimeter of the rear surface of the head; a base formed of a hard material, the base comprising an exposed annular surface that forms a portion of the rear surface of the head; a first elastomeric soft tissue cleanser coupled to the base, the first elastomeric soft tissue cleanser comprising a bumper portion on the peripheral surface, the bumper portion comprising a plurality of lower portions on the peripheral surface and a plurality of raised portions protruding above the rear surface along the perimeter; a second elastomeric soft tissue cleanser coupled to the base on the rear surface of the head, the exposed annular surface of the base circumscribing the second elastomeric soft tissue cleanser, the second elastomeric soft tissue cleanser comprising a plurality of protuberances that extend from the rear surface; the first and second elastomeric soft tissue cleansers being separate and distinct components from one another; and a plurality of tooth cleaning elements extending from the front surface.

In another aspect, the invention can be an oral care implement comprising a handle; a head coupled to the handle, the head comprising a front surface and a rear surface opposite the front surface, the head extending from a proximal end to a distal end along a longitudinal axis; an elastomeric soft tissue cleanser comprising a plurality of protuberances extending from the rear surface of the head and terminating in free ends, the free ends of the protuberances collectively defining a convex longitudinal side profile and comprising at least one convex transverse top profile; and a plurality of tooth cleaning elements extending from the front surface of the head and terminating in free ends, the free ends of the tooth cleaning elements collectively defining a concave longitudinal side profile and comprising at least one concave transverse top profile.

In another aspect, the invention can be an oral care implement comprising a handle; a head coupled to the handle, the head comprising a front surface, a rear surface opposite the front surface, a longitudinal axis extending from a proximal end to a distal end, and a central transverse plane, the longitudinal axis intersecting and orthogonal to the central transverse plane; an elastomeric soft tissue cleanser comprising a plurality of protuberances extending from the rear surface of the head and terminating in free ends, the free ends of the protuberances collectively forming a longitudinal side profile having a height, measured from the rear surface of the head, that decreases with longitudinal distance from the central transverse plane, and the free ends of the protuberances comprising at least one transverse top profile having a height, measured from the rear surface of the head, that decreases with transverse distance from the longitudinal axis; and a plurality of tooth cleaning elements extending from the front surface of the head and terminating in free ends, the free ends of the tooth cleaning elements collectively defining a longitudinal side profile having a height, measured from the front surface of the head, that increases with longitudinal distance from the central transverse plane, and the free ends of the tooth cleaning elements comprising at least one transverse top profile having a height, measured from the front surface of the head, that increases with transverse distance from the longitudinal axis.

In another aspect, the invention can be an oral care implement comprising a handle; a head coupled to the handle, the head comprising a front surface and a rear surface opposite the front surface, the head extending from a proximal end of the head to a distal end of the head along a longitudinal axis; an elastomeric soft tissue cleanser comprising a plurality of protuberances extending from the rear surface of the head and terminating in free ends, each of the protuberances having a height measured from the rear surface of the head to its free end, and wherein the free ends of the protuberances comprise at least one convex transverse top profile formed by a variation in the heights of the protuberances along a first transverse plane that intersects and is substantially orthogonal to the longitudinal axis; and a plurality of tooth cleaning elements extending from the front surface of the head and terminating in free ends, each of the tooth cleaning elements having a height measured from the front surface of the head to its free end, the free ends of the tooth cleaning elements comprising at least one concave transverse top profile formed by a variation in the heights of the tooth cleaning elements along a second transverse plane that intersects and is substantially orthogonal to the longitudinal axis.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
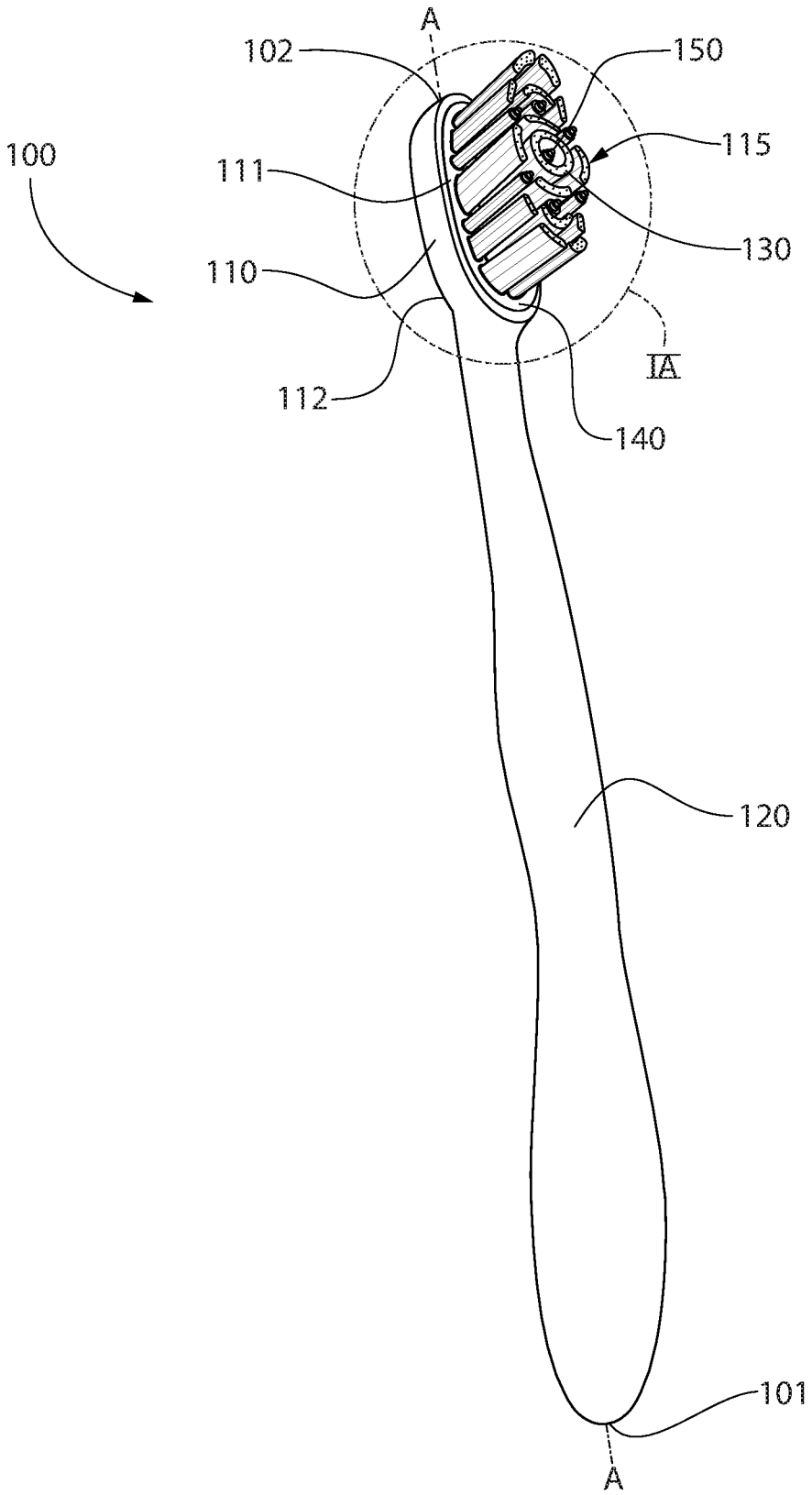
FIG. 1 is a front perspective view of an oral care implement in accordance with one embodiment of the present invention.
Figure 1A:
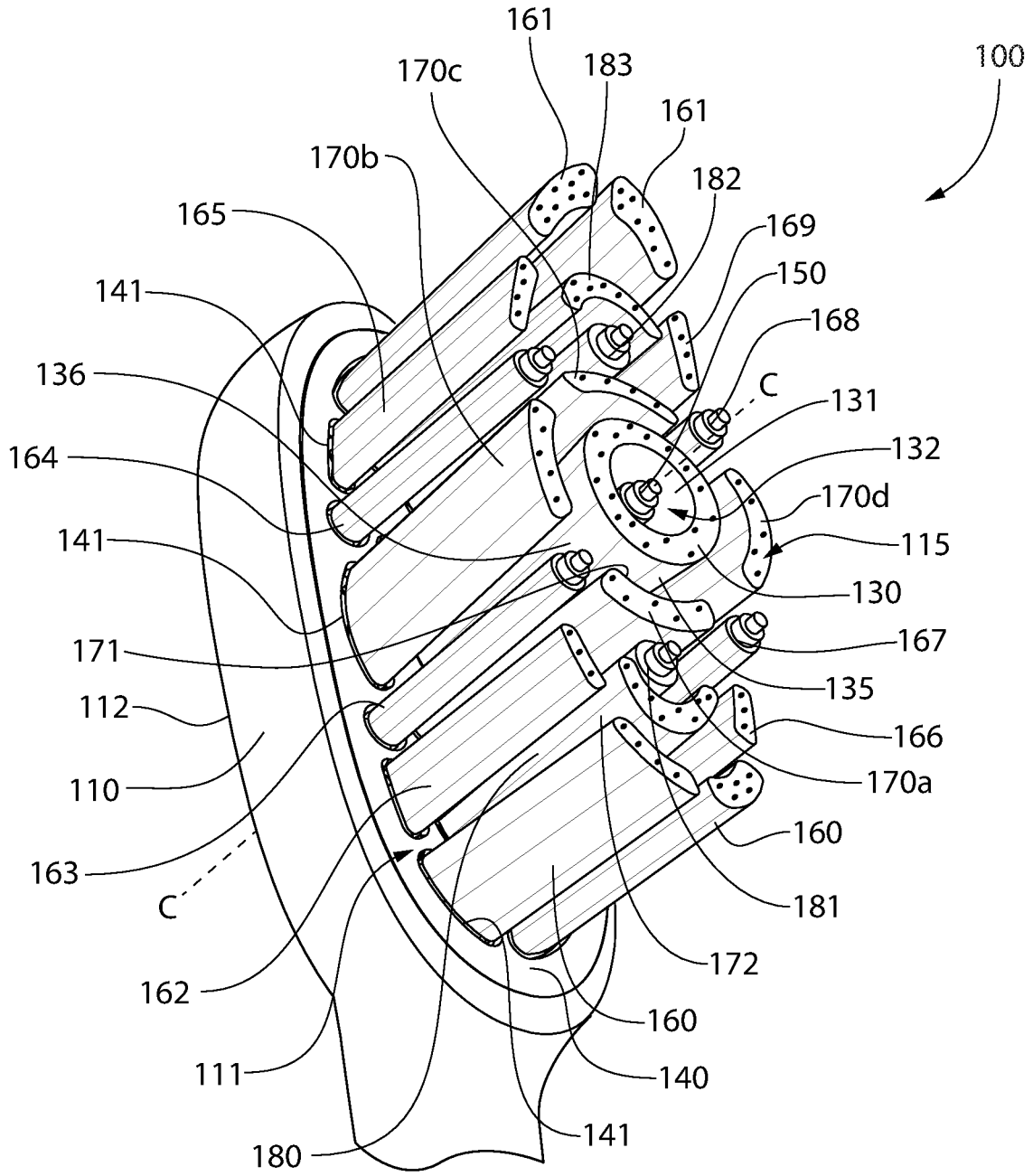
FIG. 1A is a close-up view of area IA of FIG. 1.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Concept One

Figure 2:
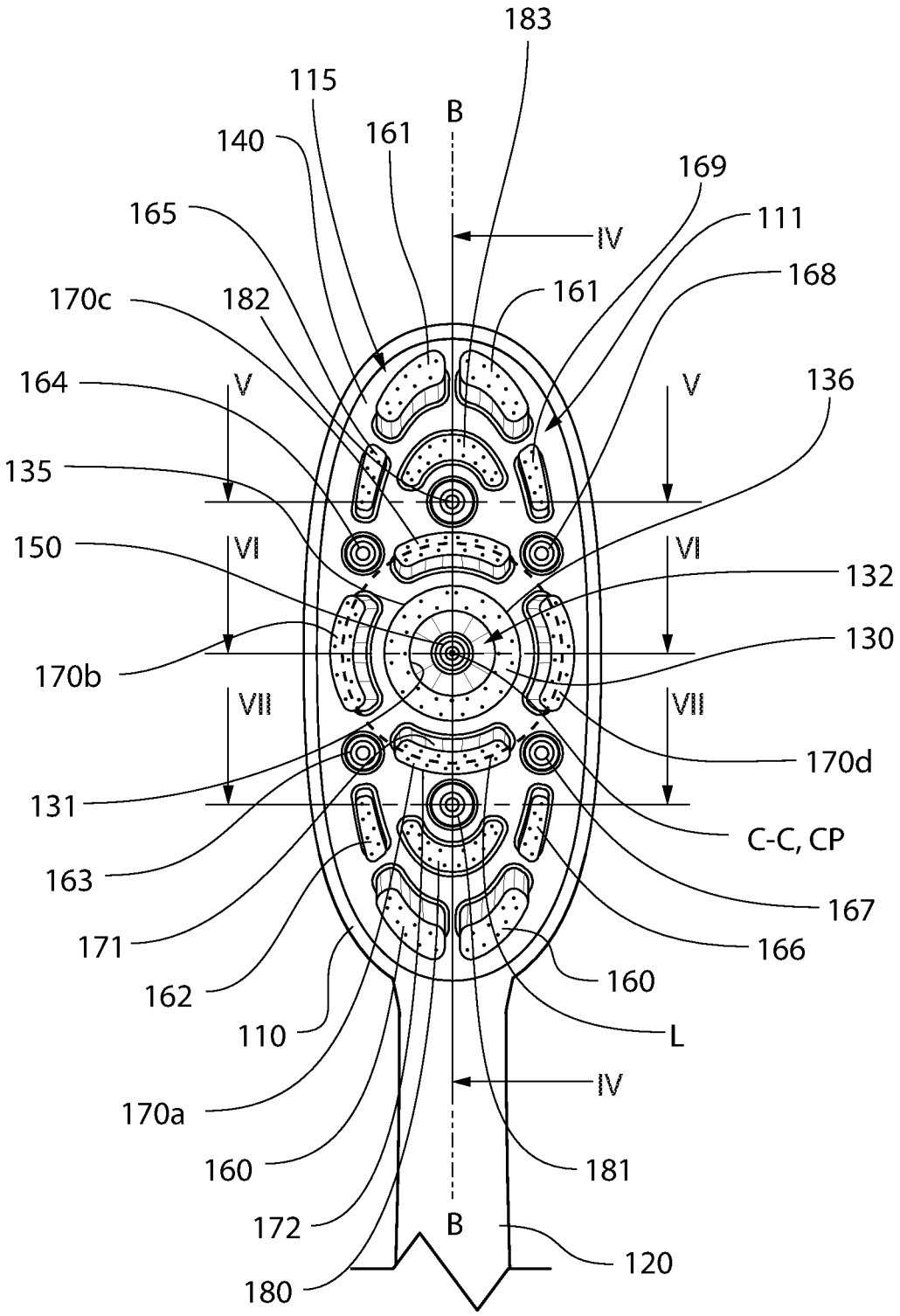
FIG. 2 is a front view of the head of the oral care implement of FIG. 1A.
Figure 3:
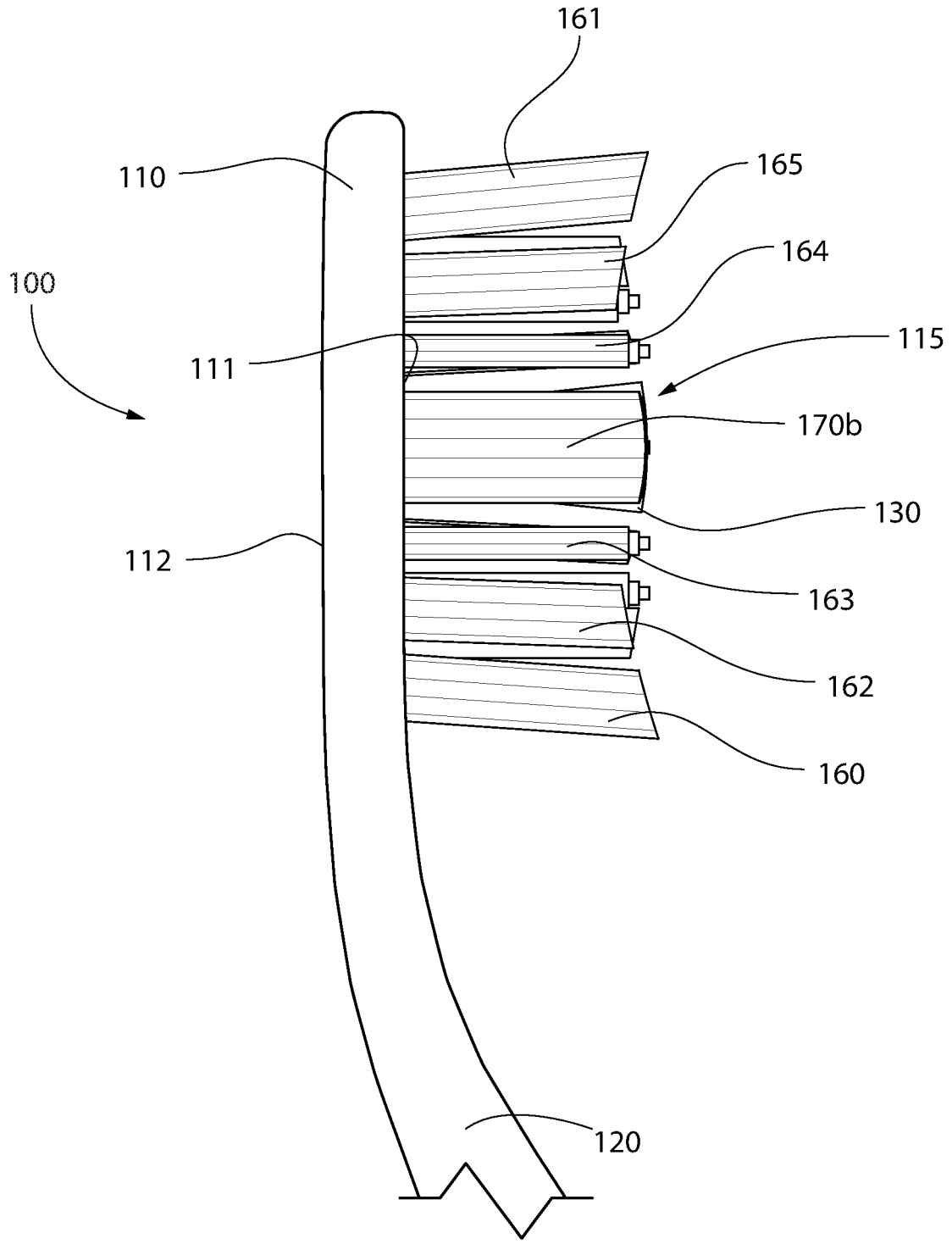
FIG. 3 is a side view of the head of the oral care implement of FIG. 1A.

Referring first to FIGS. 1-3 concurrently, an oral care implement 100 is illustrated in accordance with one embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement extends from a proximal end 101 to a distal end 102 along a longitudinal axis A-A. The oral care implement 100 generally comprises a head 110 and a handle 120. The handle 120 is an elongated structure that provides the mechanism by which the user can hold and manipulate the oral care implement 100 during use. In the exemplified embodiment, the handle 120 is generically depicted having various contours for user comfort. Of course, the invention is not to be limited by the specific shape illustrated for the handle 120 in all embodiments and in certain other embodiments the handle 120 can take on a wide variety of shapes, contours, and configurations, none of which are limiting of the present invention unless so specified in the claims.

In the exemplified embodiment, the handle 120 is formed of a rigid plastic material, such as for example without limitation polymers and copolymers of ethylene, propylene, butadiene, vinyl compounds, and polyesters such as polyethylene terephthalate. Of course, the invention is not to be so limited in all embodiments and the handle 120 may include a resilient material, such as a thermoplastic elastomer, as a grip cover that is molded over portions of or the entirety of the handle 120 to enhance the gripability of the handle 120 during use. For example, portions of the handle 120 that are typically gripped by a user's palm during use may be overmolded with a thermoplastic elastomer or other resilient material to further increase comfort to a user. Furthermore, materials other than those noted above can be used including metal, wood or any other desired material that has sufficient structural rigidity to permit a user to grip the handle 120 and manipulate the oral care implement 100 during toothbrushing.

The head 110 of the oral care implement 100 is coupled to the handle 120 and comprises a front surface 111 and an opposing rear surface 112. In the exemplified embodiment, the head 110 is formed integrally with the handle 120 as a single unitary structure using a molding, milling, machining, or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus the head 110 may, in certain embodiments, be formed of any of the rigid plastic materials described above as being used for forming the handle 120, although the invention is not to be so limited in all embodiments and other materials that are commonly used during toothbrush head manufacture may also be used.

The oral care implement 100 also comprises a plurality of tooth cleaning elements 115 extending from the front surface 111 of the head 110. The details of certain ones of the plurality of tooth cleaning elements 115 will be discussed below, including specific details with regard to structure, pattern, orientation, and material of such tooth cleaning elements 115. However, where it does not conflict with the other disclosure provided herein, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Thus, any combination of these tooth cleaning elements may be used within the tooth cleaning elements 115 in some embodiments. However, as described herein below, in certain embodiments one or more of the tooth cleaning elements 115 may be formed as tufts of bristles.

In embodiments that use elastomeric elements as one or more of the tooth cleaning elements 115, suitable elastomeric materials may include any biocompatible resilient material suitable for uses in an oral hygiene apparatus. To provide optimum comfort as well as cleaning benefits, the elastomeric material of any such tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Referring to FIGS. 1-7 concurrently, one manner in which the tooth cleaning elements 115 are secured to the head 110 will be described. Specifically, in the exemplified embodiment the tooth cleaning elements 115 are formed as a cleaning element assembly on a head plate 140 such that one or more of the tooth cleaning elements 115 are mounted onto the head plate 140 and then the head plate 140 is coupled to the head 110. In such an embodiment, the head plate 140 is a separate and distinct component from the head 110 of the oral care implement 100. However, the head plate 140 is connected to the head 110 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 140 and the head 110 are separately formed components that are secured together during manufacture of the oral care implement 100.

In certain embodiments, the head plate 140 may comprise a plurality of holes 141 formed therethrough, and the tooth cleaning elements 115 may be mounted to the head plate 140 within the holes 141. This type of technique for mounting the tooth cleaning elements 115 to the head 110 via the head plate 140 is generally known as anchor free tufting (AFT). Specifically, in AFT a plate or membrane (i.e., the head plate 140) is created separately from the head 110. The tooth cleaning elements 115 (such as bristles, elastomeric elements, and combinations thereof) are positioned into the head plate 140 so as to extend through the holes 141 of the head plate 140. The free ends of the tooth cleaning elements 115 on one side of the head plate 140 perform the cleaning function. The ends of the tooth cleaning elements 115 on the other side of the head plate 140 are melted together by heat to be anchored in place. As the tooth cleaning elements 105 are melted together, a melt matte 106 is formed. After the tooth cleaning elements 115 are secured to the head plate 140, the head plate 140 is secured to the head 110 such as by ultrasonic welding. When the head plate 140 is coupled to the head 110, the melt matte 106 is located between a lower surface 142 of the head plate 140 and a floor 107 of a basin 108 of the head 110 in which the head plate 140 is disposed. The melt matte 106, which is coupled directly to and in fact forms a part of the tooth cleaning elements 115, prevents the tooth cleaning elements 115 from being pulled through the holes 141 in the head plate 140 thus ensuring that the tooth cleaning elements 105 remain attached to the head plate 140 during use of the oral care implement 100.

Of course, techniques other than AFT can be used for mounting the tooth cleaning elements 115 to the head 110, such as widely known and used stapling techniques or the like. In such embodiments the head plate 140 may be omitted and the tooth cleaning elements 115 may be coupled directly to the head 110. Furthermore, in a modified version of the AFT process discussed above, the head plate 140 may be formed by positioning the tooth cleaning elements 115 within a mold, and then molding the head plate 140 around the tooth cleaning elements 115 via an injection molding process.

Although described herein above with regard to using AFT, in certain embodiments any suitable form of cleaning elements and attachment may be used in the broad practice of this invention. Specifically, the tooth cleaning elements 115 of the present invention can be connected to the head 110 in any manner known in the art. For example, staples/anchors or in-mold tufting (IMT) could be used to mount the cleaning elements/tooth engaging elements. In certain embodiments, the invention can be practiced with various combinations of stapled, IMT or AFT bristles. Alternatively, the tooth cleaning elements 115 could be mounted to tuft blocks or sections by extending through suitable openings in the tuft blocks so that the base of the tooth cleaning elements 115 is mounted within or below the tuft block.

Although not illustrated herein, in certain embodiments the head 110 may also include a soft tissue cleanser coupled to or positioned on its rear surface 112. An example of a suitable soft tissue cleanser that may be used with the present invention and positioned on the rear surface of the head 110 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 100 may not include any soft tissue cleanser.

With continued reference to FIGS. 1-7, the oral care implement 100, and specifically the tooth cleaning elements 115 of the oral care implement 100, will be further described. In the exemplified embodiment, the plurality of tooth cleaning elements 115 comprises a conical tuft 130. The conical tuft 130 is a tuft or grouping of bristles that are arranged together into a tuft and then secured into a single tuft hole within the head 110 (or within the head plate 140). The conical tuft 130 is described herein as being conical due to the conical tuft 130 having a conical shape. More specifically, as can best be seen in FIG. 6, the conical tuft 130 is in the shape of a truncated cone wherein the portion of the conical tuft 130 that is positioned within the head 110 is the truncated (i.e., cut off) portion of the cone such that the conical tuft 130 is in the shape of an inverted truncated cone.

The conical tuft 130 comprises a continuous bristle wall 135 having an inner surface 131 and an outer surface 136. The inner surface 131 of the continuous bristle wall 135 of the conical tuft 130 defines a cavity 132 that extends along a cavity axis C-C. The conical tuft 130 extends in a 360° manner about the cavity axis C-C. The cavity 132 of the conical tuft 130 has an open top end and is bounded by the inner surface 131 of the continuous bristle wall 135 and by the front surface 111 of the head 110. As noted above, the conical tuft 130 in the exemplified embodiment is formed by a plurality of bristles. Specifically, in the exemplified embodiment the plurality of bristles are clumped together and positioned collectively into a single tuft hole so that the plurality of bristles collectively form the conical tuft 130 having no gaps in the continuous bristle wall 135 for its entire 360° extension about the cavity axis C-C. Thus, the term continuous bristle wall 135 is intended to mean that the conical tuft 130 is a single tuft of bristles that are clumped together into a single tuft hole in a non-spaced apart manner.

Thus, in the exemplified embodiment the conical tuft 130 is a single bristle tuft formed from a plurality of individual bristles that are positioned together within a single tuft hole. As a result, the conical tuft 130 has the continuous bristle wall 135 that extends without discontinuity about the cavity axis C-C. Thus, in the exemplified embodiment there are no gaps formed into the outer surface 136 of the conical tuft 130. Of course, in other embodiments the conical tuft 130 may have small gaps therein as desired while still being a single tuft positioned within a single tuft hole. Such gaps in the bristle wall may prevent dentifrice from being trapped within the cavity 132 of the conical tuft 130 by providing means of egress from the cavity 132. In such embodiments, the bristle wall 135 of the conical tuft 130 may not be continuous.

Due to the conical shape of the conical tuft 130, and more specifically, the inverted conical shape of the conical tuft 130, the cavity 132 of the conical tuft 130 has a transverse cross-sectional area that increases with distance from the front surface 111 of the head 110. Specifically, the transverse cross-sectional area of the cavity 132 of the conical tuft 130 only increases and never decreases with distance from the front surface 111 of the head 110. Thus, the greater the distance between a particular axial location within the cavity 132 of the conical tuft 130 and the front surface 111 of the head 110, the greater the transverse cross-sectional area of the cavity 132 at that particular axial location.

In addition to the conical tuft 130, in the exemplified embodiment the oral care implement 100 comprises a central cleaning element 150 that is located within the cavity 132 of the conical tuft 130. Thus, the conical tuft 130 surrounds the central cleaning element 150. Of course, the central cleaning element 150 may be omitted in certain other embodiments if desired. However, using the conical tuft 130 in conjunction with the central cleaning element 150 may enhance cleaning by enabling the conical tuft 130 to surround a user's tooth while the central cleaning element 150 cleans in the interproximal areas and the spaces between the teeth and gums. In the exemplified embodiment, the central cleaning element 150 is a bristle tuft, although the invention is not to be so limited in all embodiments and in certain other embodiments the central cleaning element 150 may be an elastomeric element or the like as discussed above. Furthermore, the central cleaning element 150 may be formed with tapered bristles, rounded/non-tapered bristles, spiral bristles, or combinations thereof. As discussed above, in the exemplified embodiment the conical tuft 130 and the central cleaning element 150 are secured to the head 110 by anchor free tufting. Specifically, the ends of the bristles that form the conical tuft 130 and the ends of the bristles that form the central cleaning element 150 are melted together to form at least a portion of the melt matte 106 as discussed above.

In the exemplified embodiment the conical tuft 130 and the central cleaning element 150 extend from a single tuft hole 134. Of course, the invention is not to be so limited in all embodiments and in certain other embodiments the conical tuft 130 and the central cleaning element 150 may extend from different tuft holes that are spaced apart from one another such that the tuft hole of the conical tuft 130 may substantially (or concentrically) surround the tuft hole of the central cleaning element 150. Furthermore, in the exemplified embodiment the central cleaning element 150 and the conical tuft 130 extend substantially the same distance from the front surface 111 of the head 110. Of course, the invention is not to be so limited and in certain other embodiments the central cleaning element 150 may have a height that is greater than a height of the conical tuft 130 or the conical tuft 130 may have a height that is greater than the height of the central cleaning element 150.

In the exemplified embodiment, the central cleaning element 150 is aligned along the cavity axis C-C and the central cleaning element 150 is circumferentially spaced apart from the inner surface 131 of the conical tuft 130 by an annular gap 133. In the exemplified embodiment, the central cleaning element 150 is centrally positioned within the cavity 132. However, due to the conical shape of the conical tuft 130, the width of the annular gap 133 increases with distance from the front surface 111 of the head 110. Thus, the width of the annular gap 133 (or the distance between the inner surface 131 of the conical tuft 130 and the outer surface of the central cleaning element 150) is greater at the terminal ends or cleaning ends of the conical tuft 130 and central cleaning element 150 than at the front surface 111 of the head 110.

Figure 4:
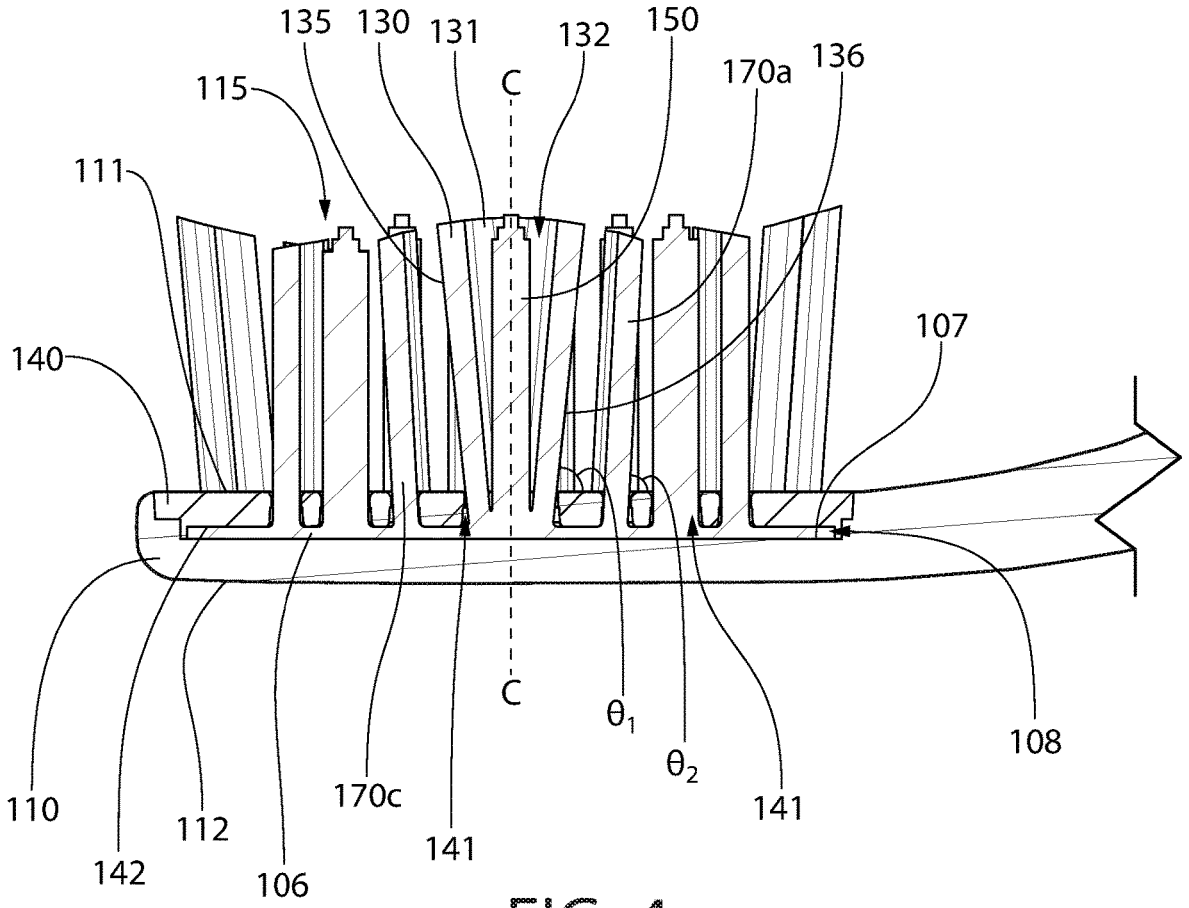
FIG. 4 is a cross-sectional view taken along line IV-IV of FIG. 2.
Figure 5:
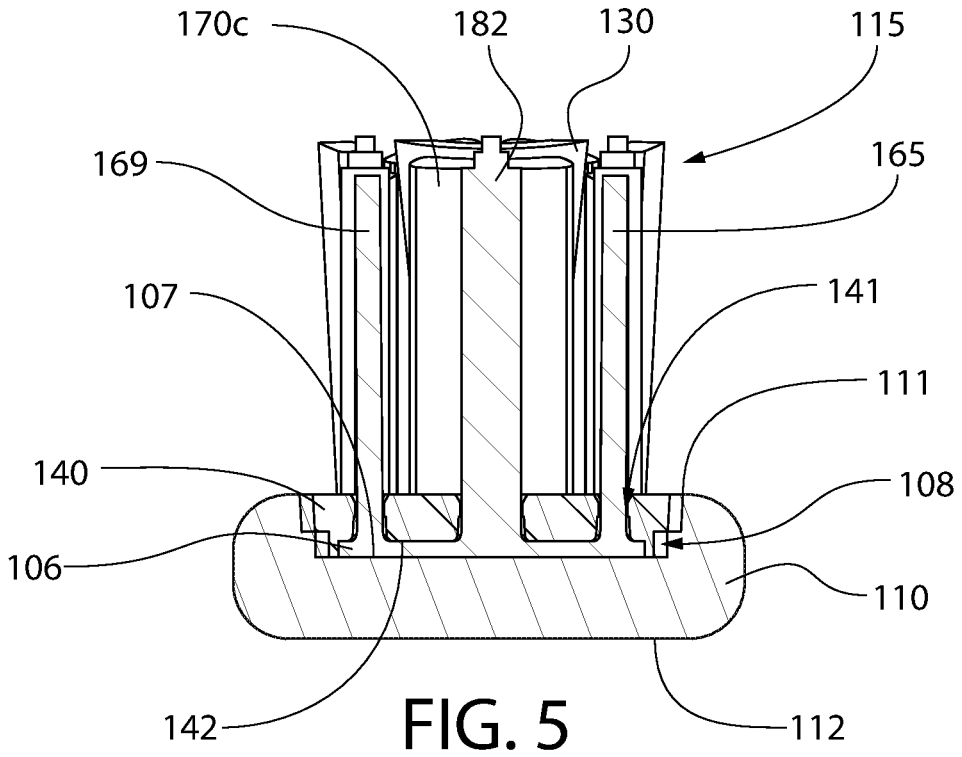
FIG. 5 is a cross-sectional view taken along line V-V of FIG. 2.
Figure 6:
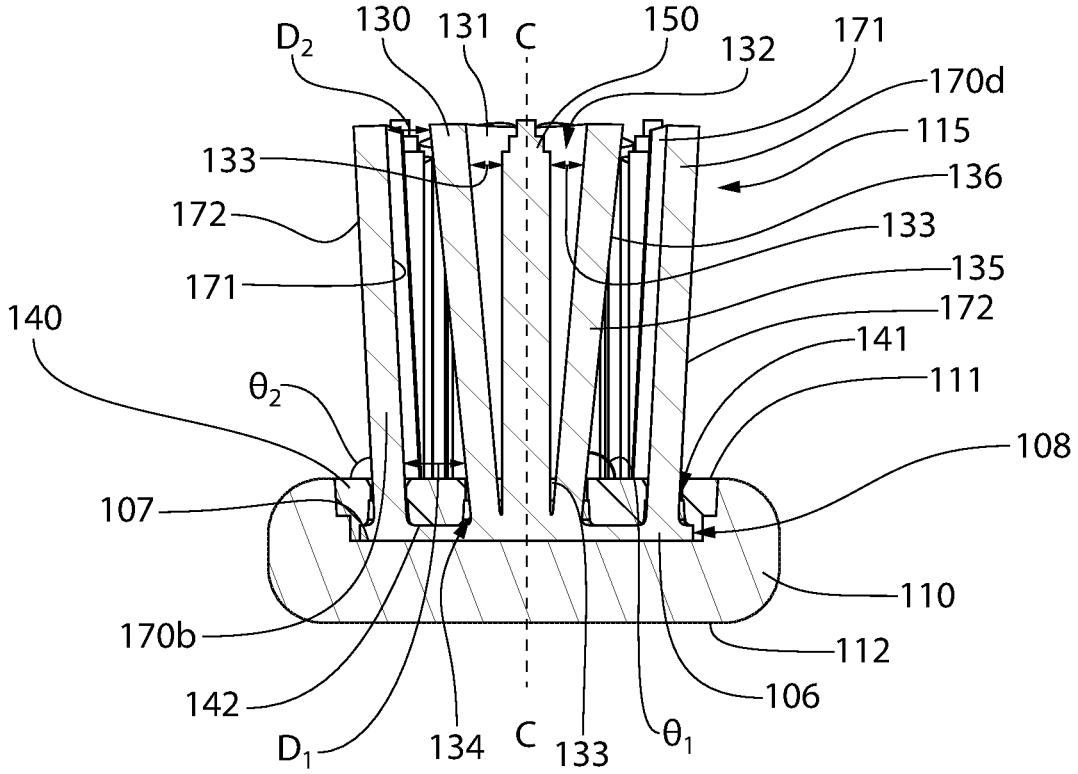
FIG. 6 is a cross-sectional view taken along line VI-VI of FIG. 2.
Figure 7:
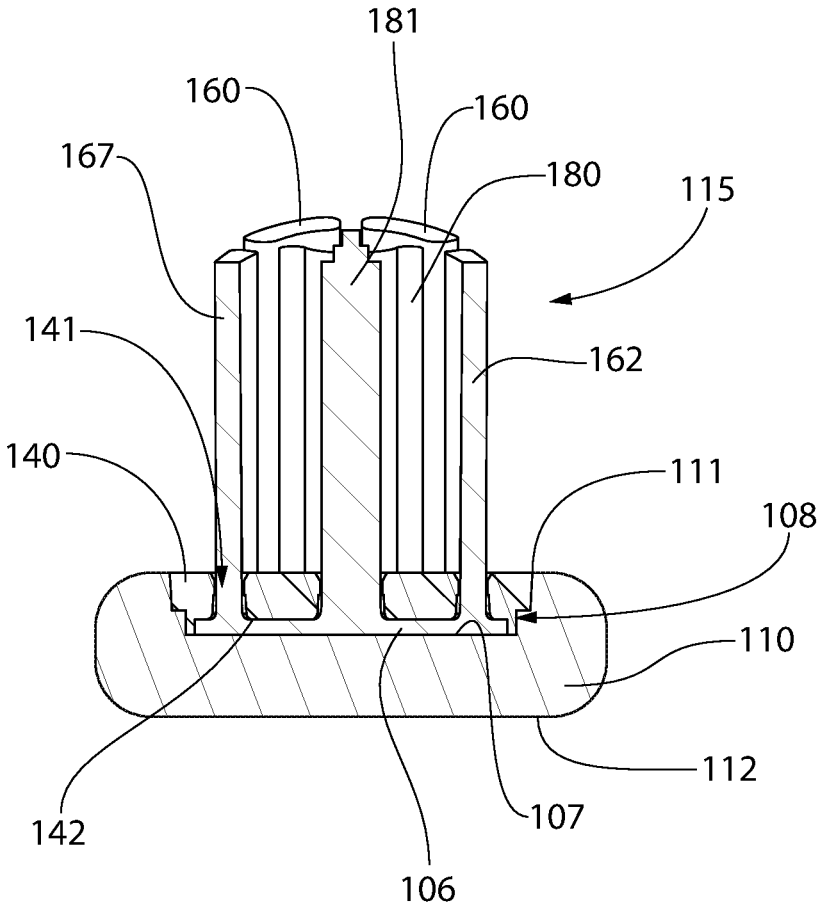
FIG. 7 is a cross-sectional view taken along line VII-VII of FIG. 2.

The conical tuft 130 circumferentially surrounds the central cleaning element 150 in a spaced apart manner for at least the portion of the conical tuft 130 and the central cleaning element 150 that extend above the front surface 111 of the head 110. However, as best seen in FIGS. 4 and 6, the central cleaning element 150 converges with the continuous bristle wall 135 of the conical tuft 130 at a position that is below the front surface 111 of the head 110. Specifically, the central cleaning element 150 and the conical tuft 130 converge into contact with one another at a location below the front surface 111 of the head 110 to form the melt matte 106 as discussed above.

Thus, the annular gap 133 formed between the inner surface 131 of the conical tuft 130 and the central cleaning element 150 extends to below the front surface 111 of the head 110. Stated another way, the annular gap 133 exists between the inner surface 131 of the conical tuft 130 and the central cleaning element 150 for the entire portion of the conical tuft 130 and the central cleaning element 150 that extends from or protrudes beyond the front surface 111 of the head 110. Due to the annular gap 133 extending to below the front surface 111 of the head 110, independent movement of the conical tuft 130 and the central cleaning element 150 is enhanced or improved. Specifically, because the conical tuft 130 and the central cleaning element 150 converges at the very bottom portion of those bristle tufts, the conical tuft 130 and the central cleaning element 150 are spaced apart along their lengths to enable independent movement thereof. This better enables the conical tuft 130 to surround a user's teeth individually during tooth brushing due to the increased flexibility of the conical tuft 130.

The head 110 extends along a longitudinal axis B-B along its length. In the exemplified embodiment, the conical tuft 130 and the central cleaning element 150 are aligned on the longitudinal axis. Furthermore, in the exemplified embodiment the conical tuft 130 and the central cleaning element 150 are also aligned along a transverse axis that is perpendicular to the longitudinal axis B-B and that divides the head 110 into two equal halves. Thus, in the exemplified embodiment the conical tuft 130 and the central cleaning element 150 are centrally located on the head 110. Of course, in other embodiments the conical tuft 130 and the central cleaning element 150 can be positioned at other located on the head 110 as desired.

The plurality of tooth cleaning elements 115 also include a plurality of arcuate cleaning elements 170*a-d* that are arranged in a spaced apart manner about a loop L that surrounds the conical tuft 130. In the exemplified embodiment, the plurality of arcuate cleaning elements 170*a-d* are depicted as tufts of bristles. However, the plurality of arcuate cleaning elements 170*a-d* can be formed from an elastomeric material in other embodiments as desired. Furthermore, the plurality of arcuate cleaning elements 170*a-d* are positioned adjacent to the conical tuft 130 such that there are no other cleaning element structures intervening in the spaces between the plurality of arcuate cleaning elements 170*a-d* and the conical tuft 130. Thus, each of the plurality of arcuate cleaning elements 170*a-d* is positioned adjacent to the conical tuft 130 in a spaced apart manner such that the space between the plurality of arcuate cleaning elements 170*a-d* and the conical tuft 130 is devoid of cleaning elements.

The loop L is a reference loop that is delineated in dotted lines in FIG. 2 for reference. The loop L has a center point CP that is located along the cavity axis C-C. The center point CP is also the point of intersection between the longitudinal axis B-B and the transverse axis discussed above that divides the head 110 into two equal halves. Thus, the loop L and the conical tuft 130 are arranged concentrically about the cavity axis C-C with the loop L having a greater diameter than the conical tuft 130. The plurality of arcuate cleaning elements 170*a-d* include a first arcuate cleaning element 170*a*, a second arcuate cleaning element 170*b*, a third arcuate cleaning element 170*c*, and a fourth arcuate cleaning element 170*d*. The first arcuate cleaning element 170*a* is positioned adjacent to and spaced apart from each of the second and fourth arcuate cleaning elements 170*b*, 170*d*. The second arcuate cleaning element 170*b* is positioned adjacent to and spaced apart from each of the first and third arcuate cleaning elements 170*a*, 170*c*. The third arcuate cleaning element 170*c* is positioned adjacent to and spaced apart from each of the second and fourth arcuate cleaning elements 170*b*, 170*d*. The fourth arcuate cleaning element 170*d* is positioned adjacent to and spaced apart from each of the first and third arcuate cleaning elements 170*a*, 170*c*.

Each of the plurality of arcuate cleaning elements 170*a-d* is an elongated bristle wall. Specifically, the first and third arcuate cleaning elements 170*a, c* are elongated in a direction transverse to the longitudinal axis B-B of the head 110 and the second and fourth arcuate cleaning elements 170*b, d* are elongated in a direction parallel to the longitudinal axis B-B. Each of the plurality of arcuate cleaning elements 170*a-d* is formed from a plurality of individual bristles that are arranged together into a single tuft hole to form the elongated bristle wall. In certain embodiments each of the plurality of arcuate cleaning elements 170*a-d* extends from a separate single tuft hole and the conical tuft 130 extends from a separate single tuft hole. Thus, each of the arcuate cleaning elements 170*a-d* extends from a different tuft hole than each of the other arcuate cleaning elements 170*a-d* and from the conical tuft 130. Each of the plurality of arcuate cleaning elements 170*a-d* includes a concave surface 171 and an opposing convex surface 172. Furthermore, in the exemplified embodiment the concave surfaces 171 of each of the plurality of arcuate cleaning elements 170*a-d* is facing or positioned adjacent to the conical tuft 130 and the convex surface 172 of each of the plurality of arcuate cleaning elements 170*a-d* is facing away from or is non-adjacent to the conical tuft 130. In some embodiments the radius of curvature of the concave surfaces 171 of the plurality of arcuate cleaning elements 170*a-d* is the same as that of the conical tuft 130.

Referring briefly to FIGS. 4 and 6, the outer surface 136 of the conical tuft 130 forms a first acute angle $\theta_1$ with the front surface 111 of the head 110. Furthermore, the convex surface 172 of each of the plurality of arcuate cleaning elements 170*a-d* (which also forms the outer surface of the plurality of arcuate cleaning elements 170*a-d*) forms a second acute angle $\theta_2$ with the front surface 111 of the head 110. In certain embodiments, the first acute angle $\theta_1$ is different from the second acute angle $\theta_2$. Furthermore, in some embodiments the second acute angle $\theta_2$ is greater than the first acute angle $\theta_1$. For example, in one embodiment the first acute angle $\theta_1$ is between 80° and 85°, more specifically between 83° and 84°, and still more specifically approximately 83.5°. In one embodiment the second acute angle $\theta_2$ is between 85° and 89°, more specifically between 87° and 88°, and still more specifically approximately 87.5°.

The conical tuft 130 is spaced apart from each of the plurality of arcuate cleaning elements 170*a-d* by a gap. Furthermore, because in the exemplified embodiment the second angle $\theta_2$ is greater than the first angle $\theta_1$, the gap between the outer surface 136 of the conical tuft 130 and the inner or concave surfaces 171 of each of the plurality of arcuate cleaning elements 170*a-d* decreases with distance from the front surface 111 of the head 110. Specifically, because the conical tuft 130 is oriented at a greater angle relative to the front surface 111 of the head 110 than the plurality of arcuate cleaning elements 170*a-d*, the conical tuft 130 becomes closer to each of the plurality of arcuate cleaning elements 170*a-d* the further away the conical tuft 130 and the plurality of arcuate cleaning elements 170*a-d* are from the front surface 111 of the head 110. Stated another way, the outer surface 136 of the conical tuft 130 is spaced apart from the concave surfaces 171 of each of the plurality of arcuate cleaning elements 170*a-d* by a first distance $D_1$ at the front surface 111 of the head 110. The outer surface 136 of the conical tufts 130 is spaced apart from the concave surfaces 171 of each of the plurality of arcuate cleaning elements 170*a-d* by a second distance $D_2$ at the terminal or free ends of the conical tuft 130 and of the plurality of arcuate cleaning elements 170*a-d*. Furthermore, the first distance $D_1$ is greater than the second distance $D_2$. Thus, even though both the conical tuft 130 and the plurality of arcuate cleaning elements 170*a-d* are oriented at an angle relative to the front surface 111 of the head 110, the conical tuft 130 leans outwardly away from the cavity axis C-C and towards each of the plurality of arcuate cleaning elements 170*a-d*.

As noted above, in the exemplified embodiment the ends of the bristles are melted together to form the melt matte 106 that becomes trapped between the lower surface 142 of the head plate 140 and the floor 107 of the basin 108 within which the head plate 140 is positioned. This melt matte 106 includes melted ends of all of the different bristles discussed herein. Thus, ends of each of the conical tuft 130 and the plurality of arcuate cleaning elements 170*a-d* are melted together to form a portion of the melt matte 106. Furthermore, in embodiments that include the central cleaning element 150, the ends of the central cleaning element 150 are also melted together to form a portion of the melt matte 106. Of course, all of the other cleaning elements including those described below may be melted to form a portion of the melt matte 106 as has been described herein.

In addition to the conical tuft 130, the central cleaning element 150, and the plurality of arcuate cleaning elements 170*a-d*, the tooth cleaning elements 115 also comprise many other additional cleaning elements on the head 110. Specifically, the tooth cleaning elements 115 include an outer loop of cleaning elements that includes the second and fourth arcuate cleaning elements 170*b*, 170*d* and an inner row of cleaning elements that includes the first and third arcuate cleaning elements 170*a*, 170*c*, the conical tuft 130 and the central cleaning element 150.

The outer loop of cleaning elements comprises a grouping of cleaning elements that are arranged so that the outer loop is symmetric about a longitudinal axis B-B of the head 110 and about a transverse axis that intersects the cavity axis C-C, the center point CP and is perpendicular to the longitudinal axis B-B. In the exemplified embodiment, the entirety of the tooth cleaning elements are arranged so as to be symmetric about the longitudinal axis B-B and the transverse axis. Specifically, the outer loop of cleaning elements includes proximal cleaning elements 160 located at a proximal region of the head 110 and distal cleaning elements 161 located at a distal region of the head 110. Each of the proximal cleaning elements 160 is an arcuate cleaning element located on opposing sides of the longitudinal axis B-B. Similarly, each of the distal cleaning elements 161 is an arcuate cleaning element located on opposing sides of the longitudinal axis B-B.

Starting from the proximal cleaning element 160 and working upwardly towards the distal cleaning elements 161, the left side of the head 110 (when viewed from the front as depicted in FIG. 2) has a first bristle wall 162, a first bristle tuft 163, the second arcuate cleaning element 170*b*, a second bristle tuft 164, and a second bristle wall 165. Starting from the proximal cleaning element 160 and working upwardly towards the distal cleaning elements 161, the right side of the head 110 has a third bristle wall 166, a third bristle tuft 167, the fourth arcuate cleaning element 170*d*, a fourth bristle tuft 168, and a fourth bristle wall 169. Each of these bristle tufts and bristle walls is in its own tuft hole and is spaced apart from adjacent ones of the bristle tufts and bristle walls. The first bristle wall 162 is longitudinally aligned with the third bristle wall 166 on opposing lateral sides of the head 110, the second bristle wall 165 is longitudinally aligned with the fourth bristle wall 169 on opposing lateral sides of the head, the first bristle tuft 163 is longitudinally aligned with the third bristle tuft 167 on opposing lateral sides of the head, and the second bristle tuft 164 is longitudinally aligned with the fourth bristle tuft 168 on opposing lateral sides of the head.

Furthermore, the first bristle tuft 163 is at least partially located within the space between the first arcuate cleaning element 170*a* and the second arcuate cleaning element 170*b*, the second bristle tuft 164 is at least partially located within the space between the second arcuate cleaning element 170*b* and the third arcuate cleaning element 170*c*, the third bristle tuft 167 is at least partially located within the space between the first arcuate cleaning element 170 and the fourth arcuate cleaning element 170*d*, and the fourth bristle tuft 168 is at least partially located within the space between the third arcuate cleaning element 170*c* and the fourth arcuate cleaning element 170*d*. In the exemplified embodiment the first, second, third, and fourth bristle tufts 163, 164, 167, 168 are located outside of the loop L, but they are still adjacent to and positioned in between the plurality of arcuate cleaning elements 170*a-d* as noted herein above.

Similarly, working upwardly from the proximal cleaning elements 160 to the distal cleaning elements 161, the inner row of cleaning elements comprise a fifth bristle wall 180, a fifth bristle tuft 181, the first arcuate cleaning element 170*a*, the conical tuft 130 and the central cleaning element 150, the third arcuate cleaning element 170*c*, a sixth bristle tuft 182, and a sixth bristle wall 183. Any of the bristle tufts (or the individual bristles that form the bristle tufts) can be tapered, non-tapered, rounded, spiral, or the like. Furthermore, the fifth and sixth bristle walls 180, 183 are arcuate and have a smaller radius of curvature than the plurality of arcuate cleaning elements 170*a-d*. The concave surfaces of the fifth and sixth bristle walls 180, 183 are facing each other and the conical tuft 130. The proximal and distal cleaning elements 160, 161 are also arcuate in the exemplified embodiment. The first, second, third, and fourth bristle walls 162, 165, 167, 169 are not arcuate in the exemplified embodiment, but are simply elongated bristle walls, although they could be arcuate in other embodiments.

Figure 8:
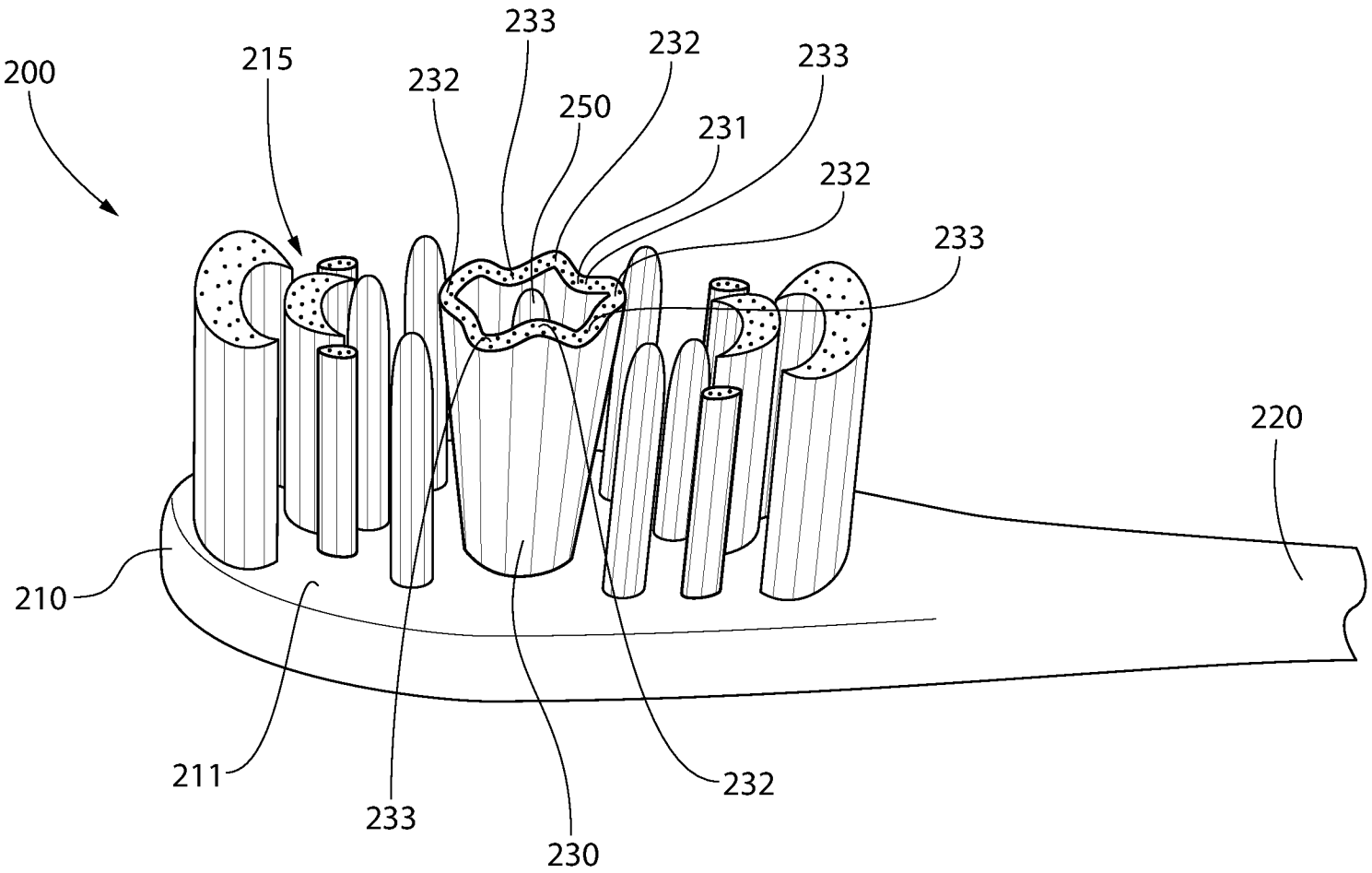
FIG. 8 is a front perspective view of an oral care implement in accordance with another embodiment of the present invention.

Referring now to FIG. 8, an oral care implement 200 will be described in accordance with another embodiment of the present invention. The oral care implement 200 is similar to the oral care implement 100 and thus much of the description above with regard to the oral care implement 100 is applicable to the oral care implement 200, except where the description of the oral care implement 100 above is contradictory to a specific description of the oral care implement 200 provided below. Features of the oral care implement 200 that are similar to features of the oral care implement 100 described above will be similarly numbered except that the 200-series of numbers will be used. Certain features of the oral care implement 200 may be labeled but not described, in which case the description of the similar feature from the oral care implement 100 applies. Furthermore, certain features of the oral care implement 200 may not be labeled, it being understood that the description of the similar feature from the oral care implement 100 applies.

The oral care implement 200 generally comprises a handle 20 and a head 210, which have the same structures, features, materials of construction, and the like as described above with regard to the oral care implement 100. Furthermore, a plurality of tooth cleaning elements 215 are positioned on and extend from a front surface 211 of the head 210. The plurality of tooth cleaning elements 215 include a conical tuft 230, a central cleaning element 250, and many additional cleaning elements that will not be described in detail herein. Specifically, although a specific configuration and pattern of the additional cleaning elements is provided in the drawings, the invention is not to be so limited. In certain embodiments, the conical tuft 230 can be used with any arrangement of additional cleaning elements, including the arrangement depicted in FIGS. 1-7. Thus, in certain embodiments the invention may be the arrangement of cleaning elements achieved by swapping out the conical tuft 130 and replacing it with the conical tuft 230. Thus, the only component of FIG. 8 that will be discussed in detail herein is the conical tuft 230, it being understood that the description of the other features above may be used with the conical tuft 230.

The conical tuft 230 is in the shape of an inverted truncated cone much like the conical tuft 130 described above. The conical tuft 230 has a first end that is inserted within a tuft hole in the head 210 (or in a head plate as discussed above), and the conical tuft 230 extends from the front surface 211 of the head 210 and terminates in an annular top surface 231. In this embodiment, the annular top surface 231 of the conical tuft 230 is an undulating or wavy surface. Thus, the side profile of the annular top surface 231 conical tuft 230 is wavy. Despite this undulating surface, the conical tuft 230 is still conical such that it has a circular or spherical transverse cross-sectional shape. Furthermore, in this embodiment the annular top surface 231 of the conical tuft 230 comprises sinusoidal-shaped undulations. Specifically, the annular top surface 231 of the conical tuft 230 undulates in height relative to the front surface 211 of the head 210. In that regard, the annular top surface 231 of the conical tuft 230 comprises a plurality of peaks 232 and a plurality of valleys 233. The plurality of peaks 232 are located at a first distance from the front surface 211 of the head 210 and the plurality of valleys 233 are located at a second distance from the front surface 211 of the head 210, the first distance being greater than the second distance. The conical tuft 230 can have any number of peaks and valleys as desired.

In this embodiment, the conical tuft 230 has a continuous bristle wall that extends 360° about an axis as discussed above with the conical tuft 130. Furthermore, the outer surface of the conical tuft 230 has a continuous cone-like shape. The undulations are formed by having some of the bristles in the conical tuft 230 having a greater height than others of the bristles in the conical tuft 230. By varying the height of the bristles within the conical tuft 230, the various peaks 232 and valleys 233 noted herein above can be formed. The conical tuft 230 can be positioned at orientations other than that depicted in FIG. 8 by rotating the conical tuft 230 relative to the head 210 so that the location of the peaks 232 and valleys 233 can be other than that which is depicted in FIG. 8.

Figure 9:
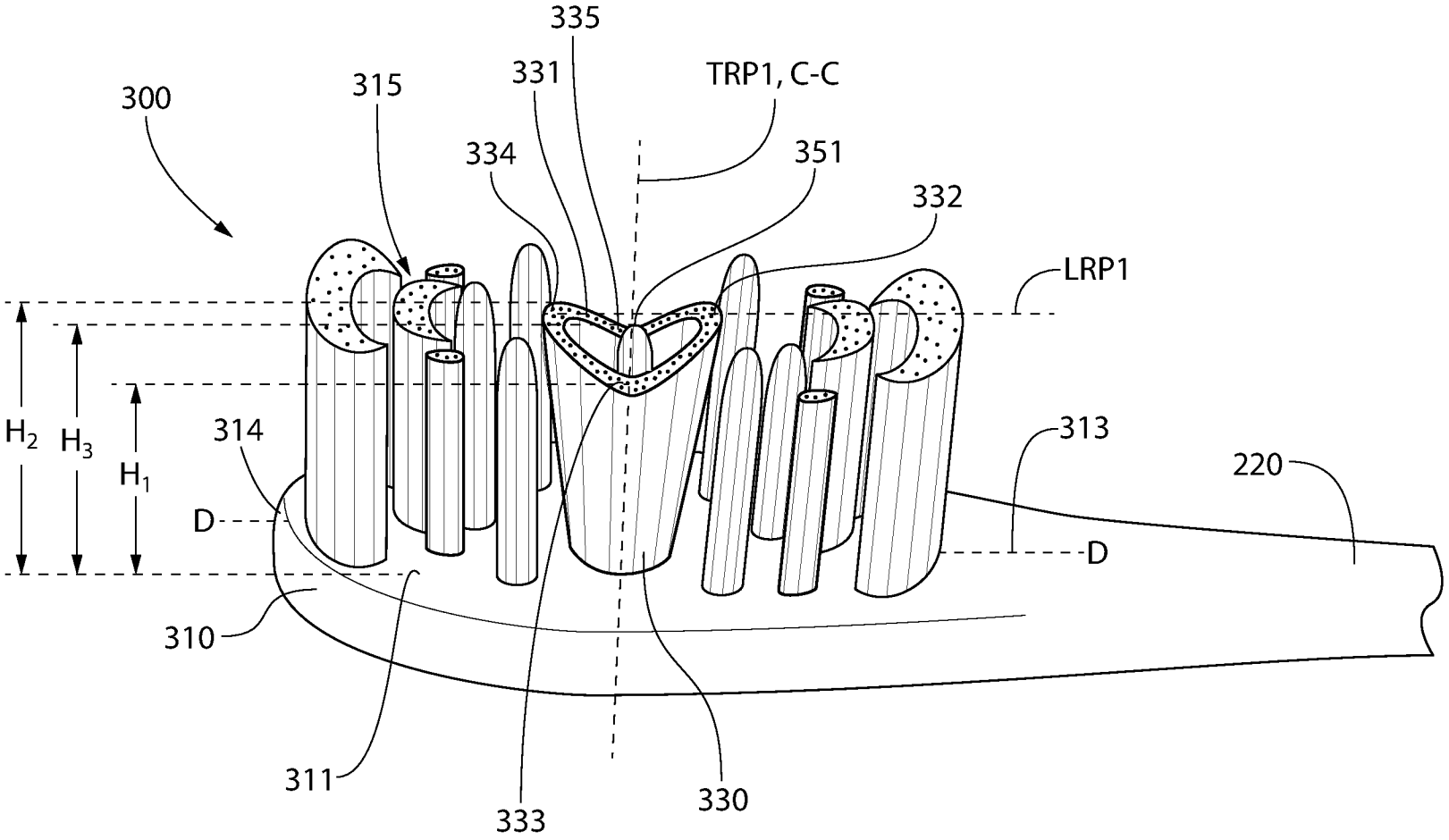
FIG. 9 is a front perspective view of an oral care implement in accordance with still another embodiment of the present invention.

Referring now to FIG. 9, an oral care implement 300 will be described in accordance with yet another embodiment of the present invention. The oral care implement 300 is similar to the oral care implement 100 and thus much of the description above with regard to the oral care implement 100 is applicable to the oral care implement 300, except where the description of the oral care implement 100 above is contradictory to a specific description of the oral care implement 300 provided below. Features of the oral care implement 300 that are similar to features of the oral care implement 100 described above will be similarly numbered except that the 300-series of numbers will be used. Certain features of the oral care implement 300 may be labeled but not described, in which case the description of the similar feature from the oral care implement 100 or from the oral care implement 200 applies. Furthermore, certain features of the oral care implement 300 may not be labeled, it being understood that the description of the similar feature from the oral care implement 100 applies.

The oral care implement 300 generally comprises a handle 320 and a head 310, which have the same structures, features, materials of construction, and the like as described above with regard to the oral care implement 100. Furthermore, a plurality of tooth cleaning elements 315 are positioned on and extend from a front surface 311 of the head 310. The plurality of tooth cleaning elements 315 include a conical tuft 330, a central cleaning element 350, and many additional cleaning elements that will not be described in detail herein. Specifically, although a specific configuration and pattern of the additional cleaning elements is provided in the drawings, the invention is not to be so limited. In certain embodiments, the conical tuft 330 can be used with any arrangement of cleaning elements, including the arrangement depicted in FIGS. 1-7. Thus, in certain embodiments the invention may be the arrangement of cleaning elements achieved by replacing the conical tuft 130 with the conical tuft 330. Thus, the only components of FIG. 9 that will be discussed in detail herein is the conical tuft 330 and the central cleaning element 350, it being understood that the description of the other features above may be used with this conical tuft 330.

In this embodiment, the head 310 of the oral care implement extends from a proximal end 313 to a distal end 314 along a longitudinal axis D-D. The conical tuft 330 is positioned on the front surface 311 of the head 310 in a similar manner, location, and orientation as the conical tuft 130 discussed above. The conical tuft 330 terminates in an annular top surface 331 that undulates in height relative to the front surface 311 of the head. Specifically, the annular top surface 311 of the conical tuft 330 comprises a first peak portion 332, a second peak portion 334, a first valley portion 333, and a second valley portion 335. The first and second peak portions 332, 334 extend a greater height from the front surface 311 of the head 310 than the first and second valley portions 333, 335. Furthermore, although in the exemplified embodiment the first and second peak portions 332, 334 extend the same height from the front surface 311 of the head 310 and the first and second valley portions 333, 335 extend the same height from the front surface 311 of the head 310, the invention is not to be so limited in all embodiments and each peak portion and each valley portion may extend different heights from the front surface 311 of the head 310 in other embodiments. Differently from the conical tuft 230, the annular top surface 331 of the conical tuft 330 comprises V-shaped undulations, although they can be sinusoidal shaped or otherwise shaped as desired in other embodiments.

In this embodiment, a longitudinal reference plane LRP1 that is substantially parallel to the longitudinal axis D-D and perpendicular to the front surface 311 of the head 310 intersects the first and second peak portions 332, 334 of the annular top surface 331 of the conical tuft 330. Furthermore, a transverse reference plane TRP1 that is substantially perpendicular to the longitudinal axis D-D and to the front surface 311 of the head 310 intersects both of the first and second valley portions 333, 335 of the annular top surface 331 of the conical tuft 330. Furthermore, in the exemplified embodiment of FIG. 9 the longitudinal reference plane LRP1 and the transverse reference plane TRP1 intersect along the cavity axis C-C. Thus, the first and second peak portions 332, 334 of the annular top surface 331 of the conical tuft 310 are transversely aligned along the longitudinal reference plane LRP1 and the first and second valley portions 333, 335 of the annular top surface 331 of the conical tuft 310 are longitudinally aligned along the transverse reference plane TRP1. Thus, due to the locations of the peak and valley portions 332, 333, 334, 335, when viewed from the transverse reference plane TRP1 the annular top surface 331 of the conical tuft 330 has a V-shaped or concave side profile and when viewed from the longitudinal reference plane LRP1 the annular top surface 331 of the conical tuft 330 has a convex side profile.

As noted above, the plurality of tooth cleaning elements 315 include the conical tuft 330 and the central cleaning element 350. The central cleaning element 350 is located within the cavity that is defined by the inner surface of the conical tuft 330 in the same manner as discussed above with regard to the oral care implement 100 and FIGS. 1-7. In the exemplified embodiment, the valley portions 333, 335 of the annular top surface 331 extend a first height H1 above the front surface 311 of the head 310, the peak portions 332, 334 of the annular top surface 331 extend a second height H2 above the front surface 311 of the head 310, and the central cleaning element 350 terminates in a free end 351 that is located at a third height H3 above the front surface 311 of the head 310. In certain embodiments the first height H1 is less than the second height H2. Furthermore, in the exemplified embodiment the third height H3 is less than the second height H2 and the third height H3 is greater than the first height H1. Of course, in other embodiments the third height H3 may be equal to or less than the second height H2 and greater than the first height H1. In still other embodiments, the third height H3 may be equal to or less than the first height H1.

Figure 10:
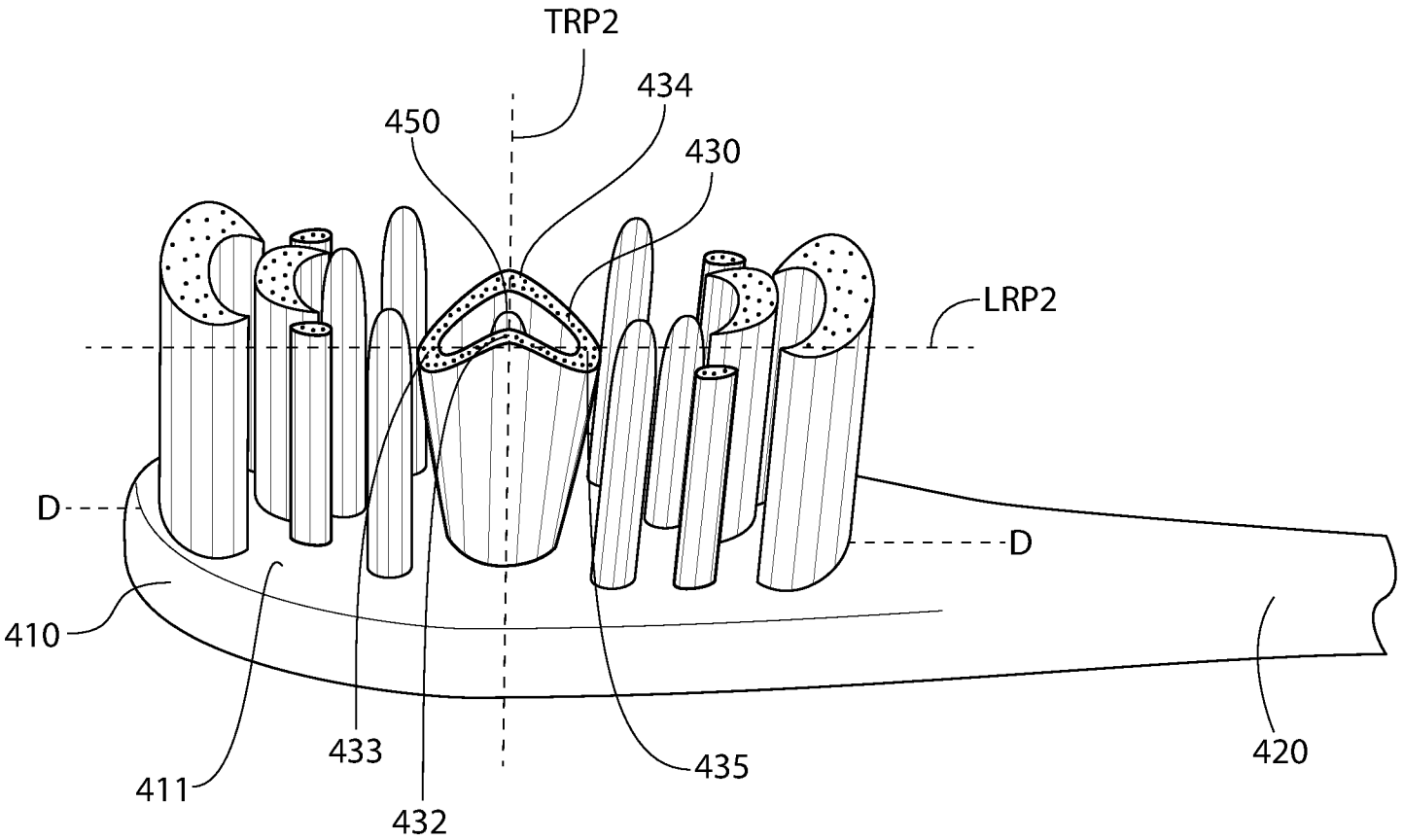
FIG. 10 is a front perspective view of an oral care implement in accordance with another embodiment.

Referring now to FIG. 10, an oral care implement 400 will be described in accordance with yet another embodiment of the present invention. The oral care implement 400 is similar to the oral care implement 300 and to the oral care implement 100, and thus much of the description above with regard to the oral care implement 100 and the oral care implement 300 is applicable to the oral care implement 400, except where the description of the oral care implements 100, 300 above is contradictory to a specific description of the oral care implement 400 provided below. Features of the oral care implement 400 that are similar to features of the oral care implements 100, 300 described above will be similarly numbered except that the 400-series of numbers will be used. Certain features of the oral care implement 400 may be labeled but not described, in which case the description of the similar feature from the oral care implement 100, 300 applies. Furthermore, certain features of the oral care implement 400 may not be labeled, it being understood that the description of the similar feature from the oral care implement 100, 300 applies.

The oral care implement 400 is identical to the oral care implement 300 except that the conical tuft 430 has been rotated ninety degrees relative to the head 410. Thus, in the oral care implement 300 the peaks 332, 334 were aligned along the longitudinal axis D-D of the head 310, but in the oral acre implement 430 the valley portions 433, 435 are aligned along the longitudinal axis D-D of the head 410. Thus, in this embodiment, a longitudinal reference plane LRP2 that is substantially parallel to the longitudinal axis D-D and perpendicular to the front surface 411 of the head 410 intersects the first and second valley portions 433, 435 of the annular top surface 431 of the conical tuft 430 and a transverse reference plane TRP2 that is substantially perpendicular to the longitudinal axis D-D and perpendicular to the front surface 411 of the head 410 intersects the first and second peak portions 432, 434 of the annular top surface 431 of the conical tuft 430. In this embodiment, the annular top surface 431 has a convex side profile when viewed from the transverse reference plane TRP2 and a concave (or V-shaped) side profile when viewed from the longitudinal reference plane LRP2.

In either of the embodiments of FIGS. 9 and 10, the central tooth cleaning element 350, 450 may be shorter than the valley portions of the conical tufts 330, 430, the same height as the valley portions of the conical tufts 330, 430, taller than the valley portions of the conical tufts 330, 430 but shorter than the peak portions of the conical tufts 330, 430, the same height as the peak portions of the conical tufts 330, 430, or taller than the peak portions of the conical tufts 330, 430 as desired to achieve a particular cleaning result. Furthermore, as discussed previously the central tooth cleaning elements 350, 450 may also be omitted in some embodiments.

Concept Two

Figure 11:
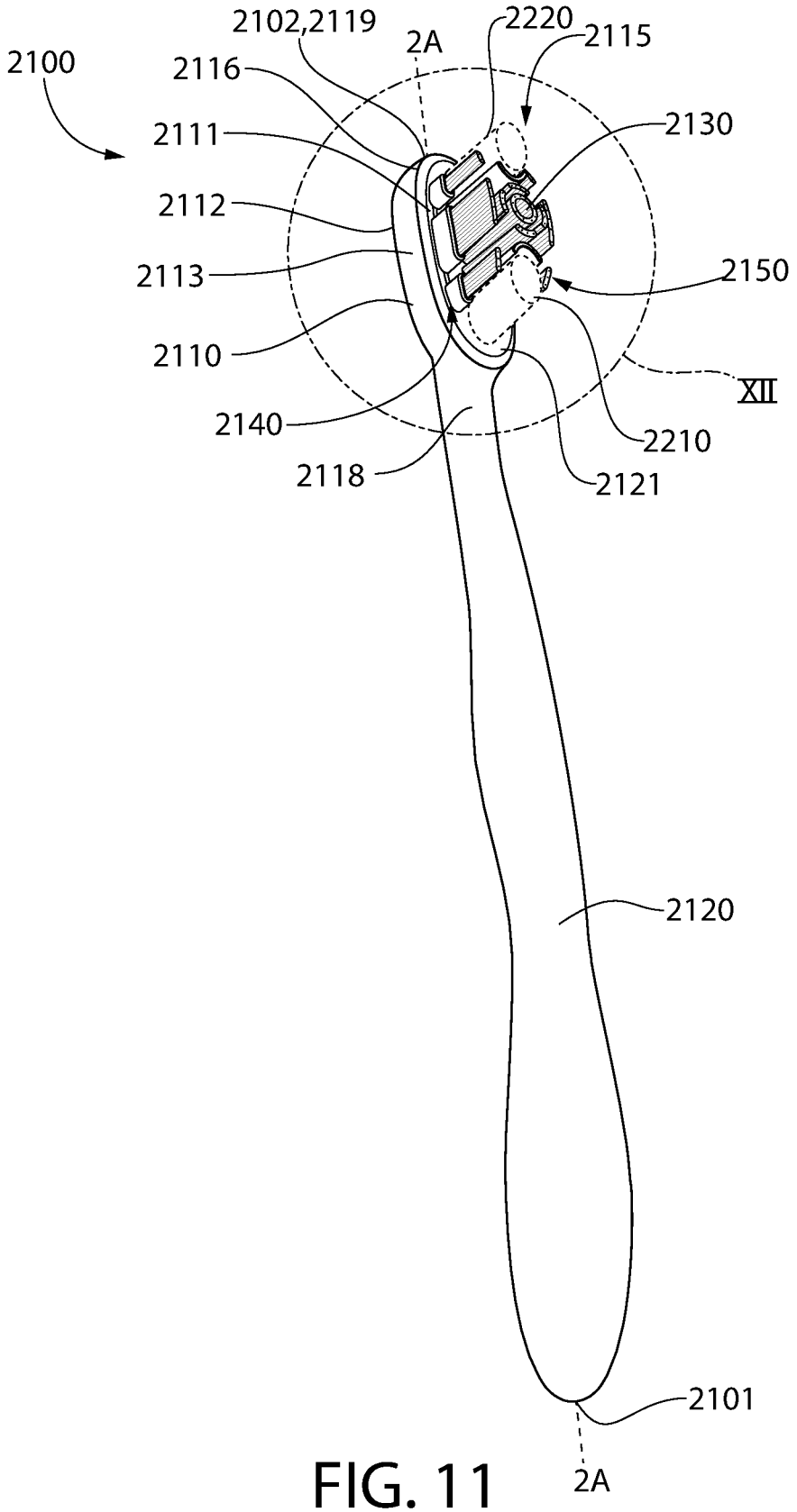
FIG. 11 is a front perspective view of an oral care implement in accordance with one embodiment of the present invention.
Figure 12:
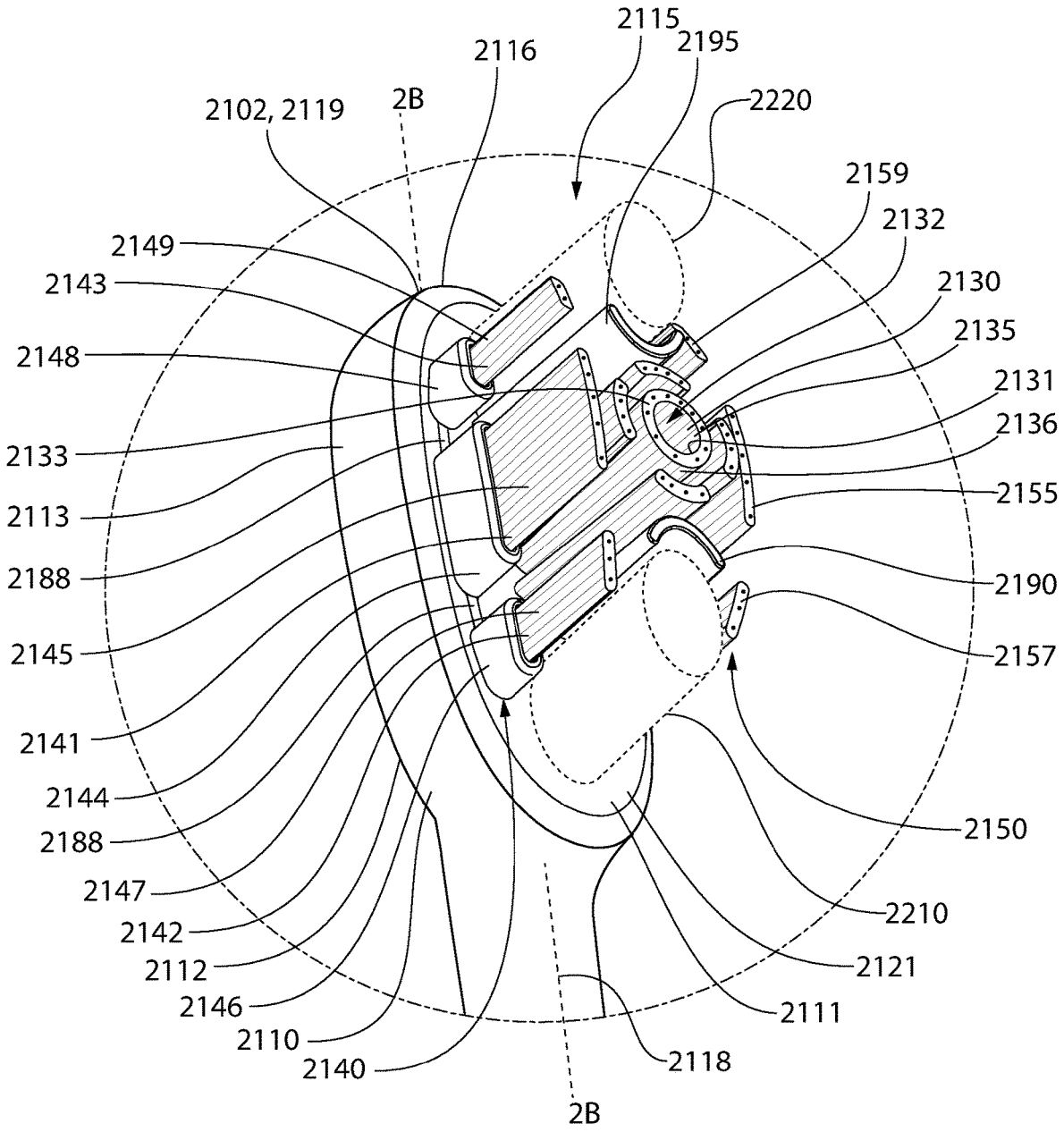
FIG. 12 is a close-up view of a head of the oral care implement of FIG. 11 as indicated by area II of FIG. 11.
Figure 13:
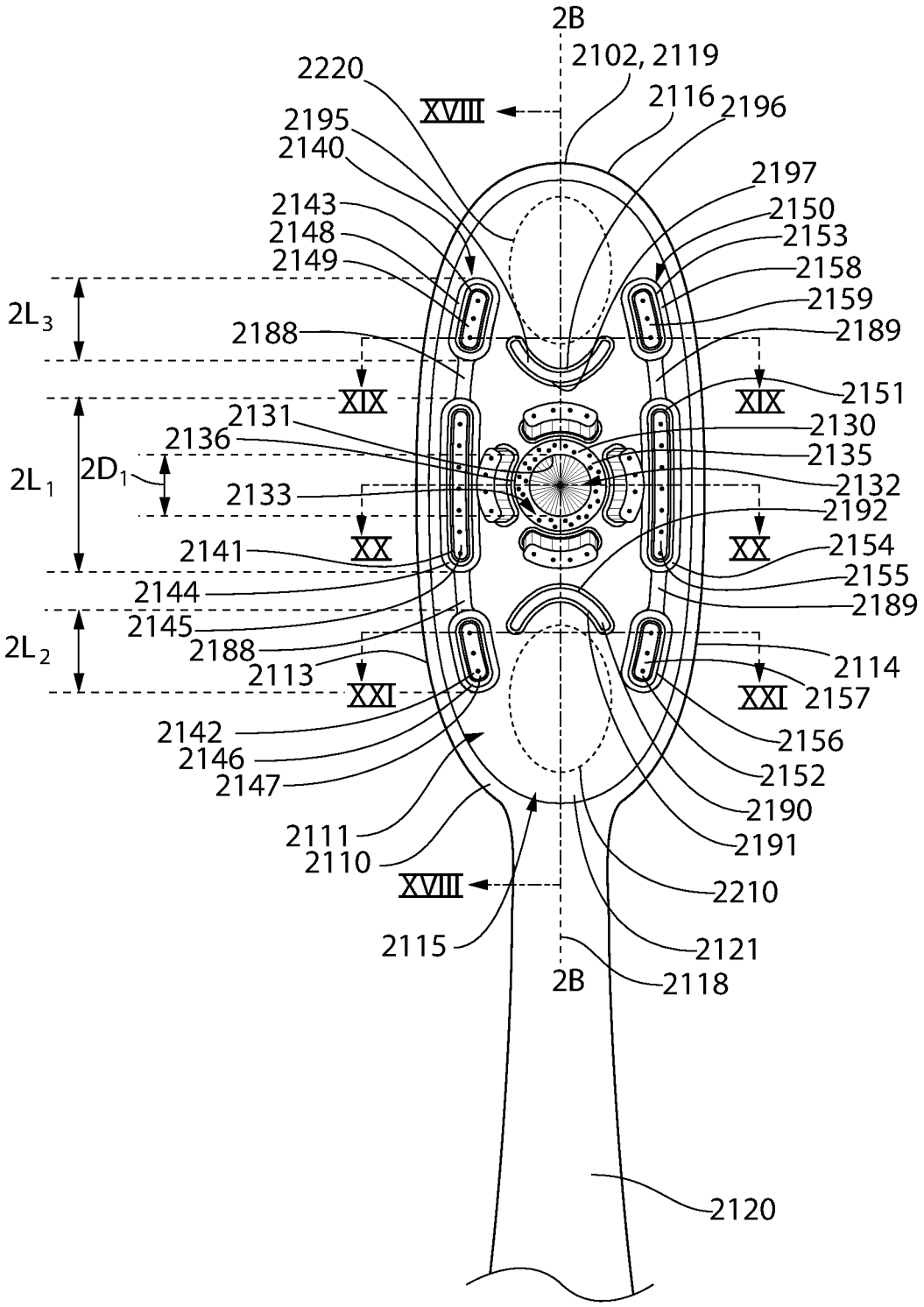
FIG. 13 is a front view of the head of the oral care implement of FIG. 12.

Referring first to FIGS. 11-13 concurrently, an oral care implement 2100 is illustrated in accordance with one embodiment of the present invention. In the exemplified embodiment, the oral care implement 2100 is in the form of a manual toothbrush. However, in certain other embodiments the oral care implement 2100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Thus, it is to be understood that the inventive concepts discussed herein can be applied to any type of oral care implement unless a specific type of oral care implement is specified in the claims.

The oral care implement 2100 extends from a proximal end 2101 to a distal end 2102 along a longitudinal axis 2A-2A. The oral care implement 2100 generally comprises a head 2110 and a handle 2120. The head 2110 extends from a proximal end 2118 to a distal end 2119 along a longitudinal axis 2B-2B that is coextensive with the longitudinal axis 2A-2A of the oral care implement 2100. Furthermore, in the exemplified embodiment the distal end 2102 of the oral care implement 2100 is the same as the distal end 2119 of the head 2110.

The handle 2120 is an elongated structure that provides the mechanism by which the user can hold and manipulate the oral care implement 2100 during use. In the exemplified embodiment, the handle 2120 is generically depicted having various contours for user comfort. Of course, the invention is not to be limited by the specific shape illustrated for the handle 2120 in all embodiments and in certain other embodiments the handle 2120 can take on a wide variety of shapes, contours, and configurations, none of which are limiting of the present invention unless so specified in the claims.

In the exemplified embodiment, the handle 2120 is formed of a rigid plastic material, such as for example without limitation polymers and copolymers of ethylene, propylene, butadiene, vinyl compounds, and polyesters such as polyethylene terephthalate. Of course, the invention is not to be so limited in all embodiments and the handle 2120 may include a resilient material, such as a thermoplastic elastomer, as a grip cover that is molded over portions of or the entirety of the handle 2120 to enhance the gripability of the handle 2120 during use. For example, portions of the handle 2120 that are typically gripped by a user's palm during use may be overmolded with a thermoplastic elastomer or other resilient material to further increase comfort to a user. Furthermore, materials other than those noted above can be used including metal, wood, or any other desired material that has sufficient structural rigidity to permit a user to grip the handle 2120 and manipulate the oral care implement 2100 during toothbrushing.

The head 2110 of the oral care implement 2100 is coupled to the handle 2120 and comprises a front surface 2111 and an opposing rear surface 2112. Furthermore, the head 2110 has a peripheral side surface extending between the front and rear surfaces 2111, 2112. The peripheral side surface of the head 2110 includes a first lateral edge 2113, a second lateral edge 2114, and a distal edge 2116. In the exemplified embodiment, the head 2110 is formed integrally with the handle 2120 as a single unitary structure using a molding, milling, machining, or other suitable process. However, in other embodiments the handle 2120 and the head 2110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus the head 2110 may, in certain embodiments, be formed of any of the rigid plastic materials described above as being used for forming the handle 2120, although the invention is not to be so limited in all embodiments and other materials that are commonly used during toothbrush head manufacture may also be used.

The oral care implement 2100 also comprises a plurality of tooth cleaning elements 2115 extending from the front surface 2111 of the head 2110. The details of certain ones of the plurality of tooth cleaning elements 2115 will be discussed below, including specific details with regard to the structure, pattern, orientation, and material of such tooth cleaning elements 2115. However, where it does not conflict with the other disclosure provided herein, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Thus, any combination of these tooth cleaning elements may be used within the tooth cleaning elements 2115 in some embodiments. However, as described herein below, in certain embodiments one or more of the tooth cleaning elements 2115 may be formed as tufts of bristles.

In embodiments that use elastomeric elements as one or more of the tooth cleaning elements 2115, suitable elastomeric materials may include any biocompatible resilient material suitable for uses in an oral hygiene apparatus. To provide optimum comfort as well as cleaning benefits, the elastomeric material of any such tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Referring now to FIGS. 11-14 and 18-21 concurrently, one manner in which the tooth cleaning elements 2115 are secured to the head 2110 will be described. Specifically, in the exemplified embodiment the tooth cleaning elements 2115 are formed as a cleaning element assembly on a head plate 2121 such that one or more of the tooth cleaning elements 2115 are mounted onto the head plate 2121 and then the head plate 2121 is coupled to or secured to the head 2110. The head plate 2121 has a lower surface 2123 and an upper surface 2124, the upper surface 2124 forming a portion of (or in some instances the entirety of) the front surface 2111 of the head 2110. In embodiments that use the head plate 2121, the head plate 2121 is a separate and distinct component from the head 2110 of the oral care implement 2100. However, the head plate 2121 is connected to the head 2110 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 2121 and the head 2110 are separately formed components that are secured together during manufacture of the oral care implement 2100.

In certain embodiments, the head plate 2121 may comprise a plurality of holes 2122 formed therethrough, and the tooth cleaning elements 2115 may be mounted to the head plate 2121 within the holes 2122. This type of technique for mounting the tooth cleaning elements 2115 to the head 2110 via the head plate 2121 is generally known as anchor free tufting (AFT). Specifically, in AFT a plate or membrane (i.e., the head plate 2121) is created separately from the head 2110. The tooth cleaning elements 2115 (such as bristles, elastomeric elements, and combinations thereof) are positioned into the head plate 2121 so as to extend through the holes 2122 of the head plate 2121. The free ends of the tooth cleaning elements 2115 on one side of the head plate 2121 perform the cleaning function. The ends of the tooth cleaning elements 2115 on the other side of the head plate 2121 are melted together by heat to be anchored in place. As the tooth cleaning elements 2105 are melted together, a melt matte 2106 is formed. After the tooth cleaning elements 2115 are secured to the head plate 2121, the head plate 2121 is secured to the head 2110 such as by ultrasonic welding. When the head plate 2121 is coupled to the head 2110, the melt matte 2106 is located between the lower surface 2123 of the head plate 2121 and a floor 2107 of a basin 2108 of the head 2110 in which the head plate 2121 is disposed. The melt matte 2106, which is coupled directly to and in fact forms a part of the tooth cleaning elements 2115, prevents the tooth cleaning elements 2115 from being pulled through the holes 2122 in the head plate 2121 to ensure that the tooth cleaning elements 2105 remain attached to the head plate 2121 during use of the oral care implement 2100.

In another embodiment, the tooth cleaning elements may be connected to the head 2110 using a technique known in the art as AMR. In this technique, the handle is formed integrally with the head plate as a one-piece structure (thus, the head plate actually forms an upper portion of the head to which the cleaning elements are attached, as noted herein below). After the handle and head plate are formed, the bristles are inserted into holes in the head plate so that free/cleaning ends of the bristles extend from the front surface of the head plate and bottom ends of the bristles are adjacent to the rear surface of the head plate. After the bristles are inserted into the holes in the head plate, the bottom ends of the bristles are melted together by applying heat thereto, thereby forming a melt matte at the rear surface of the head plate. The melt matte is a thin layer of plastic that is formed by melting the bottom ends of the bristles so that the bottom ends of the bristles transition into a liquid, at which point the liquid of the bottom ends of the bristles combine together into a single layer of liquid plastic that at least partially covers the rear surface of the head plate. After the heat is no longer applied, the melted bottom ends of the bristles solidify/harden to form the melt matte/thin layer of plastic (this same process occurs in the formation of the melt matte 2106 described above with regard to AFT). In some embodiments, after formation of the melt matte, a tissue cleaner is injection molded onto the rear surface of the head plate, thereby trapping the melt matte between the tissue cleaner and the rear surface of the head plate. In other embodiments, other structures may be coupled to the rear surface of the head plate to trap the melt matte between the rear surface of the head plate and such structure without the structure necessarily being a tissue cleaner (the structure can just be a plastic material that is used to form a smooth rear surface of the head, or the like).

Although described herein above with regard to using AFT or AMR, in certain embodiments any suitable form of cleaning elements and attachment may be used in the broad practice of this invention. Specifically, the tooth cleaning elements 2115 of the present invention can be connected to the head 2110 in any manner known in the art. For example, staples/anchors or in-mold tufting (IMT) could be used to mount the cleaning elements/tooth engaging elements. In certain embodiments, the invention can be practiced with various combinations of stapled, IMT or AFT bristles. Alternatively, the tooth cleaning elements 2115 could be mounted to tuft blocks or sections by extending through suitable openings in the tuft blocks so that the base of the tooth cleaning elements 2115 is mounted within or below the tuft block. Furthermore, in a modified version of the AFT process discussed above, the head plate 2121 may be formed by positioning the tooth cleaning elements 2115 within a mold, and then molding the head plate 2121 around the tooth cleaning elements 2115 via an injection molding process.

Although not illustrated herein, in certain embodiments the head 2110 may also include a soft tissue cleanser coupled to or positioned on its rear surface 2112. An example of a suitable soft tissue cleanser that may be used with the present invention and positioned on the rear surface of the head 2110 is disclosed in U.S. Pat. No. 7,2143,2462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 2100 may not include any soft tissue cleanser.

Referring to FIGS. 11-13, 17, and 18 concurrently, the plurality of tooth cleaning elements 2115 of the oral care implement 2100 will be further described. In the exemplified embodiment, the plurality of tooth cleaning elements 2115 comprises a conical tuft 2130. The conical tuft 2130 is a tuft or grouping of bristles that are arranged together into a tuft and then secured into a single tuft hole within the head 2110 (or within the head plate 2121). The conical tuft 2130 is described herein as being conical due to the conical tuft 2130 having a conical shape. Thus, as can best be seen in FIG. 20, the bristles of the conical tuft 2130 converge and form an apex that is located within the tuft hole within which the conical tuft 2130 is positioned. The apex may be located at the upper surface 2124 of the head plate 2121, within the tuft hole of the head plate 2121 between the upper and lower surfaces 2123, 2124, or near the lower surface 2123 of the head plate 2121. In other embodiments the apex may be located above the upper surface 2124 of the head plate 2121. In still other embodiments, the conical tuft 2130 may be in the shape of a truncated cone wherein the portion of the conical tuft 2130 that is positioned within the head 2110 is the truncated (i.e., cut off) portion of the cone such that the conical tuft 2130 is in the shape of an inverted truncated cone. In such an embodiment, the bristles of the conical tuft 2130 will not converge prior to reaching the melt matte 2106.

The conical tuft 2130 comprises a continuous bristle wall 2135 having an inner surface 2131 and an outer surface 2136. The outer surface 2136 of the conical tuft 2130 is oriented at an acute angle relative to the front surface 2111 of the head 2110. In one embodiment, the acute angle may be between 80° and 89°, more specifically between 82° and 85°, or between 86° and 89°, or between 83.5° and 87.5°.

Furthermore, the conical tuft 2130 terminates in an annular top surface 2133 that is located at a first height $2H_1$ from the front surface 2111 of the head 2110. The inner surface 2131 of the continuous bristle wall 2135 of the conical tuft 2130 defines a cavity 2132 that extends along a cavity axis 2C-2C. The conical tuft 2130 extends in a 360° manner about the cavity axis 2C-2C. The cavity 2132 of the conical tuft 2130 has an open top end and is bounded by the inner surface 2131 of the continuous bristle wall 2135 and by the front surface 2111 of the head 2110. As noted above, the conical tuft 2130 in the exemplified embodiment is formed by a plurality of bristles. Specifically, the plurality of bristles are clumped together and positioned collectively into a single tuft hole so that the plurality of bristles collectively form the conical tuft 2130 having no gaps in the continuous bristle wall 2135 for its entire 360° extension about the cavity axis 2C-2C. Thus, the term continuous bristle wall 2135 is intended to mean that the conical tuft 2130 is a single tuft of bristles that are clumped together into a single tuft hole in a non-spaced apart manner. However, the invention is not to be limited to the bristle wall 2135 being continuous in all embodiments.

Thus, in the exemplified embodiment the conical tuft 2130 is a single tuft formed from a plurality of individual bristles that are positioned together within a single tuft hole. As a result, in the exemplified embodiment the conical tuft 2130 has the continuous bristle wall 2135 that extends without discontinuity about the cavity axis 2C-2C. Thus, in the exemplified embodiment there are no gaps formed into the outer surface 2136 of the conical tuft 2130. Of course, in other embodiments the conical tuft 2130 may have small gaps therein as desired while still being a single tuft positioned within a single tuft hole. In such an embodiment, the bristle wall may not be considered continuous. Such gaps in the bristle wall may prevent dentifrice from being trapped within the cavity 2132 of the conical tuft 2130 by providing means of egress from the cavity 2132.

Figure 20:
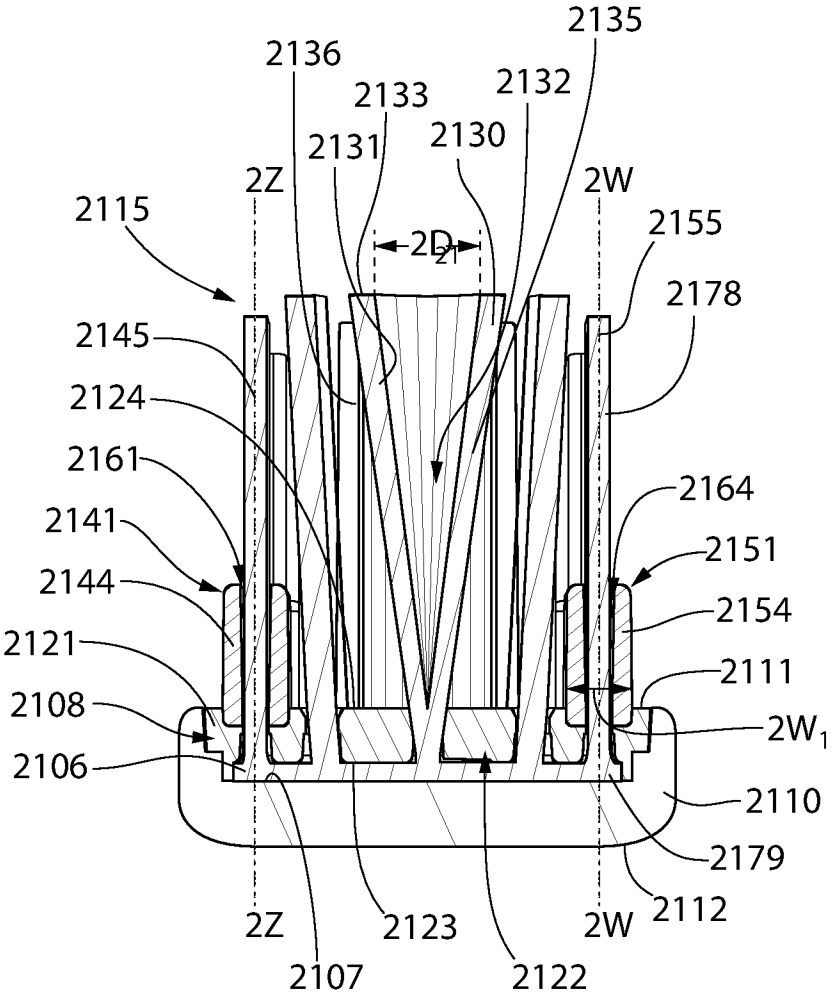
FIG. 20 is a cross-sectional view taken along line XX-XX of FIG. 13.

Due to the conical shape of the conical tuft 2130, and more specifically, the inverted conical shape of the conical tuft 2130, the cavity 2132 of the conical tuft 2130 has a transverse cross-sectional area that increases with distance from the front surface 2111 of the head 2110. Specifically, the transverse cross-sectional area of the cavity 2132 of the conical tuft 2130 only increases and never decreases with distance from the front surface 2111 of the head 2110. Thus, the greater the distance between a particular axial location within the cavity 2132 of the conical tuft 2130 and the front surface 2111 of the head 2110, the greater the transverse cross-sectional area of the cavity 2132 at that particular axial location. Referring briefly to FIGS. 13 and 20, the transverse cross-sectional area of the cavity 2132 of the conical tuft 2130 has a maximum diameter $2D_1$ located at the annular top surface 2133 of the conical tuft 2130.

Although not illustrated in the exemplified embodiment, in certain embodiments the oral care implement 2100 may include a central cleaning element that is located within the cavity 2132 of the conical tuft 2130. In such an embodiment, the conical tuft 2130 may surround the central cleaning element. Using the conical tuft 2130 in conjunction with a central cleaning element may enhance cleaning by enabling the conical tuft 2130 to surround a user's tooth while the central cleaning element cleans in the interproximal areas and the spaces between the teeth and gums. In one exemplary embodiment, the central cleaning element may be a bristle tuft, although the invention is not to be so limited in all embodiments and in certain other embodiments the central cleaning element may be an elastomeric element or the like as discussed above. Furthermore, the central cleaning element may be formed with tapered bristles, rounded/non-tapered bristles, spiral bristles, or combinations thereof. In an embodiment that includes a central tuft, the conical tuft 2130 and the central cleaning element may be secured to the head 2110 by anchor free tufting. Specifically, the ends of the bristles that form the conical tuft 2130 and the ends of the bristles that form the central cleaning element may be melted together to form at least a portion of the melt matte 2106 as discussed above.

As noted above, the head 2110 extends along the longitudinal axis 2B-2B from its proximal end 2118 to its distal end 2119. In the exemplified embodiment, the conical tuft 2130 is aligned on the longitudinal axis. Furthermore, in the exemplified embodiment the conical tuft 2130 is also aligned along a transverse axis that is perpendicular to the longitudinal axis 2B-2B and that divides the head 2110 into two equal halves. Thus, in the exemplified embodiment the conical tuft 2130 is centrally located on the head 2110. Of course, in other embodiments the conical tuft 2130 can be positioned at other locations on the head 2110 as desired, such as being located along the longitudinal axis 2B-2B and at the proximal or distal ends of the head 2110, or the like. Furthermore, in some embodiments more than one conical tuft may be included on the head 2110. In the exemplified embodiment, a set of four arcuate tooth cleaning elements are arranged so as to form a loop that substantially surrounds the conical tuft 2130. Each of the four arcuate tooth cleaning elements has a concave surface facing the conical tuft 2130 and a convex surface facing away from the conical tuft 2130. The four arcuate tooth cleaning elements are adjacent to the conical tuft 2130 such that there are no cleaning elements positioned on the head in between the concave surfaces of the four arcuate tooth cleaning elements and the outer surface 2136 of the conical tuft 2130. In the exemplified embodiment, the four arcuate tooth cleaning elements extend from the front surface 2111 of the head 2110 at the same angle as the outer surface 2136 of the conical tuft 2130 forms with the front surface 2111 of the head 2110. However, the four arcuate tooth cleaning elements may be perpendicular to the head 2110 or may extend at angles relative to the front surface 2111 of the head 2110 that are different than the conical tuft 2130 in other embodiments.

Still referring to FIGS. 11-13, and 17-21, the plurality of tooth cleaning elements 2115 also include a first set of peripheral tooth cleaning elements 2140 and a second set of peripheral tooth cleaning elements 2150. The first set of peripheral tooth cleaning elements 2140 are located on the front surface of the head 2111 adjacent to the first lateral edge 2113 of the head 2110. The second set of peripheral tooth cleaning elements 2150 are located on the front surface of the head 2111 adjacent to the second lateral edge 2114 of the head 2110. Each of the first and second sets of peripheral tooth cleaning elements 2140, 2150 are the peripheral-most cleaning elements on the respective sides of the head 2110 such that there are no cleaning elements positioned outboard of the first and second sets of peripheral tooth cleaning elements 2140, 2150. Stated another way, there are no cleaning elements positioned between the first set of peripheral tooth cleaning elements 2140 and the first lateral edge 2113 of the head 2110 and there are no cleaning elements positioned between the second set of peripheral tooth cleaning elements 2150 and the second lateral edge 2114 of the head 2110. However, the first and second sets of peripheral tooth cleaning elements 2140, 2150 are set inwardly from the first and second lateral edges 2113, 2114 of the head 2110 such that a portion of the front surface 2111 of the head 2110 separates the first and second sets of peripheral tooth cleaning elements 2140, 2150 from the first and second lateral edges 2113, 2114 of the head 2110, respectively.

The first set of peripheral tooth cleaning elements 2140 comprises a central peripheral tooth cleaning element 2141, a proximal peripheral tooth cleaning element 2142, and a distal peripheral tooth cleaning element 2143. The central peripheral tooth cleaning element 2141 of the first set of peripheral tooth cleaning elements 2140 is located axially between the proximal and distal peripheral tooth cleaning elements 2142, 2143 of the first set of peripheral tooth cleaning elements 2140. The second set of peripheral tooth cleaning elements 2150 comprises a central peripheral tooth cleaning element 2151, a proximal peripheral tooth cleaning element 2152, and a distal peripheral tooth cleaning element 2153. The central peripheral tooth cleaning element 2151 of the second set of peripheral tooth cleaning elements 2150 is located axially between the proximal and distal peripheral tooth cleaning elements 2152, 2153 of the second set of peripheral tooth cleaning elements 2150. The central peripheral tooth cleaning elements 2141, 2151 are longitudinal aligned such that a transverse plane that is perpendicular to the longitudinal axis 2B-2B and to the front surface 2111 of the head 2110 intersects both of the central peripheral tooth cleaning elements 2141, 2151. The proximal peripheral tooth cleaning elements 2142, 2152 are longitudinal aligned such that a transverse plane that is perpendicular to the longitudinal axis 2B-2B and to the front surface 2111 of the head 2110 intersects both of the proximal peripheral tooth cleaning elements 2142, 2152. The distal peripheral tooth cleaning elements 2143, 2153 are longitudinal aligned such that a transverse plane that is perpendicular to the longitudinal axis 2B-2B and to the front surface 2111 of the head 2110 intersects both of the distal peripheral tooth cleaning elements 2143, 2153.

Each of the peripheral tooth cleaning elements 2141, 2142, 2143, 2151, 2152, 2153 of the first and second sets 2140, 2150 comprises an elastomeric sleeve portion and a bristle portion. Thus, the central peripheral tooth cleaning element 2141 has an elastomeric sleeve portion 2144 and a bristle tuft portion 2145, the proximal peripheral tooth cleaning element 2142 has an elastomeric sleeve portion 2146 and a bristle tuft portion 2147, and the distal peripheral tooth cleaning element 2143 has an elastomeric sleeve portion 2148 and a bristle tuft portion 2149. Similarly, the central peripheral tooth cleaning element 2151 has an elastomeric sleeve portion 2154 and a bristle tuft portion 2155, the proximal peripheral tooth cleaning element 2152 has an elastomeric sleeve portion 2156 and a bristle tuft portion 2157, and the distal peripheral tooth cleaning element 2153 has an elastomeric sleeve portion 2158 and a bristle tuft portion 2159.

The bristle tuft portions 2145, 2147, 2149, 2155, 2157, 2159 of each of the peripheral tooth cleaning elements 2141, 2142, 2143, 2151, 2152, 2153 are separately formed of a plurality of bristles that are collected together into a tuft and inserted into a tuft hole. The sleeve portions 2144, 2146, 2148, 2154, 2156, 2158 of the peripheral tooth cleaning elements 2141, 2142, 2143, 2151, 2152, 2153 are formed of an elastomeric material and circumferentially surround at least a portion of its respective bristle tuft portion 2145, 2147, 2149, 2155, 2157, 2159. As will be discussed in more detail below with specific reference to FIGS. 14, 16A, and 16B, in the exemplified embodiment the sleeve portions 2144, 2146, 2148, 2154, 2156, 2158 of the peripheral tooth cleaning elements 2141, 2142, 2143, 2151, 2152, 2153 are formed as an integral mass of elastomeric material. Thus, the sleeve portions 2144, 2146, 2148, 2154, 2156, 2158 of the peripheral tooth cleaning elements 2141, 2142, 2143, 2151, 2152, 2153 are molded together as a single, unitary structure that is affixed, coupled, or molded directly onto the head plate 2121.

Furthermore, each of the elastomeric sleeve portions 2144, 2146, 2148, 2154, 2156, 2158 has a sleeve cavity having a sleeve axis. More specifically, the elastomeric sleeve portion 2144 of the central peripheral tooth cleaning element 2141 of the first set of peripheral tooth cleaning elements 2140 has a sleeve cavity 2161 extending along a sleeve axis 2Z-2Z. The elastomeric sleeve portion 2146 of the proximal peripheral tooth cleaning element 2142 of the first set of peripheral tooth cleaning elements 2140 has a sleeve cavity 2162 extending along a sleeve axis 2Y-2Y. The elastomeric sleeve portion 2148 of the proximal peripheral tooth cleaning element 2143 of the first set of peripheral tooth cleaning elements 2140 has a sleeve cavity 2163 extending along a sleeve axis 2X-2X. The elastomeric sleeve portion 2144 of the central peripheral tooth cleaning element 2151 of the second set of peripheral tooth cleaning elements 2150 has a sleeve cavity 2164 extending along a sleeve axis 2W-2W. The elastomeric sleeve portion 2156 of the proximal peripheral tooth cleaning element 2152 of the second set of peripheral tooth cleaning elements 2150 has a sleeve cavity 2165 extending along a sleeve axis 2V-2V. The elastomeric sleeve portion 2158 of the distal peripheral tooth cleaning element 2153 of the second set of peripheral tooth cleaning elements 2150 has a sleeve cavity 2166 extending along a sleeve axis U-U.

Each of the elastomeric sleeve portions 2144, 2146, 2148, 2154, 2156, 2158 has an outer surface and an inner surface, the inner surface defining a hollow interior cavity (i.e., the sleeve cavity). The bristle tuft portions 2145, 2147, 2149, 2155, 2157, 2159 are located within the hollow interior cavities 2161-2166 of the elastomeric sleeve portions 2144, 2146, 2148, 2154, 2156, 2158 and protrude from the top surfaces of the elastomeric sleeve portions 2144, 2146, 2148, 2154, 2156, 2158 for cleaning a user's teeth and other oral surfaces and from the bottom surfaces of the elastomeric sleeve portions 2144, 2146, 2148, 2154, 2156, 2158 for forming the melt matte 2106 or otherwise being secured to the head 2110. Thus, the elastomeric sleeve portions 2144, 2146, 2148, 2154, 2156, 2158 circumferentially surround a portion of the bristle tuft portion 2145, 2147, 2149, 2155, 2157, 2159 that is located within its cavity 2161-2166. The elastomeric sleeve portions 2144, 2146, 2148, 2154, 2156, 2158 provide support for the bristle tuft portions 2145, 2147, 2149, 2155, 2157, 2159 so that more force is required to bend the bristles, which provides for an effective and thorough cleaning of a user's teeth and other oral surfaces. The elastomeric sleeve portions 2144, 2146, 2148, 2154, 2156, 2158 may also provide a wiping action against the teeth surfaces during brushing for an enhanced cleaning effect.

The bristle tuft portion 2145 of the central tooth cleaning element 2141 of the first set of peripheral tooth cleaning elements 2140 is located within and extends through the sleeve cavity 2161 of the elastomeric sleeve portion 2144 along the sleeve axis 2Z-2Z. The bristle tuft portion 2147 of the proximal tooth cleaning element 2142 of the first set of peripheral tooth cleaning elements 2140 is located within and extends through the sleeve cavity 2162 along the sleeve axis 2Y-2Y. The bristle tuft portion 2149 of the distal tooth cleaning element 2143 of the first set of peripheral tooth cleaning elements 2140 is located within and extends through the sleeve cavity 2163 along the sleeve axis 2X-2X. Bottom ends of each of the bristle tuft portions 2145, 2147, 2149 are melted together to form a portion of the melt matte 2106 as discussed above.

The bristle tuft portion 2155 of the central tooth cleaning element 2151 of the second set of peripheral tooth cleaning elements 2150 is located within and extends through the sleeve cavity 2164 along the sleeve axis 2W-2W. The bristle tuft portion 2157 of the proximal tooth cleaning element 2152 of the second set of peripheral tooth cleaning elements 2150 is located within and extends through the sleeve cavity 2165 along the sleeve axis 2V-2V. The bristle tuft portion 2159 of the distal tooth cleaning element 2153 of the second set of peripheral tooth cleaning elements 2150 is located within and extends through the sleeve cavity 2166 along the sleeve axis U-U. Bottom ends of each of the bristle tuft portions 2155, 2157, 2159 are melted together to form a portion of the melt matte 2106 as discussed above In the exemplified embodiment, for each of the peripheral tooth tooth cleaning elements, 2141, 2142, 2143, 2151, 2152, 2153 of the first and second sets 2140, 2150, the sleeve cavity 2161-2166 of the elastomeric sleeve portion 2144, 2146, 2148, 2154, 2156, 2158 has a transverse cross-section comprising a major axis and a minor axis, the major axis being longer than the minor axis. Specifically, the sleeve cavities 2161-2166 of each of the elastomeric sleeve portions 2144, 2146, 2148, 2154, 2156, 2158 has a major axis extending in the direction of the longitudinal axis 2B-2B of the head 2110 and a minor axis extending in a direction transverse to the longitudinal axis 2B-2B of the head 2110 such that each of the cavities 2161-2166 (and each of the) elastomeric sleeve portions 2144, 2146, 2148, 2154, 2156, 2158) extends for a greater distance along the length of the head 2110 (in the direction of the longitudinal axis 2B-2B) than along the width of the head 2110.

In the exemplified embodiment, the central peripheral tooth cleaning elements 2141, 2151 of the first and second sets 2140, 2150 has a first longitudinal length $2L_1$, the proximal peripheral tooth cleaning elements 2142, 2152 of the first and second sets 2140, 2150 has a second longitudinal length $2L_2$, and the distal peripheral tooth cleaning elements 2143, 2153 of the first and second sets 2140, 2150 has a third longitudinal length $2L_3$. Furthermore, as labeled in FIGS. 19-21, the central peripheral tooth cleaning elements 2141, 2151 of the first and second sets 2140, 2150 has a first transverse width $2W_1$, the proximal peripheral tooth cleaning elements 2142, 2152 of the first and second sets 2140, 2150 has a second transverse width $2W_2$, and the distal peripheral tooth cleaning elements 2143, 2153 of the first and second sets 2140, 2150 has a third transverse width $2W_3$. Although the lengths are only labeled in the figures with regard to the first set of peripheral tooth cleaning elements 2140 and the widths are only labeled in the figures with regard to the second set of peripheral tooth cleaning elements 2150, it should be understood that the relative lengths and widths provided and discussed herein are equally applicable to the first and second sets of peripheral tooth cleaning elements 2140, 2150.

In the exemplified embodiment, the first longitudinal length $2L_1$ is greater than the first transverse width $2W_1$, the second transverse length $2L_2$ is greater than the second transverse width $2W_2$, and the third transverse width $2L_3$ is greater than the third transverse width $2W_3$. Furthermore, in the exemplified embodiment the first longitudinal length $2L_1$ of the central peripheral tooth cleaning elements 2141, 2151 of the first and second sets 2140, 2150 is greater than each of the second and third longitudinal lengths $2L_2$, $2L_3$ of the proximal and distal tooth cleaning elements 2142, 2143, 2152, 2153 of the first and second sets 2140, 2150. In one embodiment, the second and third longitudinal lengths $2L_2$, $2L_3$ may be the same, although the invention is not to be so limited and in certain other embodiments the second and third longitudinal lengths $2L_2$, $2L_3$ may differ from one another. Furthermore, in one embodiment all of the first, second, and third transverse widths $2W_1$, $2W_2$, $2W_3$ may be the same, although the invention is not to be so limited and in other embodiments the first, second, and third transverse widths $2W_1$, $2W_2$, $2W_3$ may be different from one another.

The oral care implement 2100 also includes a grouping of proximal cleaning elements 2210 and a grouping of distal cleaning elements 2220, both of which are generically illustrated as cylinders in dotted-line. Each of the groupings of proximal and distal cleaning elements 2210, 2220 may comprise one or more cleaning elements, such as bristle tufts, elastomeric elements, or combinations thereof. In certain embodiments, each of the groupings of proximal and distal cleaning elements 2210, 2220 may comprise arcuate bristle tufts respectively located at the proximal-most and distal-most ends of the head 2100. In one such an embodiment, the arcuate proximal-most bristle tuft of the grouping of proximal cleaning elements 2210, the arcuate distal-most bristle tuft of the grouping of distal cleaning elements 2220, and the first and second sets of peripheral tooth cleaning elements 2140, 2150, collectively form a loop about the periphery of the front surface 2111 of the head 2110. This loop surrounds the conical tuft 2130 (although there are additional tooth cleaning elements positioned between the conical tuft 2130 and each of the tooth cleaning elements that form the loop).

In the exemplified embodiment, the conical tuft 2130 is located between the central peripheral tooth cleaning element 2141 of the first set 2140 and the central peripheral tooth cleaning element 2151 of the second set 2150. Specifically, the conical tuft 2130 is located on the longitudinal axis 2B-2B of the head 2110, the central peripheral tooth cleaning element 2141 of the first set 2140 is located on a first side of the longitudinal axis 2B-2B of the head 2110, and the central peripheral tooth cleaning element 2151 of the second set 2150 is located on a second opposite side of the longitudinal axis 2B-2B of the head 2110. Furthermore, the conical tuft 2130 is longitudinally aligned with the central peripheral tooth cleaning elements 2141, 2151 of the first and second sets 2140, 2150 so that when viewed from the side of the head 2110 no portion of the conical tuft 2130 is visible (unless the conical tuft 2130 has a height that is greater than that of the central peripheral tooth cleaning elements 2141, 2151). In the exemplified embodiment the first longitudinal length $2L_1$ of each of the central peripheral tooth cleaning elements 2141, 2151 of the first and second sets 2140, 2150 is greater than the maximum diameter $2D_1$ of the transverse cross-sectional area of the cavity 2132 of the conical tuft 2130. Furthermore, in the exemplified embodiment the first longitudinal length $2L_1$ of each of the central peripheral tooth cleaning elements 2141, 2151 is greater than the outer diameter of the conical tuft 2130.

Referring to FIGS. 14-16B and 18-21 concurrently, as noted above in the exemplified embodiment the oral care implement 2100 comprises the head plate 2121 and the plurality of tooth cleaning elements 2115 that are coupled to the head plate 2121. Furthermore, the oral care implement 2100 also includes an integrally formed elastomeric component 2170. The integrally formed elastomeric component 2170 is an integral mass of elastomeric material that comprises the sleeve portions 2144, 2146, 2148, 2154, 2156, 2158 of the first and second sets of peripheral tooth cleaning elements 2140, 2150, a first elastomeric tooth cleaning element 2190 and a second elastomeric tooth cleaning element 2195. Thus, the sleeve portions 2144, 2146, 2148, 2154, 2156, 2158 of the first and second sets of peripheral tooth cleaning elements 2140, 2150 and the first and second elastomeric tooth cleaning elements 2190, 2195 are integrally formed together as a single component that is either coupled to the head plate 2121 or directly injection molded onto the head plate 2121 (or the head 2110 in embodiments in which no head plate 2121 is used).

As noted above, the head plate 2121 has an upper surface 2124 and an opposing lower surface 2123. Furthermore, a plurality of through holes 2122 are formed into the head plate 2121 and extend from the lower surface 2123 of the head plate 2121 to the upper surface 2124 of the head plate 2121. Each of the plurality of tooth cleaning elements 2115 comprises a cleaning portion 2178 that protrudes from the upper surface 2124 of the head plate 2121 and an anchor portion 2179 that is located adjacent to the lower surface 2123 of the head plate 2121. The anchor portions 2179 of the plurality of tooth cleaning elements 2115 comprise or form a portion of the melt matte 2106.

Figure 14:
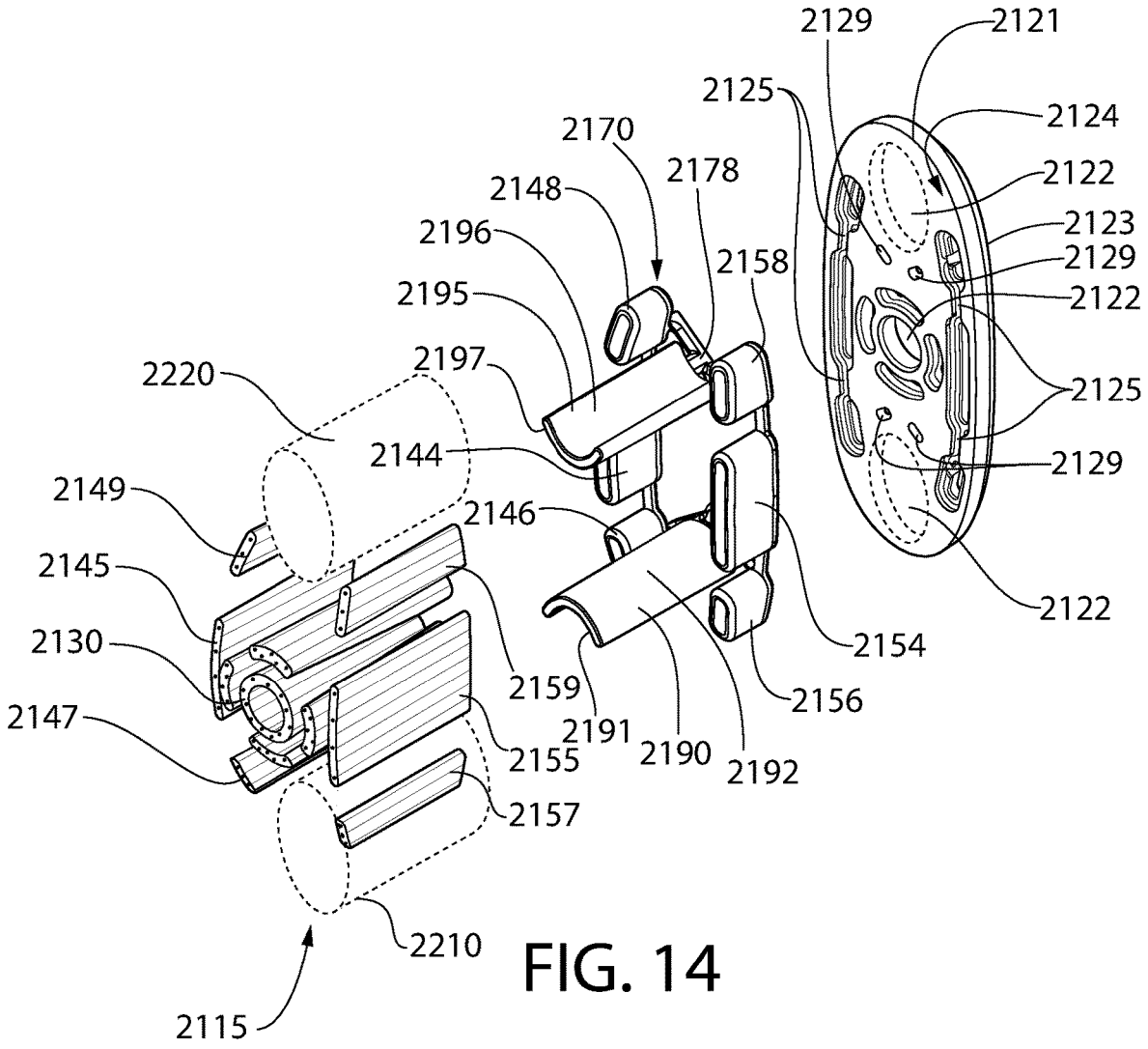
FIG. 14 is an exploded view of a head plate, an integrally formed elastomeric component, and tooth cleaning elements of the oral care implement of FIG. 11.
Figure 16A:
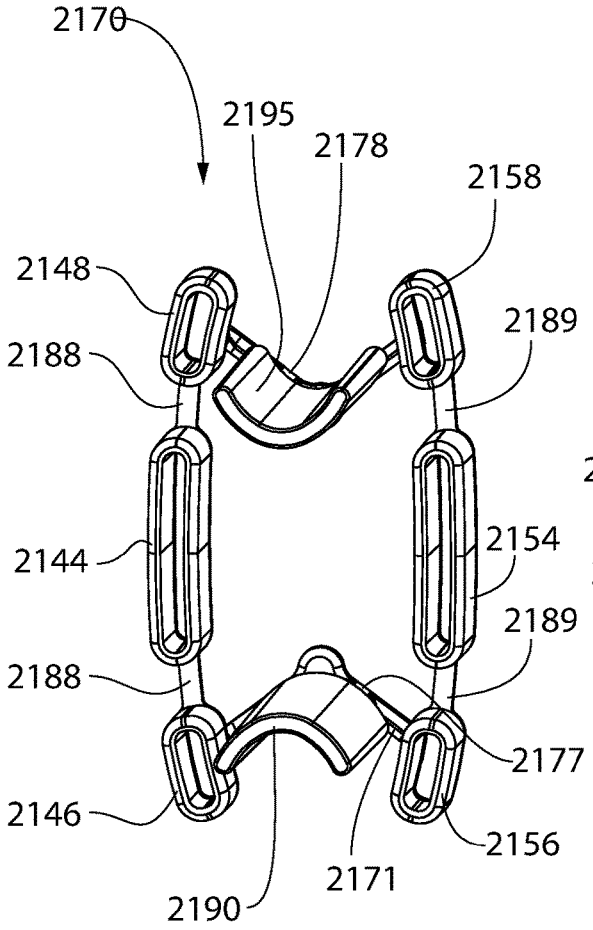
FIG. 16A is a front perspective view of the integrally formed elastomeric component of FIG. 14.
Figure 16B:
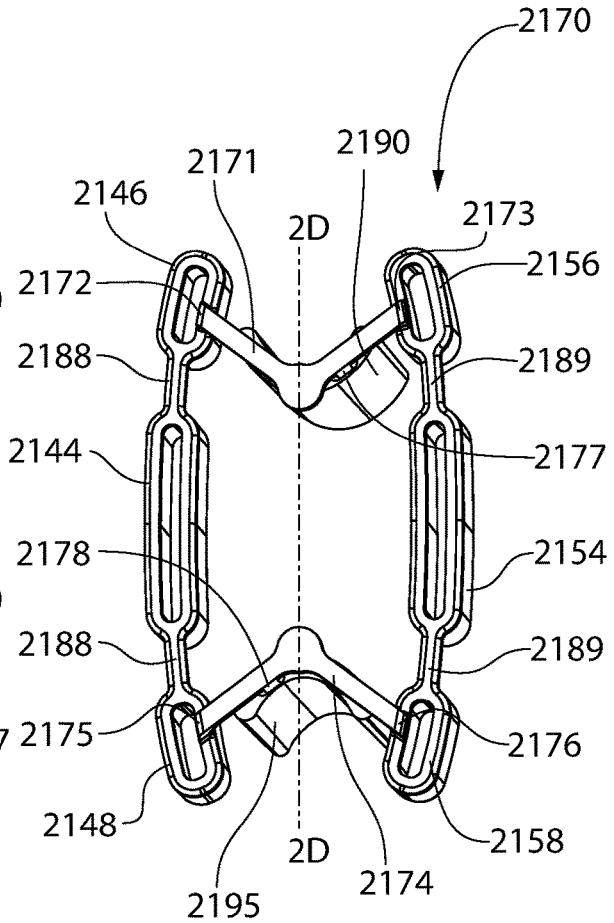
FIG. 16B is a rear perspective view of the integrally formed elastomeric component of FIG. 14.
Figure 17:
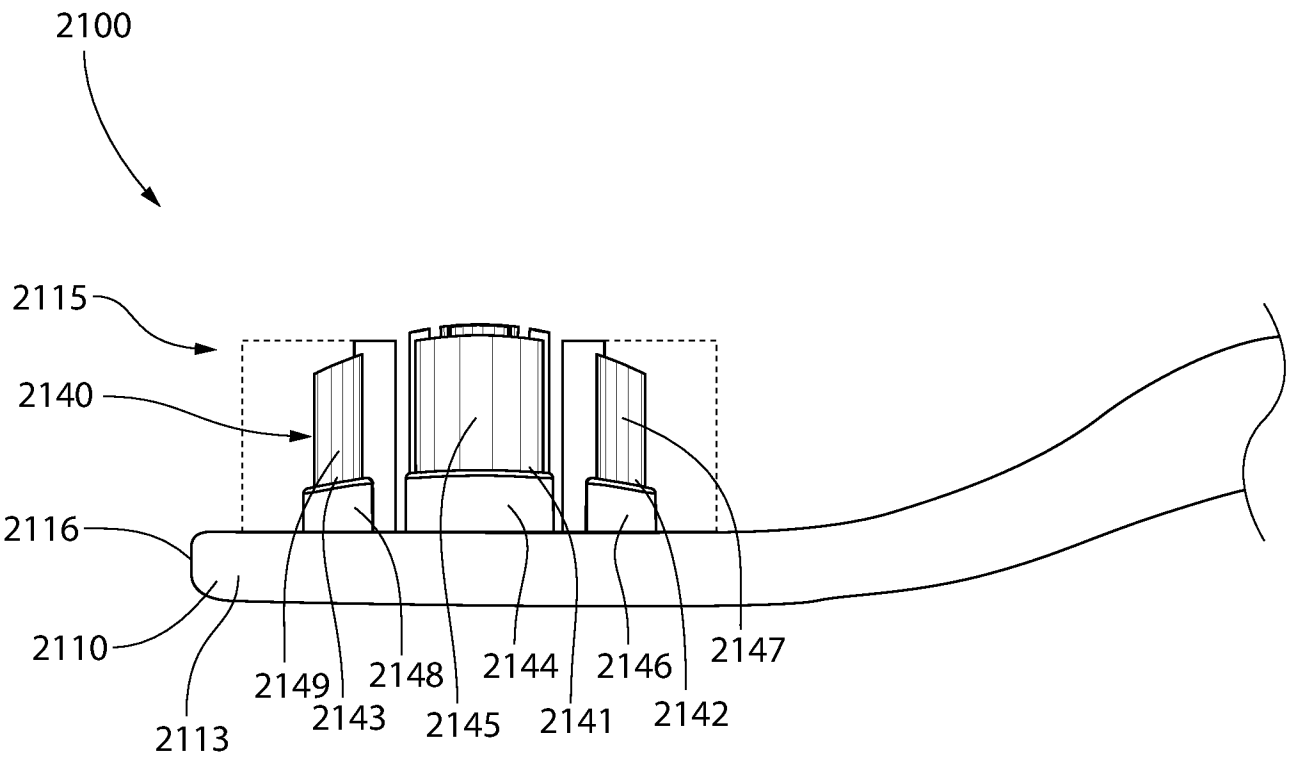
FIG. 17 is a side view of the head of the oral care implement of FIG. 12.
Figure 18:
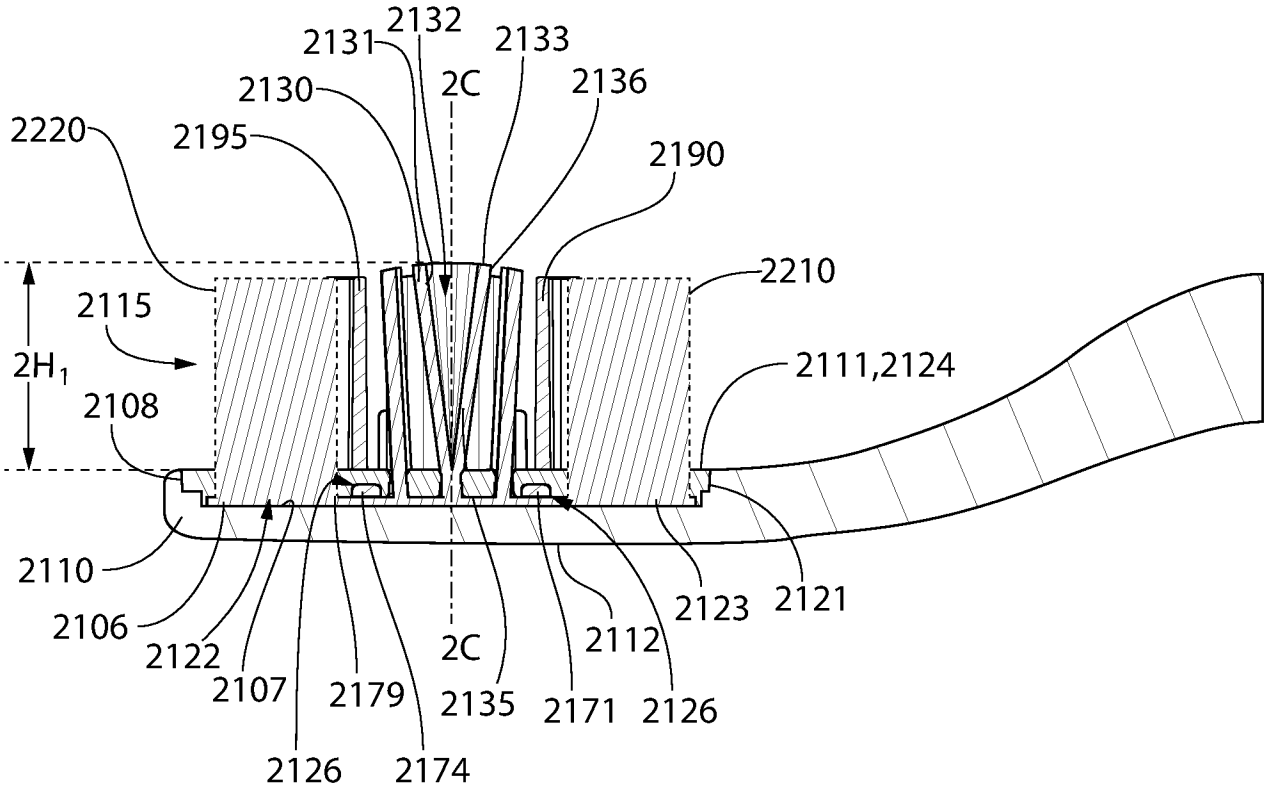
FIG. 18 is a cross-sectional view taken along line XVIII-XVIII of FIG. 13.

Referring now to FIGS. 14, 16A, and 16B concurrently, the integrally formed elastomeric component 2170 will be further described. As noted above, the integrally formed elastomeric component 2170 comprises the elastomeric sleeve portions 2144, 2146, 2148, 2154, 2156, 2158 of the first and second sets of peripheral tooth cleaning elements 2140, 2150 and the first and second elastomeric tooth cleaning elements 2190, 2195. Furthermore, the integrally formed elastomeric component 2170 also comprises a first elastomeric base strip 2171 comprising a first end 2172 connected to the elastomeric sleeve 2146 of the first set of peripheral tooth cleaning elements 2140 and a second end 2173 connected to the elastomeric sleeve 2156 of the second set of peripheral tooth cleaning elements 2150. The integrally formed elastomeric component 2170 further comprises a second elastomeric base strip 2174 comprising a first end 2175 connected to the elastomeric sleeve 2148 of the first set of peripheral tooth cleaning elements 2140 and a second end 2176 connected to the elastomeric sleeve 2158 of the second set of peripheral tooth cleaning elements 2150.

In the exemplified embodiment, each of the first and second elastomeric base strips 2171, 2174 is V-shaped and has two leg portions that connect at an apex that is located inward of each of the elastomeric sleeves 2146, 2148, 2156, 2158 in a direction of the elastomeric sleeves 2154, 2144. Thus, the apex of the elastomeric base strips 2171, 2174 are located closer to one another than the first and second ends 2172, 2173, 2175, 2176 of the elastomeric base strips 2171, 2174. More specifically, the integrally formed elastomeric component 2170 extends along a longitudinal axis 2D-2D. Each of the first and second elastomeric base strips 2171, 2174 has two legs that are located on opposing sides of the longitudinal axis 2D-2D and that intersect at the longitudinal axis 2D-2D. Thus, one of the legs of the first elastomeric base strip 2171 extends from the longitudinal axis 2D-2D to the elastomeric sleeve portion 2146 and the other leg of the first elastomeric base strip 2171 extends from the longitudinal axis 2D-2D to the elastomeric sleeve portion 2156. Similarly, one of the legs of the second elastomeric base strip 2174 extends from the longitudinal axis 2D-2D to the elastomeric sleeve portion 2148 and the other leg of the second elastomeric base strip 2174 extends from the longitudinal axis 2D-2D to the elastomeric sleeve portion 2158.

The first elastomeric tooth cleaning element 2190 is arcuate in shape and has a concave surface 2191 and a convex surface 2192. Furthermore, the first elastomeric tooth cleaning element 2190 extends upwardly from the first elastomeric base strip 2171 of the integrally formed elastomeric component 2170. More specifically, a pair of struts 2177 extend upwardly from the first elastomeric base strip 2171 to the first elastomeric tooth cleaning element 2190. The pair of struts 2177 includes a first strut that extends from the first leg of the first elastomeric base strip 2171 to a bottom surface of the first elastomeric tooth cleaning element 2190 and a second strut that extends from the second leg of the first elastomeric base strip 2171 to the bottom surface of the first elastomeric tooth cleaning element 2190. Similarly, the second elastomeric tooth cleaning element 2195 is arcuate in shape and has a concave surface 2196 and a convex surface 2197. The second elastomeric tooth cleaning element 2195 extends upwardly from the second elastomeric base strip 2174 of the integrally formed elastomeric component 2170. More specifically, a pair of struts 2178 extend upwardly from the second elastomeric base strip 2174 to the second elastomeric tooth cleaning element 2195. The pair of struts 2178 includes a first strut that extends from the first leg of the second elastomeric base strip 2174 to a bottom surface of the second elastomeric tooth cleaning element 2195 and a second strut that extends from the second leg of the second elastomeric base strip 2174 to the bottom surface of the second elastomeric tooth cleaning element 2195.

Figure 19:
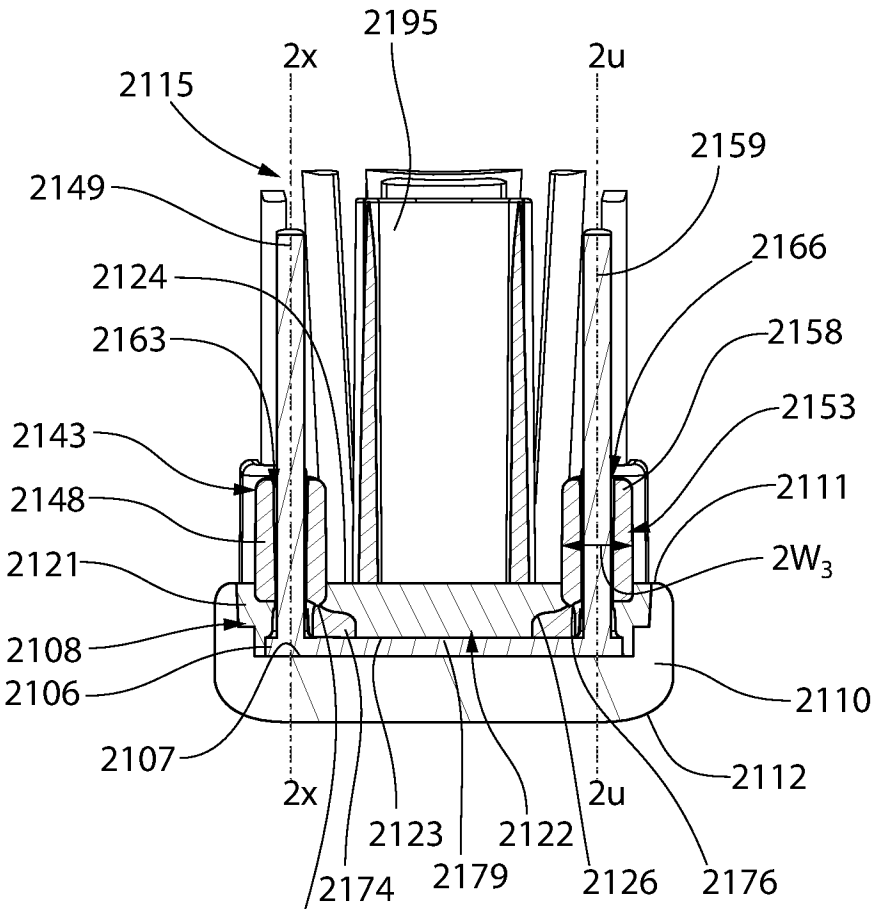
FIG. 19 is a cross-sectional view taken along line XIX-XIX of FIG. 13.
Figure 21:
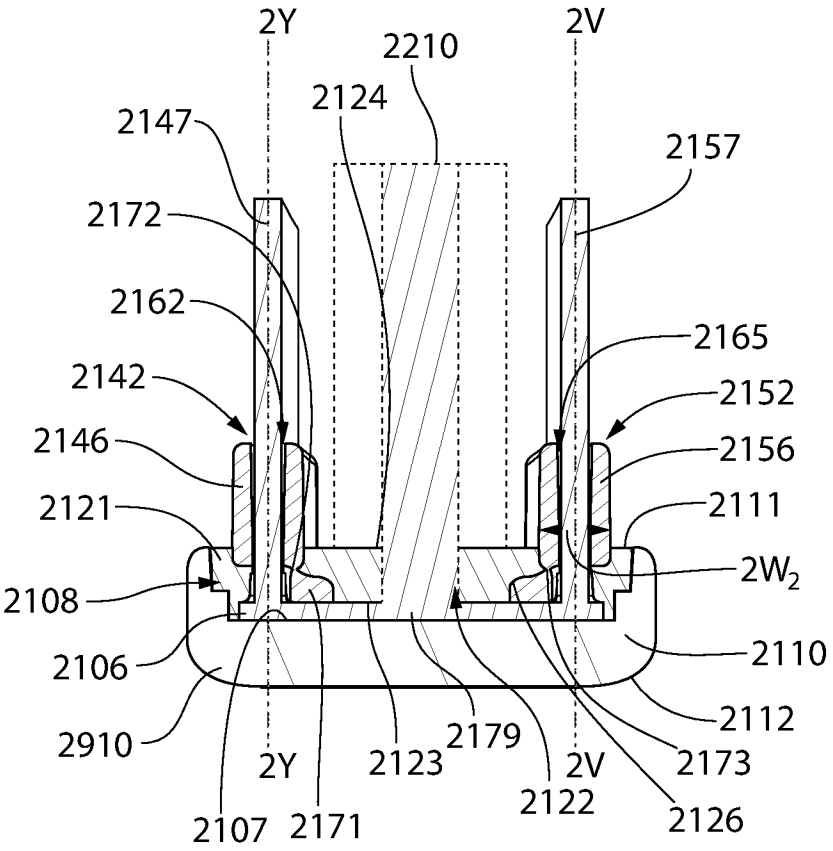
FIG. 21 is a cross-sectional view taken along line XXI-XXI of FIG. 13.

As will be discussed in more detail below, when the integrally formed elastomeric component is coupled to the head plate 2121, the first and second elastomeric base strips 2171, 2174 are positioned adjacent the lower surface 2123 of the head plate 2121, the pairs of struts 2177, 2178 are each located within a through hole 2129 of the head plate 2121 (see FIG. 15A), and the first and second elastomeric tooth cleaning elements 2190, 2195 protrude from the upper surface 2124 of the head plate 2121. As can be seen in FIGS. 19-21, in the exemplified embodiment a lower portion of each of the elastomeric sleeve portions 2144, 2146, 2148, 2154, 2156, 2158 extends into the head plate 2121 beyond the upper surface 2124 of the head plate 2121 so as to be recessed below the front surface 2111 of the head 2110. Specifically, in one particular embodiment between 10% and 20%, more specifically between 12% and 17%, and still more specifically between 14% and 15% of the height of the elastomeric sleeve portions 2144, 2146, 2148, 2154, 2156, 2158 extends below the front surface 2111 of the head 2110 with the remainder of the elastomeric sleeve portions 2144, 2146, 2148, 2154, 2156, 2158 protruding from the front surface 2111 of the head 2110. However, in other embodiments the bottom ends of the elastomeric sleeve portions 2144, 2146, 2148, 2154, 2156, 2158 may rest atop of the upper surface 2124 of the head plate 2121.

The integrally formed elastomeric component 2170 also comprises elastomeric sleeve strips 2188 that extend between and connect the elastomeric sleeve portions 2144, 2146, 2148 of adjacent ones of the first set of peripheral tooth cleaning elements 2140. Specifically, a first elastomeric sleeve strip 2188 extends between and connects the elastomeric sleeve portion 2144 to the elastomeric sleeve portion 2146. A second elastomeric sleeve strip 2188 extends between and connects the elastomeric sleeve portion 2144 to the elastomeric sleeve portion 2148. Similarly, the integrally formed elastomeric component 2170 comprises elastomeric sleeve strips 2189 that extend between and connect the elastomeric sleeve portions 2154, 2156, 2158 of adjacent ones of the second set of peripheral tooth cleaning elements 2150. Specifically, a first elastomeric sleeve strip 2189 extends between and connects the elastomeric sleeve portion 2154 to the elastomeric sleeve portion 2156. A second elastomeric sleeve strip 2189 extends between and connects the elastomeric sleeve portion 2154 to the elastomeric sleeve portion 2158. When the integrally formed elastomeric component 2170 is coupled to the head plate 2121, the elastomeric sleeve strips 2189 are located on or adjacent to the upper surface 2124 of the head plate 2121.

The elastomeric base strips 2171, 2174 and the elastomeric sleeve strips 2188, 2189 are located at different elevations on the integrally formed elastomeric component 2170. Specifically, the elastomeric sleeve strips 2188, 2189 are flush/planar with a lower surface of the elastomeric sleeve portions 2144, 2146, 2148, 2154, 2156, 2158 and the elastomeric base strips 2171, 2174 are offset or below the lower surface of the elastomeric sleeve portions 2144, 2146, 2148, 2154, 2156, 2158. This enables the elastomeric sleeve strips 2188, 2189 to be on the upper surface 2124 of the head plate 2121 and the elastomeric base strips 2171, 2174 to be on the lower surface 2123 of the head plate 2121 when the integrally formed elastomeric component 2170 is coupled to the head plate 2121, as discussed below.

Figure 15A:
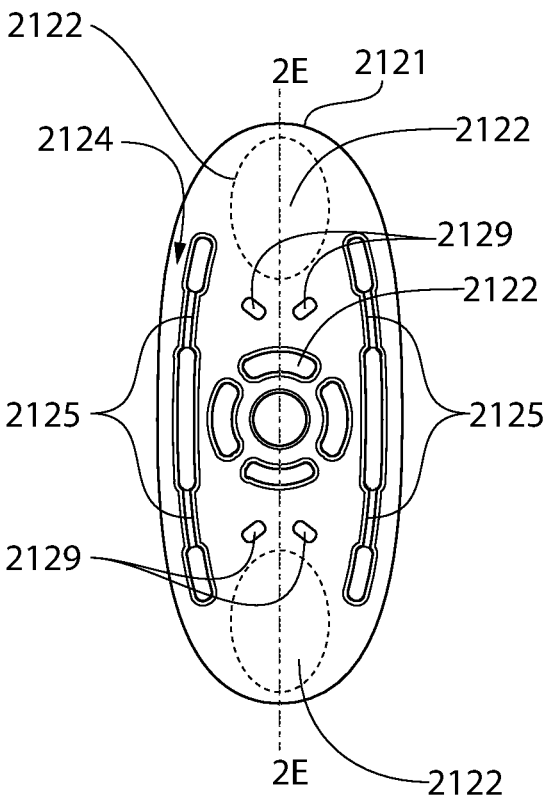
FIG. 15A is a front view of the head plate of FIG. 14.
Figure 15B:
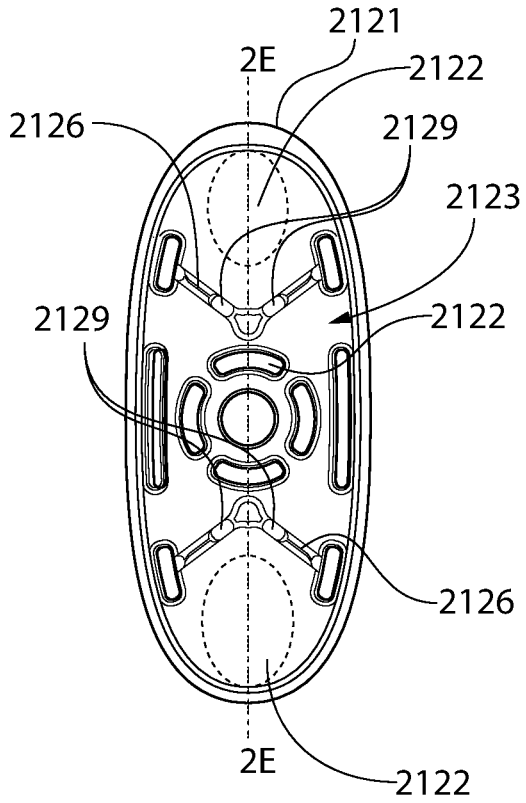
FIG. 15B is a rear view of the head plate of FIG. 14.

Referring to FIGS. 14, 15A, and 15B concurrently, the head plate 2121 will be further described. As discussed above, the head plate 2121 has an upper surface 2124, a lower surface 2123, and holes 2122, 2129 that extend through the head plate 2121 from the upper surface 2124 to the lower surface 2123. Furthermore, the head plate 2121 has a longitudinal axis 2E-2E. In addition to the holes 2122, the upper surface 2124 of the head plate 2121 comprises channels 2125 that extend between the holes 2122 that are located adjacent to the lateral sides of the head plate 2121. Specifically, the channels 2125 extend between the adjacent holes 2122 through which the bristle portions 2145, 2147, 2159, 2155, 2157, 2159 of the first and second sets of peripheral tooth cleaning elements 2140, 2150 extend. The channels 2125 extend along the head plate 2121 adjacent to the lateral edges of the head plate 2121 in the direction of the longitudinal axis 2E-2E of the head plate 2121.

The channels 2125 are grooves or recesses formed into the upper surface 2124 of the head plate 2121 that do not extend all the way through the head plate 2121, and thus do not form holes through the head plate 2121. Rather, the channels 2125 form a grooved or recessed region of the head plate 2121 within which the elastomeric sleeve strips 2188, 2189 are positioned when the integrally formed elastomeric component 2170 is coupled to the head plate 2121. Specifically, when the integrally formed elastomeric component 2170 is coupled to the head plate 2121, the elastomeric sleeve strips 2188, 2189 are located within the channels 2125 in the upper surface 2124 of the head plate 2121. In certain embodiments, the elastomeric sleeve strips 2188, 2189 are flush with the upper surface 2124 of the head plate 2121 (because the channels 2125 have a depth which is equal to a thickness of the elastomeric sleeve strips 2188, 2189).

In addition to the channels 2125 in the upper surface 2124 of the head plate 2121, at least one channel 2126 is formed in the lower surface 2123 of the head plate 2121. More specifically, in the exemplified embodiment two of the channels 2126 are formed into the lower surface 2123 of the head plate 2121. One of the channels 2126 extends between the tuft hole within which the bristle tuft portion 2149 is positioned to the tuft hole within which the bristle tuft portion 2159 is positioned. The other one of the channels 2126 extends between the tuft hole within which the bristle tuft portion 2147 is positioned to the tuft hole within which the bristle tuft portion 2157 is positioned. Thus, each of the channels 2126 extends transversely across the head plate 2121 in a direction transverse to the longitudinal axis 2E-2E of the head plate 2121. Furthermore, each of the channels 2125 is a V-shaped channel having an apex portion that is positioned closer to the center of the head plate 2121 than the terminal ends of the legs which are in spatial communication with the tuft holes within which the bristle tuft portions 2147, 2149, 2157, 2159 are positioned.

As can be seen in FIG. 15B, the through holes 2129 are located within the channels 2126. Thus, when the integrally formed elastomeric component 2170 is coupled to the head plate 2121, the first and second elastomeric base strips 2171, 2174 are located within the channels 2126 on the rear surface 2123 of the head plate 2121, the strut portions 2177, 2178 are located within the through holes 2129, and the elastomeric tooth cleaning elements 2190, 2195 protrude from the upper surface 2124 of the head plate 2121. In one embodiment, when the integrally formed elastomeric component 2170 is coupled to the head plate 2121, the first and second elastomeric base strips 2171, 2174 are flush with the rear surface 2123 of the head plate 2121.

Thus, the first and second elastomeric tooth cleaning elements 2190, 2195 protrude from the front surface 2111 of the head 2110 and are coupled to the head plate 2121 via the through holes 2129. The through holes 2129 which couple the first and second elastomeric tooth cleaning elements 2190, 2195 to the head plate 2121 do not have a similar shape to the shape of the first and second elastomeric tooth cleaning elements 2190, 2195. Rather, it is only the strut portions 2177, 2178 that must fit within the through holes 2129, and thus in the exemplified embodiment the through holes 2129 which affix the first and second elastomeric tooth cleaning elements 2190, 2195 to the head plate 2121 have a cross-sectional area which is less than the cross-sectional area of the elastomeric tooth cleaning elements 2190, 2195. More specifically, each of the first and second elastomeric tooth cleaning elements 2190, 2195 is coupled to the head plate 2121 via two of the through holes 2129. The collective cross-sectional area of the two through holes 2129 that affix the first elastomeric tooth cleaning element 2190 to the head plate 2121 is less than the cross-sectional area of the first elastomeric tooth cleaning element 2190. Similarly, the collective cross-sectional area of the two through holes 2129 that affix the second elastomeric tooth cleaning element 2195 to the head plate 2121 is less than the cross-sectional area of the second elastomeric tooth cleaning element 2195.

Referring to FIGS. 12, 13, and 18-21 concurrently, the fully assembled head 2110 with the head plate 2121 and the tooth cleaning elements 2115 coupled thereto is illustrated. When viewed from the front surface 2111 of the head 2110 as depicted in FIGS. 12 and 13, the elastomeric sleeve strips 2188, 2189 that interconnect the adjacent ones of the elastomeric sleeve portions 2144, 2146, 2148, 2154, 2156, 2158 of the first and second sets of peripheral tooth cleaning elements 2140, 2150 are visible. This is because the elastomeric sleeve strips 2188, 2189 are positioned within the channels 2125 on the front surface 2124 of the head plate 2121. Although the first and second elastomeric tooth cleaning elements 2190, 2195 are formed integrally with the elastomeric sleeve portions 2144, 2146, 2148, 2154, 2156, 2158 of the first and second sets of peripheral tooth cleaning elements 2140, 2150, the first and second elastomeric base strips 2171, 2174 that interconnect the elastomeric sleeve portions 2144, 2146, 2148, 2154, 2156, 2158 with the first and second elastomeric tooth cleaning elements 2190, 2195 are not visible because the first and second elastomeric base strips 2171, 2174 are positioned within the grooves 2126 on the lower surface 2123 of the head plate 2121, which is completely hidden from view in the assembled oral care implement 2100. Thus, the first and second elastomeric tooth cleaning elements 2190, 2195 appear to be free standing independent elements despite the fact that they are in actuality formed as a part of the integrally formed elastomeric component 2170.

The first and second elastomeric tooth cleaning elements 2190, 2195 are located between the first and second sets of peripheral tooth cleaning elements 2130, 2140 and on opposite sides of the conical tuft 2130. Specifically, the first elastomeric tooth cleaning element 2190 is located between the proximal peripheral tooth cleaning element 2142 of the first set of peripheral tooth cleaning elements 2140 and the proximal peripheral tooth cleaning element 2152 of the second set of peripheral tooth cleaning elements. Furthermore, the first elastomeric tooth cleaning element 2190 is located between the conical tuft 2130 and the proximal end 2118 of the head 2110. The concave surface 2191 of the first elastomeric component 2190 faces the proximal end 2118 of the head 2110 and the convex surface 2192 of the first elastomeric component 2190 faces the conical tuft 2130. The second elastomeric tooth cleaning element 2195 is located between the distal peripheral tooth cleaning element 2143 of the first set of peripheral tooth cleaning elements 2140 and the distal peripheral tooth cleaning element 2153 of the second set of peripheral tooth cleaning elements 2150. Furthermore, the second elastomeric tooth cleaning element 2195 is located between the conical tuft 2130 and the distal end 2119 of the head 2110. The concave surface 2196 of the second elastomeric component 2195 faces the distal end 2119 of the head and the convex surface 2197 of the second elastomeric component 2195 faces the conical tuft 2130. The pattern of the tooth cleaning elements 2115 is such that they have lateral and longitudinal symmetry.

Concept Three

Figure 22:
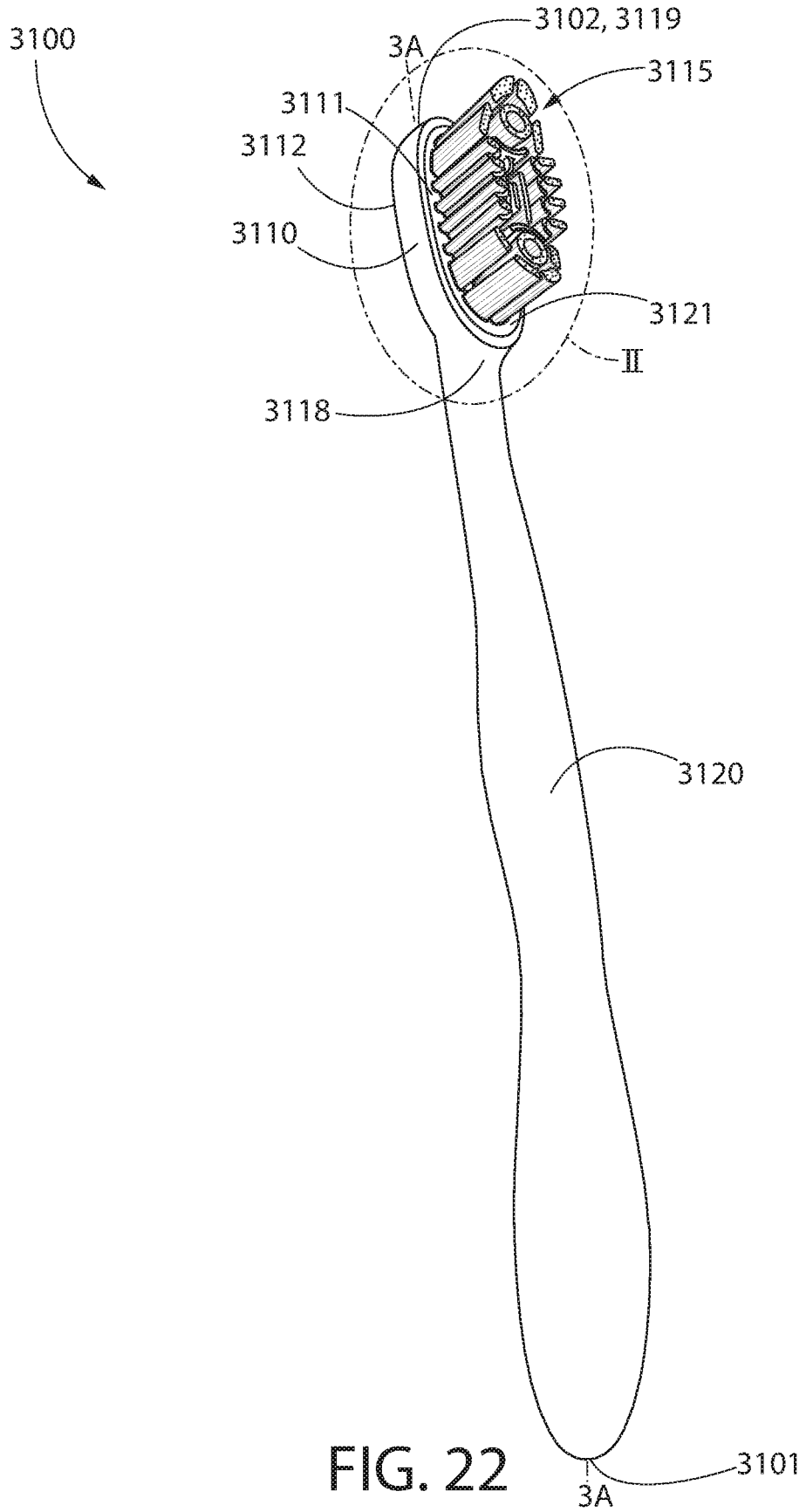
FIG. 22 is a front perspective view of an oral care implement in accordance with one embodiment of the present invention.
Figure 23:
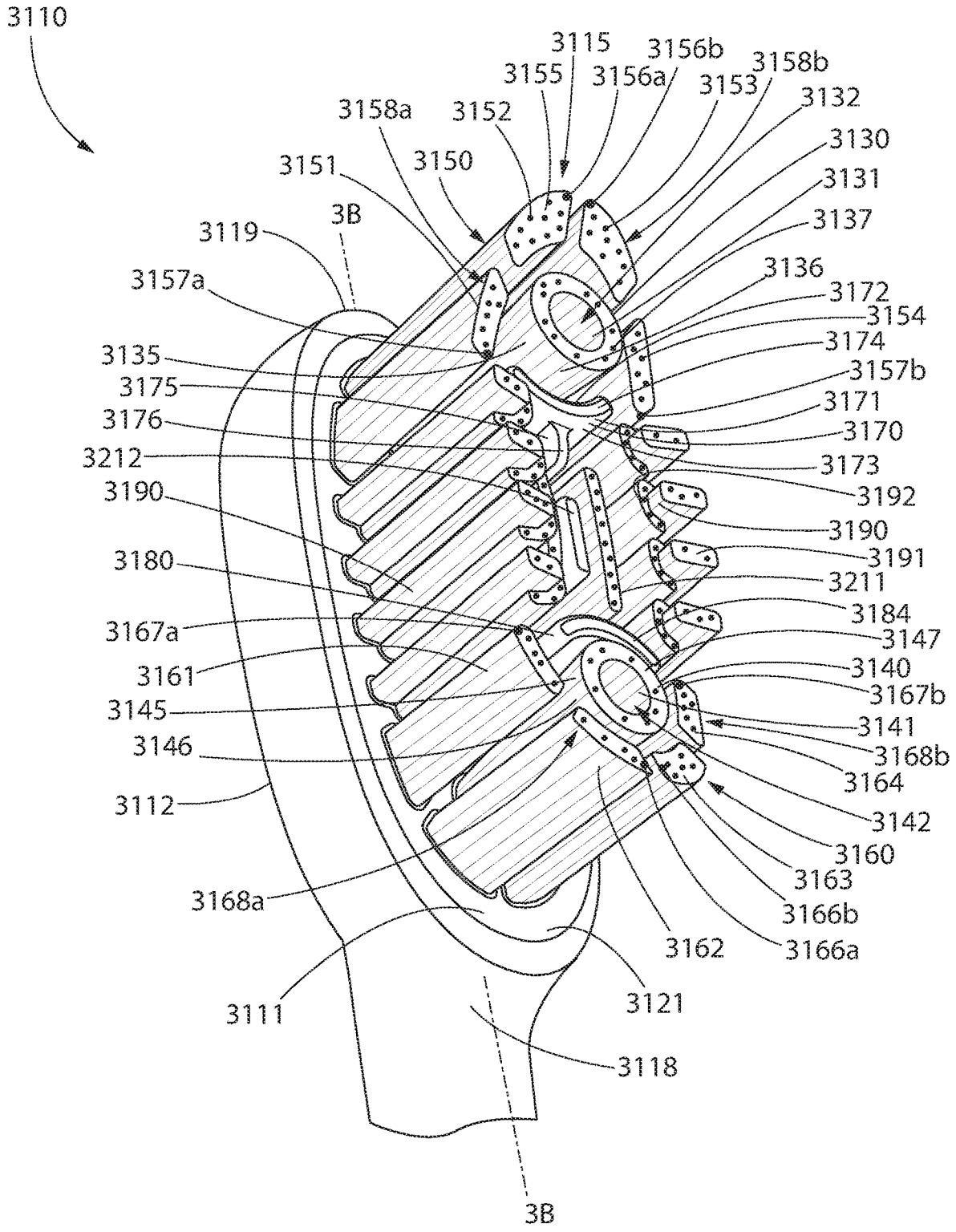
FIG. 23 is a close-up view of a head of the oral care implement of FIG. 22 as indicated by area II of FIG. 22.
Figure 24:
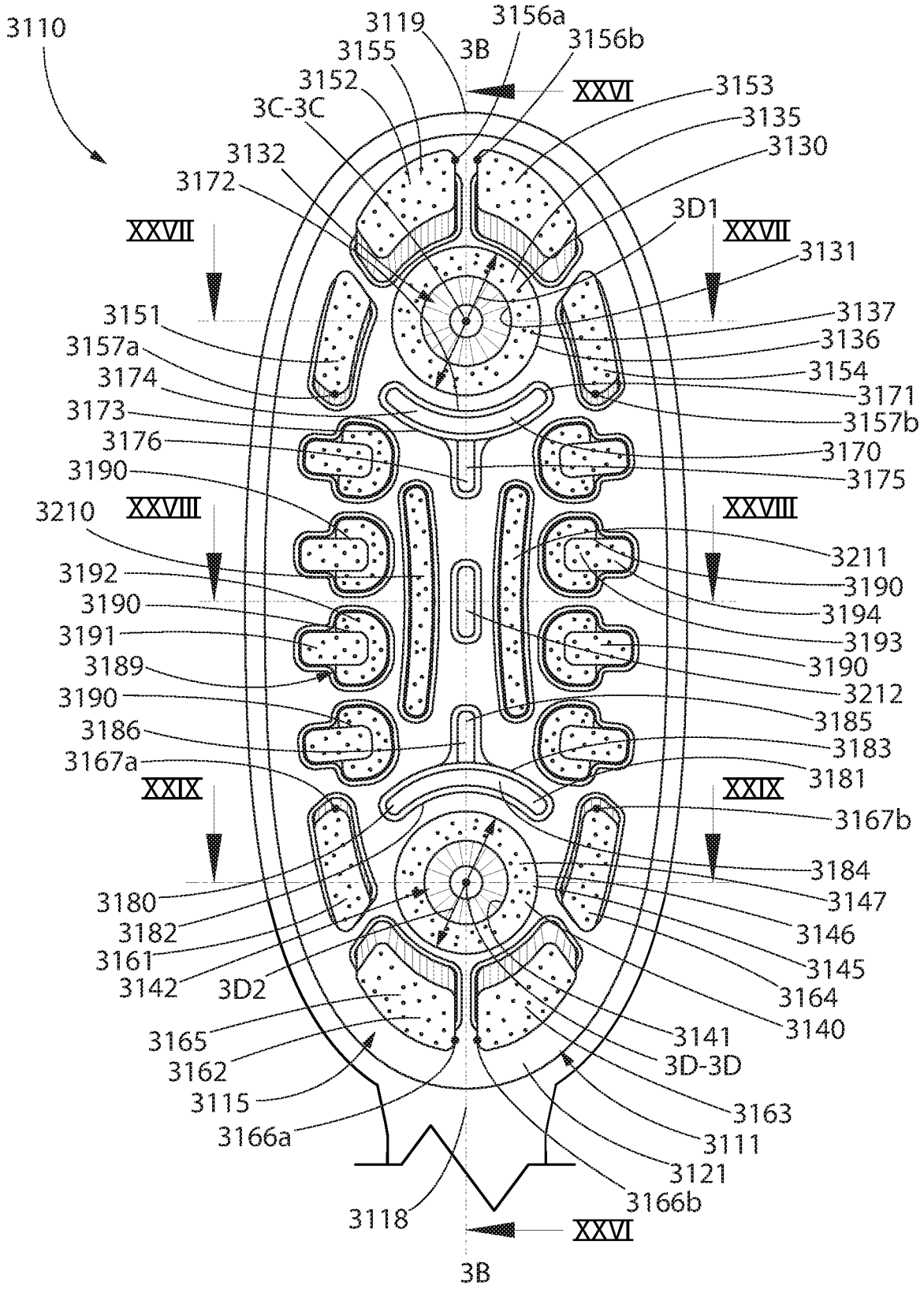
FIG. 24 is a front view of the head of the oral care implement of FIG. 23.

Referring first to FIGS. 22-24 concurrently, an oral care implement 3100 is illustrated in accordance with one embodiment of the present invention. In the exemplified embodiment, the oral care implement 3100 is in the form of a manual toothbrush. However, in certain other embodiments the oral care implement 3100 can take on other forms such as being a powered toothbrush, a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement 3100 extends from a proximal end 3101 to a distal end 3102 along a longitudinal axis 3A-3A. The oral care implement 3100 generally comprises a head 3110 and a handle 3120. The head 3110 extends from a proximal end 3118 to a distal end 3119 along a longitudinal axis 3B-3B that is coextensive with the longitudinal axis 3A-3A of the oral care implement 3100. Furthermore, in the exemplified embodiment the distal end 3102 of the oral care implement 3100 is the same as the distal end 3119 of the head 3110.

The handle 3120 is an elongated structure that provides the mechanism by which the user can hold and manipulate the oral care implement 3100 during use. In the exemplified embodiment, the handle 3120 is generically depicted having various contours for user comfort. Of course, the invention is not to be limited by the specific shape illustrated for the handle 3120 in all embodiments and in certain other embodiments the handle 3120 can take on a wide variety of shapes, contours, and configurations, none of which are limiting of the present invention unless so specified in the claims.

In the exemplified embodiment, the handle 3120 is formed of a rigid plastic material, such as for example without limitation polymers and copolymers of ethylene, propylene, butadiene, vinyl compounds, and polyesters such as polyethylene terephthalate. Of course, the invention is not to be so limited in all embodiments and the handle 3120 may include a resilient material, such as a thermoplastic elastomer, as a grip cover that is molded over portions of or the entirety of the handle 3120 to enhance the gripability of the handle 3120 during use. For example, portions of the handle 3120 that are typically gripped by a user's palm during use may be overmolded with a thermoplastic elastomer or other resilient material to further increase comfort to a user. Furthermore, materials other than those noted above can be used including metal, wood, or any other desired material that has sufficient structural rigidity to permit a user to grip the handle 3120 and manipulate the oral care implement 3100 during toothbrushing.

The head 3110 of the oral care implement 3100 is coupled to the handle 3120 and comprises a front surface 3111 and an opposing rear surface 3112. In the exemplified embodiment, the head 3110 is formed integrally with the handle 3120 as a single unitary structure using a molding, milling, machining, or other suitable process. However, in other embodiments the handle 3120 and the head 3110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus the head 3110 may, in certain embodiments, be formed of any of the rigid plastic materials described above as being used for forming the handle 3120, although the invention is not to be so limited in all embodiments and other materials that are commonly used during toothbrush head manufacture may also be used.

The oral care implement 3100 also comprises a plurality of tooth cleaning elements 3115 extending from the front surface 3111 of the head 3110. The details of certain ones of the plurality of tooth cleaning elements 3115 will be discussed below, including specific details with regard to structure, pattern, orientation, and material of such tooth cleaning elements 3115. However, where it does not conflict with the other disclosure provided herein, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Thus, any combination of these tooth cleaning elements may be used within the tooth cleaning elements 3115 in some embodiments. However, as described herein below, in certain embodiments one or more of the tooth cleaning elements 3115 may be formed as tufts of bristles.

In embodiments that use elastomeric elements as one or more of the tooth cleaning elements 3115, suitable elastomeric materials may include any biocompatible resilient material suitable for uses in an oral hygiene apparatus. To provide optimum comfort as well as cleaning benefits, the elastomeric material of any such tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Referring now to FIGS. 22-29 concurrently, one manner in which the tooth cleaning elements 3115 are secured to the head 3110 will be described. Specifically, in the exemplified embodiment the tooth cleaning elements 3115 are formed as a cleaning element assembly on a head plate 3121 such that one or more of the tooth cleaning elements 3115 are mounted onto the head plate 3121 and then the head plate 3121 is coupled to the head 3110. In such an embodiment, the head plate 3121 is a separate and distinct component from the head 3110 of the oral care implement 3100. However, the head plate 3121 is connected to the head 3110 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 3121 and the head 3110 are separately formed components that are secured together during manufacture of the oral care implement 3100.

In certain embodiments, the head plate 3121 may comprise a plurality of holes 3122 formed therethrough, and the tooth cleaning elements 3115 may be mounted to the head plate 3121 within the holes 3122. This type of technique for mounting the tooth cleaning elements 3115 to the head 3110 via the head plate 3121 is generally known as anchor free tufting (AFT). Specifically, in AFT a plate or membrane (i.e., the head plate 3121) is created separately from the head 3110. The tooth cleaning elements 3115 (such as bristles, elastomeric elements, and combinations thereof) are positioned into the head plate 3121 so as to extend through the holes 3122 of the head plate 3121. The free ends of the tooth cleaning elements 3115 on one side of the head plate 3121 perform the cleaning function. The ends of the tooth cleaning elements 3115 on the other side of the head plate 3121 are melted together by heat to be anchored in place. As the tooth cleaning elements 3105 are melted together, a melt matte 3106 is formed. After the tooth cleaning elements 3115 are secured to the head plate 3121, the head plate 3121 is secured to the head 3110 such as by ultrasonic welding. When the head plate 3121 is coupled to the head 3110, the melt matte 3106 is located between a lower surface 3123 of the head plate 3121 and a floor 3107 of a basin 3108 of the head 3110 in which the head plate 3121 is disposed. The melt matte 3106, which is coupled directly to and in fact forms a part of the tooth cleaning elements 3115, prevents the tooth cleaning elements 3115 from being pulled through the holes 3122 in the head plate 3121 to ensure that the tooth cleaning elements 3105 remain attached to the head plate 3121 during use of the oral care implement 3100.

Of course, techniques other than AFT can be used for mounting the tooth cleaning elements 3115 to the head 3110, such as widely known and used stapling techniques or the like. In such embodiments the head plate 3121 may be omitted and the tooth cleaning elements 3115 may be coupled directly to the head 3110. Furthermore, in a modified version of the AFT process discussed above, the head plate 3121 may be formed by positioning the tooth cleaning elements 3115 within a mold, and then molding the head plate 3121 around the tooth cleaning elements 3115 via an injection molding process.

Although described herein above with regard to using AFT, in certain embodiments any suitable form of cleaning elements and attachment may be used in the broad practice of this invention. Specifically, the tooth cleaning elements 3115 of the present invention can be connected to the head 3110 in any manner known in the art. For example, staples/anchors or in-mold tufting (IMT) could be used to mount the cleaning elements/tooth engaging elements. In certain embodiments, the invention can be practiced with various combinations of stapled, IMT or AFT bristles. Alternatively, the tooth cleaning elements 3115 could be mounted to tuft blocks or sections by extending through suitable openings in the tuft blocks so that the base of the tooth cleaning elements 3115 is mounted within or below the tuft block.

Although not illustrated herein, in certain embodiments the head 3110 may also include a soft tissue cleanser coupled to or positioned on its rear surface 3112. An example of a suitable soft tissue cleanser that may be used with the present invention and positioned on the rear surface of the head 3110 is disclosed in U.S. Pat. No. 7,3143,3462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 3100 may not include any soft tissue cleanser.

With reference to FIGS. 22-29, the oral care implement 3100, and specifically the tooth cleaning elements 3115 of the oral care implement 3100, will be further described. In the exemplified embodiment, the plurality of tooth cleaning elements 3115 comprises a first conical tuft 3130 and a second conical tuft 3140. Each of the first and second conical tufts 3130, 3140 is a tuft or grouping of bristles that are arranged together into a tuft and then secured into a single tuft hole within the head 3110 (or within the head plate 3121). The first and second conical tufts 3130, 3140 are described herein as being conical due to the first and second conical tufts 3130, 3140 having a conical shape. More specifically, as can best be seen in FIGS. 26, 27, and 29, the first and second conical tufts 3130, 3140 are in the shape of a truncated cone wherein the portion of the first and second conical tufts 3130, 3140 that are positioned within the head 3110 is the truncated (i.e., cut off) portion of the cone such that the first and second conical tufts 3130, 3140 are in the shape of an inverted truncated cone.

The first conical tuft 3130 comprises a first continuous bristle wall 3135 having an inner surface 3131 and an outer surface 3136. The inner surface 3131 of the first continuous bristle wall 3135 of the first conical tuft 3130 defines a first cavity 3132 that extends along a first cavity axis 3C-3C. The first conical tuft 3130, and specifically the first continuous bristle wall 3135 thereof, extends in a 360° manner about the first cavity axis 3C-3C. The first cavity 3132 of the first conical tuft 3130 has an open top end and is bounded by the inner surface 3131 of the first continuous bristle wall 3135 and by the front surface 3111 of the head 3110. As noted above, the first conical tuft 3130 in the exemplified embodiment is formed by a plurality of bristles. Specifically, the plurality of bristles are clumped together and positioned collectively into a single tuft hole so that the plurality of bristles collectively form the first conical tuft 3130 having no gaps in the first continuous bristle wall 3135 for its entire 360° extension about the first cavity axis 3C-3C. Thus, the first conical tuft 3130 extends from a single tuft hole. The term continuous bristle wall is intended to mean that the first conical tuft 3130 is a single tuft of bristles that are clumped together into a single tuft hole in a non-spaced apart manner.

Thus, in the exemplified embodiment the first conical tuft 3130 is a single bristle tuft formed from a plurality of individual bristles that are positioned together within a single tuft hole. As a result, the first conical tuft 3130 has the first continuous bristle wall 3135 that extends without discontinuity about the first cavity axis 3C-3C. Thus, in the exemplified embodiment there are no gaps formed into the outer surface 3136 of the first conical tuft 3130. Of course, in other embodiments the first conical tuft 3130 may have small gaps therein as desired while still being a single tuft positioned within a single tuft hole. Such gaps in the bristle wall may prevent dentifrice from being trapped within the first cavity 3132 of the first conical tuft 3130 by providing means of egress from the first cavity 3132. In such an embodiment, the bristle wall 3135 of the first conical tuft 3130 may not be continuous.

Due to the conical shape of the first conical tuft 3130, and more specifically, the inverted conical shape of the first conical tuft 3130, the first cavity 3132 of the first conical tuft 3130 has a first transverse cross-sectional area that increases with distance from the front surface 3111 of the head 3110. Specifically, the first transverse cross-sectional area of the first cavity 3132 of the first conical tuft 3130 only increases and never decreases with distance from the front surface 3111 of the head 3110. Thus, the greater the distance between a particular axial location within the first cavity 3132 of the first conical tuft 3130 and the front surface 3111 of the head 3110, the greater the transverse cross-sectional area of the first cavity 3132 at that particular axial location.

The second conical tuft 3140 comprises a second continuous bristle wall 3145 having an inner surface 3141 and an outer surface 3146. The inner surface 3141 of the second continuous bristle wall 3145 of the second conical tuft 3140 defines a second cavity 3142 that extends along a second cavity axis 3D-3D. The second conical tuft 3144 extends in a 360° manner about the second cavity axis 3D-3D. The second cavity 3142 of the second conical tuft 3140 has an open top end and is bounded by the inner surface 3141 of the second continuous bristle wall 3145 and by the front surface 3111 of the head 3110. As noted above, the second conical tuft 3140 in the exemplified embodiment is formed by a plurality of bristles. Specifically, the plurality of bristles are clumped together and positioned collectively into a single tuft hole so that the plurality of bristles collectively form the second conical tuft 3140 having no gaps in the second continuous bristle wall 3145 for its entire 360° extension about the second cavity axis 3D-3D. Thus, the term continuous bristle wall is intended to mean that the second conical tuft 3140 is a single tuft of bristles that are clumped together into a single tuft hole in a non-spaced apart manner.

Thus, in the exemplified embodiment the second conical tuft 3140 is a single tuft formed from a plurality of individual bristles that are positioned together within a single tuft hole. As a result, the second conical tuft 3140 has the second continuous bristle wall 3145 that extends without discontinuity about the second cavity axis 3D-3D. Thus, in the exemplified embodiment there are no gaps formed into the outer surface 3146 of the second conical tuft 3140. Of course, in other embodiments the second conical tuft 3140 may have small gaps therein as desired while still being a single tuft positioned within a single tuft hole. Such gaps in the bristle wall may prevent dentifrice from being trapped within the second cavity 3142 of the second conical tuft 3140 by providing means of egress from the second cavity 3142. In such an embodiment, the bristle wall 3145 of the second conical tuft 3140 may not be continuous.

Due to the conical shape of the second conical tuft 3140, and more specifically, the inverted conical shape of the second conical tuft 3140, the second cavity 3142 of the second conical tuft 3140 has a second transverse cross-sectional area that increases with distance from the front surface 3111 of the head 3110. Specifically, the second transverse cross-sectional area of the second cavity 3142 of the second conical tuft 3140 only increases and never decreases with distance from the front surface 3111 of the head 3110. Thus, the greater the distance between a particular axial location within the second cavity 3142 of the second conical tuft 3140 and the front surface 3111 of the head 3110, the greater the transverse cross-sectional area of the second cavity 3142 at that particular axial location.

In the exemplified embodiment, the first conical tuft 3130 is located at a distal region of the head 3110 near the distal end 3119 of the head 3110 and the second conical tuft 3140 is located at a proximal region of the head 3110 near the proximal end 3118 of the head 3110. However, in the exemplified embodiment the first conical tuft 3130 is not the distal-most tuft and the second conical tuft 3140 is not the proximal-most tuft. Rather, there are tufts positioned between the first conical tuft 3130 and the distal end 3119 of the head 3110 and there are tufts positioned between the second conical tuft 3140 and the proximal end 3118 of the head 3110, as discussed in more detail below. Of course, in other embodiments the first and second conical tufts 3130, 3140 may be the proximal-most and distal-most tufts on the head 3110. Furthermore, there are several different tooth cleaning elements positioned in between the first and second conical tufts 3130, 3140 in the direction of the longitudinal axis 3B-3B as will be discussed in more detail below. In the exemplified embodiment, each of the first and second conical tufts 3130, 3140 is aligned on the longitudinal axis 3B-3B such that the longitudinal axis 3B-3B crosses through a center point of each of the first and second conical tufts 3130, 3140. The first and second conical tufts 3130, 3140 are on opposite sides of a transverse axis that is perpendicular to the longitudinal axis 3B-3B and that divides the head 3110 into two equal halves.

Figure 26:
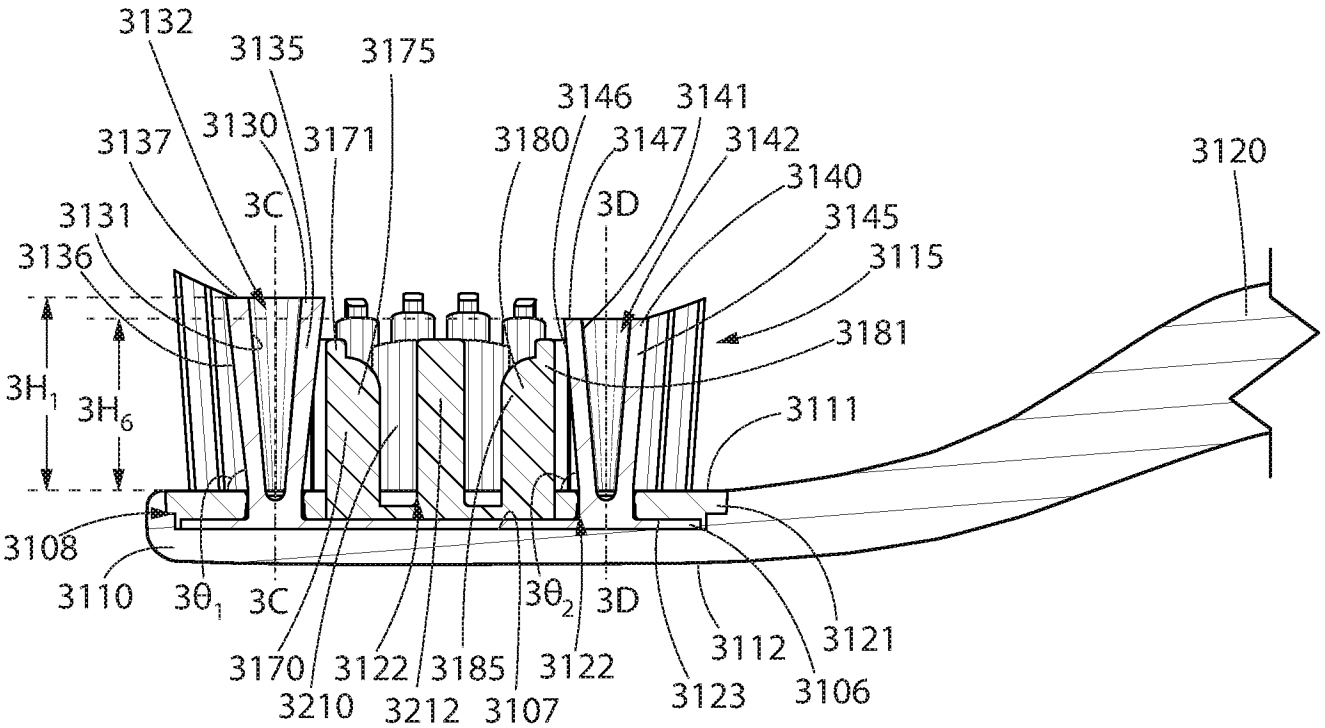
FIG. 26 is a cross-sectional view taken along line XXVI-XXVI of FIG. 24.
Figure 27:
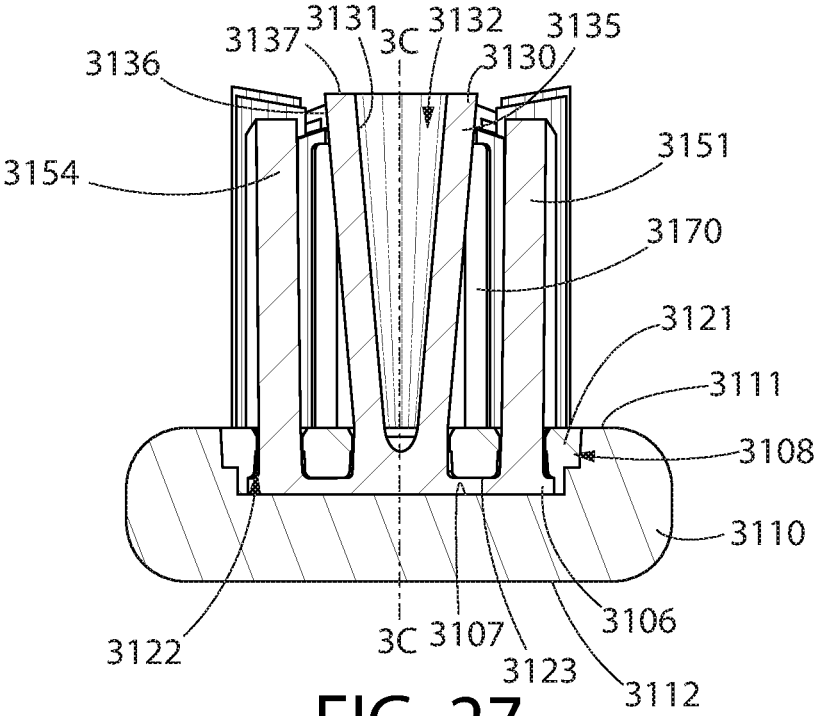
FIG. 27 is a cross-sectional view taken along line XXVII-XXVII of FIG. 24.
Figure 28:
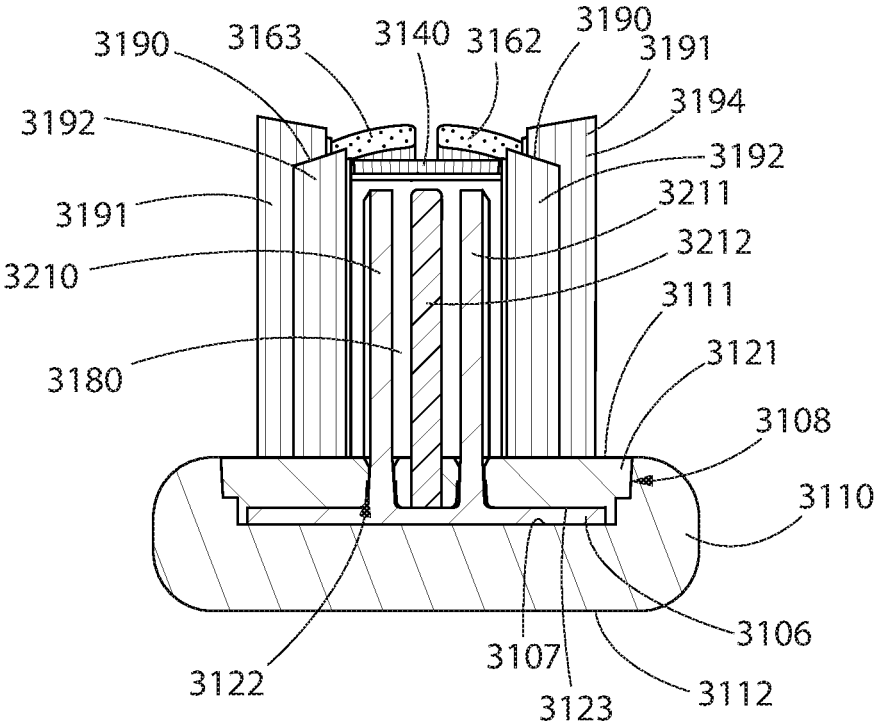
FIG. 28 is a cross-sectional view taken along line XXVIII-XXVIII of FIG. 24.
Figure 29:
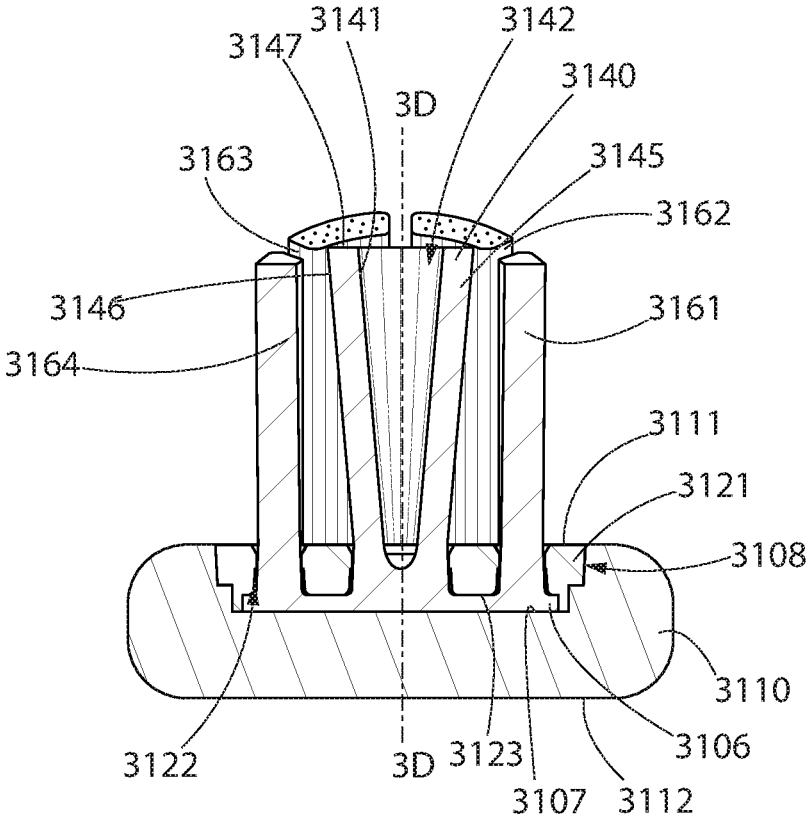
FIG. 29 is a cross-sectional view taken along line XXVIX-XXVIX of FIG. 24.

Referring briefly to FIGS. 24 and 26 concurrently, the first conical tuft 3130 terminates in a first annular top surface 3137 that extends a first height 3H1 above the front surface 3111 of the head 3110. The first conical tuft 3130 also has a first outer diameter 3D1 taken at the first annular top surface 3137 and at the outer surface 3136. The second conical tuft 3140 terminates in a second annular top surface 3147 that extends a second height 3H6 above the front surface 3111 of the head 3110. The second conical tuft 3140 also has a second outer diameter 3D2 taken at the second annular top surface 3147 and at the outer surface 3136. In the exemplified embodiment, the first height 3H1 is greater than the second height 3H6. However, in other embodiments the first and second heights 3H1, 3H6 may be the same, or the second height 3H6 may be greater than the first height 3H1. Furthermore, in the exemplified embodiment the first and second diameters 3D1, 3D2 are different, and more specifically the first diameter 3D1, 3D2 is greater than the second diameter. However, in certain other embodiments the first and second diameters 3D1, 3D2 may be the same, or the second diameter 3D2 may be greater than the first diameter 3D1.

Furthermore, the outer surface 3136 of the first continuous bristle wall 3135 of the first conical tuft 3130 is oriented at a first acute angle 3θ1 relative to the front surface 3111 of the head 3110. The outer surface 3146 of the second continuous bristle wall 3145 of the second conical tuft 3140 is oriented at a second acute angle 3θ2 relative to the front surface 3111 of the head 3110. In the exemplified embodiment, the first and second acute angles 3θ1, 3θ2 are different from one another. Specifically, in the exemplified embodiment the second acute angle 3θ2 is greater than the first acute angle 3θ1. Of course, the invention is not to be so limited in all embodiments and in certain other embodiments the first acute angle 3θ1 may be greater than the second acute angle 3θ2, or the first and second acute angles 3θ1, 3θ2 may be substantially the same. In certain embodiments, each of the first and second acute angles 3θ1, 3θ2 are between 80° and 89°, more specifically between 83.5° and 87.5°. In certain embodiments, one or both of the first and second acute angles 3θ1, 3θ2 is between 82° and 85°, and in other embodiments one or both of the first and second acute angles 3θ1, 3θ2 is between 86° and 89°. Furthermore, one of the first and second acute angles 3θ1, 3θ2 may be between 82° and 85° while the other one of the first and second acute angles 3θ1, 3θ2 is between 86° and 89°.

Although not depicted herein, in certain embodiments a central cleaning element may be positioned within each of the first and second cavities 3132, 3142 of the first and second conical tufts 3130, 3140. The central cleaning elements may be bristle tufts containing tapered bristles, spiral bristles, rounded bristles, or combinations thereof. Alternatively, the central cleaning elements may be elastomeric protrusions/elements.

In addition to the first and second conical tufts 3130, 3140, the plurality of tooth cleaning elements 3115 also comprises a first arcuate cleaning element 3150 and a second arcuate cleaning element 3160. The first arcuate cleaning element 3150 is at least partially located between the first conical tuft 3130 and the distal end 3119 of the head 3110 and the second arcuate cleaning element 3160 is at least partially located between the second conical tuft 3140 and the proximal end 3118 of the head 3110. Thus, the first arcuate cleaning element 3150 is the distal-most cleaning element on the head 3110 and the second arcuate cleaning element 3160 is the proximal-most cleaning element on the head 3110. Stated another way, there are no intervening cleaning elements between the first arcuate cleaning element 3150 and the distal end 3119 of the head 3110 and there are no intervening cleaning elements between the second arcuate cleaning element 3160 and the proximal end 3118 of the head 3110.

In the exemplified embodiment, the first arcuate cleaning element 3150 is formed of a plurality of bristle wall segments including a first segment 3151, a second segment 3152, a third segment 3153, and a fourth segment 3154. In this embodiment, each of the first, second, third, and fourth segments 3151-3154 is positioned within its own tuft hole that is spaced apart from the other tuft holes of the segments of the first arcuate cleaning element 3150. Thus, in the exemplified embodiment the first segment 3151 is spaced from the second segment 3152 by a gap, the second segment 3152 is spaced from the third segment 3153 by a gap, and the third segment 3153 is spaced from the fourth segment 3154 by a gap. However, in certain other embodiments the first arcuate cleaning element 3150 may be formed by a single continuous cleaning element that is positioned within a single tuft hole. Furthermore, in embodiments that include the spaced apart segments 3151-3154 that form the first arcuate cleaning element 3150, the gaps between adjacent ones of the segments 3151-3154 may be considered as a part of the first arcuate cleaning element 3150.

In the exemplified embodiment, the second arcuate cleaning element 3160 is formed of a plurality of bristle wall segments including a first segment 3161, a second segment 3162, a third segment 3163, and a fourth segment 3164. In this embodiment, each of the first, second, third, and fourth segments 3161-3164 is positioned within its own tuft hole that is spaced apart from the other tuft holes of the segments of the second arcuate cleaning element 3160. However, in certain other embodiments the second cleaning element 3160 may be formed by a single continuous cleaning element that is positioned within a single tuft hole. Thus, in the exemplified embodiment, the first segment 3161 is spaced from the second segment 3162 by a gap, the second segment 3162 is spaced from the third segment 3163 by a gap, and the third segment 3163 is spaced from the fourth segment 3164 by a gap. However, in certain other embodiments the second arcuate cleaning element 3160 may be formed by a single continuous cleaning element that is positioned within a single tuft hole. Furthermore, in embodiments that include the spaced apart segments 3161-3164 that form the first arcuate cleaning element 3160, the gaps between adjacent ones of the segments 3161-3164 may be considered as a part of the second arcuate cleaning element 3160.

Figure 25:
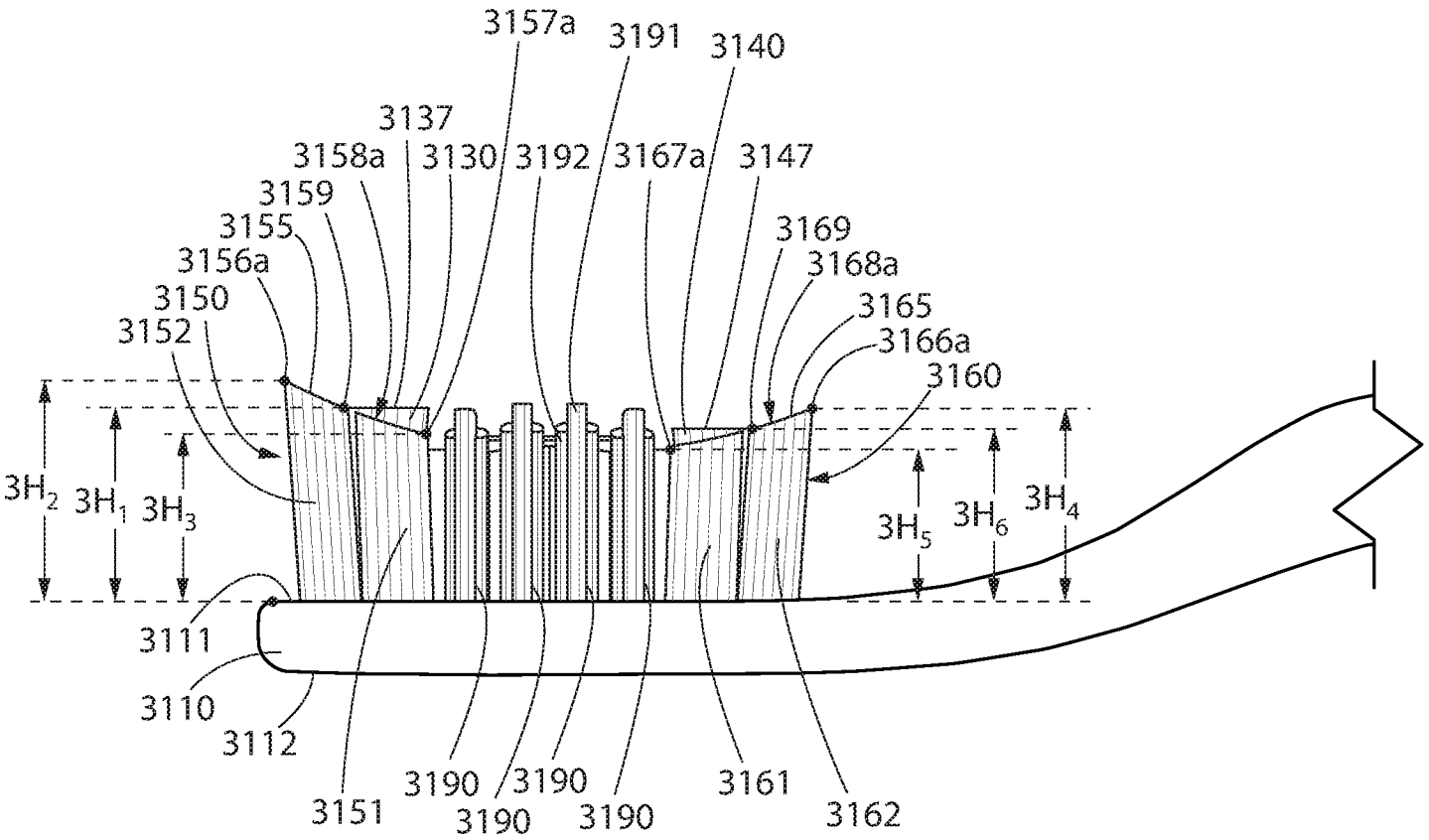
FIG. 25 is a side view of the head of the oral care implement of FIG. 23.

Referring briefly to FIGS. 23-25 concurrently, the oral care implement 3100 will be further described. The first arcuate cleaning element 3150 is arranged on the head 3110 so as to at least partially surround the first conical tuft 3130. Specifically, in the exemplified embodiment the first arcuate cleaning element 3150 surrounds the first conical tuft 3130 for at least 180° about the circumference of the first conical tuft 3130, or between 180° and 270° about the circumference of the first conical tuft 3130. In that regard, there are no other bristle tufts or cleaning elements positioned between the first arcuate cleaning element 3150 and the first conical tuft 3130 where the first arcuate cleaning element 3150 surrounds the first conical tuft 3130. In the exemplified embodiment, the second and third segments 3152, 3153 of the first arcuate cleaning element 3150 are located between the first conical tuft 3130 and the distal end 3119 of the head 3110 and the first and fourth segments 3151, 3154 of the first arcuate cleaning element 3150 are located between the first conical tuft 3130 and the lateral sides or peripheral edge of the head 3110.

The first arcuate cleaning element 3150 has a top surface 3155 having a first high point **3156*a* and a second high point 3156*b*. The first high point 3156*a* is located on the second segment 3152 and the second high point 3156*b* is located on the third segment 3153. The first and second high points 3156*a*, 3156*b* are located on opposite sides of the longitudinal axis 3B-3B. Furthermore, each of the first and second high points 3156*a*, 3156*b* extends to a second height 3H2 from the front surface 3111 of the head 3110. The top surface 3155 of the first arcuate cleaning element 3150 also has a first low point 3157*a* and a second low point 3157*b*. The first low point 3157*a* is located on the first segment 3151 and the second low point 3157*b* is located on the fourth segment 3154. The first and second low points 3157*a*, 3157*b* are located on opposite sides of the longitudinal axis 3B-3B and on opposite sides of the first conical tuft 3130. Furthermore, each of the first and second low points 3157***a*, 3157*b* extends to a third height 3H3 from the front surface 3111 of the head 3110.

Although noted herein as having first and second high points 3156*a*, 3156*b*, in certain embodiments the second and third segments 3152, 3153 may be formed as a single segment having a single high point located on the longitudinal axis 3B-3B. Furthermore, in the exemplified embodiment the first and second high points 3156*a*, 3156*b* are the same height, and thus the first and second high points 3156*a*, 3156*b* may be considered a single high point in some embodiments.

The second arcuate cleaning element 3160 is arranged on the head 3110 so as to at least partially surround the second conical tuft 3140. Specifically, in the exemplified embodiment the second arcuate cleaning element 3160 surrounds the second conical tuft 3140 for at least 180° about the circumference of the second conical tuft 3140, or between 180° and 270° about the circumference of the second conical tuft 3140. In that regard, there are no other bristle tufts or cleaning elements positioned between the second arcuate cleaning element 3160 and the second conical tuft 3140 where the second arcuate cleaning element 3160 surrounds the second conical tuft 3140. In the exemplified embodiment, the second and third segments 3162, 3163 of the second arcuate cleaning element 3160 are located between the second conical tuft 3140 and the proximal end 3118 of the head 3110 and the first and fourth segments 3161, 3164 of the second arcuate cleaning element 3160 are located between the second conical tuft 3140 and the lateral sides or peripheral edge of the head 3110.

The second arcuate cleaning element 3160 has a top surface 3165 having a first high point 3166*a* and a second high point 3166*b*. The first high point 3166*a* is located on the second segment 3162 and the second high point 3166*b* is located on the third segment 3163. The first and second high points 3166*a*, 3166*b* are located on opposite sides of the longitudinal axis 3B-3B. Furthermore, each of the first and second high points 3166*a*, 3166*b* is located at a fourth height 3H4 from the front surface 3111 of the head 3110. The top surface 3155 of the second arcuate cleaning element 3160 also has a first low point 3167*a* and a second low point 3167*b*. The first low point 3167*a* is located on the first segment 3161 and the second low point 3167*b* is located on the fourth segment 3164. The first and second low points 3167*a*, 3167*b* are located on opposite sides of the longitudinal axis 3B-3B and on opposite sides of the second conical tuft 3140. Furthermore, each of the first and second low points 3167*a*, 3167*b* is located at a fifth height 3H5 from the front surface 3111 of the head 3110.

Although noted herein as having first and second high points 3166*a*, 3166*b*, in certain embodiments the second and third segments 3162, 3163 may be formed as a single segment having a single high point located on the longitudinal axis 3B-3B. Furthermore, in the exemplified embodiment the first and second high points 3166*a*, 3166*b* may be the same height, and thus the first and second high points 3166*a*, 3166*b* may be considered a single high point in some embodiments.

In the exemplified embodiment, the first height 3H1 (which is the height at which the annular top surface 3137 of the first conical tuft 3130 extends from the front surface 3111 of the head 3110) is greater than the third height 3H3 and less than the second height 3H2. Similarly, in the exemplified embodiment the sixth height 3H6 (which is the height at which the annular top surface 3147 of the second conical tuft 3140 extends from the front surface 3111 of the head 3110) is greater than the fifth height 3H5 and less than the fourth height 3H4. Furthermore, in the exemplified embodiment the third height 3H3 is greater than the fifth height 3H5, and the second height 3H2 is greater than the fourth height 3H4. Thus, each of the cleaning elements in the distal region of the head 3110 is taller than its counterpart in the proximal region of the head 3110 (the high point 3156*a*, 3156*b* of the first arcuate cleaning element 3150 is taller than the high point 3166*a*, 3166*b* of the second arcuate cleaning element 3160, the low point 3157*a*, 3157*b* of the first arcuate cleaning element 3150 is taller than the low point 3167*a*, 3167*b* of the second arcuate cleaning element 3160, and the first conical tuft 3130 is taller than the second conical tuft 3140).

In the exemplified embodiment the top surface 3155 of the first arcuate cleaning element 3150 comprises a first ramped portion 3158*a* extending from the first low point 3157*a* to the first high point 3156*a* (visible in FIG. 25) and a second ramped portion 3158*b* extending from the second low point 3157*b* to the second high point 3156*b* (not visible in FIG. 25, but denoted in FIG. 23). In the exemplified embodiment, each of the first and second ramped portions 3158*a*, 3158*b* of the top surface 3155 of the first arcuate cleaning element 3150 have a constant slope (i.e., the ramped portions 3158*a*, 3158*b* are linear), although in other embodiments the slope may gradually increase or decrease when extending from the low points 3157*a*, 3157*b* to the high points 3156*a*, 3156*b* as desired. Similarly, the top surface 3165 of the second arcuate cleaning element 3160 comprises a first ramped portion 3168*a* extending from the first low point 3167*a* to the first high point 3166*a* (visible in FIG. 25) and a second ramped portion 3168*b* extending from the second low point 3167*b* to the second high point 3166*b* (not visible in FIG. 4, but denoted in FIG. 23). In the exemplified embodiment, each of the first and second ramped portions 3168*a*, 3168*b* of the top surface 3165 of the second arcuate cleaning element 3160 have a constant slope (i.e., the ramped portions 3168*a*, 3168*b* are linear), although in other embodiments the slope may gradually increase or decrease when extending from the low points 3167*a*, 3167*b* to the high points 3166*a*, 3166*b* as desired.

Furthermore, in embodiments wherein the first arcuate cleaning element 3150 is a single continuous cleaning element, the first and second high points 3156*a*, 3156*b* of the first arcuate cleaning element 3150 may be located along a reference plane that includes the longitudinal axis 3B-3B and is perpendicular to the front surface 3111 of the head 3110. Furthermore, even when the first arcuate cleaning element 3150 is formed by separate bristle segments 3151-3154 having gaps therebetween, conceptually the high points 3156*a*, 3156*b* may still be located along the reference plane that includes the longitudinal axis 3B-3B and is perpendicular to the front surface 3111 of the head 3110. Furthermore, as can be seen in FIG. 25, when viewed in side profile the first ramped portion 3158*a* (and also the second ramped portion 3158*b*, although not visible in FIG. 25) of the top surface 3155 of the first arcuate cleaning element 3150 intersects the annular top surface 3137 of the first conical tuft 3130 at a first intersection point 3159.

Similarly, in embodiments wherein the second arcuate cleaning element 3160 is a single continuous cleaning element, the first and second high points 3166*a*, 3166*b* of the second arcuate cleaning element 3160 may be located along a reference plane that includes the longitudinal axis 3B-3B and is perpendicular to the front surface 3111 of the head 3110. Furthermore, even when the second arcuate cleaning element 3160 is formed by separate bristle segments 3161-

3164 having gaps therebetween, conceptually the high points 3166*a*, 3166*b* may still be located along the reference plane that includes the longitudinal axis 3B-3B and is perpendicular to the front surface 3111 of the head 3110. Furthermore, as can be seen in FIG. 25, when viewed in side profile the first ramped portion 3168*a* (and also the second ramped portion 3168*b*, although not visible in FIG. 25) of the top surface 3165 of the second arcuate cleaning element 3160 intersects the annular top surface 3147 of the second conical tuft 3140 at a second intersection point 3169.

Referring to FIGS. 2-24 and 26 concurrently, the oral care implement 3100 will be further described. As noted above, in the exemplified embodiment the first arcuate cleaning element 3150 only partially surrounds the first conical tuft 3130 and the second arcuate cleaning element 3160 only partially surrounds the second conical tuft 3140. However, the plurality of tooth cleaning elements 3115 further comprise a first arcuate elastomeric wall 3170 positioned adjacent to the first conical tuft 3130 and a second arcuate elastomeric wall 3180 positioned adjacent to the second conical tuft 3140. In the exemplified embodiment, each of the first and second arcuate elastomeric walls 3170, 3180 is formed of a resilient elastomeric material, such as a thermoplastic elastomer. This is different than the first and second arcuate cleaning elements 3150, 3160 and the first and second conical tufts 3130, 3140, which are formed as tufts of bristles.

The first arcuate elastomeric wall 3170 has an arcuate section 3171 and a support section 3175. The arcuate section 3171 has an inner concave surface 3172 and an outer convex surface 3173. The inner concave surface 3172 of the arcuate section 3171 of the first elastomeric wall 3170 is adjacent to and faces the first conical tuft 3130. The first arcuate elastomeric wall 3170 is located on the head 3110 in between the first conical tuft 3130 and the proximal end 3118 of the head 3110. Thus, as can be seen, the first arcuate cleaning element 3150 and the first arcuate elastomeric wall 3170 collectively completely surround the first conical tuft 3130. The support section 3175 of the first arcuate elastomeric wall 3170 extends from the outer convex surface 3173 of the arcuate section 3171 of the first arcuate elastomeric wall 3170. More specifically, the support section 3175 extends from the outer convex surface 3173 of the arcuate section 3171 along and in the direction of the longitudinal axis 3B-3B and in a direction away from the first conical tuft 3130. The first arcuate elastomeric wall 3170 provides support for the first conical tuft 3130 such that flexing of the bristles of the first conical tuft 3130 in the direction of the first arcuate elastomeric wall 3170 will be kept to a minimum during brushing.

The arcuate section 3171 of the first arcuate elastomeric wall 3170 terminates in a top surface 3174. Furthermore, the support section 3175 of the first arcuate elastomeric wall 3170 terminates in a top surface 3176. The top surface 3174 of the arcuate section 3171 of the first arcuate elastomeric wall 3170 extends a greater height from the front surface 3111 of the head 3110 than the top surface 3176 of the support section 3175 of the first arcuate elastomeric wall 3170.

The second arcuate elastomeric wall 3180 has an arcuate section 3181 and a support section 3185. The arcuate section 3181 has an inner concave surface 3182 and an outer convex surface 3183. The inner concave surface 3182 of the arcuate section 3181 of the second elastomeric wall 3180 is adjacent to and faces the second conical tuft 3140. The second arcuate elastomeric wall 3180 is located on the head 3110 in between the second conical tuft 3140 and the distal end 3119 of the head 3110. Thus, as can be seen, the second arcuate elastomeric element 3160 and the second arcuate elastomeric wall 3180 collectively completely surround the second conical tuft 3140. The support section 3185 of the second arcuate elastomeric wall 3180 extends from the outer convex surface 3183 of the arcuate section 3181 of the second arcuate elastomeric wall 3180. More specifically, the support section 3185 extends from the outer convex surface 3183 of the arcuate section 3181 along and in the direction of the longitudinal axis 3B-3B and in a direction away from the second conical tuft 3140. The second arcuate elastomeric wall 3180 provides support for the second conical tuft 3140 such that flexing of the second conical tuft 3140 in the direction of the second arcuate elastomeric wall 3180 will be kept to a minimum during brushing.

The arcuate section 3181 of the second arcuate elastomeric wall 3180 terminates in a top surface 3184. Furthermore, the support section 3185 of the second arcuate elastomeric wall 3180 terminates in a top surface 3186. The top surface 3184 of the arcuate section 3181 of the second arcuate elastomeric wall 3180 extends a greater height from the front surface 3111 of the head 3110 than the top surface 3186 of the support section 3185 of the second arcuate elastomeric wall 3180.

Referring now to FIGS. 23-25 and 28 concurrently, the oral care implement 3100 will be further described. In addition to the above, the tooth cleaning elements 3115 also comprise at least one multi-height bristle tuft 3190 that extends from a single tuft hole along a tuft axis. In certain embodiments, the invention may be directed to the inclusion of one or more of the multi-height bristle tufts 3190 on the head 3110 regardless of the structure, pattern, shape, and configuration of the other tooth cleaning elements that are on the head.

In the exemplified embodiment, a plurality of the multi-height bristle tufts 3190 are positioned on opposing sides of the longitudinal axis 3B-3B. Specifically, in the exemplified embodiment there are four multi-height bristle tufts 3190 positioned between the first segment 3151 of the first arcuate cleaning element 3150 and the first segment 3161 of the second arcuate cleaning element 3160 along a first lateral edge of the head 3110. Similarly, in the exemplified embodiment there are four multi-height bristle tufts 3190 positioned between the fourth segment 3154 of the first arcuate cleaning element 3150 and the fourth segment 3164 of the second arcuate cleaning element 3160 along a second lateral edge of the head 3110. Of course, more or less than four of the multi-height bristle tufts 3190 can be used on the opposing lateral sides of the head 3110 in other embodiments as desired. The specific details of the multi-height bristle tufts 3190 will only be denoted in the drawings with regard to one or a couple of the multi-height bristle tufts 3190 in order to avoid clutter, it being understood that each of the multi-height bristle tufts 3190 has an identical structure.

Each of the multi-height bristle tufts 3190 comprises a first bristle tuft section 3191 and a second bristle tuft section 3192. The first bristle tuft section 3191 has a rectangular transverse cross-sectional shape and the second bristle tuft section 3192 has a U-shaped transverse cross-sectional shape. Despite the multi-height bristle tufts 3190 being formed of two different bristle tuft sections having two different shapes, each multi-height bristle tuft 3190 is positioned within a single tuft hole 3189. Thus, the tuft holes 3189 within which the multi-height bristle tufts 3190 are positioned have a U-shaped portion and a rectangular-shaped portion that are in spatial communication with each other.

As noted above, the second bristle tuft section 3192 of the multi-height bristle tufts 3190 has a U-shaped transverse cross-sectional shape. Thus, the second bristle tuft sections 3192 have edges at the top of each of the legs of the "U" and a cavity defined between the legs of the "U." The first bristle tuft section 3191 is positioned within the U-shaped cavity formed by the second bristle tuft section 3192 such that the second bristle tuft sections 3192 at least partially surround the first bristle tuft sections 3191. Each of the first bristle tuft sections 3191 has first and second major surfaces and first and second minor surfaces. In the exemplified embodiment, one of the minor surfaces and a portion of each of the major surfaces is surrounded by (and in the exemplified embodiment in contact with) the second bristle tuft section 3192. The other minor surface and the remainder of the major surfaces of the first bristle tuft sections 3191 is exposed and not surrounded by the second bristle tuft section 3192.

In the exemplified embodiment, approximately one-half of the transverse-cross section of the first bristle tuft sections 3191 is positioned within the U-shaped cavity of the second bristle tuft sections 3192, the other half of the transverse cross-section of the first bristle tuft sections 3191 extending from the U-shaped cavity. Thus, the first bristle tuft sections 3191 extend further laterally away from the longitudinal axis 3B-3B than the second bristle tuft sections 3192. The first bristle tuft sections 3191 comprise a first portion 3193 that is nested within the U-shape of the second bristle tuft section 3192 and a second portion 3194 that transversely protrudes from the U-shape of the second bristle tuft sections 3192 in the direction of the lateral sides of the head 3110. The first portion 3193 of the first bristle tuft sections 3191 that are nested within the U-shape of the second bristle tuft sections 3192 are in surface contact with the second bristle tuft section 3192. The second bristle tuft sections 3192 are positioned closer to the longitudinal axis 3B-3B of the head 3110 than the first bristle tuft sections 3191 because the "U" of the second bristle tuft sections 3192 wraps around the side of the first bristle tuft sections 3191 that is closest to the longitudinal axis 3B-3B of the head 3110.

The multi-height bristles 3190 on the first lateral side of the head 3110 are longitudinally aligned with the multi-height bristles 3190 on the second lateral side of the head 3110. Furthermore, the convex portions of the "U" of the second bristle tuft sections 3192 of the multi-height bristles 3190 on the first lateral side of the head 3110 are in facing relation with the convex portions of the U of the second bristle tuft sections 3192 of the multi-height bristles 3190 on the second lateral side of the head 3110. The first bristle tuft sections 3191 of the multi-height bristles 3190 extend a greater height from the front surface 3111 of the head 3110 than the second bristle tuft sections 3192. Thus, the second bristle tuft sections 3192 partially surround the first bristle tuft sections 3191 and the first bristle tuft sections 3191 axially protrude from an upper surface of the second bristle tuft sections 3192.

The tooth cleaning elements 3115 also include first and second arcuate walls 3210, 3211 and a central elastomeric wall 3212. The first and second arcuate walls 3210, 3211 and the central elastomeric wall 3212 are located centrally on the head in between the first and second arcuate elastomeric walls 3170, 3180. The first and second arcuate walls 3210, 3211 each have a convex surface and a concave surface. The convex surface of the first and second arcuate walls 3210, 3211 are facing each other. The concave surface of the first arcuate wall 3210 is facing the first set of the multi-height bristle tufts 3190 on the first lateral side of the head. The concave surface of the second arcuate wall 3211 is facing the second set of multi-height bristle tufts 3190 on the second lateral side of the head. The central elastomeric wall 3212 is positioned on and elongated along the longitudinal axis 3B-3B and is adjacent to the convex surfaces of each of the first and second arcuate walls 3210, 3211.

In the exemplified embodiment, the collection of the tooth cleaning elements 3115 are all symmetric about the longitudinal axis 3B-3B and about a transverse axis that is perpendicular to the longitudinal axis 3B-3B and that divides the head 3110 into two equal halves. Thus, the pattern of the tooth cleaning elements 3115 is such that they have lateral and longitudinal symmetry.

Concept Four

Figure 30:
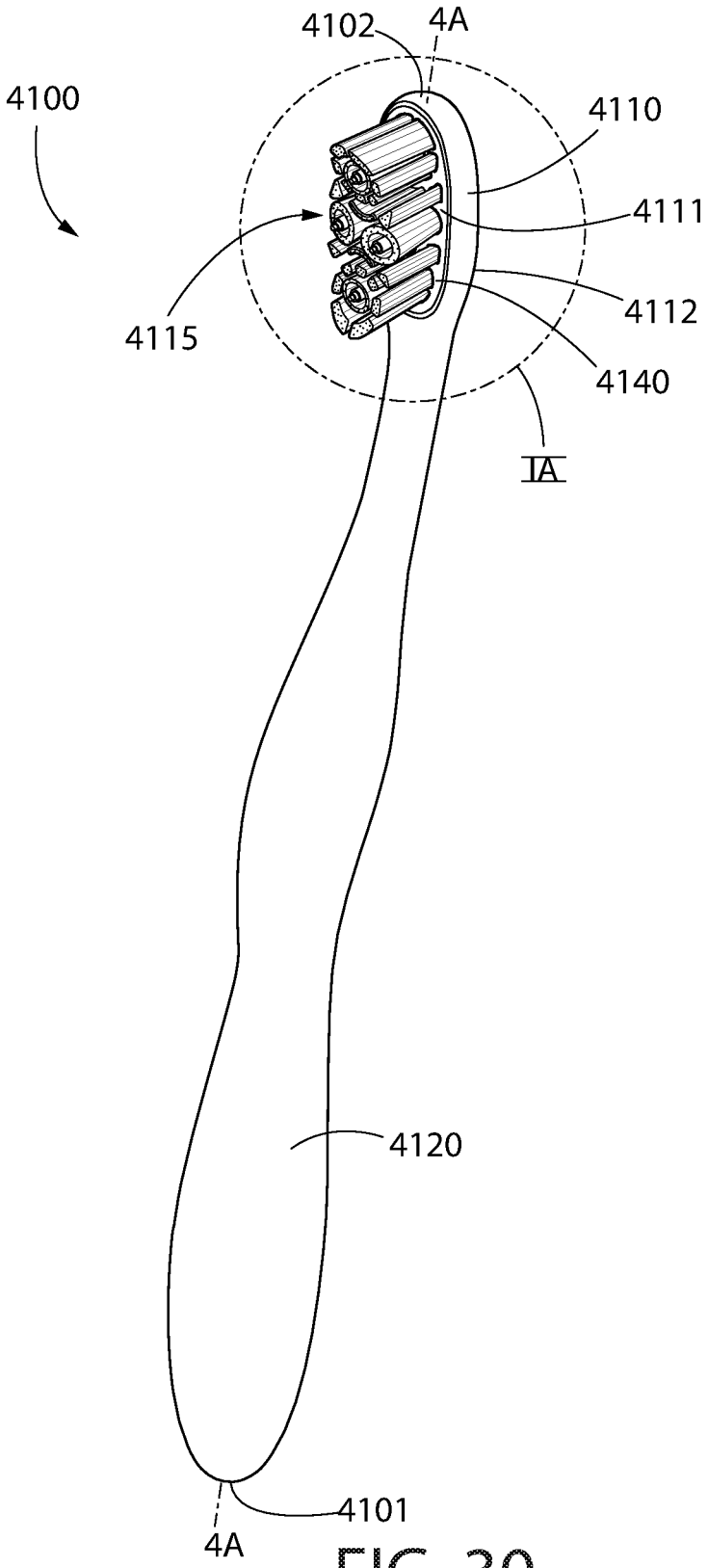
FIG. 30 is a front perspective view of an oral care implement in accordance with one embodiment of the present invention.
Figure 31:
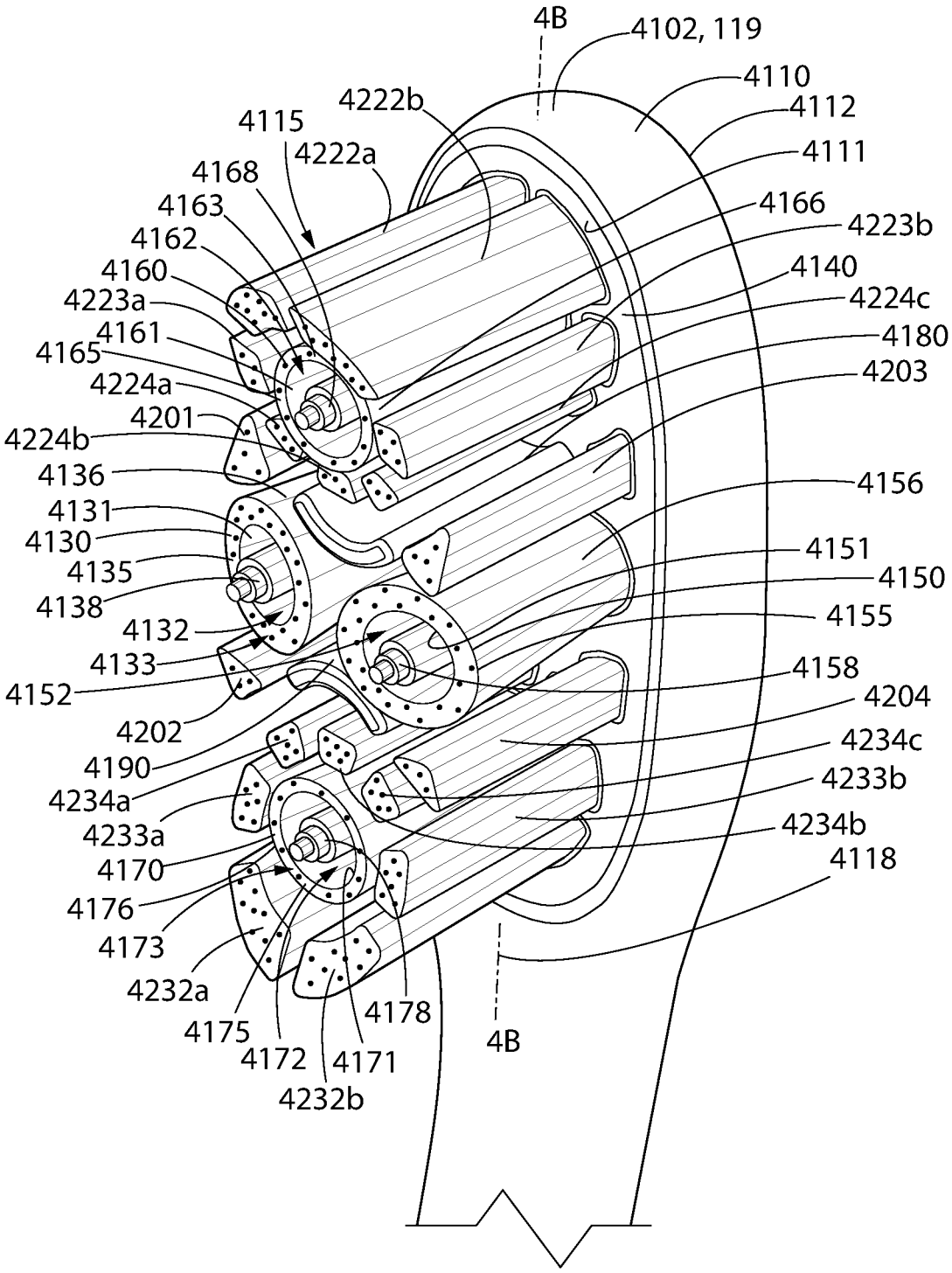
FIG. 31 is a close-up view of area IA of FIG. 30.
Figure 32:
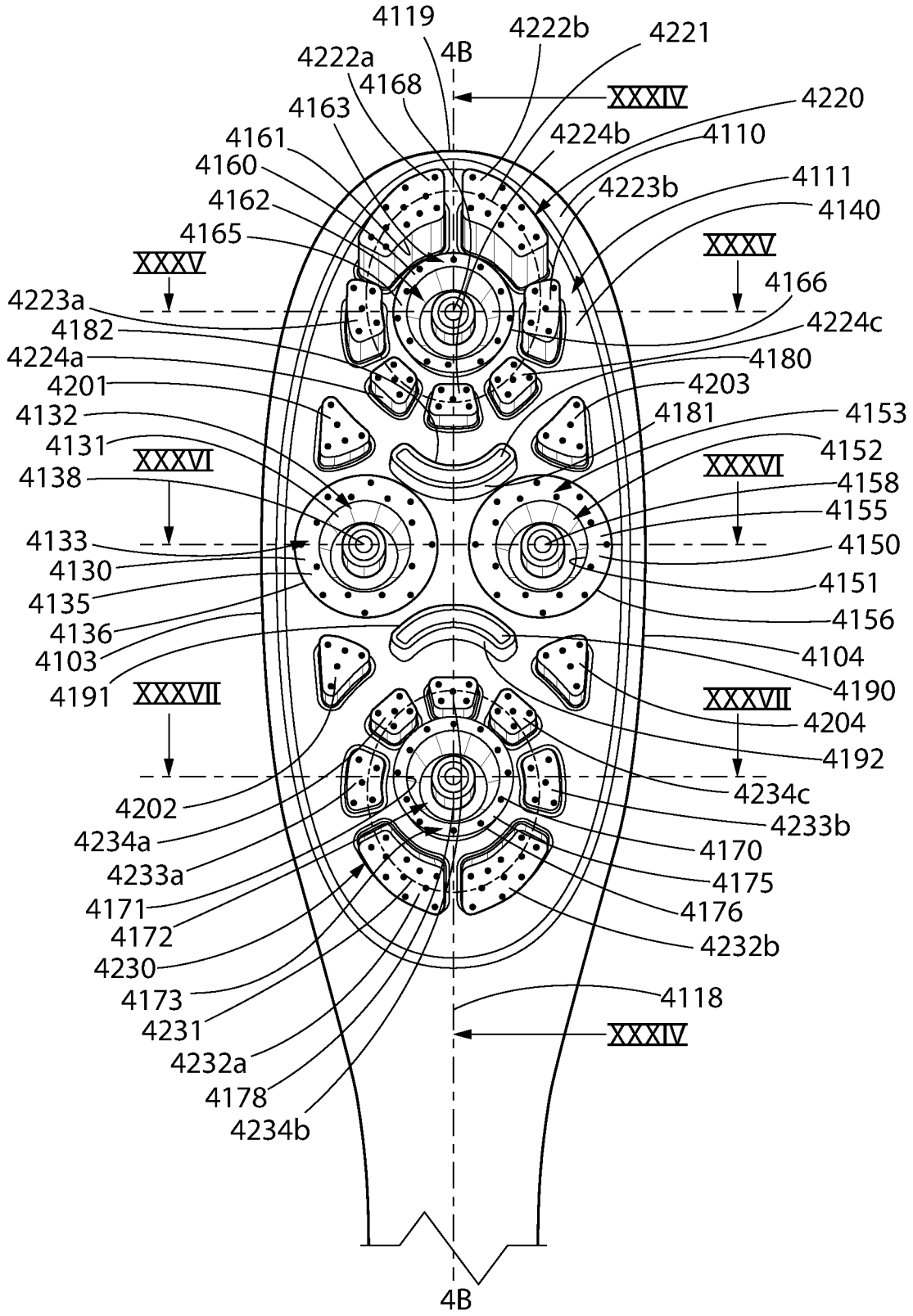
FIG. 32 is a front view of the head of the oral care implement of FIG. 31.
Figure 33:
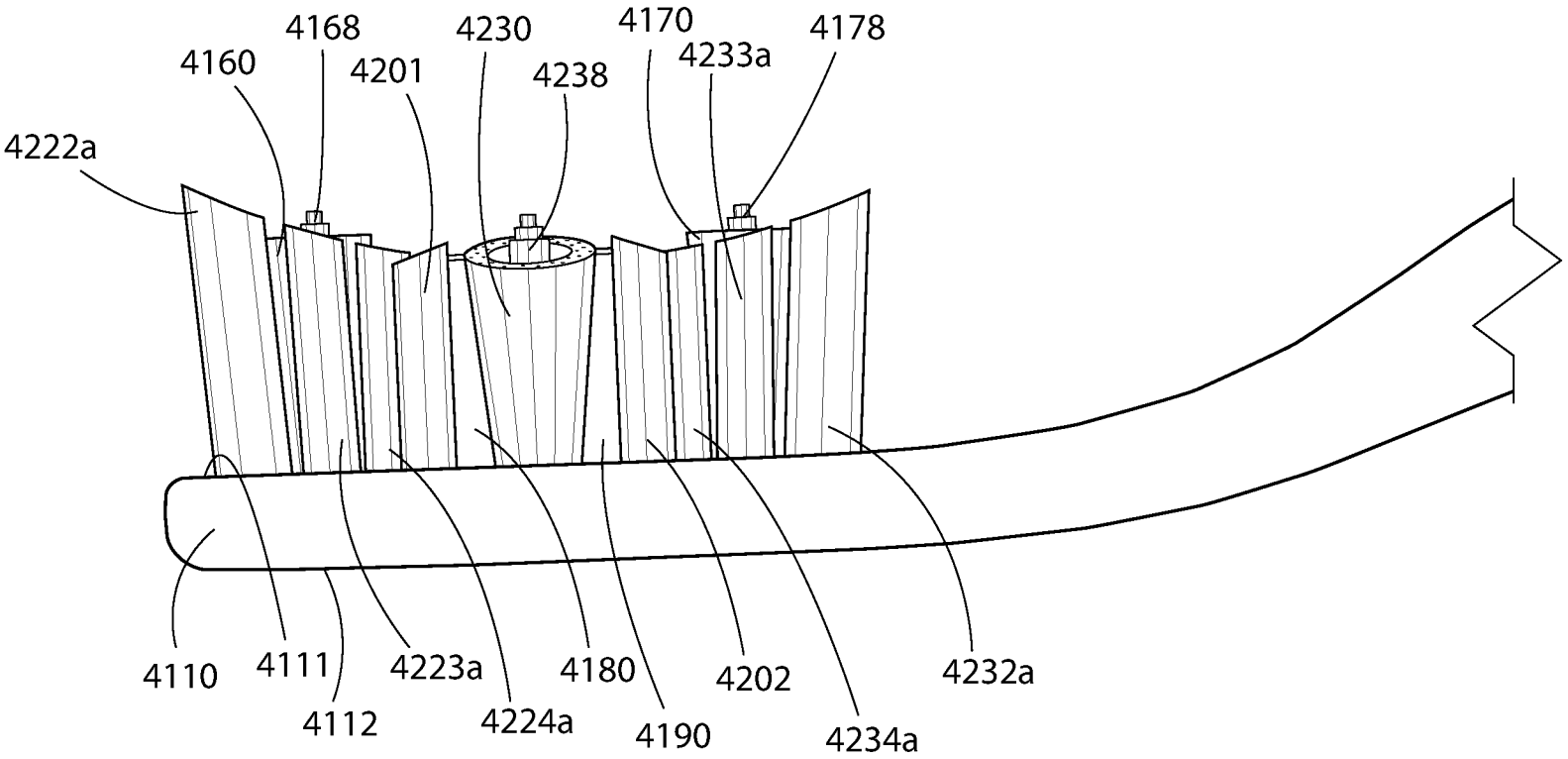
FIG. 33 is a side view of the head of the oral care implement of FIG. 31.
Figure 34:
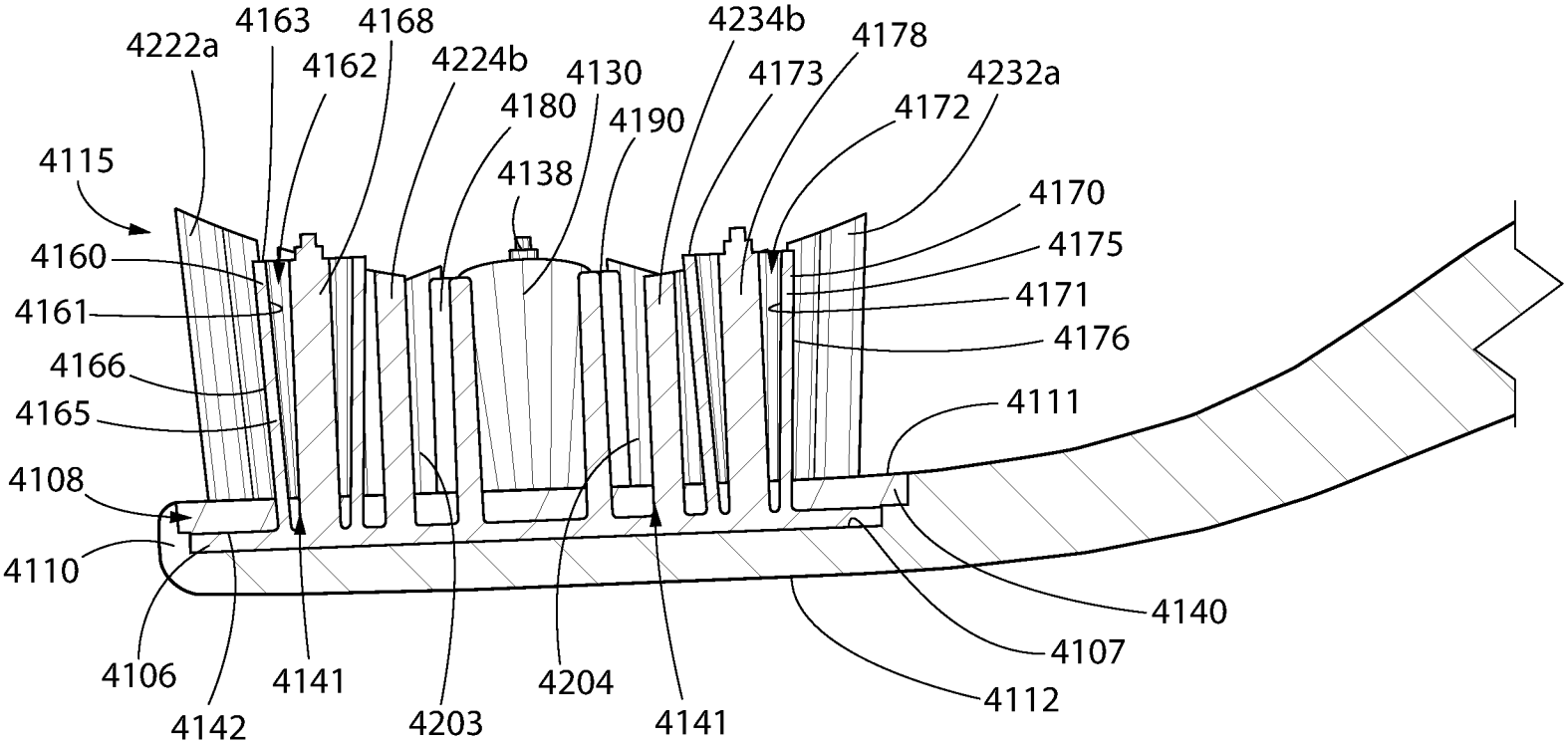
FIG. 34 is a cross-sectional view taken along line XXXIV-XXXIV of FIG. 32.
Figure 35:
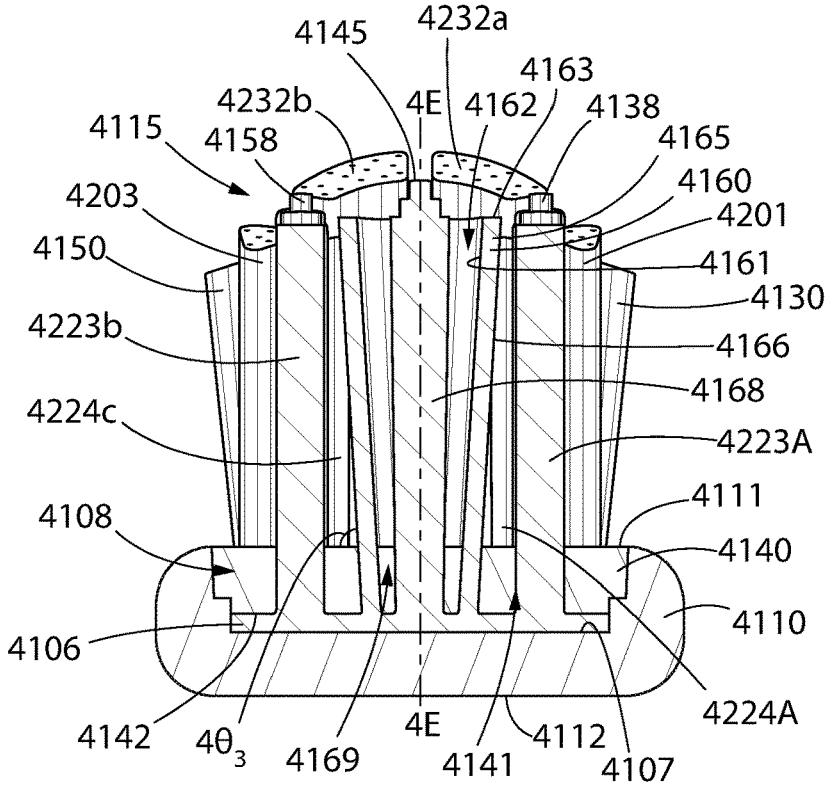
FIG. 35 is a cross-sectional view taken along line XXXV-XXXV of FIG. 32.

Referring first to FIGS. 30, 31, and 32 concurrently, an oral care implement 44100 is illustrated in accordance with one embodiment of the present invention. In the exemplified embodiment, the oral care implement 4100 is in the form of a manual toothbrush. However, in certain other embodiments the oral care implement 4100 can take on other forms such as being a powered toothbrush, a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement 4100 extends from a proximal end 4101 to a distal end 4102 along a longitudinal axis 4A-4A. The oral care implement 4100 generally comprises a head 4110 and a handle 4120. The head 4110 extends from a proximal end 4118 to a distal end 4119 along a longitudinal axis 4B-4B that is coextensive with the longitudinal axis 4A-4A of the oral care implement 4100. Furthermore, in the exemplified embodiment the distal end 4102 of the oral care implement 4100 is the same as the distal end 4119 of the head 4110.

The handle 4120 is an elongated structure that provides the mechanism by which the user can hold and manipulate the oral care implement 4100 during use. In the exemplified embodiment, the handle 4120 is generically depicted having various contours for user comfort. Of course, the invention is not to be limited by the specific shape illustrated for the handle 4120 in all embodiments and in certain other embodiments the handle 4120 can take on a wide variety of shapes, contours, and configurations, none of which are limiting of the present invention unless so specified in the claims.

In the exemplified embodiment, the handle 4120 is formed of a rigid plastic material, such as for example without limitation polymers and copolymers of ethylene, propylene, butadiene, vinyl compounds, and polyesters such as polyethylene terephthalate. Of course, the invention is not to be so limited in all embodiments and the handle 4120 may include a resilient material, such as a thermoplastic elastomer, as a grip cover that is molded over portions of or the entirety of the handle 4120 to enhance the gripability of the handle 4120 during use. For example, portions of the handle 4120 that are typically gripped by a user's palm during use may be overmolded with a thermoplastic elastomer or other resilient material to further increase comfort to a user. Furthermore, materials other than those noted above can be used including metal, wood, or any other desired material that has sufficient structural rigidity to permit a user to grip the handle 4120 and manipulate the oral care implement 4100 during toothbrushing.

The head 4110 of the oral care implement 4100 is coupled to the handle 4120 and comprises a front surface 4111 and an opposing rear surface 4112. In the exemplified embodiment, the head 4110 is formed integrally with the handle 4120 as a single unitary structure using a molding, milling, machining, or other suitable process. However, in other embodiments the handle 4120 and the head 4110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus the head 4110 may, in certain embodiments, be formed of any of the rigid plastic materials described above as being used for forming the handle 4120, although the invention is not to be so limited in all embodiments and other materials that are commonly used during toothbrush head manufacture may also be used.

The oral care implement 4100 also comprises a plurality of tooth cleaning elements 4115 extending from the front surface 4111 of the head 4110. The details of certain ones of the plurality of tooth cleaning elements 4115 will be discussed below, including specific details with regard to structure, pattern, orientation, and material of such tooth cleaning elements 4115. However, where it does not conflict with the other disclosure provided herein, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof, and/or structures containing such materials or combinations. Thus, any combination of these tooth cleaning elements may be used within the tooth cleaning elements 4115 in some embodiments. However, as described herein below, in certain embodiments one or more of the tooth cleaning elements 4115 may be formed as tufts of bristles.

In embodiments that use elastomeric elements as one or more of the tooth cleaning elements 4115, suitable elastomeric materials may include any biocompatible resilient material suitable for uses in an oral hygiene apparatus. To provide optimum comfort as well as cleaning benefits, the elastomeric material of any such tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Referring to FIGS. 30-37 concurrently, one manner in which the tooth cleaning elements 4115 are secured to the head 4110 will be described. Specifically, in the exemplified embodiment the tooth cleaning elements 4115 are formed as a cleaning element assembly on a head plate 4140 such that one or more of the tooth cleaning elements 4115 are mounted onto the head plate 4140 and then the head plate 4140 is coupled to the head 4110. In such an embodiment, the head plate 4140 is a separate and distinct component from the head 4110 of the oral care implement 4100. However, the head plate 4140 is connected to the head 4110 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 4140 and the head 4110 are separately formed components that are secured together during manufacture of the oral care implement 4100.

In certain embodiments, the head plate 4140 may comprise a plurality of holes 4141 formed therethrough, and the tooth cleaning elements 4115 may be mounted to the head plate 4140 within the holes 4141. This type of technique for mounting the tooth cleaning elements 4115 to the head 4110 via the head plate 4140 is generally known as anchor free tufting (AFT). Specifically, in AFT a plate or membrane (i.e., the head plate 4140) is created separately from the head 4110. The tooth cleaning elements 4115 (such as bristles, elastomeric elements, and combinations thereof) are positioned into the head plate 4140 so as to extend through the holes 4141 of the head plate 4140. The free ends of the tooth cleaning elements 4115 on one side of the head plate 4140 perform the cleaning function. The ends of the tooth cleaning elements 4115 on the other side of the head plate 4140 are melted together by heat to be anchored in place. As the tooth cleaning elements 4105 are melted together, a melt matte 4106 is formed, which is a layer of plastic formed from the collective ends of the tooth cleaning elements 4115 that prevents the tooth cleaning elements 4115 from being pulled through the tuft holes 4141.

After the tooth cleaning elements 4115 are secured to the head plate 4140, the head plate 4140 is secured to the head 4110 such as by ultrasonic welding. When the head plate 4140 is coupled to the head 4110, the melt matte 4106 is located between a lower surface 4142 of the head plate 4140 and a floor 4107 of a basin 4108 of the head 4110 in which the head plate 4140 is disposed. The melt matte 4106, which is coupled directly to and in fact forms a part of the tooth cleaning elements 4115, prevents the tooth cleaning elements 4115 from being pulled through the holes 4141 in the head plate 4140 thus ensuring that the tooth cleaning elements 4105 remain attached to the head plate 4140 during use of the oral care implement 4100.

In another embodiment, the tooth cleaning elements may be connected to the head 4110 using a technique known in the art as AMR. In this technique, the handle is formed integrally with the head plate as a one-piece structure. After the handle and head plate are formed, the bristles are inserted into holes in the head plate so that free/cleaning ends of the bristles extend from the front surface of the head plate and bottom ends of the bristles are adjacent to the rear surface of the head plate. After the bristles are inserted into the holes in the head plate, the bottom ends of the bristles are melted together by applying heat thereto, thereby forming a melt matte at the rear surface of the head plate. The melt matte is a thin layer of plastic that is formed by melting the bottom ends of the bristles so that the bottom ends of the bristles transition into a liquid, at which point the liquid of the bottom ends of the bristles combine together into a single layer of liquid plastic that at least partially covers the rear surface of the head plate. After the heat is no longer applied, the melted bottom ends of the bristles solidify/harden to form the melt matte/thin layer of plastic. In some embodiments, after formation of the melt matte, a tissue cleaner is injection molded onto the rear surface of the head plate, thereby trapping the melt matte between the tissue cleaner and the rear surface of the head plate. In other embodiments, other structures may be coupled to the rear surface of the head plate to trap the melt matte between the rear surface of the head plate and such structure without the structure necessarily being a tissue cleaner (the structure can just be a plastic material that is used to form a smooth rear surface of the head, or the like, and the structure can be molded onto the rear surface of the head plate or snap-fit (or other mechanical coupling) to the rear surface of the head plate as desired).

Of course, techniques other than AFT and AMR can be used for mounting the tooth cleaning elements 4115 to the head 4110, such as widely known and used stapling techniques or the like. In such embodiments the head plate 4140 may be omitted and the tooth cleaning elements 4115 may be coupled directly to the head 4110. Furthermore, in a modified version of the AFT process discussed above, the head plate 4140 may be formed by positioning the tooth cleaning elements 4115 within a mold, and then molding the head plate 4140 around the tooth cleaning elements 4115 via an injection molding process. However, it should be appreciated that certain of the bristle tufts disclosed herein cannot be adequately secured to the head using staple techniques, and one of AFT or AMR is therefore use for securing such bristle tufts (i.e., the conical tufts described below) to the head.

Although described herein above with regard to using AFT, in certain embodiments any suitable form of cleaning elements and attachment may be used in the broad practice of this invention. Specifically, the tooth cleaning elements 4115 of the present invention can be connected to the head 4110 in any manner known in the art. For example, staples/anchors or in-mold tufting (IMT) could be used to mount the cleaning elements/tooth engaging elements. In certain embodiments, the invention can be practiced with various combinations of stapled, IMT, AMR, or AFT bristles. Alternatively, the tooth cleaning elements 4115 could be mounted to tuft blocks or sections by extending through suitable openings in the tuft blocks so that the base of the tooth cleaning elements 4115 is mounted within or below the tuft block.

Although not illustrated herein, in certain embodiments the head 4110 may also include a soft tissue cleanser coupled to or positioned on its rear surface 4112. An example of a suitable soft tissue cleanser that may be used with the present invention and positioned on the rear surface of the head 4110 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 4100 may not include any soft tissue cleanser.

Still referring to FIGS. 30-37, the oral care implement 4100, and specifically the tooth cleaning elements 4115 of the oral care implement 4100, will be further described. In the exemplified embodiment, the plurality of tooth cleaning elements 4115 comprise a first conical tuft 4130, a second conical tuft 4150, a third conical tuft 4160, and a fourth conical tuft 4170. Each of the first, second, third, and fourth conical tufts 4130, 4150, 4160, 4170 is a tuft or grouping of bristles that are arranged together into a tuft and then secured into a single tuft hole within the head 4110 (or within the head plate 4140). The first, second, third, and fourth conical tufts 4130, 4150, 4160, 4170 are described herein as being conical due to the first, second, third, and fourth conical tufts 4130, 4150, 4160, 4170 having a conical shape. More specifically, as can best be seen in FIGS. 32 and 34-37, the first, second, third, and fourth conical tufts 4130, 4150, 4160, 4170 are in the shape of a truncated cone wherein the portion of the first, second, third, and fourth conical tufts 4130, 4150, 4160, 4170 that is positioned within the head 4110 is the truncated (i.e., cut off) portion of the cone such that the first, second, third, and fourth conical tufts 4130, 4150, 4160, 4170 are in the shape of an inverted truncated cone.

Figure 36:
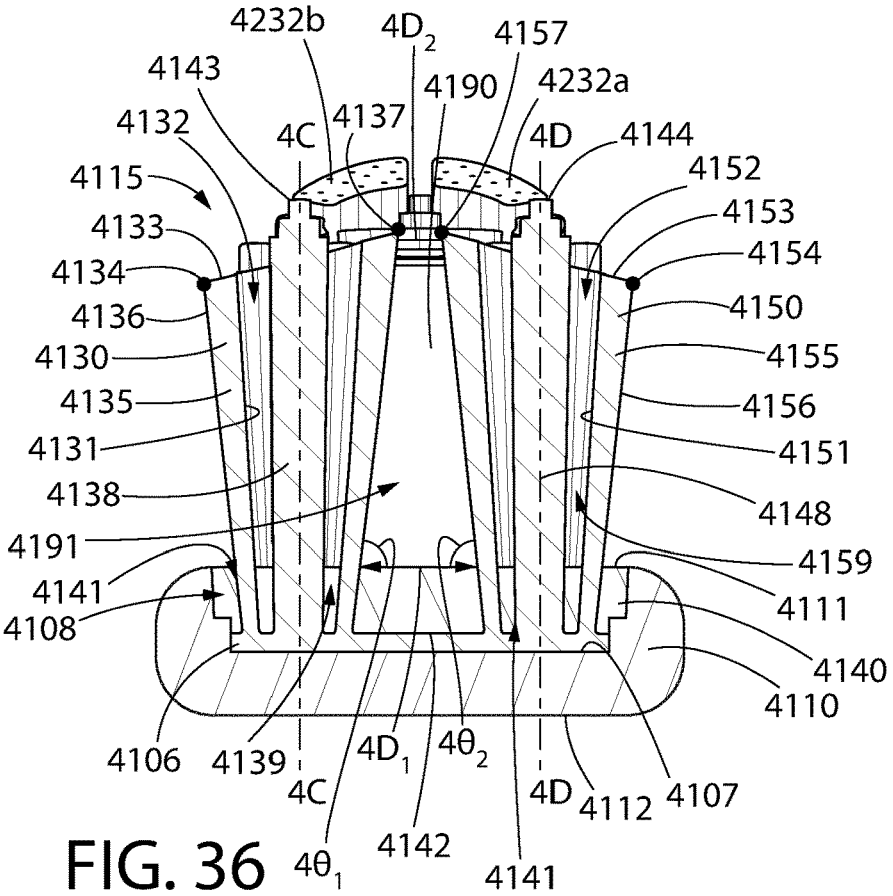
FIG. 36 is a cross-sectional view taken along line XXXVI-XXXVI of FIG. 32.
Figure 37:
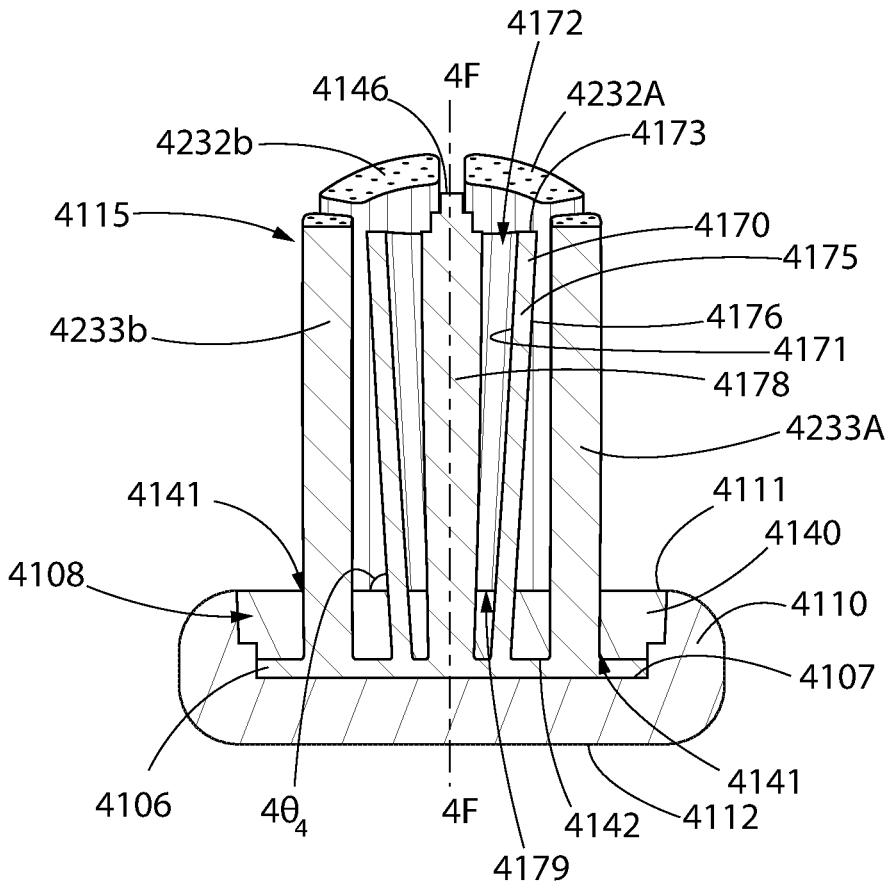
FIG. 37 is a cross-sectional view taken along line XXXVII-XXXVII of FIG. 32.

Referring now to FIGS. 31, 32, and 36 concurrently, the first and second conical tufts 4130, 4150 will be further described. The first conical tuft 4130 comprises a first continuous bristle wall 4135 having an inner surface 4131 and an outer surface 4136. The inner surface 4131 of the first continuous bristle wall 4135 of the first conical tuft 4130 defines a first cavity 4132 that extends along a first cavity axis 4C-4C. In the exemplified embodiment, the first conical tuft 4130, and specifically the first continuous bristle wall 4135 thereof, extends in a 360° manner about the first cavity axis 4C-4C without any breaks or gaps.

The first cavity 4132 of the first conical tuft 4130 has an open top end and is bounded by the inner surface 4131 of the first continuous bristle wall 4135 and by the front surface 4111 of the head 4110. As noted above, the first conical tuft 4130 in the exemplified embodiment is formed by a plurality of bristles. Specifically, the plurality of bristles are clumped together and positioned collectively into a single tuft hole so that the plurality of bristles collectively form the first conical tuft 4130 having no gaps in the first continuous bristle wall 4135 for its entire 360° extension about the first cavity axis 4C-4C. Thus, the first conical tuft 4130 extends from a single tuft hole. The term continuous bristle wall is intended to mean that the first conical tuft 4130 is a single tuft of bristles that are clumped together into a single tuft hole in a non-spaced apart manner.

Thus, the first conical tuft 4130 is a single tuft formed from a plurality of individual bristles that are positioned together within a single tuft hole. As a result, in the exemplified embodiment the first conical tuft 4130 has the first continuous bristle wall 4135 that extends without discontinuity about the first cavity axis 4C-4C. Thus, in the exemplified embodiment there are no gaps formed into the outer surface 4136 of the first conical tuft 4130. Of course, in other embodiments the first conical tuft 4130 may have small gaps therein as desired while still being a single tuft positioned within a single tuft hole. Such gaps in the bristle wall may prevent dentifrice from being trapped within the first cavity 4132 of the first conical tuft 4130 by providing means of egress from the first cavity 4132. In such an embodiment, the first bristle wall 4135 may not be continuous. In one embodiment, the first conical tuft 4130 is secured to the head 4110 by anchor free tufting or AMR.

Due to the conical shape of the first conical tuft 4130, and more specifically, the inverted conical shape of the first conical tuft 4130, the first cavity 4132 of the first conical tuft 4130 has a first transverse cross-sectional area that increases with distance from the front surface 4111 of the head 4110. Specifically, the first transverse cross-sectional area of the first cavity 4132 of the first conical tuft 4130 only increases and never decreases with distance from the front surface 4111 of the head 4110. Thus, the greater the distance between a particular axial location within the first cavity 4132 of the first conical tuft 4130 and the front surface 4111 of the head 4110, the greater the transverse cross-sectional area of the first cavity 4132 at that particular axial location. Stated another way, the diameter of the first cavity 4132 increases with distance from the front surface 4111 of the head 4110 so that the diameter of the first cavity 4132 is greater at the terminal ends of the bristles of the first conical tuft 4130 than at the front surface 4111 of the head 4110.

The first continuous bristle wall 4135 of the first conical tuft 4130 terminates in a first annular top surface 4133. In the exemplified embodiment, the first annular top surface 4133 is inclined relative to the front surface 4111 of the head 4110 such that the height of the first conical tuft 4130 increases with distance from the peripheral edge of the head 4110 towards the center of the head 4110. Thus, the first annular top surface 4133 has a first low point 4134 and a first high point 4137. The first annular top surface 4133 is inclined relative to the front surface 4111 of the head 4110 from the first low point 4134 to the first high point 4137. Specifically, the first annular top surface 4133 may be inclined at approximately between 10° and 20° relative to the front surface 4111 of the head 4110, and more specifically between 10° and 15° relative to the front surface 4111 of the head 4110. In other embodiments the angle may be greater than 20°, such as between 20° and 30° or the like.

The second conical tuft 4150 comprises a second continuous bristle wall 4155 having an inner surface 4151 and an outer surface 4156. The inner surface 4151 of the second continuous bristle wall 4155 of the second conical tuft 4150 defines a second cavity 4152 that extends along a second cavity axis 4D-4D. The second conical tuft 4150, and specifically the second continuous bristle wall 4155 thereof, extends in a 360° manner about the second cavity axis 4D-4D. The second cavity 4152 of the second conical tuft 4150 has an open top end and is bounded by the inner surface 4151 of the second continuous bristle wall 4155 and by the front surface 4111 of the head 4110. The second conical tuft 4150 in the exemplified embodiment is formed by a plurality of bristles. Specifically, the plurality of bristles are clumped together and positioned collectively into a single tuft hole so that the plurality of bristles collectively form the second conical tuft 4150 having no gaps in the second continuous bristle wall 4155 for its entire 360° extension about the second cavity axis 4D-4D. Thus, the second conical tuft 4150 extends from a single tuft hole. The term continuous bristle wall is intended to mean that the second conical tuft 4150 is a single tuft of bristles that are clumped together into a single tuft hole in a non-spaced apart manner. Of course, in other embodiments the second bristle wall 4155 may not be continuous as it may have gaps or the like formed therein.

Thus, the second conical tuft 4150 is a single tuft formed from a plurality of individual bristles that are positioned together within a single tuft hole. As a result, in the exemplified embodiment the second conical tuft 4150 has the second continuous bristle wall 4155 that extends without discontinuity about the second cavity axis 4D-4D. Thus, in the exemplified embodiment there are no gaps formed into the outer surface 4156 of the second conical tuft 4150. Of course, in other embodiments the second conical tuft 4150 may have small gaps therein as desired while still being a single tuft positioned within a single tuft hole. Such gaps in the bristle wall may prevent dentifrice from being trapped within the second cavity 4152 of the second conical tuft 4150 by providing means of egress from the second cavity 4152. In one embodiment, the second conical tuft 4150 is secured to the head 4110 by anchor free tufting or AMR.

Due to the conical shape of the second conical tuft 4150, and more specifically, the inverted conical shape of the second conical tuft 4150, the second cavity 4152 of the second conical tuft 4150 has a second transverse cross-sectional area that increases with distance from the front surface 4111 of the head 4110. Specifically, the second transverse cross-sectional area of the second cavity 4152 of the second conical tuft 4150 only increases and never decreases with distance from the front surface 4111 of the head 4110. Thus, the greater the distance between a particular axial location within the second cavity 4152 of the second conical tuft 4150 and the front surface 4111 of the head 4110, the greater the transverse cross-sectional area of the second cavity 4152 at that particular axial location. Stated another way, the diameter of the second cavity 4152 increases with distance from the front surface 4111 of the head 4110 so that the diameter of the second cavity 4152 is greater at the terminal ends of the bristles of the second conical tuft 4150 than at the front surface 4111 of the head 4110.

The second continuous bristle wall 4155 of the second conical tuft 4150 terminates in a second annular top surface 4153. In the exemplified embodiment, the second annular top surface 4153 is inclined relative to the front surface 4111 of the head 4110 such that the height of the second conical tuft 4150 increases with distance from the peripheral edge of the head 4110 towards the center of the head 4110. Thus, the second annular top surface 4153 has a second low point 4154 and a second high point 4157. The second annular top surface 4153 is inclined relative to the front surface 4111 of the head 4110 from the second low point 4154 to the second high point 4157. Specifically, the second annular top surface 4153 may be inclined at approximately between 10° and 20° relative to the front surface 4111 of the head 4110, and more specifically between 10° and 15° relative to the front surface 4111 of the head 4110. In other embodiments the angle may be greater than 20°, such as between 20° and 30° or the like.

The first and second conical tufts 4130, 4150 are positioned on the head 4110 in an adjacent manner. More specifically, the first and second conical tufts 4130, 4150 are positioned adjacent to one another on opposite sides of the longitudinal axis 4B-4B of the head 4110. Furthermore, in the exemplified embodiment each of the first and second conical tufts 4130, 4150 is positioned on a transverse axis Z-Z (see FIG. 32) that is perpendicular to the longitudinal axis 4B-4B of the head 4110 and that is centrally located on the head 4110 so as to divide the head 4110 into two halves of substantially equal length. Moreover, the first and second conical tufts 4130, 4150 are positioned such that a transverse reference plane that is substantially perpendicular to the longitudinal axis 4B-4B of the head 4110 and perpendicular to the front surface 4111 of the head 4110 intersects the first and second high points 4137, 4157 and the first and second low points 4134, 4154 (the transverse reference plane would be a plane that includes the transverse axis Z-Z and extends perpendicular to the front surface 4111 of the head 4110). Of course, the invention is not to be so limited and the transverse axis Z-Z need not be located centrally on the head 4110 in all embodiments, but rather the transverse axis Z-Z can be any axis that is perpendicular to the longitudinal axis 4B-4B of the head 4110 and that extends along the width of the head 4110.

Furthermore, in the exemplified embodiment the first low point 4134 of the first conical tuft 4130 is positioned adjacent to a first lateral edge 4103 of the head 4110 and the first high point 4137 of the first conical tuft 4130 is positioned in a central region of the head 4110. The second low point 4154 of the second conical tuft 4150 is positioned adjacent to a second lateral edge 4104 of the head 4110 and the second high point 4157 of the second conical tuft 4150 is positioned in a central region of the head 4110. Thus, the first high point 4137 of the first conical tuft 4130 is positioned adjacent to the first high point 4157 of the second conical tuft 4150. As used in regard to the locations of the first and second high points 4137, 4157 of the first and second conical tufts 4130, 4150, the term adjacent means that there are no intervening tufts between the first high point 4137 of the first conical tuft 4130 and the second high point 4157 of the second conical tuft 4150. Thus, although the first and second conical tufts 4130, 4150 are spaced apart from one another, the first high point 4137 of the first conical tuft 4130 is immediately adjacent to the second high point 4157 of the second conical tuft 4150 with no tufts or other cleaning elements positioned between the first high point 4137 of the first conical tuft 4130 and the second high point 4157 of the second conical tuft 4150 in a direction of the transverse axis Z-Z.

Furthermore, due to the conical shape of the first and second conical tufts 4130, 4150, the distance between the first and second conical tufts 4130, 4150 decreases with increasing distance from the front surface 4111 of the head 4110. Thus, the first and second conical tufts 4130, 4150 are spaced apart by a first distance 4D1 at the front surface 4111 of the head 4110. The first and second conical tufts 4130, 4150 are spaced apart by a second distance 4D2 at the first and second high points 4137, 4157 of the first and second conical tufts 4130, 4150. The first distance 4D1 is greater than the second distance 4D2.

The first annular top surface 4133 of the first conical tuft 4130 slopes downwardly with distance from the longitudinal axis 4B-4B towards the first lateral edge 4103 of the head 4110. The second annular top surface 4153 of the second conical tuft 4150 slopes downwardly with distance from the longitudinal axis 4B-4B towards the second lateral edge 4104 of the head 4110. Thus, each of the first and second annular top surfaces 4133, 4153 of the first and second conical tufts 4130, 4150 slopes downwardly with increasing distance from a longitudinal reference plane that is parallel to (or includes) the longitudinal axis 4B-4B and is perpendicular to the front surface 4111 of the head 4110.

As can be seen from FIG. 36, in the exemplified embodiment each of the first and second annular top surfaces 4133, 4153 of the first and second conical tufts 4130, 4150 has a linear side profile when viewed from the transverse reference plane noted above. Of course, the invention is not to be so limited in all embodiments and in certain other embodiments one or both of the first and second annular top surfaces 4133, 4153 of the first and second conical tufts 4130, 4150 may have a concave or convex side profile when viewed from the transverse reference plane.

In the exemplified embodiment, the outer surface 4136 of the first conical tuft 4130 forms a first angle 4θ1 with the front surface 4111 of the head 4110. Furthermore, the outer surface 4156 of the second conical tuft 4150 forms a second angle 4θ2 with the front surface 4111 of the head 4110. In certain embodiments, the first and second angles 4θ1, 4θ2 may be the same, although in other embodiments the first and second angles 4θ1, 4θ2 may be different. In certain embodiments, each of the first and second acute angles 4θ1, 4θ2 are between 80° and 89°, more specifically between 83.5° and 87.5°. In certain embodiments, one or both of the first and second acute angles 4θ1, 4θ2 is between 82° and 85°, and in other embodiments one or both of the first and second acute angles 4θ1, 4θ2 is between 86° and 89°. Furthermore, one of the first and second acute angles 4θ1, 4θ2 may be between 82° and 85° while the other one of the first and second acute angles 4θ1, 4θ2 is between 86° and 89°.

Still referring to FIGS. 31, 32, and 36 concurrently, in the exemplified embodiment a first central cleaning element 4138 is located within the first central cavity 4132 of the first conical tuft 4130. In some embodiments, the first central cleaning element 4138 and the first conical tuft 4130 may be positioned within a single tuft hole. However, the invention is not to be so limited in all embodiments and in certain other embodiments the first central cleaning element 4138 may be positioned in a tuft hole that is spaced apart from and surrounded by the tuft hole within which the first conical tuft 4130 is positioned. The first central cleaning element 4138 (and any other central cleaning element discussed herein below) may be a tapered bristle tuft, a bristle tuft that comprises tapered bristles, a non-tapered bristle tuft, a rounded bristle tuft, bristle tuft that comprises spiral bristle, combinations thereof, or the like.

In the exemplified embodiment, the first central cleaning element 4138 extends perpendicularly from the front surface 4111 of the head 4110. In the exemplified embodiment, an annular gap 4139 is present between an outer surface of the first central cleaning element 4138 and the inner surface 4131 of the first conical tuft 4130. In the exemplified embodiment, the annular gap 4139 extends to below the front surface 4111 of the head 4110. Furthermore, in the exemplified embodiment the first central cleaning element 4139 converges with the first conical tuft 4130 at the melt matte 4106. Due to the conical shape of the first conical tuft 4130 and the perpendicular extension of the first central cleaning element 4138 relative to the front surface 4111 of the head 4110, the distance between the outer surface of the first central cleaning element 4138 and the inner surface 4131 of the first conical tuft 4130 increases with distance from the front surface 4111 of the head 4110.

Figure 38:
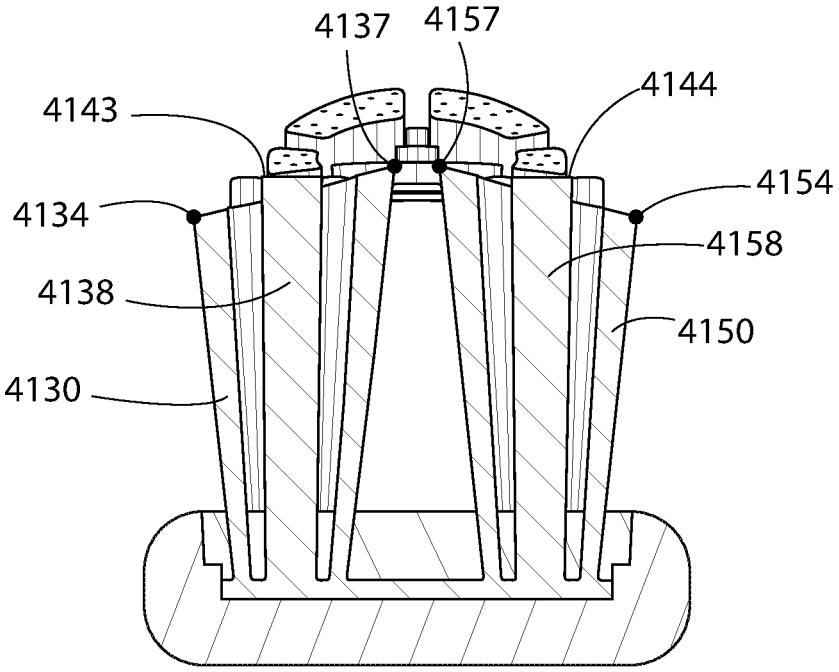
FIG. 38 is an alternative cross-section taken along line XXXVI-XXXVI of FIG. 32.

The first central cleaning element 4138 terminates in a free end 4143. In the embodiment exemplified in FIGS. 31, 32, and 36, the free end 4143 of the first central cleaning element 4138 extends to a height that is above the first low point 4134 of the first conical tuft 4130 and above the first high point 4137 of the first conical tuft 4130. However, referring briefly to FIG. 38, in another embodiment the free end 4143 of the first central cleaning element 4138 may extend to a height that is above the first low point 4134 of the first conical tuft 4130 and below the first high point 4137 of the first conical tuft 4130. Furthermore, in still other embodiments the free end 4143 of the first central cleaning element 4138 may extend to a height that is below the first low point 4134 of the first conical tuft 4130.

Furthermore, in the exemplified embodiment a second central cleaning element 4158 is located within the second central cavity 4152 of the second conical tuft 4150. The second central cleaning element 4158 may share a single tuft hole with the second conical tuft 4150 or each may have its own separate tuft hole as discussed above with regard to the first central cleaning element 4138. In the exemplified embodiment, the second central cleaning element 4158 extends perpendicularly from the front surface 4111 of the head 4110. In the exemplified embodiment, an annular gap 4159 is present between an outer surface of the second central cleaning element 4158 and the inner surface 4151 of the second conical tuft 4150. In the exemplified embodiment, the annular gap 4159 extends to below the front surface 4111 of the head 4110. Furthermore, in the exemplified embodiment the second central cleaning element 4158 converges with the second conical tuft 4150 at the melt matte 4106. Due to the conical shape of the second conical tuft 4150 and the perpendicular extension of the second central cleaning element 4158 relative to the front surface 4111 of the head 4110, the distance between the outer surface of the second central cleaning element 4158 and the inner surface 4141 of the second conical tuft 4135 increases with distance from the front surface 4111 of the head 4110.

The second central cleaning element 4158 terminates in a free end 4144. In the embodiment exemplified in FIGS. 31, 32, and 36, the free end 4144 of the second central cleaning element 4158 extends to a height that is above the second low point 4154 of the second conical tuft 4150 and above the second high point 4157 of the second conical tuft 4150. However, referring briefly to FIG. 38, in another embodiment the free end 4144 of the second central cleaning element 4158 may extend to a height that is above the second low point 4154 of the second conical tuft 4150 and below the second high point 4157 of the second conical tuft 4150. Furthermore, in still other embodiments the free end 4144 of the second central cleaning element 4158 may extend to a height that is below the second low point 4154 of the second conical tuft 4150.

The plurality of tooth cleaning elements 4115 also include a first arcuate tooth cleaning element 4180 having a first convex side surface 4181 and a first concave side surface 4182 and a second arcuate tooth cleaning element 4190 having a second convex side surface 4191 and a second concave side surface 4192. In the exemplified embodiment, each of the first and second arcuate tooth cleaning elements 4180, 4190 are formed of an elastomeric material (i.e., elastomer, thermoplastic elastomer, etc.). However, the invention is not to be so limited in all embodiments and in certain other embodiments the first and second arcuate tooth cleaning elements 4180, 4190 may be formed as tufts of bristles.

The first and second arcuate tooth cleaning elements 4180, 4190 are positioned on the head so that the first and second conical tufts 4130, 4150 are in between the first and second arcuate tooth cleaning elements 4180, 4190. Furthermore, the first and second arcuate tooth cleaning elements 4180, 4190 are oriented so that the convex side surfaces 4181, 4191 of the first and second arcuate tooth cleaning elements 4180, 4190 are facing the first and second conical tufts 4130, 4150. More specifically, the convex side surface 4181 of the first arcuate tooth cleaning element 4180 faces the first and second conical tufts 4130, 4150 and the concave side surface 4182 of the first arcuate tooth cleaning element 4180 faces the distal end 4119 of the head 4110. The convex side surface 4191 of the second arcuate tooth cleaning element 4190 faces the first and second conical tufts 4130, 4150 and the concave side surface 4192 of the second arcuate tooth cleaning element 4190 faces the proximal end 4118 of the head 4110. Thus, the first and second arcuate tooth cleaning elements 4180, 4190 are located on opposite sides of the first and second conical tufts 4130, 4150 and on opposite sides of the transverse axis Z-Z. Furthermore, the first and second arcuate tooth cleaning elements 4180, 4190 are located on the longitudinal axis 4B-4B of the head 4110.

The plurality of tooth cleaning elements 4115 also includes a first peripheral tooth cleaning element 4201 and a second peripheral tooth cleaning element 4202 located along the first lateral edge 4103 of the head 4110. Furthermore, the plurality of tooth cleaning elements 4115 includes a third peripheral cleaning element 4203 and a fourth peripheral cleaning element 4204 located along the second lateral edge 4104 of the head 4110. In the exemplified embodiment, each of the first, second, third, and fourth peripheral tooth cleaning elements 4201, 4202, 4203, 4204 are tufts of bristles, although they could be formed of elastomer in other embodiments. Furthermore, in the exemplified embodiment the first conical tuft 4130 is located between the first and second peripheral tooth cleaning elements 4201, 4202 and the second conical tuft 4150 is located between the third and fourth peripheral tooth cleaning elements 4203, 4204. In the exemplified embodiment, each of the first, second, third, and fourth peripheral tooth cleaning elements 4201, 4202, 4203, 4204 has a triangular-shaped cross-section. However, the invention is not to be so limited in all embodiments and other cross-sectional shapes can be used for the first, second, third, and fourth peripheral tooth cleaning elements 4201, 4202, 4203, 4204.

In the exemplified embodiment, each of the first, second, third, and fourth peripheral tooth cleaning elements 4201, 4202, 4203, 4204 has three edges and three corners. One of the edges of the first peripheral tooth cleaning element 4201 faces the first conical tuft 4130, one of the edges of the first peripheral tuft 4201 faces the third conical tuft 4160, and one of the edges of the first peripheral tuft 4201 faces the first lateral side edge 4103 of the head 4110. One of the edges of the second peripheral tooth cleaning element 4202 faces the first conical tuft 4130, one of the edges of the second peripheral tooth cleaning element 4202 faces the fourth conical tuft 4170, and one of the edges of the second peripheral tooth cleaning element 4202 faces the first lateral side edge 4103 of the head 4110. One of the edges of the third peripheral tooth cleaning element 4203 faces the second conical tuft 4140, one of the edges of the third peripheral tooth cleaning element 4203 faces the third conical tuft 4160, and one of the edges of the third peripheral tooth cleaning element 4203 faces the second lateral side edge 4104 of the head 4110. Finally, one of the edges of the fourth peripheral tooth cleaning element 4204 faces the second conical tuft 4150, one of the edges of the fourth peripheral tooth cleaning element 4204 faces the fourth conical tuft 4170, and one of the edges of the fourth peripheral tooth cleaning element 4204 faces the second lateral side edge 4104 of the head 4110.

Referring to FIGS. 31, 32, 34 and 35 concurrently, the third conical tuft 4160 will be further described. The third conical tuft 4160 comprises a third continuous bristle wall 4165 having an inner surface 4161 and an outer surface 4166. The inner surface 4161 of the third continuous bristle wall 4165 of the third conical tuft 4160 defines a third cavity 4162 that extends along a third cavity axis 4E-4E. In the exemplified embodiment, the third conical tuft 4160, and specifically the third continuous bristle wall 4165 thereof, extends in a 360° manner about the third cavity axis 4E-4E. Of course, the invention is not to be so limited in all embodiments and the third bristle wall 4165 may not be continuous in other embodiments. The third cavity 4162 of the third conical tuft 4160 has an open top end and is bounded by the inner surface 4161 of the third continuous bristle wall 4165 and by the front surface 4111 of the head 4110. As noted above, the third conical tuft 4160 in the exemplified embodiment is formed by a plurality of bristles. Specifically, the plurality of bristles are clumped together and positioned collectively into a single tuft hole so that the plurality of bristles collectively form the third conical tuft 4160 having no gaps in the third continuous bristle wall 4165 for its entire 360° extension about the third cavity axis 4E-4E. Thus, the third conical tuft 4160 extends from a single tuft hole. The term continuous bristle wall is intended to mean that the third conical tuft 4160 is a single tuft of bristles that are clumped together into a single tuft hole in a non-spaced apart manner.

Thus, the third conical tuft 4160 is a single tuft formed from a plurality of individual bristles that are positioned together within a single tuft hole. As a result, the third conical tuft 4160 has the third continuous bristle wall 4165 that extends without discontinuity about the third cavity axis 4E-4E. Thus, in the exemplified embodiment there are no gaps formed into the outer surface 4166 of the third conical tuft 4160. Of course, in other embodiments the third conical tuft 4160 may have small gaps therein as desired while still being a single tuft positioned within a single tuft hole. Such gaps in the bristle wall may prevent dentifrice from being trapped within the third cavity 4162 of the third conical tuft 4160 by providing means of egress from the third cavity 4162. Thus, in certain embodiments the third bristle wall 4165 may not be continuous. In one embodiment, the third conical tuft 4160 is secured to the head 4110 by anchor free tufting or AMR.

Due to the conical shape of the third conical tuft 4160, and more specifically, the inverted conical shape of the third conical tuft 4160, the third cavity 4162 of the third conical tuft 4160 has a third transverse cross-sectional area that increases with distance from the front surface 4111 of the head 4110. Specifically, the third transverse cross-sectional area of the third cavity 4162 of the third conical tuft 4160 only increases and never decreases with distance from the front surface 4111 of the head 4110. Thus, the greater the distance between a particular axial location within the third cavity 4162 of the third conical tuft 4160 and the front surface 4111 of the head 4110, the greater the transverse cross-sectional area of the third cavity 4162 at that particular axial location. Stated another way, the diameter of the third cavity 4162 increases with distance from the front surface 4111 of the head 4110 so that the diameter of the third cavity 4162 is greater at the terminal ends of the bristles of the third conical tuft 4160 than at the front surface 4111 of the head 4110.

The third continuous bristle wall 4165 of the third conical tuft 4160 terminates in a third annular top surface 4153. In the exemplified embodiment, the third annular top surface 4163 is flat and parallel to the front surface 4111 of the head 4110. Thus, in the exemplified embodiment the third conical tuft 4160 has a constant height. However, in other embodiments the third annular top surface 4163 may be inclined relative to the front surface 4111 of the head 4110 in the same manner as discussed above with regard to the first and second conical tufts 4130, 4150. Furthermore, in the exemplified embodiment the outer surface 4166 of the third conical tuft 4160 is oriented at an angle 4θ3 relative to the front surface 4111 of the head 4110. The angle 4θ3 can be any of the angles described above with regard to the first and second angles 4θ1, 4θ2. All other description above with regard to the first and second conical tufts 4130, 4150 that is not contradictory to the description above regarding the third conical tuft 4160 may be applicable to the third conical tuft 4160 in some embodiments.

In the exemplified embodiment, a third central cleaning element 4168 is located within the third central cavity 4162 of the third conical tuft 4160. In the exemplified embodiment, the third central cleaning element 4168 extends perpendicularly from the front surface 4111 of the head 4110. In the exemplified embodiment, an annular gap 4169 is present between an outer surface of the third central cleaning element 4168 and the inner surface 4161 of the third conical tuft 4160. In the exemplified embodiment, the annular gap 4169 extends to below the front surface 4111 of the head 4110. Furthermore, in the exemplified embodiment the third central cleaning element 4168 converges with the third conical tuft 4160 at the melt matte 4106. Due to the conical shape of the third conical tuft 4160, the distance between the outer surface of the third central cleaning element 4168 and the inner surface 4161 of the third conical tuft 4160 increases with distance from the front surface 4111 of the head 4110. The third central cleaning element 4168 terminates in a free end 4145. In the exemplified embodiment, the free end 4145 of the third central cleaning element 4168 extends to a height that is above the third annular top surface 4163 of the third conical tuft 4160. However, the invention is not to be so limited in all embodiments and in some embodiments the free end 4145 of the third central cleaning element 4168 may extend to a height that is below the third annular top surface 4163 of the third conical tuft 4160.

Referring to FIGS. 31, 32, 34 and 37 concurrently, the fourth conical tuft 4170 will be further described. The fourth conical tuft 4170 comprises a fourth continuous bristle wall 4175 having an inner surface 4171 and an outer surface 4176. The inner surface 4171 of the fourth continuous bristle wall 4175 of the fourth conical tuft 4170 defines a fourth cavity 4172 that extends along a fourth cavity axis 4F-4F. In the exemplified embodiment, the fourth conical tuft 4170, and specifically the fourth continuous bristle wall 4175 thereof, extends in a 360° manner about the fourth cavity axis 4F-4F. The fourth cavity 4172 of the fourth conical tuft 4170 has an open top end and is bounded by the inner surface 4171 of the fourth continuous bristle wall 4175 and by the front surface 4111 of the head 4110. As noted above, the fourth conical tuft 4170 in the exemplified embodiment is formed by a plurality of bristles. Specifically, the plurality of bristles are clumped together and positioned collectively into a single tuft hole so that the plurality of bristles collectively form the third conical tuft 4170 having no gaps in the third continuous bristle wall 4175 for its entire 360° extension about the fourth cavity axis 4F-4F. Thus, the fourth conical tuft 4170 extends from a single tuft hole. The term continuous bristle wall is intended to mean that the fourth conical tuft 4170 is a single tuft of bristles that are clumped together into a single tuft hole in a non-spaced apart manner.

Thus, the fourth conical tuft 4170 is a single tuft formed from a plurality of individual bristles that are positioned together within a single tuft hole. As a result, the fourth conical tuft 4170 has the fourth continuous bristle wall 4175 that extends without discontinuity about the fourth cavity axis 4F-4F. Thus, in the exemplified embodiment there are no gaps formed into the outer surface 4176 of the fourth conical tuft 4170. Of course, in other embodiments the fourth conical tuft 4170 may have small gaps therein as desired while still being a single tuft positioned within a single tuft hole. In such embodiments, the fourth bristle wall 4175 may not be continuous. Such gaps in the bristle wall may prevent dentifrice from being trapped within the fourth cavity 4172 of the fourth conical tuft 4170 by providing means of egress from the fourth cavity 4172. In one embodiment, the fourth conical tuft 4170 is secured to the head 4110 by anchor free tufting or AMR.

Due to the conical shape of the fourth conical tuft 4170, and more specifically, the inverted conical shape of the fourth conical tuft 4170, the fourth cavity 4172 of the fourth conical tuft 4170 has a fourth transverse cross-sectional area that increases with distance from the front surface 4111 of the head 4110. Specifically, the fourth transverse cross-sectional area of the fourth cavity 4172 of the fourth conical tuft 4170 only increases and never decreases with distance from the front surface 4111 of the head 4110. Thus, the greater the distance between a particular axial location within the fourth cavity 4172 of the fourth conical tuft 4170 and the front surface 4111 of the head 4110, the greater the transverse cross-sectional area of the fourth cavity 4172 at that particular axial location. Stated another way, the diameter of the fourth cavity 4172 increases with distance from the front surface 4111 of the head 4110 so that the diameter of the fourth cavity 4172 is greater at the terminal ends of the bristles of the fourth conical tuft 4170 than at the front surface 4111 of the head 4110.

The fourth continuous bristle wall 4175 of the fourth conical tuft 4170 terminates in a fourth annular top surface 4173. In the exemplified embodiment, the fourth annular top surface 4173 is flat and parallel to the front surface 4111 of the head 4110. Thus, in the exemplified embodiment the fourth conical tuft 4170 has a constant height. However, in other embodiments the fourth annular top surface 4173 may be inclined relative to the front surface 4111 of the head 4110 in the same manner as discussed above with regard to the first and second conical tufts 4130, 4150. Furthermore, the outer surface 4176 of the fourth conical tuft 4170 is oriented at an angle 4θ4 relative to the front surface 4111 of the head 4110. The angle 4θ4 can be any of the angles described above with regard to the first and second angles 4θ1, 4θ2. All other description above with regard to the first and second conical tufts 4130, 4150 that is not contradictory to the description above regarding the fourth conical tuft 4170 may be applicable to the fourth conical tuft 4170 in some embodiments.

In the exemplified embodiment, a fourth central cleaning element 4178 is located within the fourth central cavity 4172 of the fourth conical tuft 4170. In the exemplified embodiment, the fourth central cleaning element 4178 extends perpendicularly from the front surface 4111 of the head 4110. In the exemplified embodiment, an annular gap 4179 is present between an outer surface of the fourth central cleaning element 4178 and the inner surface 4171 of the fourth conical tuft 4170. In the exemplified embodiment, the annular gap 4179 extends to below the front surface 4111 of the head 4110. Furthermore, in the exemplified embodiment the fourth central cleaning element 4179 converges with the fourth conical tuft 4170 at the melt matte 4106. Due to the conical shape of the fourth conical tuft 4170, the distance between the outer surface of the fourth central cleaning element 4178 and the inner surface 4171 of the fourth conical tuft 4170 increases with distance from the front surface 4111 of the head 4110. The fourth central cleaning element 4178 terminates in a free end 4146. In the exemplified embodiment, the free end 4146 of the fourth central cleaning element 4178 extends to a height that is above the fourth annular top surface 4173 of the fourth conical tuft 4170. However, the invention is not to be so limited in all embodiments and in some embodiments the free end 4146 of the fourth central cleaning element 4178 may extend to a height that is below the fourth annular top surface 4173 of the fourth conical tuft 4170.

In the exemplified embodiment, each of the third and fourth conical tufts 4160, 4170 is located on the longitudinal axis 4B-4B of the head 4110. More specifically, the third and fourth conical tufts 4160, 4170 are transversely aligned on the longitudinal axis 4B-4B of the head 4110. Furthermore, in the exemplified embodiment the third conical tuft 4160 is located between the first and second conical tufts 4130, 4150 and the distal end 4119 of the head and the fourth conical tuft 4170 is located between the first and second conical tufts 4130, 4150 and the proximal end 4118 of the head 4110. Furthermore, the first arcuate tooth cleaning element 4180 is positioned between the first and second conical tufts 4130, 4150 and the third conical tuft 4160 such that the concave side surface 4182 of the first arcuate tooth cleaning element 4180 faces the third conical tuft 4160 and the convex side surface 4181 of the first arcuate tooth cleaning element 4180 faces the first and second conical tufts 4130, 4150. Similarly, the second arcuate tooth cleaning element 4190 is positioned between the first and second conical tufts 4130, 4150 and the fourth conical tuft 4170 such that the concave side surface 4192 of the second arcuate tooth cleaning element 4190 faces the fourth conical tuft 4170 and the convex side surface 4191 of the second arcuate tooth cleaning element 4190 faces the first and second conical tufts 4130, 4150. Furthermore, the first and second conical tufts 4130, 4150 are located between the third and fourth conical tufts 4160, 4170 such that the conical tufts 4130, 4150, 4160, 4170 collectively form a cruciform arrangement (if a line was drawn to connect the first and second conical tufts 4130, 4150 and a separate line was drawn to connect the third and fourth conical tufts 4160, 4170, the result would be a cruciform shape).

In one embodiment, the first bristle wall 4135 has a first thickness measured from the inner surface 4131 of the first conical tuft 4130 to the outer surface 4136 of the first conical tuft 4130. The second bristle wall 4145 has a second thickness measured from the inner surface 4141 of the second conical tuft 4140 to the outer surface 4146 of the second conical tuft 4140. The third bristle wall 4155 has a third thickness measured from the inner surface 4151 of the third conical tuft 4150 to the outer surface 4156 of the third conical tuft 4150. The fourth bristle wall 4165 has a fourth thickness measured from the inner surface 4161 of the fourth conical tuft 4160 to the outer surface 4166 of the fourth conical tuft 4160. In one embodiment, the first and second thickness are substantially the same and the third and fourth thicknesses are substantially the same. Furthermore, in some embodiments the first and second thicknesses are greater than the third and fourth thicknesses, which renders the first and second conical tufts 4130, 4140 more rigid than the third and fourth conical tufts 4150, 4160. Furthermore, in some embodiments the first and second conical tufts 4130, 4140 may have an outer diameter that is substantially the same and the third and fourth conical tufts 4150, 4160 may have an outer diameter that is substantially the same, the outer diameter of the first and second conical tufts 4130, 4140 being greater than the outer diameter of the third and fourth conical tufts 4150, 4160.

In addition to the above, the plurality of tooth cleaning elements 4115 also include a first set of distal tooth cleaning elements 4220 arranged about a first loop 4221 that surrounds the third conical tuft 4160. The first set of distal tooth cleaning elements 4220 comprises a grouping of tooth cleaning elements of various shapes and/or sizes that surround the third conical tuft 4160. Specifically, the first set of distal tooth cleaning elements 4220 comprises two arcuate tufts **4222*a*, 4222*b* at the distal-most portion of the head 4110 that form the distal-most tooth cleaning elements on the head 4110 and five rectangular (or otherwise four-sided) shaped tufts arranged in the loop 4221 and extending from one of the two arcuate tufts 4222*a*, 4222*b* to the other of the two arcuate tufts 4222*a*, 4222*b*. In the exemplified embodiment, there are two arcuate tufts 4222*a*, 4222*b* that are spaced apart by a gap that is located on the longitudinal axis 4B-4B, and thus the two arcuate tufts 4222*a*, 4222*b* are located on opposite sides of the longitudinal axis 4B-4B. In other embodiments, the two arcuate tufts 4222*a*, 4222*b* can be combined into a single arcuate tuft at the distal end 4119 of the head 4110 that traverses over the longitudinal axis 4B-4B**.

The arcuate tufts **4222*a*, 4222*b* at the distal-most portion of the head 4110 have larger cross-sectional areas than any of the other tufts in the loop 4221. More specifically, the arcuate tufts 4222*a*, 4222*b* at the distal-most portion of the head 4110 have the largest cross-sectional area of the tufts in the loop 4221, the two tufts 4223***a*, 4223*b* that are immediately adjacent to each of the arcuate tufts 4222*a*, 4222*b* at the distal-most portion of the head 4110 have the second largest cross-sectional area of the tufts in the loop 4221, and the three tufts 4224*a*, 4224*b*, 4224*c* positioned adjacent to the first arcuate tooth cleaning element 4180 have the smallest cross-sectional area.

Thus, the two arcuate tufts 4222*a*, 4222*b* located between the third conical tuft 4160 and the distal end 4119 of the head 4110 have a first transverse cross-sectional area, the two tufts 4223*a*, 4223*b* located between the third conical tuft 4160 and the first and second lateral side edges 4103, 4104 of the head 4110 have a second transverse cross-sectional area, and the three tufts 4224*a*, 4224*b*, 4224*c* located between the third conical tuft 4160 and the first arcuate tooth cleaning element 4180 have a third transverse cross-sectional area. Furthermore, the first transverse cross-sectional area is greater than the second transverse cross-sectional area and the second transverse cross-sectional area is greater than the third transverse cross-sectional area.

Each of the tufts in the loop 4221 is a separate and distinct tuft that is positioned within a separate tuft hole in the head 4110. Thus, the tufts are spaced apart along the loop 4221. Although the first set of distal tooth cleaning elements 4220 are described as forming a loop that surrounds the third conical tuft 4160, it should be appreciated that the loop has gaps therein in between each adjacent tuft of the first set of distal tooth cleaning elements 4220.

The plurality of tooth cleaning elements 4115 also include a second set of proximal tooth cleaning elements 4230 arranged about a second loop 4231 that surrounds the fourth conical tuft 4170. The second set of proximal tooth cleaning elements 4230 comprises a grouping of tooth cleaning elements of various shapes and/or sizes that surround the fourth conical tuft 4170. Specifically, the second set of proximal tooth cleaning elements 4230 comprises two arcuate tufts 4232*a*, 4232*b* at the proximal-most portion of the head 4110 that form the proximal-most tooth cleaning elements on the head 4110 and five rectangular (or otherwise four-sided) shaped tufts arranged in the loop 4231 and extending from one of the two arcuate tufts 4232*a*, 4232*b* to the other of the two arcuate tufts 4232*a*, 4232*b*. In the exemplified embodiment, there are two arcuate tufts 2.2*a*, 4232*b* that are spaced apart by a gap that is located on the longitudinal axis 4B-4B, and thus the two arcuate tufts 4232*a*, 4232*b* are located on opposite sides of the longitudinal axis 4B-4B. In other embodiments, the two arcuate tufts 4232*a*, 4232*b* can be combined into a single arcuate tuft at the distal end 4119 of the head 4110 that traverses over the longitudinal axis 4B-4B.

The arcuate tufts 4232*a*, 4232*b* at the proximal-most portion of the head 4110 have larger cross-sectional areas than any of the other tufts in the loop 4231. More specifically, the arcuate tufts 4232*a*, 4232*b* at the proximal-most portion of the head 4110 have the largest cross-sectional area of the tufts in the loop 4231, the two tufts 4233*a*, 4233*b* that are immediately adjacent to each of the arcuate tufts 4232*a*, 4232*b* at the proximal-most portion of the head 4110 have the second largest cross-sectional area of the tufts in the loop 4231, and the three tufts 4234*a*, 4234*b*, 4234*c* positioned adjacent to the second arcuate tooth cleaning element 4190 have the smallest cross-sectional area.

Thus, the two arcuate tufts 4232*a*, 4232*b* located between the fourth conical tuft 4170 and the proximal end 4118 of the head 4110 have a first transverse cross-sectional area, the two tufts 4233*a*, 4233*b* located between the fourth conical tuft 4170 and the first and second lateral side edges 4103, 4104 of the head 4110 have a second transverse cross-sectional area, and the three tufts 4234*a*, 4234*b*, 4234*c* located between the fourth conical tuft 4170 and the second arcuate tooth cleaning element 4190 have a third transverse cross-sectional area. Furthermore, the first transverse cross-sectional area is greater than the second transverse cross-sectional area and the second transverse cross-sectional area is greater than the third transverse cross-sectional area.

Each of the tufts in the loop 4231 is a separate and distinct tuft that is positioned within a separate tuft hole in the head 4110. Thus, the tufts are spaced apart along the loop 4231. Although the second set of proximal tooth cleaning elements 4230 are described as forming a loop that surrounds the fourth conical tuft 4170, it should be appreciated that the loop has gaps therein in between each adjacent tuft of the second set of proximal tooth cleaning elements 4230.

Concept Five

Figure 39:
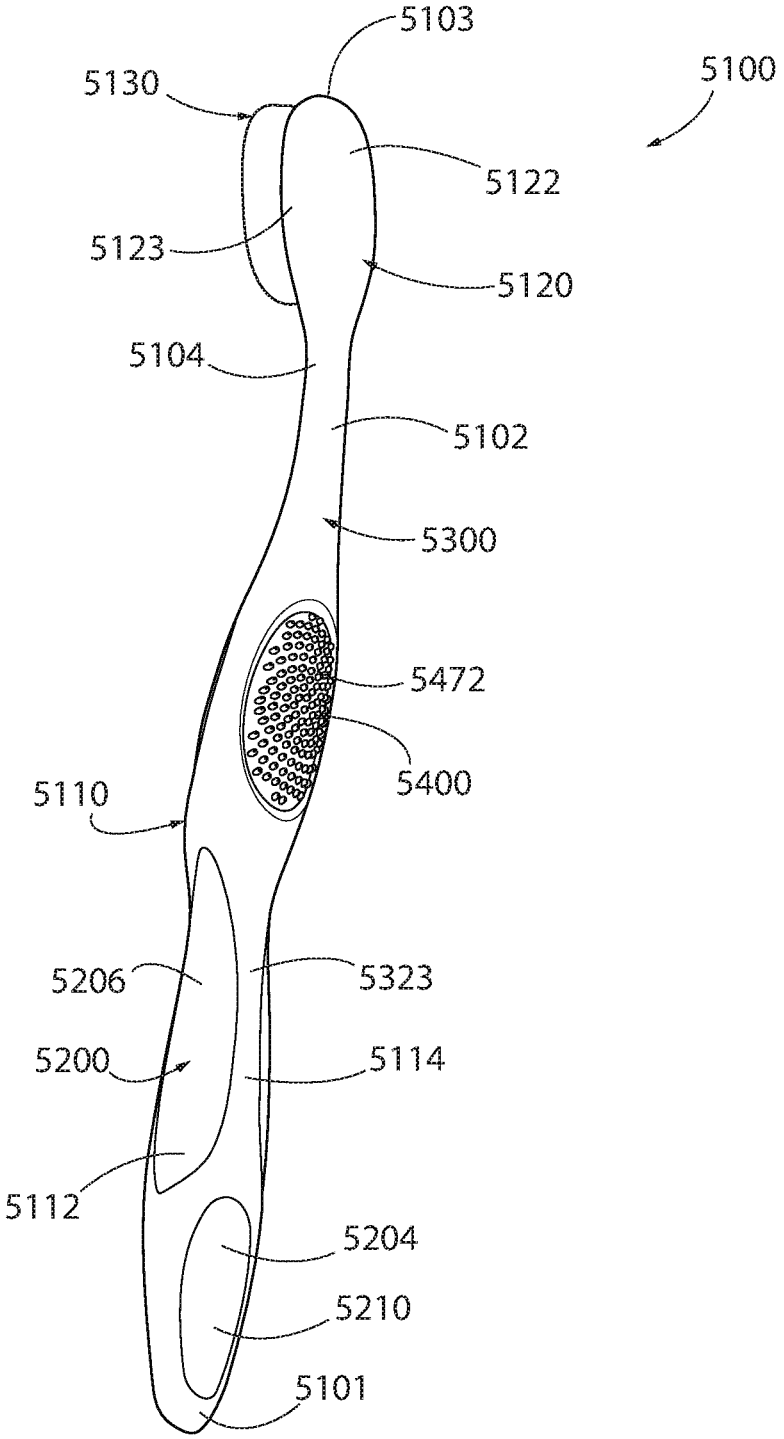
FIG. 39 is a rear perspective view of an oral care implement according to an embodiment of the present invention.
Figure 40:
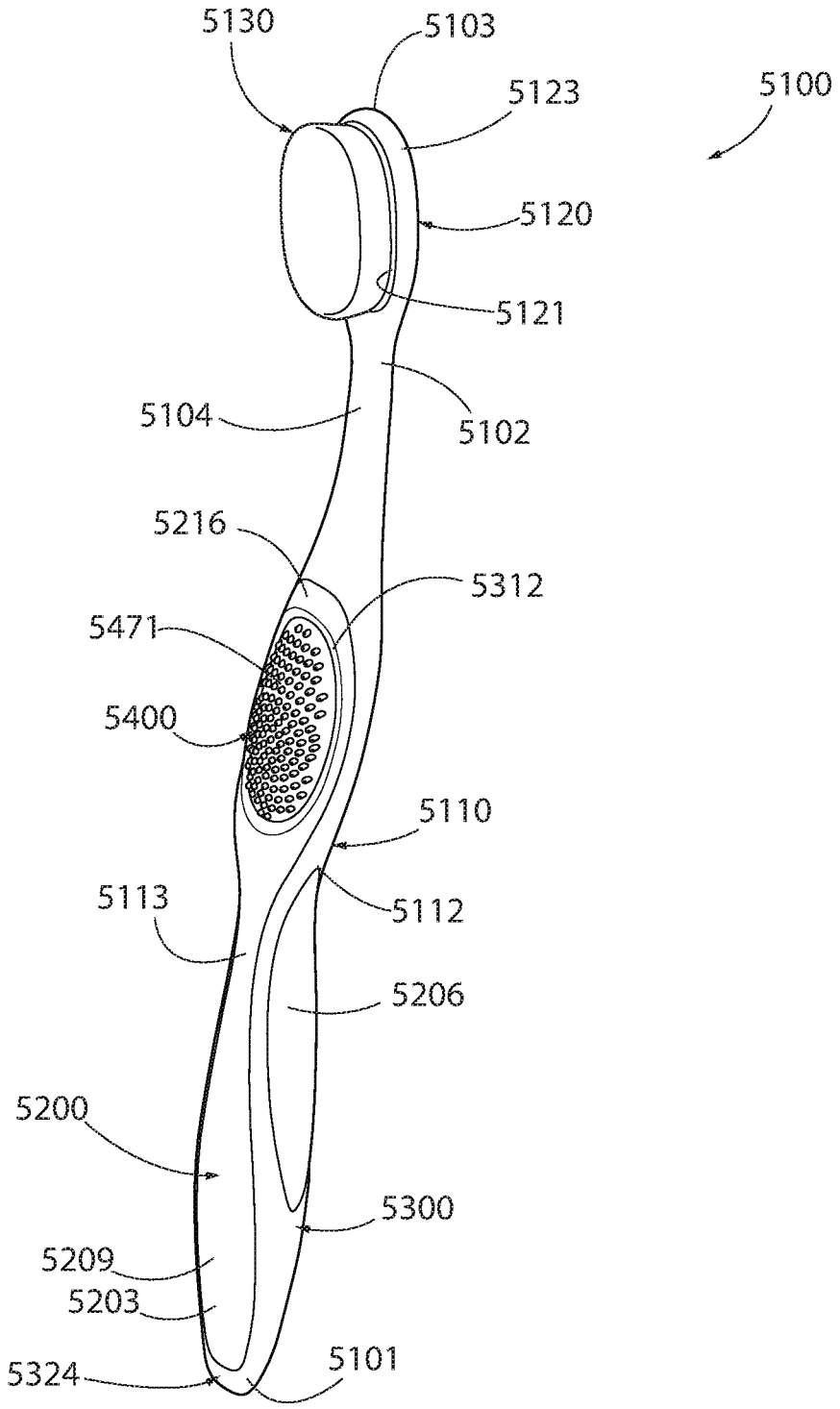
FIG. 40 is a front perspective view of the oral care implement of FIG. 39.
Figure 41:
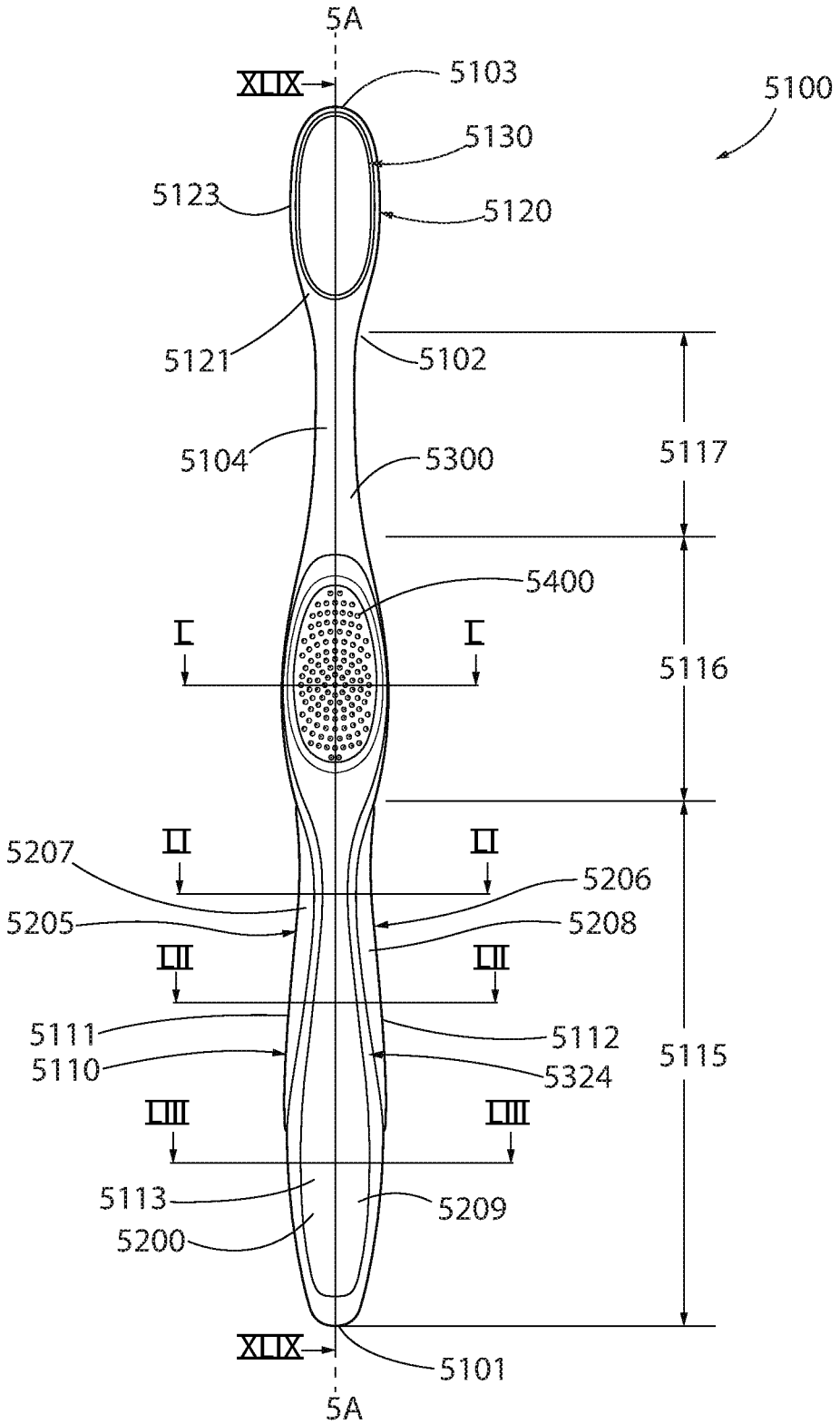
FIG. 41 is a front view of the oral care implement of FIG. 39.
Figure 42:
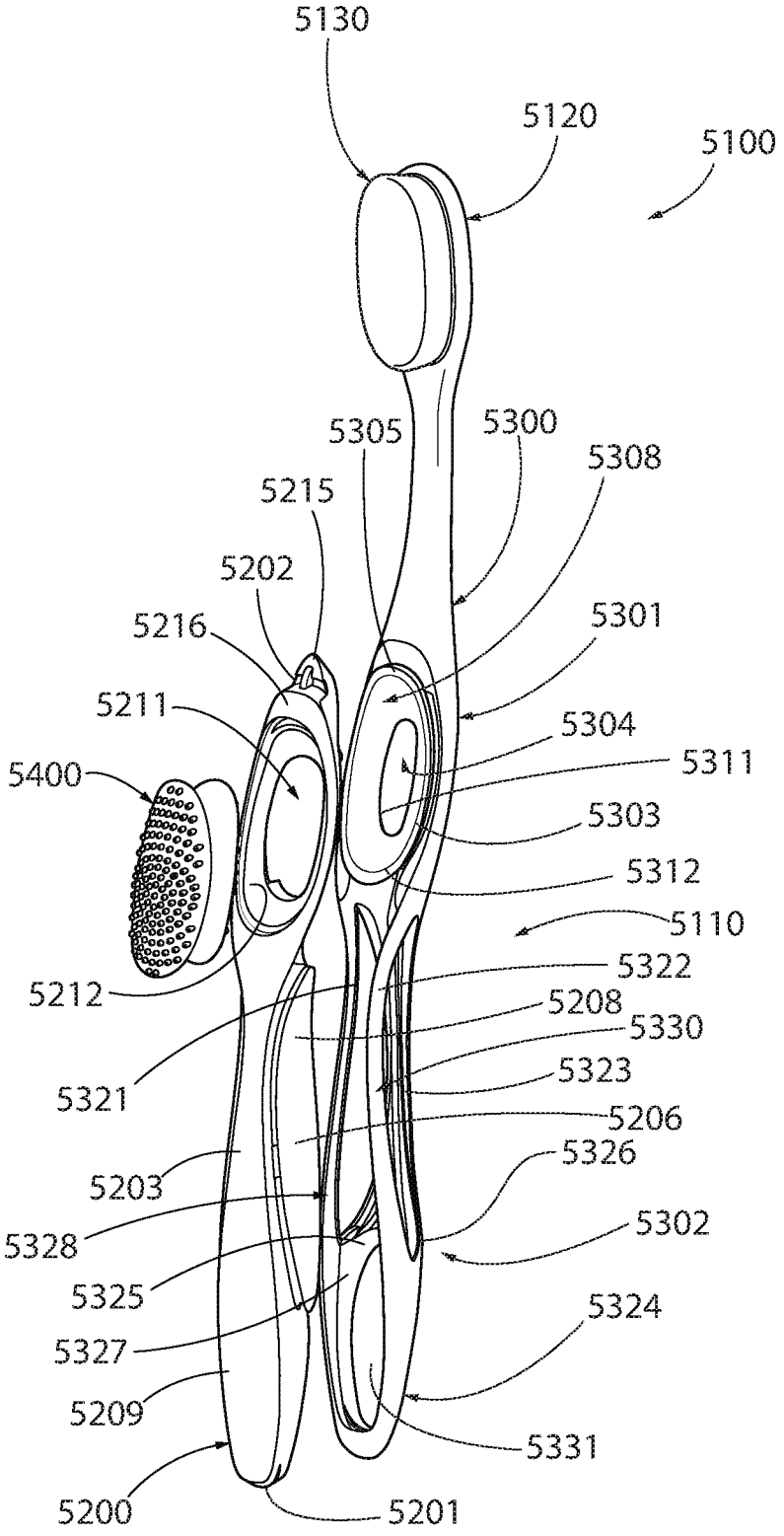
FIG. 42 is a front perspective of the oral care implement of FIG. 39 with the handle in an exploded state.
Figure 43:
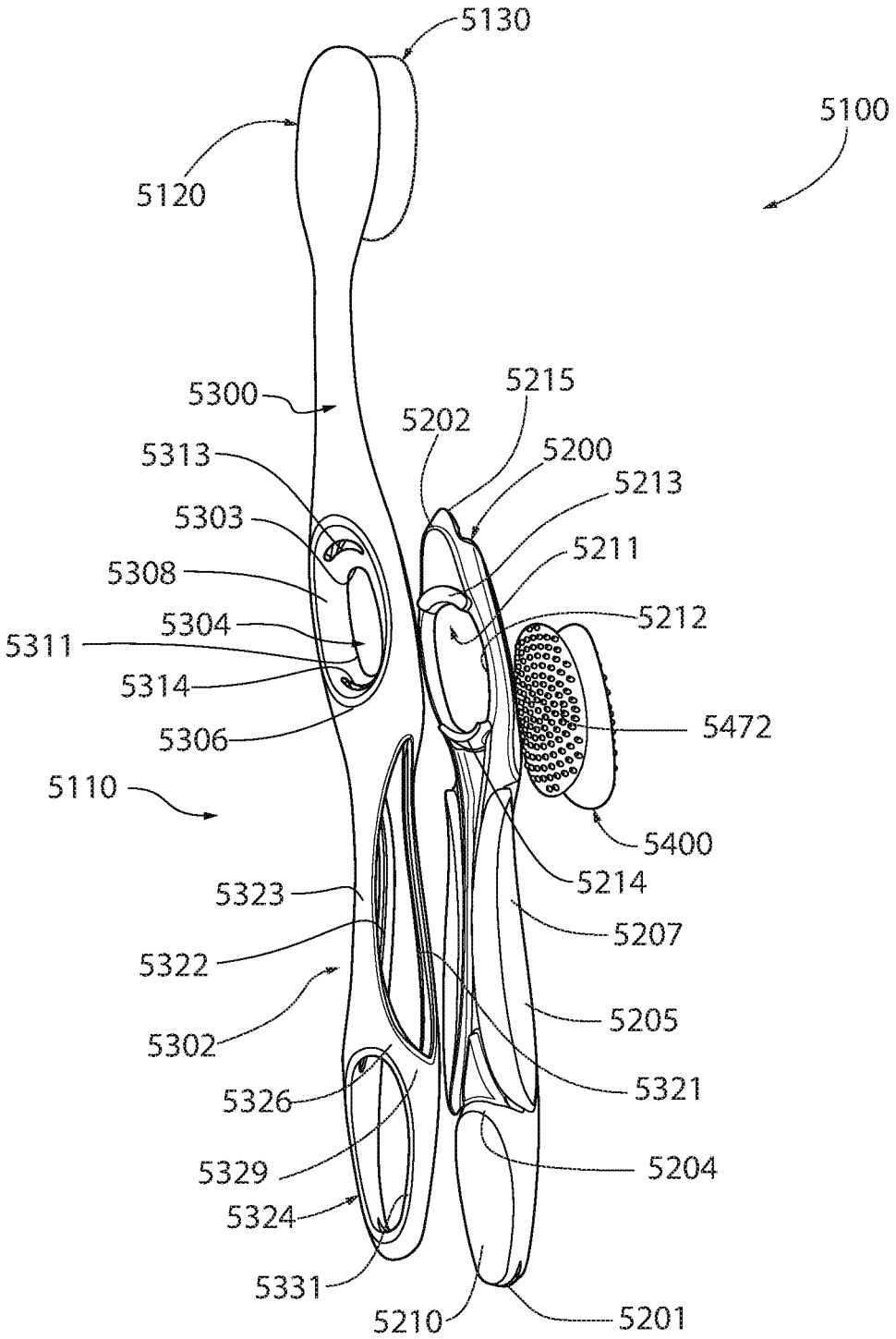
FIG. 43 is a rear perspective of the oral care implement of FIG. 39 with the handle in an exploded state.
Figure 44:
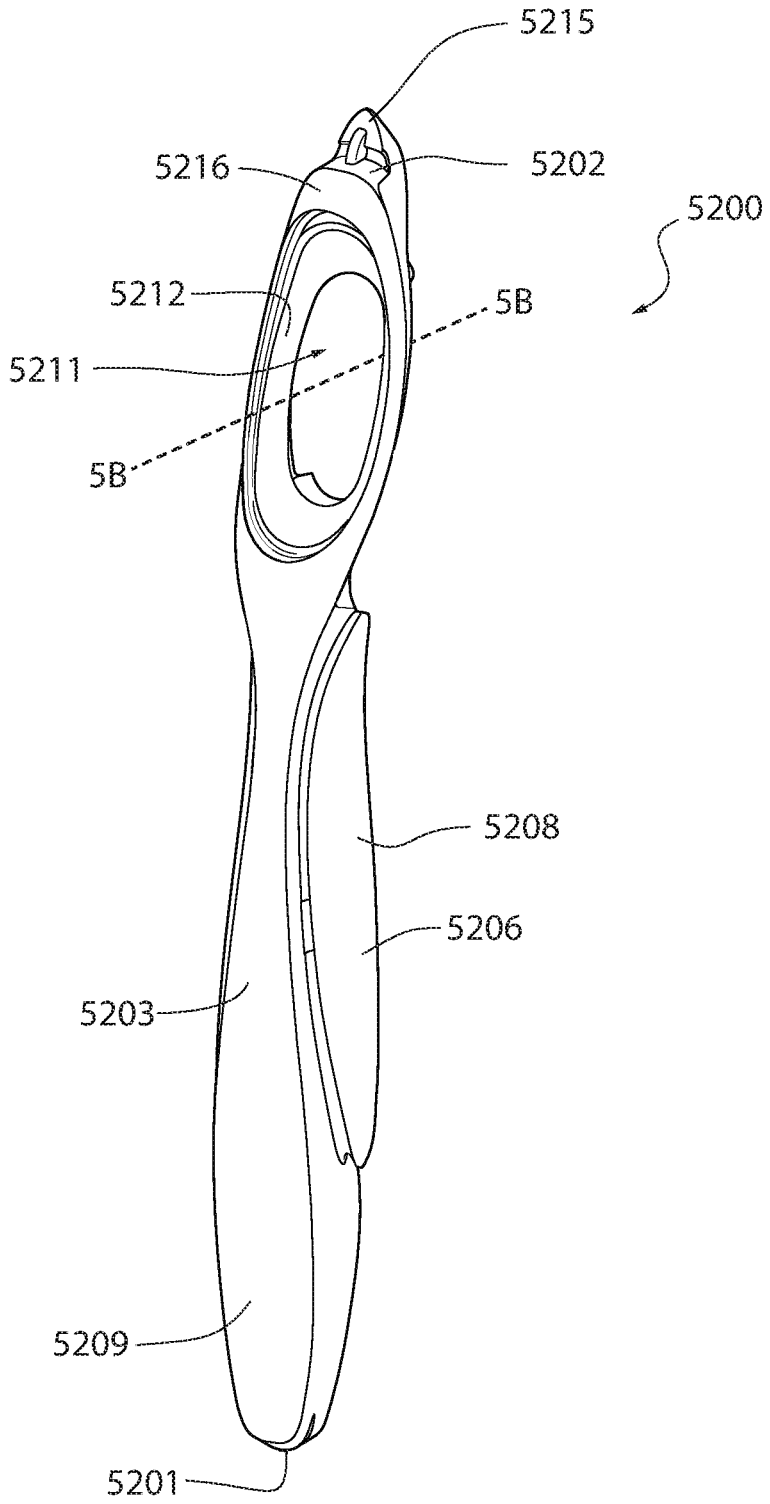
FIG. 44 is a front perspective view of a first component of the handle of the oral care implement of FIG. 39.

Referring first to FIGS. 39-41 concurrently, a toothbrush 5100 is illustrated according to one embodiment of the present invention. The toothbrush 5100 generally comprises a handle 5110 and a head 5120. The handle 5110 provides the user with a mechanism by which he/she can readily grip and manipulate the toothbrush 5100. The handle 5110 includes ergonomic features which provide a high degree of control for the user while maintaining comfort. The head 5120 is connected to a distal end 5102 of the handle 5110 and includes a set of teeth cleaning elements 5130, which are generically illustrated.

Generally, the toothbrush 5100 extends from a proximal end 5101 (which is also the proximal end of the handle 5110) to a distal end 5103 along a longitudinal axis 5A-5A (illustrated in FIG. 41). Conceptually, the longitudinal axis 5A-5A is a reference line that is generally coextensive with the three-dimensional center line of the handle 5110 (and the body of the head 5120). Because the handle 5110 is a non-linear structure (as can be seen in FIGS. 39 and 40) in the illustrated embodiment, the longitudinal axis 5A-5A for the handle 5110 (and the toothbrush 5100) is also non-linear in the illustrated embodiment. However, the invention is not so limited, and in certain embodiments, the toothbrush may have a simple linear arrangement and thus a substantially linear longitudinal axis 5A-5A. As best visible in FIG. 50-53, the handle 5110 has a generally elliptical transverse cross-sectional shape along its longitudinal length. Other transverse cross-sectional shapes can be used in other embodiments.

The head 5120 is connected to the distal end 5102 of the handle 5110. As discussed in greater detail below, the head 5120 and at least a portion of the handle 5110 of the toothbrush 5100 are preferably formed as a single-component integral structure using an injection molding process, which in the exemplified embodiment is the second component 5300. More specifically, in the exemplified embodiment, the head 5120 is integrally formed as part of the second component 5300 of the handle 5110. The second component 5300 also comprises the neck 5104 of the toothbrush 5100. As exemplified, the neck is a portion of the handle 5110 of the toothbrush 5100 that is narrowed relative to the head 5120 and the gripping portion of the handle 5110.

In other embodiments, the handle 5110 and the head 5120 may be formed as separate components which are operably connected at a later stage of the manufacturing process by any suitable technique known in the art, including without limitation thermal welding, sonic welding, a tight-fit assembly, a coupling sleeve, adhesion, or fasteners. Whether the head 5120 is integrally formed as part of the second component 5300 of the handle 5110 or is a multi-piece assembly (including connection techniques) is not limiting of the present invention in all embodiments. Furthermore, in other embodiments, other manufacturing techniques may be used in place of and/or in addition to injection molding to create the handle 5110 and/or the head 5120 (or components thereof), such as milling and/or machining.

The head 5120 generally comprises a front surface 5121 and a rear surface 5122. The front surface 5121 and the rear surface 5122 of the head 5120 can take on a wide variety of shapes and contours, none of which are limiting of the present invention unless specifically recited in the claims. For example, the front and rear surfaces 5121, 5122 can be planar, contoured or combinations thereof. The front surface 5121 and rear surface 5122 are bound by a peripheral surface 5123.

The set of tooth cleaning elements 5130, which are generically illustrated as a block, are provided on and extend outward from the front surface 5121 of the head 5120 for cleaning contact with an oral surface, preferably teeth. While the set of tooth cleaning elements 5130 is particularly suited for brushing teeth, the set of tooth cleaning elements 5130 can also be used to clean oral soft tissue, such as a tongue, gums, or cheeks instead of or in addition to teeth. Common examples of "tooth cleaning elements" include, without limitation, filament bristles, fiber bristles, nylon bristles, spiral bristles, core-sheath bristles, rubber bristles, elastomeric protrusions, flexible polymer protrusions, co-extruded filaments, flag bristles, crimped bristles, anti-bacterial bristles and combinations thereof and/or structures containing such materials or combinations.

Figure 47:
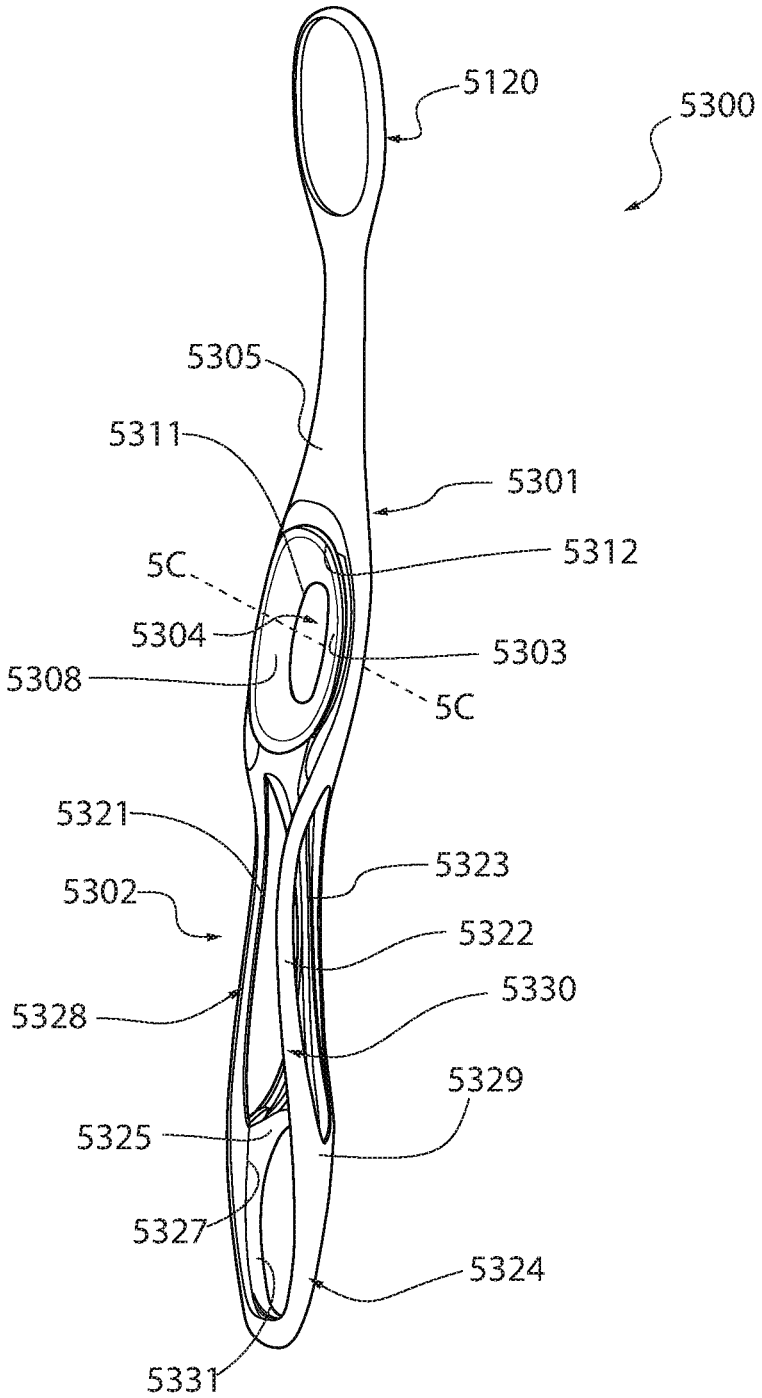
FIG. 47 is a front perspective view of a second component of the handle of the oral care implement of FIG. 39.
Figure 48:
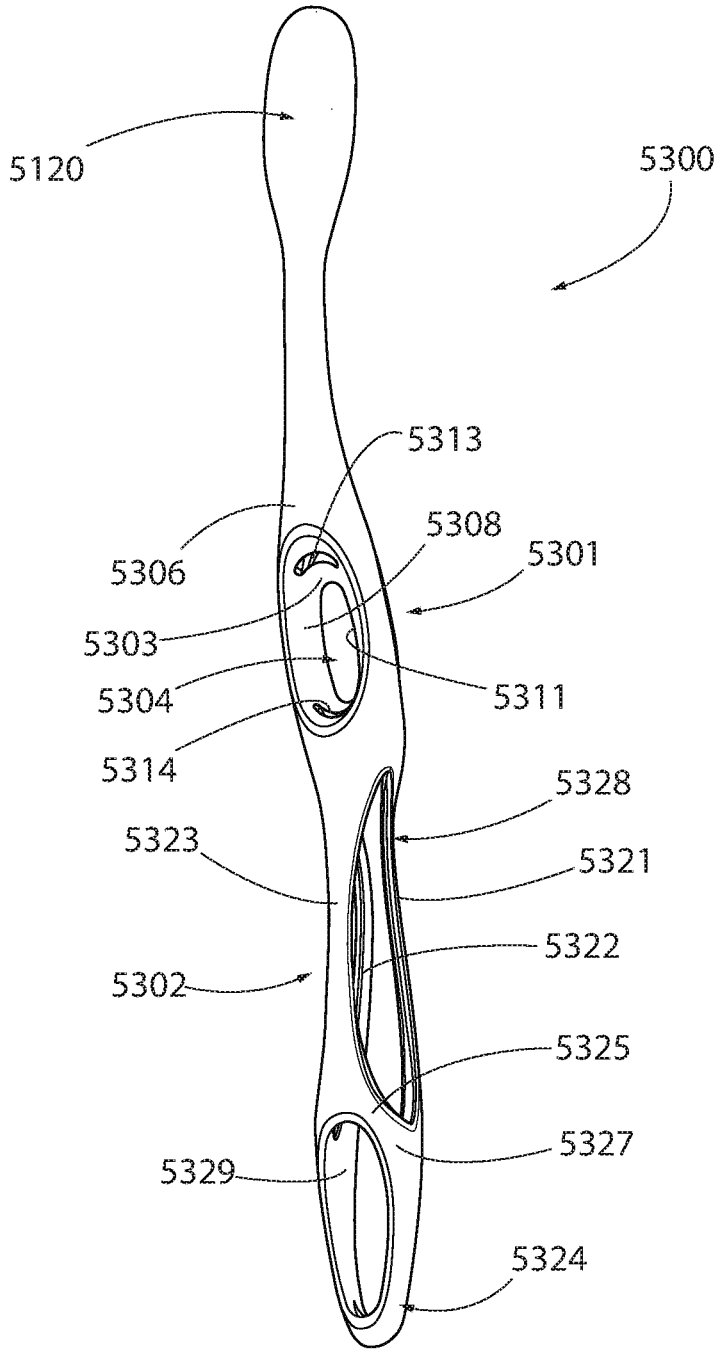
FIG. 48 is a rear perspective view of the second component of FIG. 47.

The set of tooth cleaning elements 5130 can be connected to the head 5120 in any manner known in the art. In the exemplified embodiment (see FIGS. 47-49), anchor free tufting (AFT) is used to mount the cleaning elements. In this embodiment, the body of the head 5120 comprises a depression (or basin) 5125 for receiving a cleaning element assembly that comprises a carrier plate to which the tooth cleaning elements 5130 are connected prior to being coupled to the body of the head 5120. The carrier plate is then positioned within the depression 5125 and secured to the body of the head 5120, such as by ultrasonic welding, thermal fusion, mechanical fit or adhesion. The bristles (or other elastomeric elements) of the set of tooth cleaning elements 5130 extend through the carrier. The free ends of the set of tooth cleaning elements 5130 on one side of the carrier plate perform the cleaning function. The ends of the set of tooth cleaning elements 5130 on the other side of the carrier plate are melted together by heat, thereby retaining the set of tooth cleaning elements 5130 in place.

In other embodiments, the set of tooth cleaning elements 5130 can be mounted to tuft blocks or sections by extending through suitable openings in the tuft blocks so that the base of the bristles is mounted within or below the tuft block. In still another embodiment, tuft holes may be formed in the body of the head and staples, or other anchors, can be sued to secure the bristles tufts therein.

While not in the exemplified embodiment, the rear surface 5122 of the head 5120 may also comprise additional structures for oral cleaning, such as a soft tissue cleanser, in other embodiments. Such soft tissue cleansers are typically constructed of a TPE and include one or more projections, such as nubs and/or ridges, for engaging and massaging soft oral tissue, such as the tongue.

As shown in FIG. 41, the handle 5110 can be conceptually delineated in longitudinal sections comprising a proximal section 5115, a middle section 5116 and a neck section 5117. The proximal section 5115 is the portion or segment of the handle 5110 that generally fits comfortably within the palm of the user. The middle section 5116 forms the portion or segment of the handle 5110 that generally fits comfortably between the user's thumb and index finger. The neck portion 5117 forms the portion or segment of the handle 5110 that connects to the head 5120.

The proximal section 5115 longitudinally extends from the proximal end 5101 of the toothbrush 5100 to the middle section 5116. The middle section 5116 longitudinally extends from the proximal section 5115 to the neck section 5117. The neck section 5117 extends from the middle section 5116 to the head 5120. While the head 5120 is illustrated as being widened relative to the neck section 5117 of the handle 5110, the head 5120 could in some constructions simply be a continuous extension or narrowing of the neck section 5117 of the handle 5110.

As discussed in greater detail below, the first component 5200 is located within (and forms a part of) both the proximal section 5115 and the middle section 5116. The second component 5300 is located within (and forms part of) each of the proximal section 5115, the middle section 5116 and the neck section 5117. Moreover, in the exemplified embodiment, the first and third components 5200, 5400 are not located within the neck section 5117. The third component 5400 is located (and forms part of) the middle section 5116. As exemplified, the third component is only located (and forms part of) in the middle section 5116.

Figure 45:
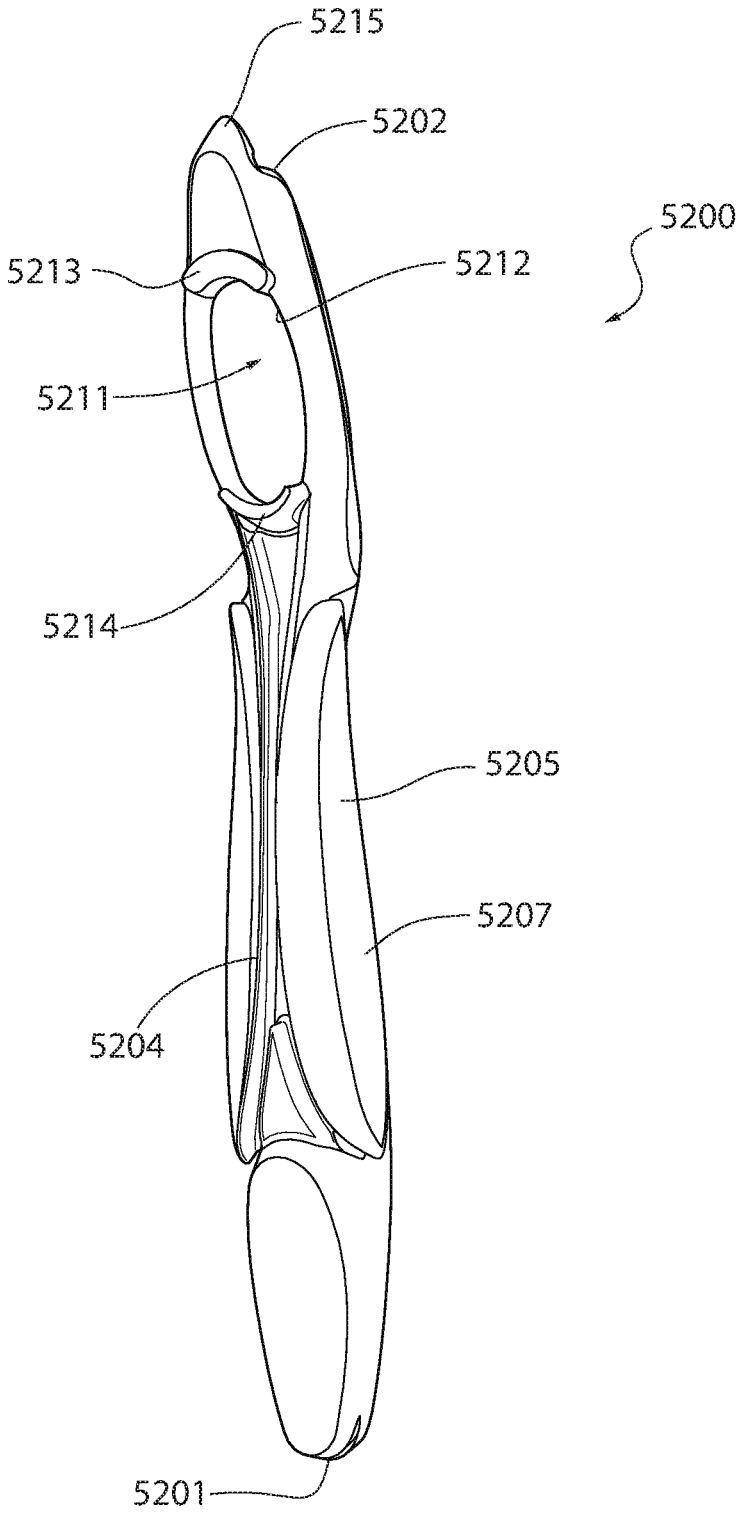
FIG. 45 is a rear perspective view of the first component of FIG. 44.
Figure 46:
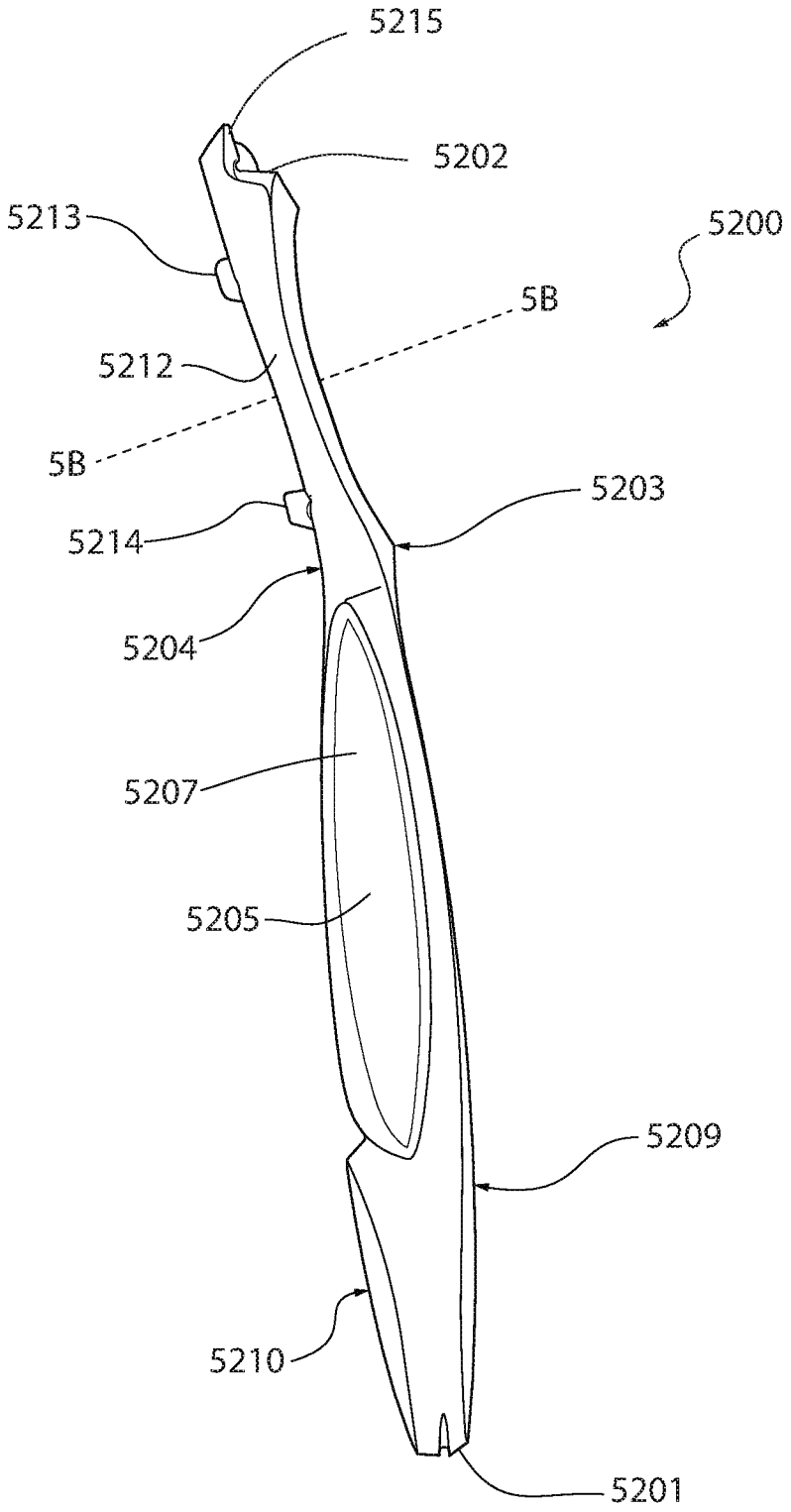
FIG. 46 is a left-side view of the first component of FIG. 44, wherein the right-side view is a mirror image.

Referring now to FIGS. 45-46 concurrently, the handle 5110 is illustrated in an exploded state so that its three components are visible. The three components of the handle 5110 include a first component 5200, a second component 5300 and a third component 5400. In certain embodiments, the first component 5200 can be considered a core structure, the second component can be considered an elongated handle body, and the third component can be considered a grip body. While three components 5200, 5300, 5400 are exemplified as forming the multi-component handle 5110 of the toothbrush 5100 in the illustrated embodiment, in other embodiments of the multi-component handle 5110 of the toothbrush 5100, the third component 5400 may be omitted if desired. In one such embodiment, the second component 5300 can be modified to assume the volume of the omitted third component 5400. In still another such embodiment, the first component 5200 can be modified to assume the volume of the omitted third component 5400. In still other embodiments, the multi-component handle 5110 of the toothbrush 5100 may further comprise an additional component (in addition to the first, second and third components 5200, 5300, 5400), such as a thermoplastic elastomer overlay, which is commonly referred to in the art as a grip cover.

In one embodiment, each of the first, second and third components 5200, 5300, 5400 is an integrally formed single-component structure. One suitable forming method for forming the first, second and third components 5200, 5300, 5400 is injection molding. Of course, in certain other embodiments, other forming techniques may be utilized, such as machining and/or milling. In one embodiment, the first component 5300 is formed of a first hard plastic, the second component 5400 is formed of a second hard plastic, and the third component 5400 is formed of an elastomeric material.

Suitable first hard plastics for formation of the first component 5200 include polyethylene, polyethylene terephthalate, polypropylene (PP), polyamide, polyester, cellulosics, SAN, acrylic, ABS, BR or any other of the hard plastics used in toothbrush manufacture. Suitable second hard plastics include polyethylene, polypropylene (PP), polyamide, polyester, cellulosics, SAN, acrylic, ABS, BR or any other of the hard plastics used in toothbrush manufacture. As used herein, the term "plastic" may include a blend of different plastics or a copolymer. The third component 5400 is constructed of a first elastomeric material, such as a thermoplastic elastomer (TPE). In certain embodiments, the first elastomeric material of the third component may have a hardness durometer in a range of A11 to A15 Shore hardness. Of course, materials outside this hardness range could be used. As an example, one potential first elastomeric material for the third component 5400 can be styrene-ethylene/butylene-styrene (SEBS) manufactured by GLS Corporation. Nevertheless, other manufacturers can supply the SEBS material and other materials could be used.

In one embodiment, the first hard plastic is different than the second hard plastic. In an even more specific embodiment, the first hard plastic and the second hard plastic are different hard plastics that are chemically incompatible with one another such that they do not form a chemical bond with each other during an injection molding process.

In certain embodiments, the hard plastic that forms one of the first and second components is an opaque hard plastic while the hard plastic that forms the other one of the first and second components is a transparent (or light transmissive) hard plastic. As used herein, the term "transparent hard plastic" includes hard plastics that are color tinted but still allow light to transmit therethrough. Suitable transparent hard plastics include without limitation clarified PP and clear polyesters, such as polyethylene terephthalate or a copolyester, such as poly-cyclohexylene dimethylene terephthalate, acid modified, polyester (PCTA) or styrene acrylonitrile (SAN), acrylonitrile butadiene styrene (ABS), polymethyl methacrylate (PMMA) or a cellulosic plastic, such as cellulose acetate propionate (CAP). One suitable opaque hard plastic is opaque PP. However, opaque versions of the hard plastics listed above for the first and second hard plastics may also be used.

In one specific embodiment, the first hard plastic of the first component 5200 is a transparent hard plastic while the second hard plastic of the second component 5300 is an opaque hard plastic. In one such embodiment, the first hard plastic of the first component 5200 can be a transparent BR while the second hard plastic of the second component 5300 can be an opaque PP.

In one embodiment, the first elastomeric material of the third component 5400 and the second hard plastic of the second component 5300 are selected so as to be chemically compatible with one another such that so that a chemical bond is formed between the first elastomeric material and the second hard plastic during an injection molding process. In one such specific embodiment, the first elastomeric material can be a TPE while the second hard plastic can be PP.

Referring now to FIGS. 42-46 concurrently, the first component 5200 and its structural cooperation with the second and third components 5300, 5400 will be described in greater detail. The first component 5200 is an elongated structure that, when assembled within the handle 5110 of the toothbrush, extends along the longitudinal axis 5A-5A (see FIG. 41). The first component 5200 extends longitudinally from a proximal end 5201 to a distal end 5202. The first component 5200 comprises a front outer surface 5203, a rear outer surface 5204, a left-side outer surface 5205, and a right-side outer surface 5206. As will be discussed in greater detail below, when the handle 5110 of the toothbrush 5100 is fully assembled (as shown in FIGS. 39-41) portions of each of the front outer surface 5203, the rear outer surface 5204, the left-side outer surface 5205, and the right-side outer surface 5206 remain exposed. Moreover, in certain embodiments where the first hard plastic is a transparent hard plastic, a first window 5250 may be formed through the handle 5110 via exposed portions 5207, 5208 of the first component 5200 from the first and second opposing outer surfaces 5111, 5112 of the handle 5110 (which are the lateral surfaces) (see FIG. 51). Additionally, a second window 5260 may be formed through the handle 5110 via exposed portions 5209, 5210 of the first component 5200 from the third and fourth opposing outer surfaces 5113, 5114 of the handle 5110 (which are the front and rear surfaces) (see FIG. 51).

The first component 5200 comprises a first component aperture 5211. As discussed in greater detail below, the first component aperture 5211 is provided to receive an anchor 5303 of the second component 5300 when the handle 5110 is assembled. As will become apparent from the below discussion, the mechanical cooperation between the anchor 5303 of the second component 5300 and a sidewall 5212 that defines the first component aperture 5211 assists in ensuring a secure coupling between the first and second components 5200, 5300, especially when the first and second components 5200, 5300 are formed of chemically incompatible hard plastics as described above.

In the exemplified embodiment, the first component aperture 5211 is a through-hole that extends between the front outer surface 5203 and the rear outer surface 5204 of the first component 5200. In other embodiments, the first component aperture 5211 may be a blind hole extending into the front outer surface 5203 of the first component 5200 or a blind hole extending into the rear outer surface 5204 of the first component 5200.

The first component aperture 5211 extends along a first axis 5B-5B. When the handle 5110 is assembled, the first axis 5B-5B is transverse to the longitudinal axis 5A-5A. In one specific embodiment, the first axis 5B-5B may be substantially orthogonal to the longitudinal axis 5A-5A. In the exemplified embodiment, the sidewall 5212 comprises an annular structure that circumferentially surrounds the first component aperture 5211 about the first axis 5B-5B. This annular structure terminates in an upper annular surface 5216 that remains exposed when the handle 5110 is assembled.

Figure 49:
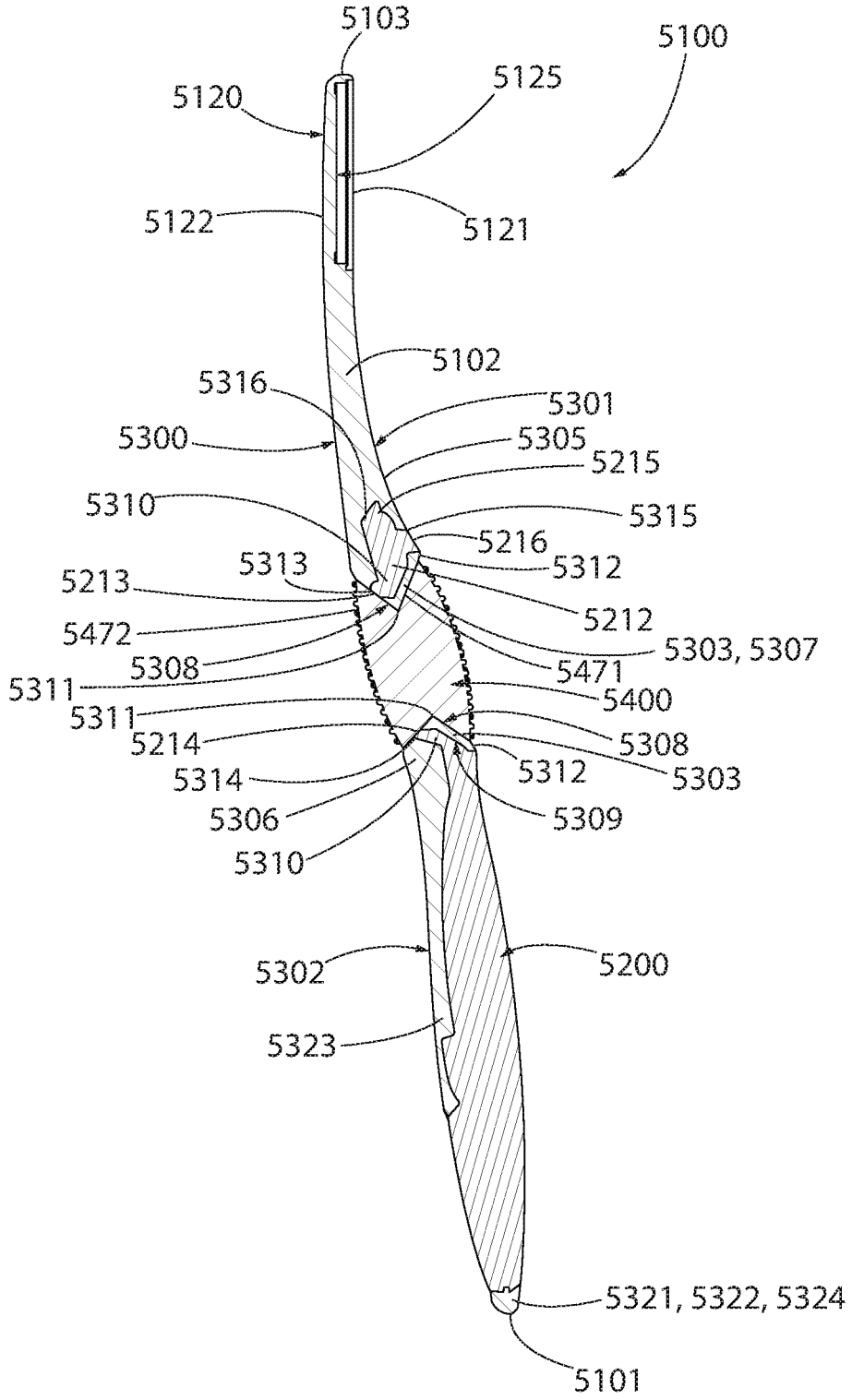
FIG. 49 is longitudinal cross-sectional view of the oral care implement of FIG. 39 taken along view XLIX-XLIX of FIG. 41, wherein the tooth cleaning element assembly has been omitted.

The sidewall 5212 of the first component 5200 comprises a first transverse protuberance 5213 and a second transverse protuberance 5214 located adjacent the first component aperture 5211 and extending from the rear outer surface 5204 of the first component 5200. The first and second transverse protuberances 5213, 5214 are circumferentially spaced apart from one another about the first axis 5B-5B. In the exemplified embodiment, the first and second transverse protuberances 5213, 5214 are located on opposite sides of the first component aperture 5211 but may be at other locations in other embodiments. When the handle 5110 is assembled, the first and second transverse protuberances 5213, 5214 respectively extend into first and second transverse openings 5313, 5314 of the anchor 5303 (shown in FIG. 49). Moreover, when the handle 5110 the first and second transverse protuberances 5213, 5214 are located on opposite sides of the second component aperture 5304 of the second component 5300. As seen in FIG. 49, the first and second transverse protuberances 5213, 5214 extend through the first and second transverse openings 5313, 5314 to form portions of an inner surface that defines the second component aperture 5304 (discussed in greater detail below). As a result of the above mechanical cooperation, the first and second transverse protuberances 5213, 5214 further assist in ensuring a secure coupling between the first and second components 5200, 5300. While in the exemplified embodiment, two transverse protuberances 5213, 5214 are exemplified, in other embodiments more or less than two transverse protuberances may be used. In still other embodiments, the transverse protuberances may be omitted all together.

Figure 50:
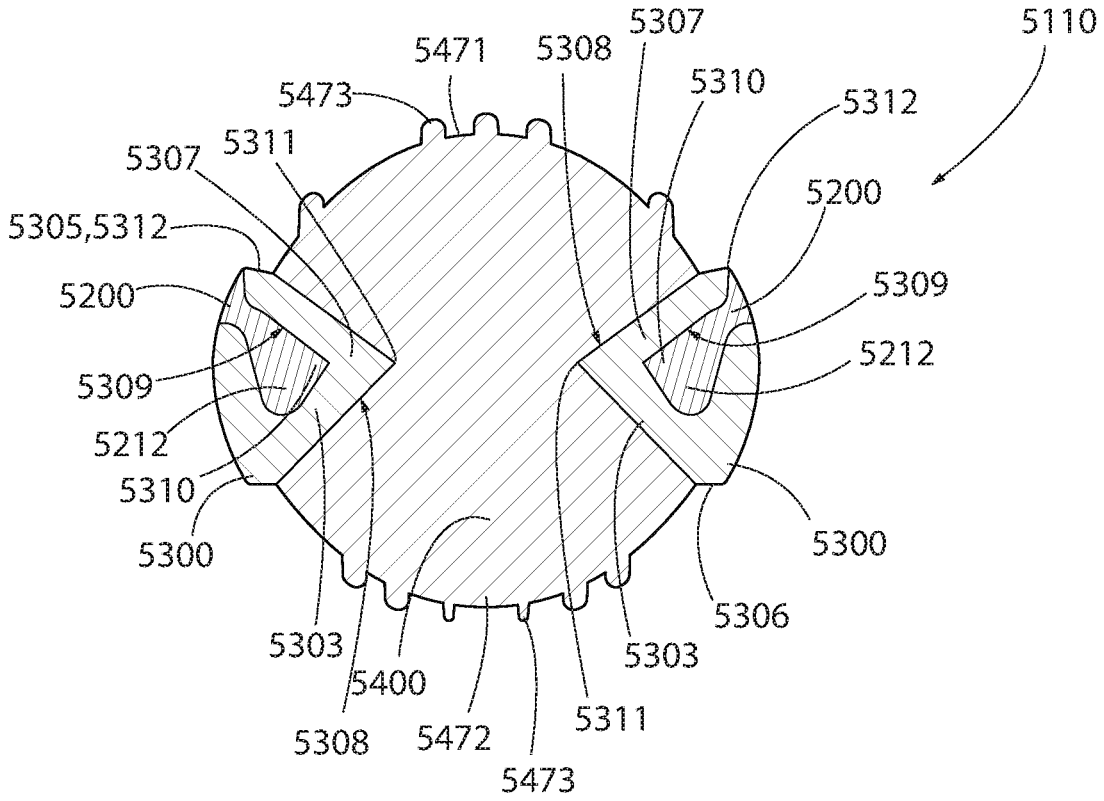
FIG. 50 is transverse cross-sectional view of the oral care implement of FIG. 39 taken along view L-L of FIG. 41.

As can also be seen in FIGS. 49 and 50, the sidewall 5212 of the first component nests within a groove 5310 formed in an outer surface 5309 of the anchor 5303 of the second component 5300, thereby further assisting in ensuring a secure coupling between the first and second components 5200, 5300.

The first component 5200 further comprises a longitudinal protuberance 5215 extending from the distal end 5202 of the first component 5200. When the handle 5110 is assembled, the longitudinal protuberance 5215 extends into a longitudinal recess 5316 formed in a transverse wall 5315 of the second component 5300 (see FIG. 49). When the handle 5110 is assembled, the longitudinal protuberance 5215 is embedded within the second component 5300.

Referring now to FIGS. 42-43 and 47-60, certain structural details of the second component 5300 will be described, along with its structural cooperation with the first and third components 5200, 5400. The second component 5300 is an elongated handle structure that generally comprises a body portion 5301 and a strap network 5302 extending longitudinally from the body portion 5301. The body portion 5301 further comprises an anchor 5303 which, as discussed above, extends into the first component opening 5211 when the handle 5110 is assembled.

The body portion 5301 is located within (and forms part of) the middle section 5116 and neck section 5117 of the handle 5110 while the strap network 5302 is located within (and forms part of) the proximal middle section 5115 of the handle 5110 (see FIG. 41). The body portion 5301 also comprises the head 5120 of the toothbrush 5110 in the exemplified embodiment as discussed above.

The anchor of the second component 5300 comprises a second component aperture 5304. In the exemplified embodiment, the second component aperture 5304 is a through-hole that extends between a front outer surface 5305 and a rear outer surface 5306 of the second component 5300. In other embodiments, the second component aperture 5304 may be a blind hole extending into the front outer surface 5305 of the second component 5300 or a blind hole extending into the rear outer surface 5306 of the second component 5300.

The second component aperture 5304 extends along a second axis 5C-5C. When the handle 5110 is assembled, the second axis 5C-5C is transverse to the longitudinal axis 5A-5A. In one specific embodiment, the second axis 5C-5C may be substantially orthogonal to the longitudinal axis 5A-5A. In certain embodiments, when the handle 5100 is assembled, the first and second axes 5B-5B, 5C-5C may be substantially parallel to one another and/or substantially coextensive.

In the exemplified embodiment, the second component aperture 5304 has a cross-sectional area (measured transverse to the second axis 5B-5B) that tapers with increasing depth from the opposing front and rear outer surfaces 5305, 5306 of the second component 5300. As a result an apex edge 5311 is formed that is embedded by the third component 5400 within the handle 5100. This structure assists with retaining the third component 5400 within the second component aperture 5304. In other embodiments, however, the cross-sectional area of the second component aperture 5304 (measured transverse to the second axis 5B-5B) may be substantially constant, may be stepped, or may increase and decrease in a repetitive manner.

In the exemplified embodiment, the anchor 5304 comprises a sidewall 5307 that defines an annular structure that circumferentially surrounds the second component aperture 5304 about the second axis 5C-5C. The sidewall 5307 comprises an inner surface 5308 that defines the second component aperture 5304 and an outer surface 5309. A groove 5310 (or channel) is formed into the outer surface 5309 of the anchor 5304. As discussed above, the sidewall 5212 of the first component 5200 nests within the groove 5310 when the handle 5110 is assembled.

The sidewall 5307 (which defines an annular structure in the exemplified embodiment) comprises an upper surface 5312 that remains exposed on the front outer surface 5104 of the handle 5110. Additionally, when the handle 5110 is assembled, the sidewall 5307 of the anchor 5303 isolates the third component 5400 from the first component 5200 (best shown in FIG. 49-50), with the exception of the terminal surfaces of the transverse protuberances 5213, 5214 of the first component 5200.

As mentioned above, the sidewall 5307 of the anchor 5303 comprises first and second transverse openings 5313, 5314 that extend from the inner surface 5308 to the outer surface 5309. These first and second transverse openings 5313, 5314 are provided to receive the first and second transverse protuberances 5213, 5214 of the first component 5200 when the handle 5110 is assembled (see FIG. 49). As can be seen, in this embodiment, the terminal surface of the first and second transverse protuberances 5213, 5214 form portions of the inner surface that defines the second component aperture 5304 of the anchor 5303. While in the exemplified embodiment, two transverse openings 5313, 5314 are exemplified, in other embodiments more or less than two transverse openings may be used. In still other embodiments, the transverse openings may be omitted all together.

As shown in FIG. 49, the second component 5300 further comprises an internal transverse wall 5315. A longitudinal recess 5316 is formed into the transverse wall 5315 of the second component 5300. When the handle 5110 is assembled, the longitudinal protuberance 5215 of the first component 5200 extends into and is located within the longitudinal recess 5316, thereby assisting in ensuring a secure coupling between the first and second components 5200, 5300. In the exemplified embodiment, the longitudinal protuberance 5215 is embedded within the handle 5110.

Referring now to FIGS. 42-43 and 47-53, the second component 5300 further comprises the strap network 5302. The strap network 5302 is formed by a plurality of strips that, when the handle is assembled, wraps around the first component 5200 to assist with ensuring that first and second components 5200, 5300 are securely coupled together.

In the exemplified embodiment of the strap network 5302, the strap network 5302 comprises a first longitudinal strip 5321, a second longitudinal strip 5322 and a third longitudinal strip 5323. As can best be seen in FIGS. 51-52, when the handle 5110 is assembled the first, second and third longitudinal strips 5321, 5322, 5333 are arranged about the first component 5200 in a circumferentially spaced-apart manner about the longitudinal axis 5A-5A. In one embodiment, the first, second and third strips 5321, 5322, 5323 may be substantially equi-spaced from one another. In another embodiment, the spacing between first, second and third strips 5321, 5322, 5323 may not be substantially equal.

The first strip 5321 extends longitudinally from the body portion 5301 of the second component 5300 toward the proximal end 5101 of the handle 5110 until it joins with the second strip 5322 at the proximal end 5101. Similarly, the second strip 5322 extends longitudinally from the body portion 5301 of the second component 5300 toward the proximal end 5101 of the handle 5110 until it joins with the first strip 5321 at the proximal end 5101. As a result, the first and second strips 5321, 5322 collectively form a first strap 5324 that wraps around the proximal end 5201 of the first component 5200, and also forms a portion of the proximal end 5101 of the handle 5110.

The third strip 5323 also extends longitudinally from the body portion 5301 of the second component 5300 toward the proximal end 5101 of the handle 5110. However, as a distance from the proximal end 5101 of the handle, the third strip divides/branches into a first branch 5325 and a second branch 5326. The first branch 5325 of the third strip 5323 converges with the first strip 5321 at a first strap node 5327. As a result, the third strip 5323 and the first strip 5321 collectively form a second strap 5328 that forms a loop (in conjunction with the body portion 5301) on a first lateral surface 5111 of the handle 5110. Similarly, the second branch 5326 of the third strip 5323 converges with the second strip 5322 at a second strap node 5329. As a result, the third strip 5323 and the first strip 5321 collectively form a third strap 5330 that forms a loop (in conjunction with the body portion 5301) on a second lateral surface 5112 of the handle 5110. Additionally, as can be seen, the first, second and third straps 5321, 5322, 5323 also collectively form a loop 5331 on the rear outer surface 5114 of the handle 5110. It is to be noted that while one embodiment of a strap network 5302 is exemplified, the strap network 5302 can take on a wide range of potential structural manifestations.

Figure 51:
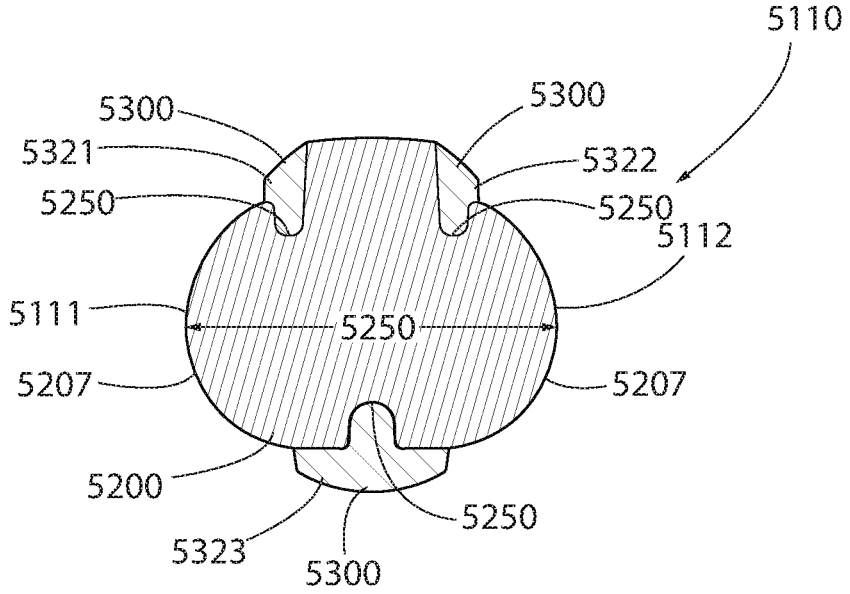
FIG. 51 is transverse cross-sectional view of the oral care implement of FIG. 39 taken along view LI-LI of FIG. 41.
Figure 53:
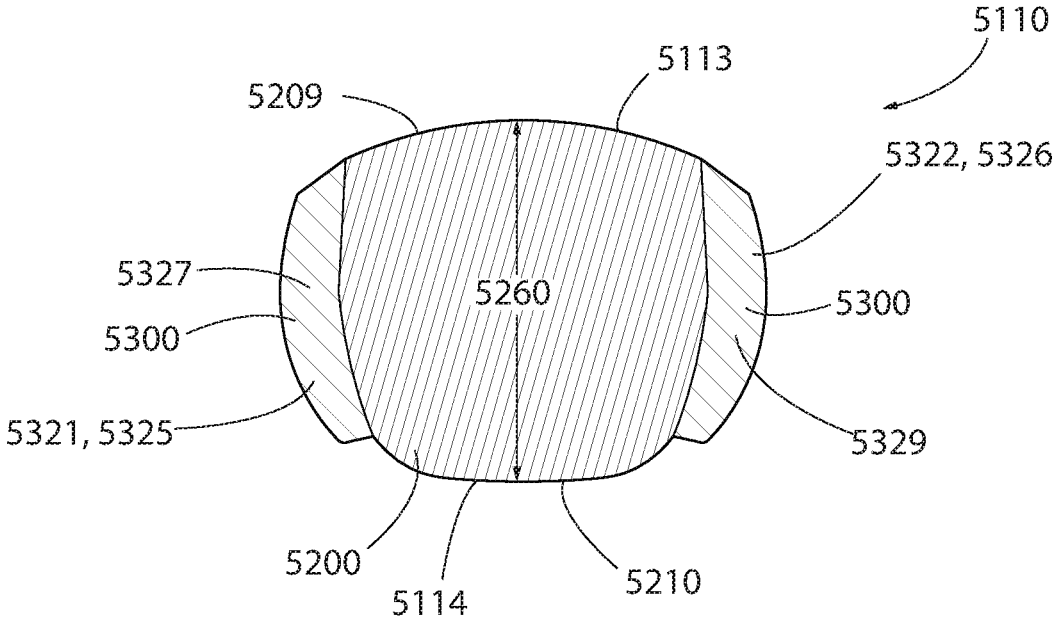
FIG. 53 is transverse cross-sectional view of the oral care implement of FIG. 39 taken along view LIII-LIII of FIG. 41.

Referring now to FIGS. 51 and 53 concurrently, when the first component 5200 is constructed of a first hard plastic that is substantially transparent and the second component 5300 is constructed of a second hard plastic that is substantially opaque, the plurality of strips 5321, 5322, 5323 define a first window 5250 through the first component 5200 from first and second lateral surfaces 5111, 5112 of the handle 5110 and a second window 5260 through the front and rear surfaces 5113, 5114 of the handle 5110.

Figure 52:
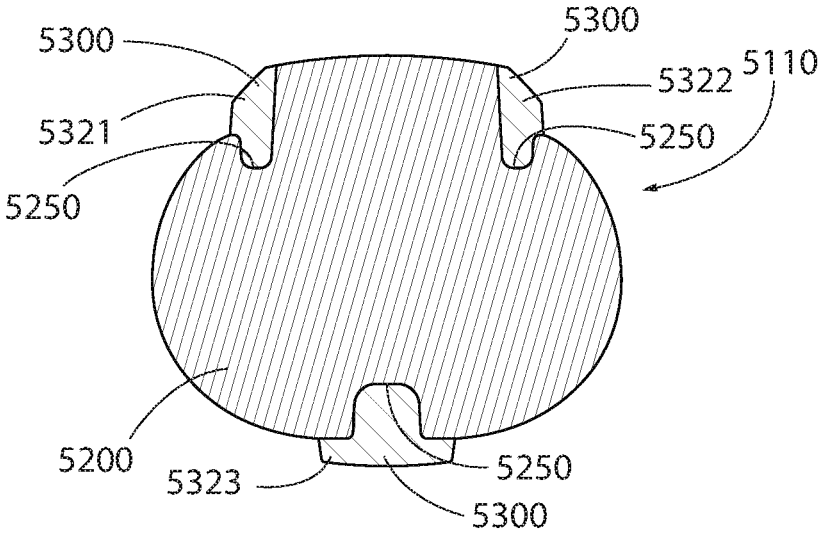
FIG. 52 is transverse cross-sectional view of the oral care implement of FIG. 39 taken along view LII-LII of FIG. 41.

Referring now to FIGS. 51 and 52 concurrently, the first component 5200 is provided with a plurality of grooves 5250 that are formed into the outer surface of the first component 5200. These grooves 5250 are provided so that when the handle 5110 is assembled, the plurality of strips 5321, 5322, 5323 are located therein, thereby further assisting with ensuring that secure coupling is achieved between the first and second components 5200, 5300, even when chemically incompatible materials are used.

While the exemplified embodiment of the toothbrush 5100 has a second component 5300 that comprises both the anchor 5303 and the strap network 5302, in certain embodiments the strap network 5302 may be omitted. In still other embodiments, the anchor 5303 may be omitted. In such embodiments, corresponding modifications can be made to the first component 5200 to compensate for said omissions. For example, if the anchor 5303 is omitted, the third component 5400 may be located directly in the first component aperture 5211.

Turning now to FIGS. 39-40, 43 and 49-50 concurrently, the third component 5400 will be described in greater detail. The third component 5400 is a generally bulbous shaped body that bulges out of the apertures 5211, 5304 of the first and second components 5200, 5300. The third component 5400 fills the second component aperture 5304 of the second component 5300 and, thus, takes on the shape of the second component aperture 5304. The third component 5400 has a convex front surface 5471 and a convex rear surface 5472, which resemble an oval or elliptical shape. The bulbous shape of the third component 5400 enables the user to reliably roll and control the handle 5110 between the thumb and index fingers during use. The third component 5400 may also be non-bulging or have any number of shapes, such as circular, a true oval shape and the like.

In one preferred construction, the third component 5400 has a multiplicity of finger grip protrusions 5473 projecting from the front and rear surfaces 5471, 5472. The finger grip protrusions 5473 provide a tactile feature to increase the friction on the user's finger surfaces and thus enhance the user's ability to grip the handle 5110, particularly under wet conditions. The finger grip protrusions 5473 are preferably provided in a desired conical or frusto-conical shape for improved grip performance. In other embodiments, other roughened surfaces and geometries could be used.

A method of manufacturing the toothbrush 5100 according to one embodiment of the present invention will be described. The first component created in manufacturing the toothbrush 5100 is the first component 5200. To create the first component 5200, a first mold is provided having a first mold cavity and at least one port/nozzle for injecting the first hard plastic in a liquefied state into the first mold cavity. In one embodiment, a single port is used to inject the liquefied first hard plastic, which may be BR. The first mold cavity has a volume that is sized and shaped to correspond to the first component 5200 as described above and illustrated herein. The first mold may be two-part mold, as is known in the art. Once the first mold cavity is created/provided, liquefied first hard plastic is injected into the first mold so as to fill the first mold cavity. The liquefied first hard plastic is allowed to cool to an appropriate temperature so as to form the first component 5200, as described above and illustrated herein, for further handling.

Once the first component 5200 is created (and allowed to adequately cool for further handling), the first component 5200 is supported by one or more clamping members that engage one or more points of contact on first component 5200 with at least one set of arms.

Once the clamping member is properly supporting the first component 5200, the first component 5200 is positioned within a second mold cavity of a second mold. This positioning can be effectuated by either moving the first component 5200 into the second mold cavity or by creating the second mold cavity about the first component 5200 while supporting the first component 5200 in a stationary manner, which can be accomplished by translating and mating multiple pieces of the second mold into position so that the second mold cavity is formed about the first component 5200. The second mold cavity has a volume that is sized and shaped to correspond to the second component 5300. One or more ports are present in the second mold for injecting the second hard plastic in a liquefied state into the second mold cavity. In one embodiment, a single port is used to inject the liquefied PP.

Once the first component 5200 is in proper position within the second mold cavity (and the second mold cavity is adequately sealed), the liquefied second hard plastic (which may be PP) is injected into the second mold cavity so as to fill the remaining volume of the second mold cavity that is not occupied by the first component 5200. The liquefied second hard plastic forms the strap network 5302 about the first component 5200 and the anchor 5303 within the first component aperture 5211 (as described above).

The liquefied second hard plastic is then allowed to cool to an appropriate temperature, thereby forming the second component 5300 about the first component 5200, as described above. The first component 5200 and second component 5300 collectively form a handle assembly. If the first and second plastics are selected so as to be chemically incompatible with one another, the second hard plastic of second component 5300 does not chemically bond with the first hard plastic of the first component 5400 during the injection molding process.

Once the handle assembly is sufficiently cool for further handling, at least the middle section 5116 is positioned within a third mold cavity of a third mold. When in the third mold cavity, the first elastomeric material in a liquefied state is injected therein to fill the second component aperture 5304, which is enclosed by an appropriate mold, via a port. The first elastomeric material, in one embodiment, chemically bonds with the second hard plastic of the second component 5300 during this injection molding process.

The inventive aspects discussed above may be practiced for a manual toothbrush or a powered toothbrush. In operation, the previously described features, individually and/or in any combination, may improve the control, grip performance, aesthetics and cost point of oral implements. Other constructions of toothbrush are possible. For example, the head 5120 may be replaceable or interchangeable on the handle 5110. The head 5120 may include various oral surface engaging elements, such as inter-proximal picks, brushes, flossing element, plaque scrapper, tongue cleansers and soft tissue massages. While the various features of the toothbrush 5100 work together to achieve the advantages previously described, it is recognized that individual features and sub-combinations of these features can be used to obtain some of the aforementioned advantages without the necessity to adopt all of these features in an oral care implement.

Concept Six

Figure 54:
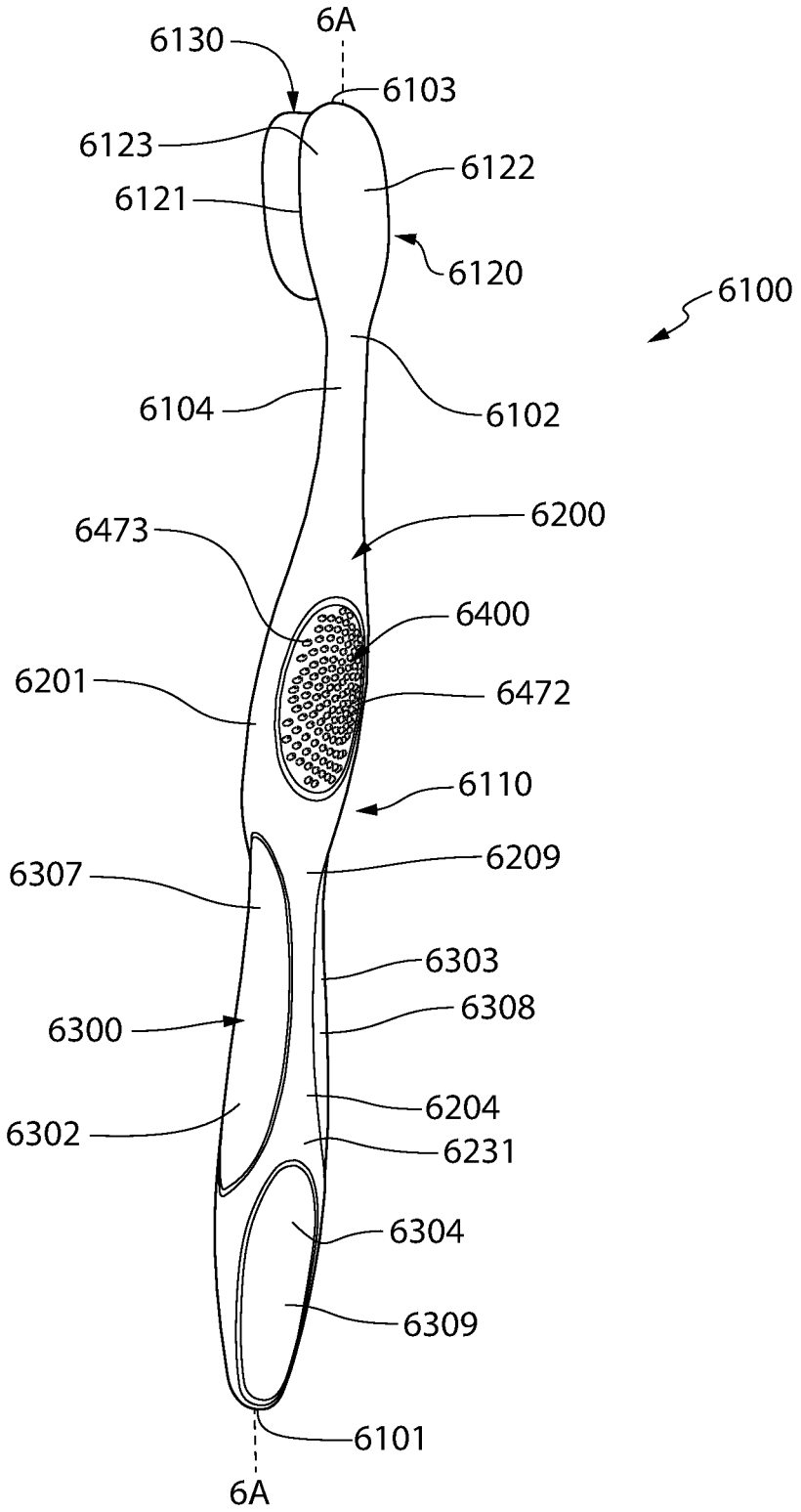
FIG. 54 is a rear perspective view of an oral care implement according to an embodiment of the present invention.
Figure 55:
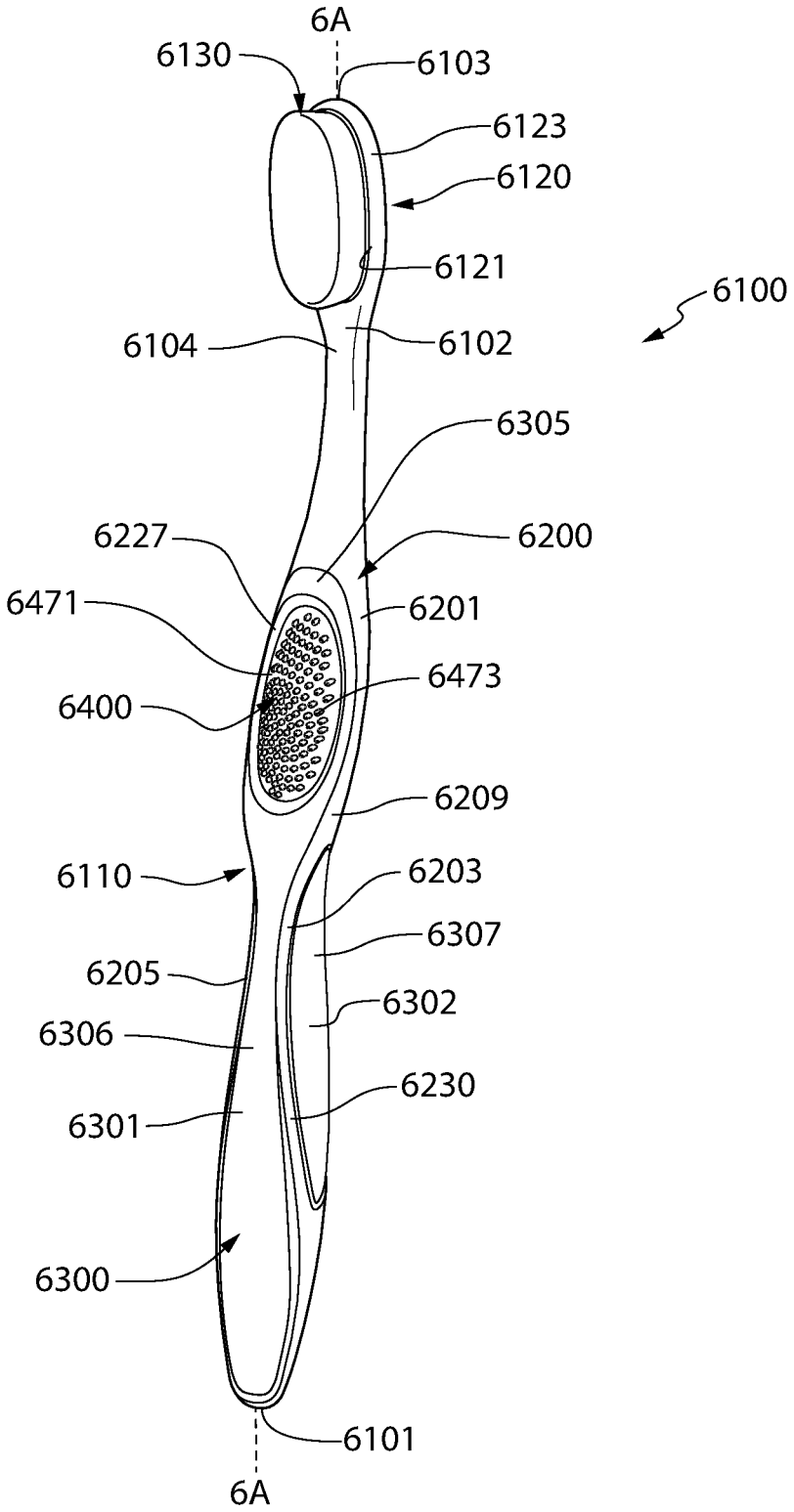
FIG. 55 is a front perspective view of the oral care implement of FIG. 54.
Figure 56:
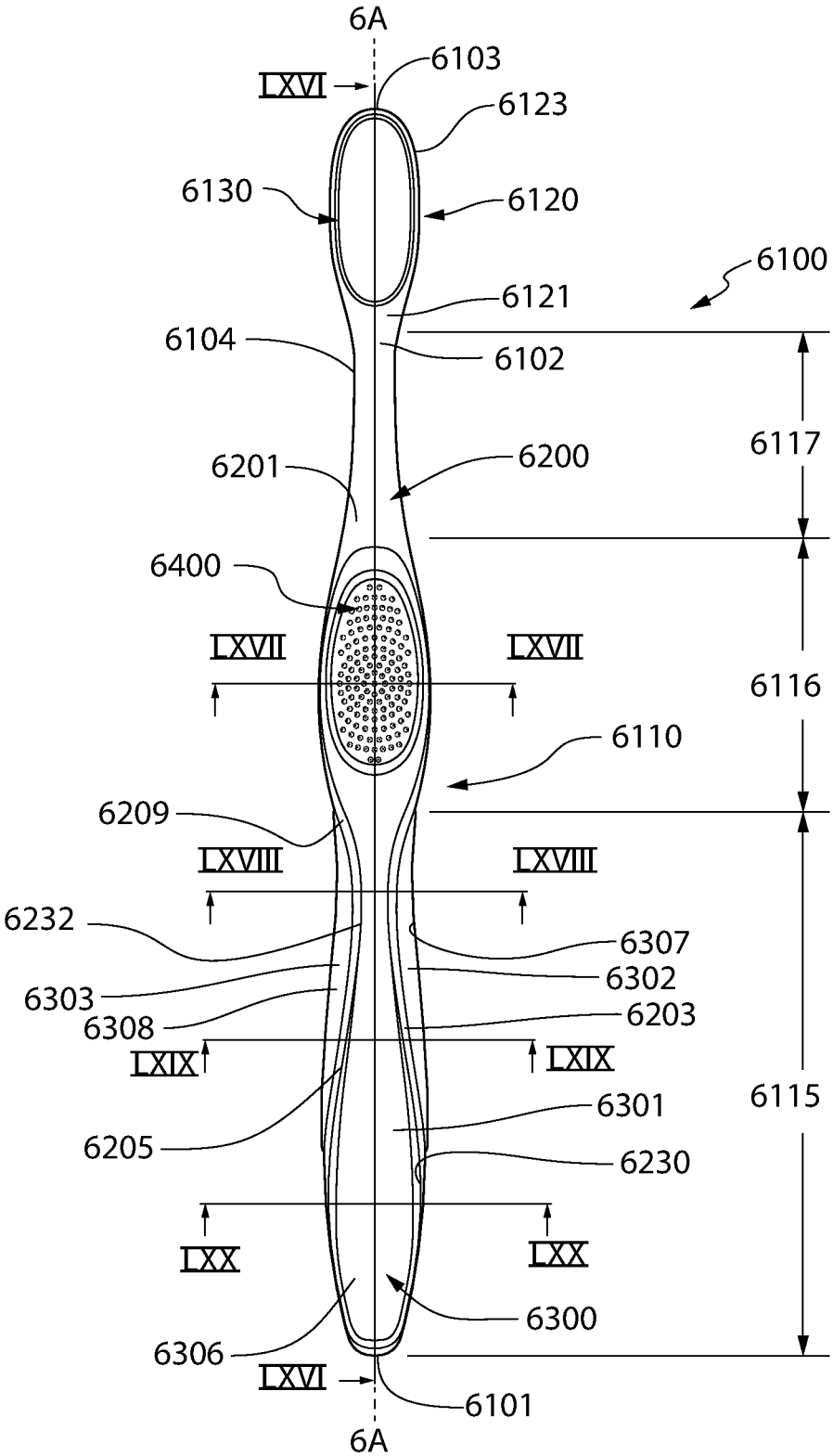
FIG. 56 is a front view of the oral care implement of FIG. 54.

Referring first to FIGS. 54-56 concurrently, a toothbrush 66100 is illustrated according to one embodiment of the present invention. The toothbrush 6100 generally comprises a handle 6110 and a head 6120. The handle 6110 provides the user with a mechanism by which he/she can readily grip and manipulate the toothbrush 6100. The handle 6110 includes ergonomic features which provide a high degree of control for the user while maintaining comfort. The head 6120 is connected to a distal end 6102 of the handle 6110 and includes a set of teeth cleaning elements 6130, which are generically illustrated.

Generally, the toothbrush 6100 extends from a proximal end 6101 (which is also the proximal end of the handle 6110) to a distal end 6103 along a longitudinal axis 6A-6A (which is also the longitudinal axis of the handle 6110). Conceptually, the longitudinal axis 6A-6A is a reference line that is generally coextensive with the three-dimensional center line of the handle 6110 (and the body of the head 6120). Because the handle 6110 is a non-linear structure (as can be seen in FIGS. 54 and 55) in the illustrated embodiment, the longitudinal axis 6A-6A for the toothbrush 6100 (and the handle 6110) is also non-linear in the illustrated embodiment. However, in certain other embodiments, the toothbrush 6100 may have a simple linear arrangement and thus a substantially linear longitudinal axis 6A-6A. As best visible in FIG. 67-70, the handle 6110 has a generally elliptical transverse cross-sectional shape along its longitudinal length. Other transverse cross-sectional shapes can be used in other embodiments.

The head 6120 is connected to the distal end 6102 of the handle 6110. As discussed in greater detail below, the head 6120 and the handle 6110 of the toothbrush 6100 are preferably formed as a single-component integral structure using an injection molding process, which in the exemplified embodiment is the first component 6200. More specifically, in the exemplified embodiment, the head 6120 is integrally formed as part of the first component 6200 of the handle 6110. The first component 6200 also comprises the neck 6104 of the toothbrush 6100. As exemplified, the neck 6104 is a portion of the handle 6110 of the toothbrush 6100 that is narrowed relative to the head 6120 and the gripping portion of the handle 6110.

In other embodiments, the handle 6110 and the head 6120 may be formed as separate components which are operably connected at a later stage of the manufacturing process by any suitable technique known in the art, including without limitation thermal welding, sonic welding, a tight-fit assembly, a coupling sleeve, adhesion, or fasteners. Whether the head 6120 is integrally formed as part of the first component 6200 of the handle 6110 or is a multi-piece assembly (including connection techniques) is not limiting of the present invention in all embodiments. Furthermore, other manufacturing techniques may be used in place of and/or in addition to injection molding to create the handle 6110 and/or the head 6120 (or components thereof), such as milling and/or machining.

The head 6120 generally comprises a front surface 6121 and a rear surface 6122. The front surface 6121 and the rear surface 6122 of the head 6120 can take on a wide variety of shapes and contours, none of which are limiting of the present invention. For example, the front and rear surfaces 6121, 6122 can be planar, contoured or combinations thereof. The front surface 6121 and rear surface 6122 are bound by a peripheral surface 6123.

The set of tooth cleaning elements 6130, which are generically illustrated as a block, are provided on and extend outward from the front surface 6121 of the head 6120 for cleaning contact with an oral surface, preferably teeth. While the set of tooth cleaning elements 6130 is particularly suited for brushing teeth, the set of tooth cleaning elements 6130 can also be used to clean oral soft tissue, such as a tongue, gums, or cheeks instead of or in addition to teeth. Common examples of "tooth cleaning elements" include, without limitation, filament bristles, fiber bristles, nylon bristles, spiral bristles, core-sheath bristles, rubber bristles, elastomeric protrusions, flexible polymer protrusions, co-extruded filaments, flag bristles, crimped bristles, anti-bacterial bristles and combinations thereof and/or structures containing such materials or combinations.

Figure 66:
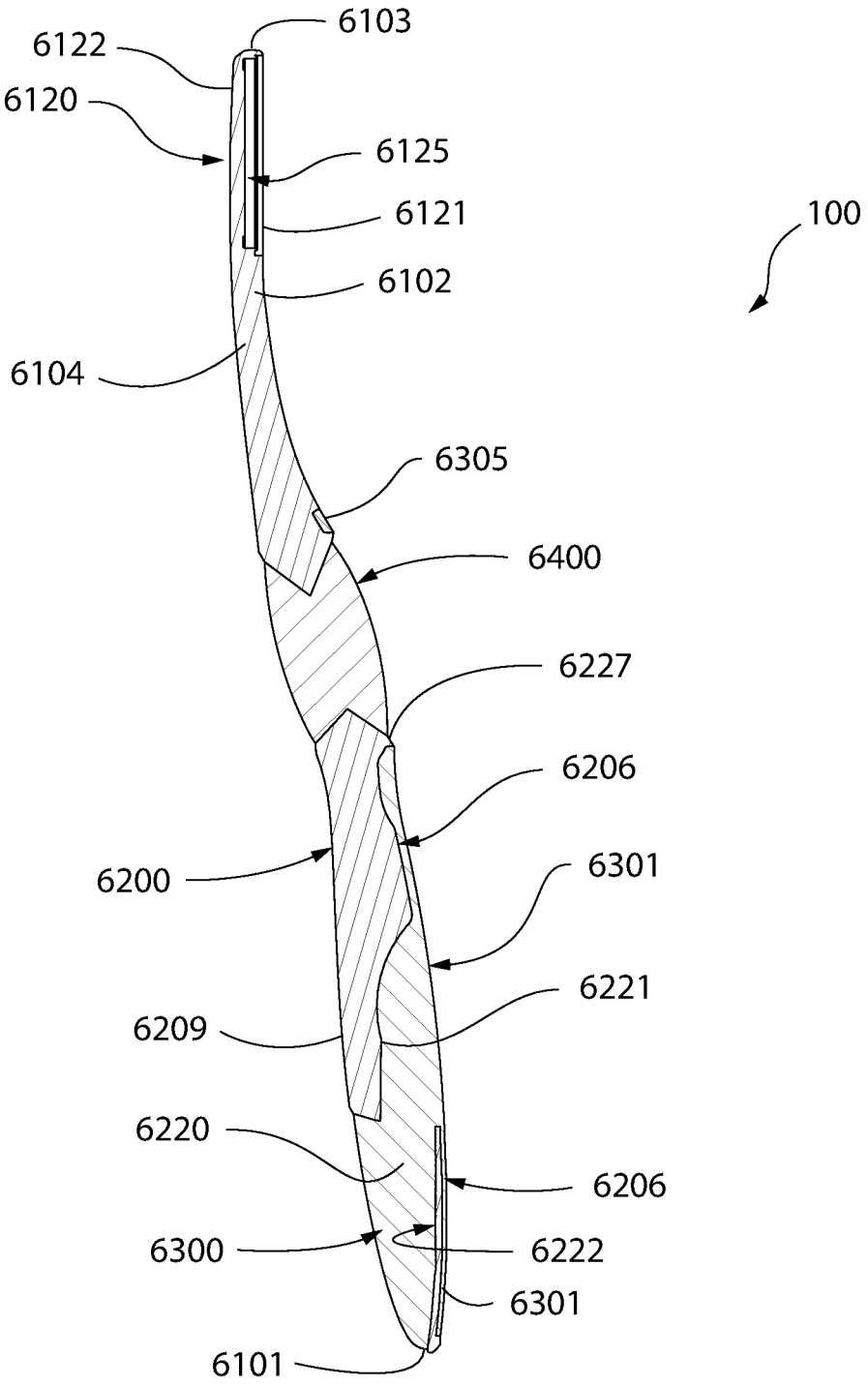
FIG. 66 is a longitudinal cross-sectional view of the oral care implement of FIG. 54 taken along view LXVI-LXVI of FIG. 56, wherein the tooth cleaning element assembly has been omitted.
Figure 67:
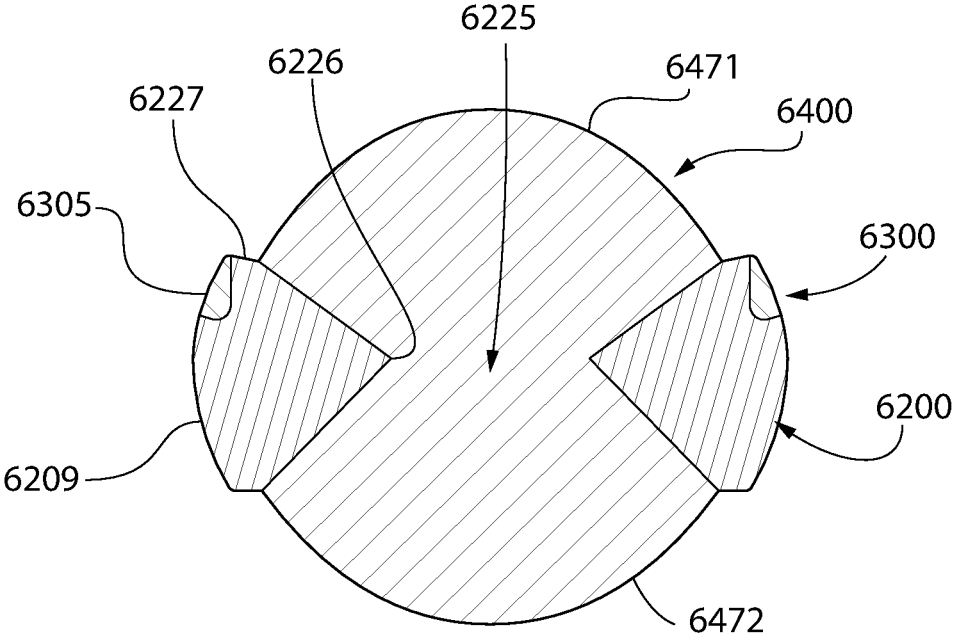
FIG. 67 is transverse cross-sectional view of the oral care implement of FIG. 54 taken along view LXVII-LXVII of FIG. 56.

The set of tooth cleaning elements 6130 can be connected to the head 6120 in any manner known in the art. In the exemplified embodiment (see FIGS. 59 and 66), anchor free tufting (AFT) is used to mount the cleaning elements. In this embodiment, the body of the head 6120 comprises a depression (or basin) 6125 for receiving a cleaning element assembly that comprises a carrier plate to which the tooth cleaning elements 6130 are connected prior to being coupled to the body of the head 6120. The carrier plate is then positioned within the depression 6125 and secured to the body of the head 6120, such as by ultrasonic welding, thermal fusion, mechanical fit or adhesion. The bristles (or elastomeric elements) of the set of tooth cleaning elements 6130 extend through the carrier. The free ends of the set of tooth cleaning elements 6130 on one side of the carrier plate perform the cleaning function. The ends of the set of tooth cleaning elements 6130 on the other side of the carrier plate are melted together by heat, thereby retaining the set of tooth cleaning elements 6130 in place.

In other embodiments, the set of tooth cleaning elements 6130 can be mounted to tuft blocks or sections by extending through suitable openings in the tuft blocks so that the base of the bristles is mounted within or below the tuft block. In still another embodiment, tuft holes may be formed in the body of the head and staples, or other anchors, can be used to secure the bristles tufts therein.

While not in the exemplified embodiment, the rear surface 6122 of the head 6120 may also comprise additional structures for oral cleaning, such as a soft tissue cleanser, in other embodiments. Such soft tissue cleansers are typically constructed of a thermoplastic elastomer (TPE) and include one or more projections, such as nubs and/or ridges, for engaging and massaging soft oral tissue, such as the tongue.

As shown in FIG. 56, the handle 6110 can be conceptually delineated in longitudinal sections comprising a proximal section 6115, a middle section 6116 and a neck section 6117. The proximal section 6115 is the portion or segment of the handle 6110 that generally fits comfortably within the palm of the user. The middle section 6116 forms the portion or segment of the handle 6110 that generally fits comfortably between the user's thumb and index finger. The neck portion 6117 forms the portion or segment of the handle 6110 that connects to the head 6120.

The proximal section 6115 longitudinally extends from the proximal end 6101 of the toothbrush 6100 to the middle section 6116. The middle section 6116 longitudinally extends from the proximal section 6115 to the neck section 6117. The neck section 6117 extends from the middle section 6116 to the head 6120. While the head 6120 is illustrated as being widened relative to the neck section 6117 of the handle 6110, the head 6120 could in some constructions simply be a continuous extension or narrowing of the neck section 6117 of the handle 6110.

As discussed in greater detail below, the first component 6200 is located within (and forms a part of) each of the proximal section 6115, the middle section 6116 and the neck section 6117. The second component 6300 is located within (and forms part of) each of the proximal section 6115 and the middle section 6116. Moreover, in the exemplified embodiment, the second and third components 6300, 6400 are not located within the neck section 6117. The third component 6400 is located within (and forms part of) the middle section 6116. As exemplified, the third component is only located within (and forms part of) the middle section 6116.

Figure 57:
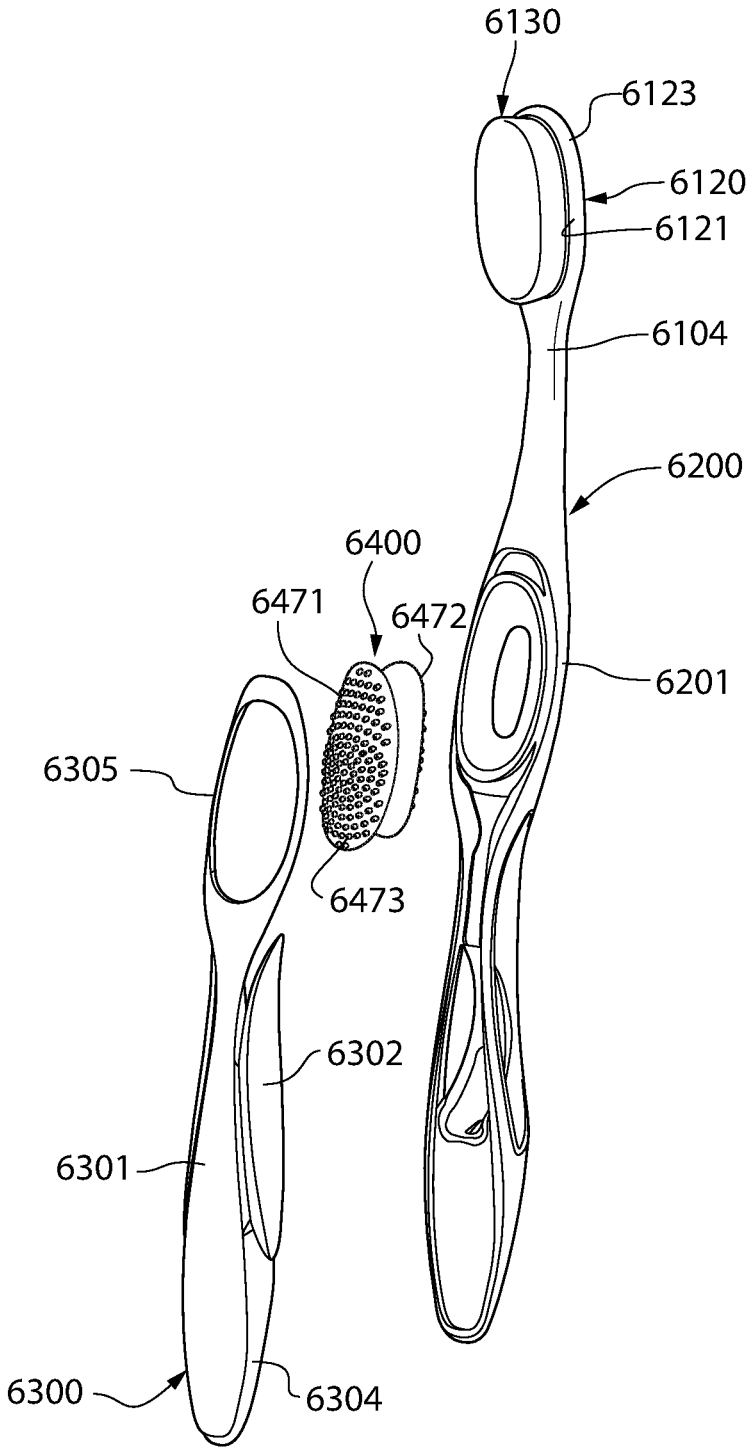
FIG. 57 is a front perspective of the oral care implement of FIG. 54 with the handle in an exploded state.
Figure 58:
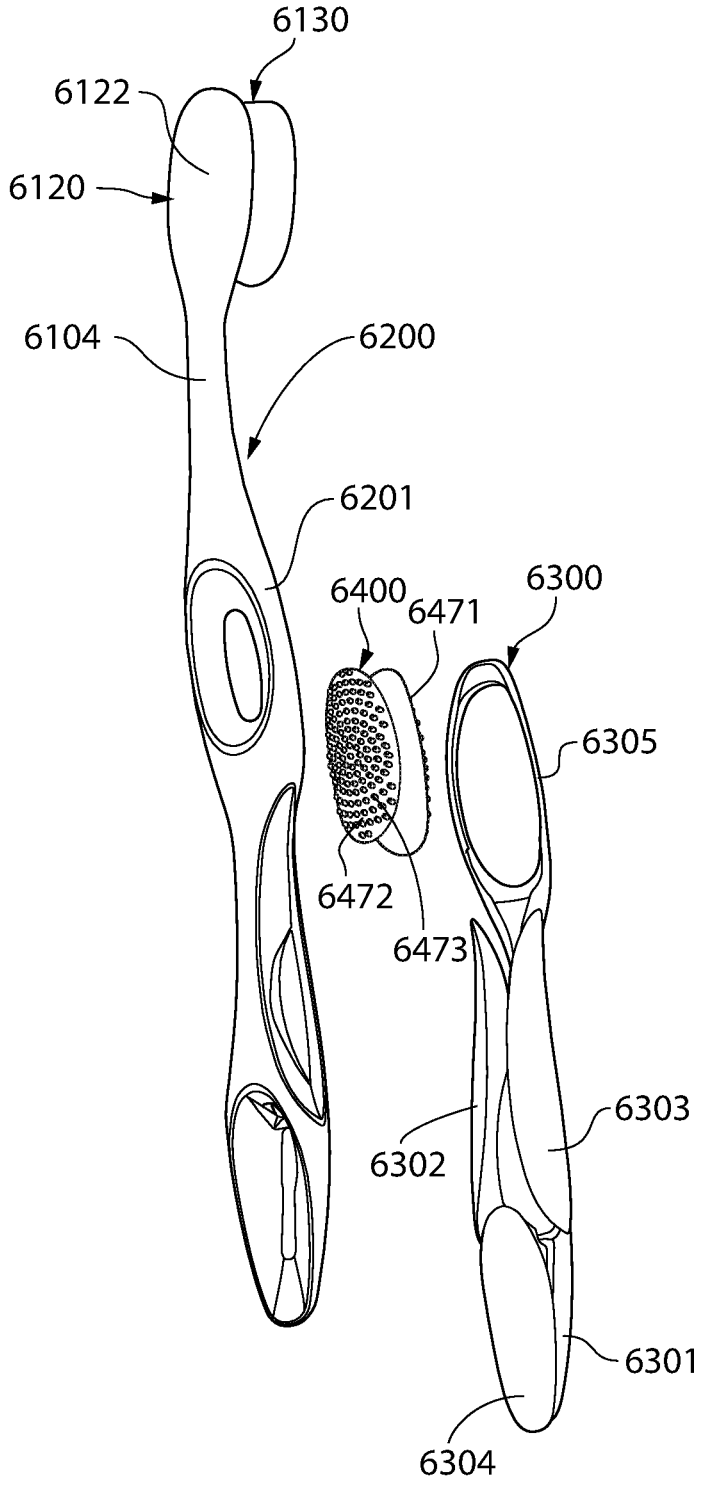
FIG. 58 is a rear perspective of the oral care implement of FIG. 54 with the handle in an exploded state.
Figure 59:
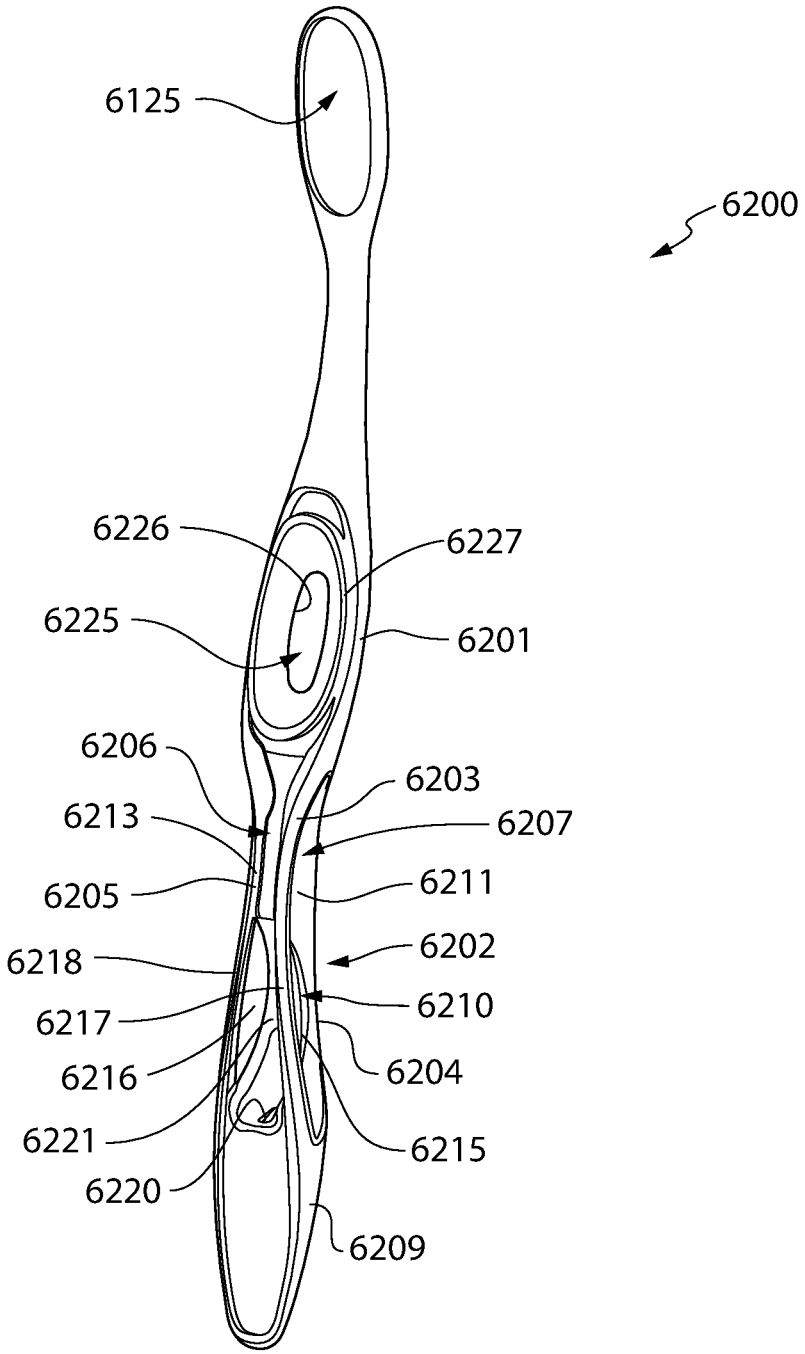
FIG. 59 is a front perspective view of a first component of the handle of the oral care implement of FIG. 54.
Figure 60:
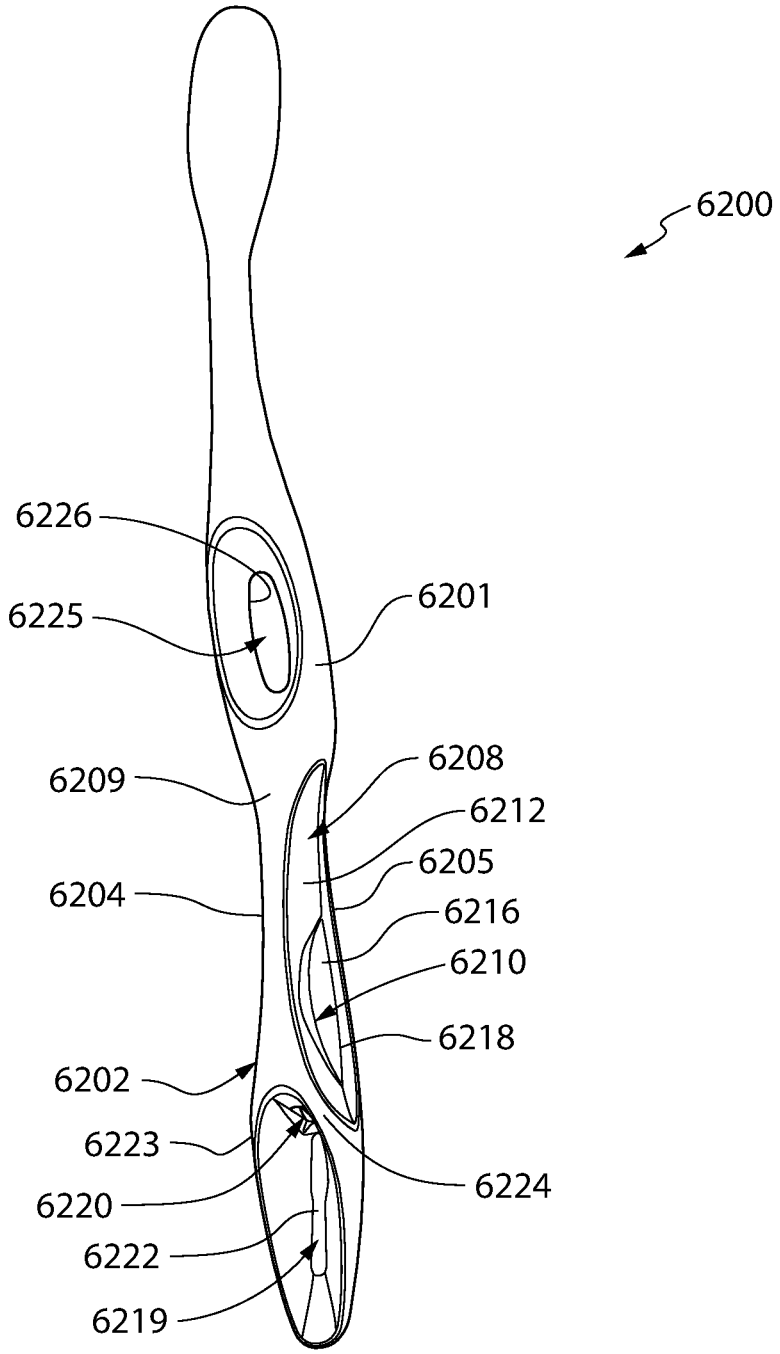
FIG. 60 is a rear perspective view of the first component of FIG. 59.
Figure 61:
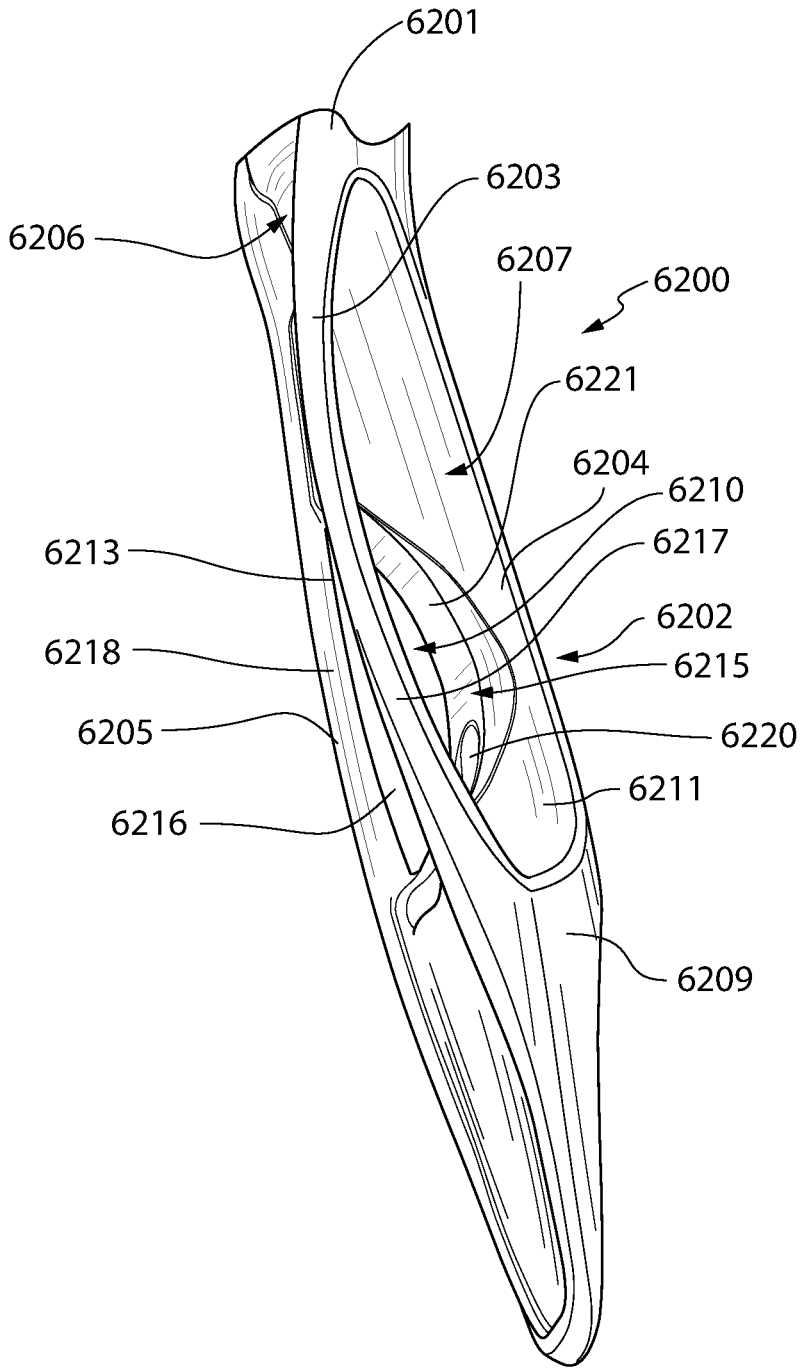
FIG. 61 is a right-side perspective view of a proximal portion of the first component of FIG. 59, wherein the left-side perspective view is a mirror image thereof.
Figure 62:
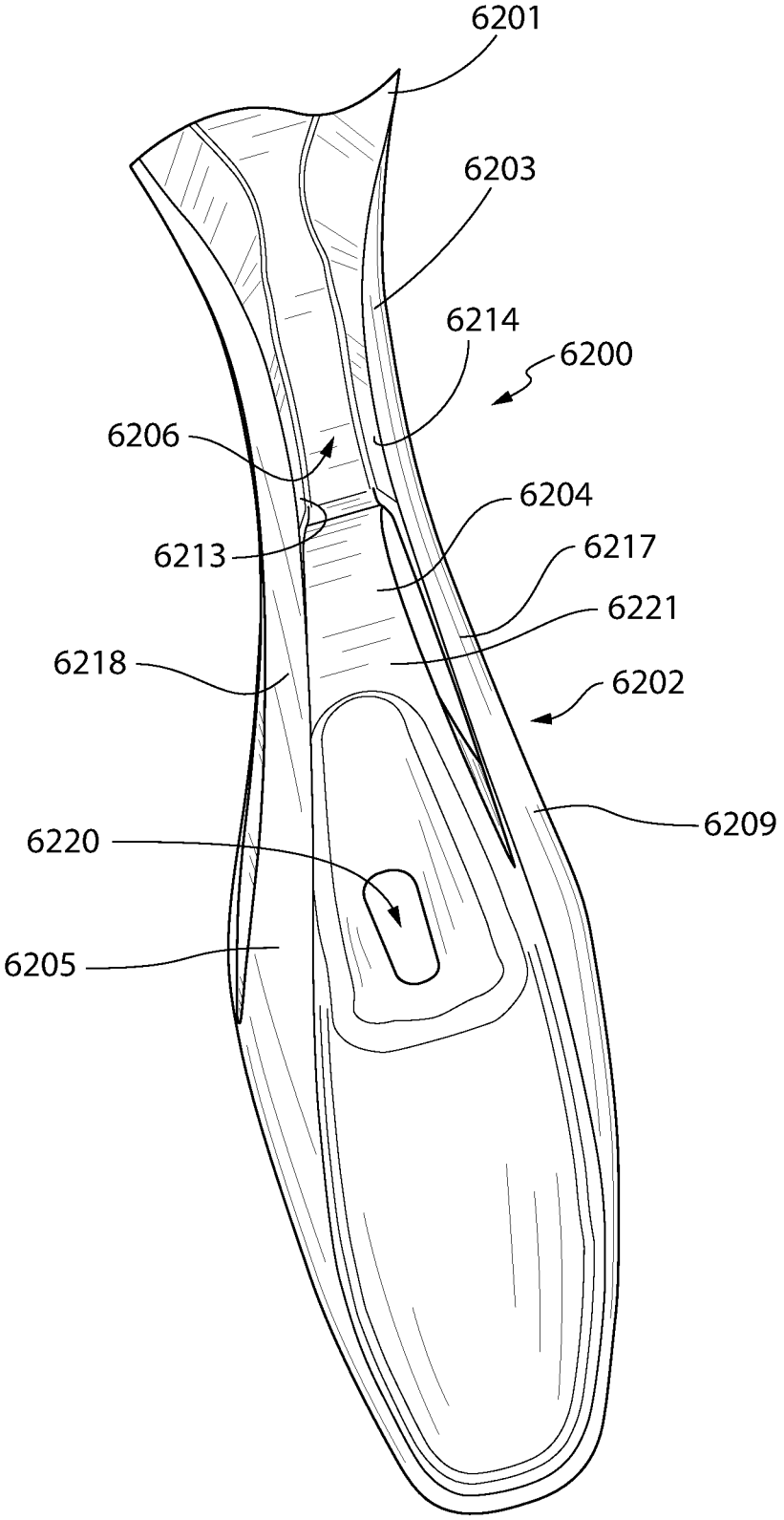
FIG. 62 is a front perspective view of the proximal portion of the first component of FIG. 59.
Figure 63:
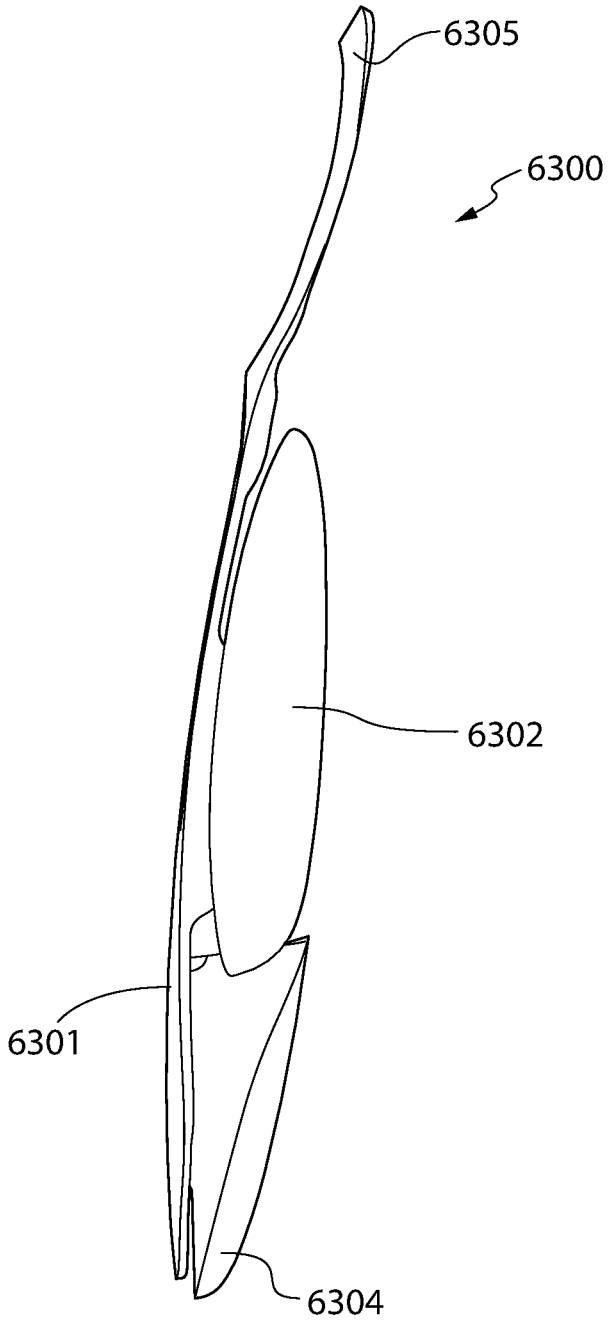
FIG. 63 is a right-side view of a second component of the handle of the oral care implement of FIG. 54, the left-side view being a mirror image thereof.
Figure 64:
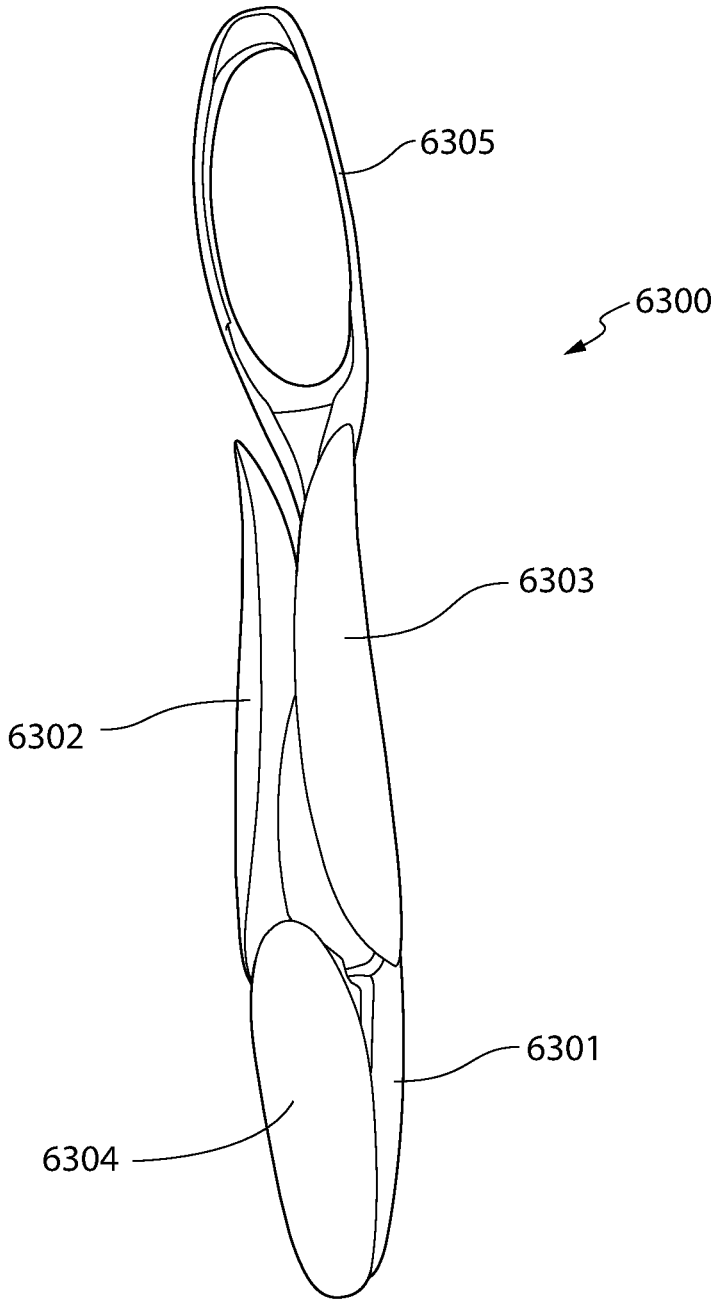
FIG. 64 is a rear perspective view of the second component of FIG. 63.
Figure 65:
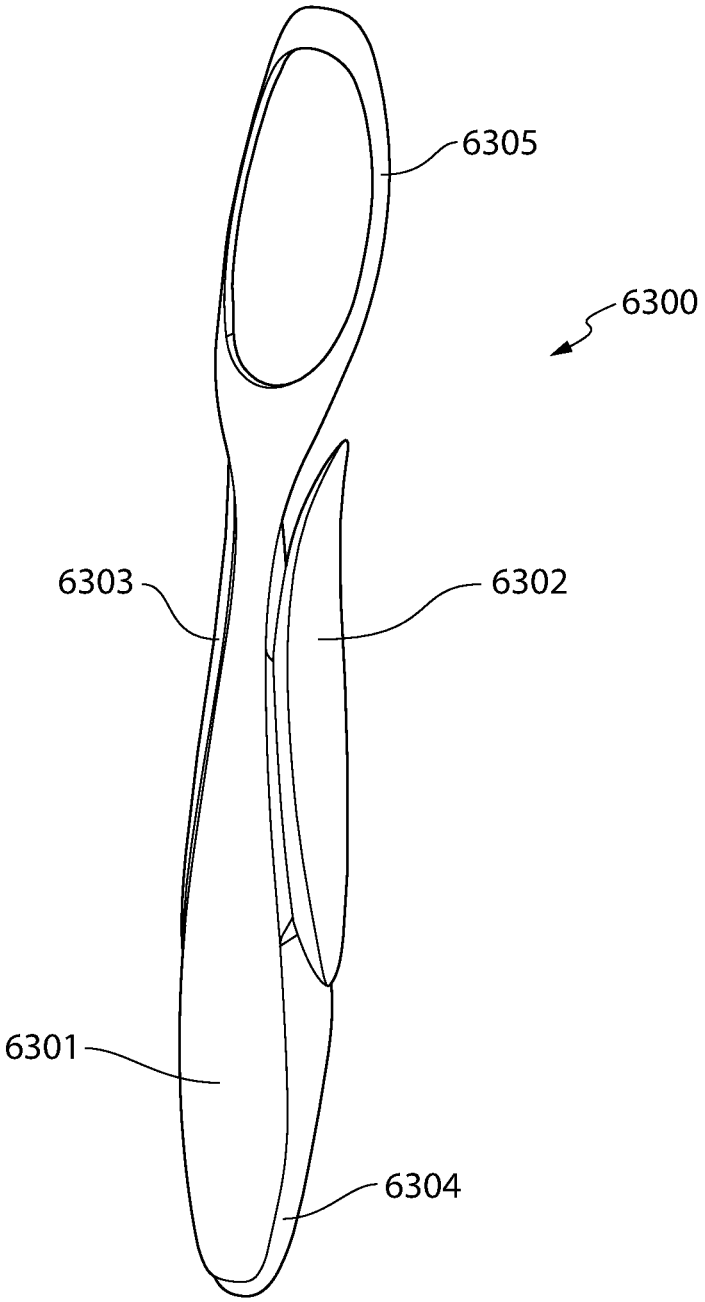
FIG. 65 is a front perspective view of the second component of FIG. 63.

Referring now to FIGS. 57-58 concurrently, the handle 6110 is illustrated in an exploded state so that its three components are visible. The three components of the handle 6110 include a first component 6200, a second component 6300 and a third component 6400. In certain embodiments, the first component 6200 can be considered the frame or base structure of the handle 6110, the second component 6300 can be considered a cushioning or compressible structure, and the third component can be considered a thumb and finger grip body. While three components 6200, 6300, 6400 are exemplified as forming the multi-component handle 6110, in other embodiments of the multi-component handle 6110 of the toothbrush 6100, the third component 6400 may be omitted if desired. In one such embodiment, the first component 6200 can be modified to assume the volume of the omitted third component 6400. In still another such embodiment, the second component 6300 can be modified to assume the volume of the omitted third component 6400. In still other embodiments, the multi-component handle 6110 of the toothbrush 6100 may further comprise one or more additional components (in addition to the first, second and third components 6200, 6300, 6400).

In one embodiment, each of the first, second, and third components 6200, 6300, 6400 is an integrally formed single-component structure. One suitable forming method for forming the first, second and third components 6200, 6300, 6400 as integral structures is injection molding. Of course, in certain other embodiments, other forming techniques may be utilized, such as machining and/or milling. In one embodiment, the first component 6200 is formed of a first material, the second component 6300 is formed of a second material, and the third component 6400 is formed of a third material. In certain embodiments, the first material is different than the second material. In other embodiments, each of the first, second and third materials are different from one another. In one embodiment, the first material has a first hardness durometer, the second material has a second hardness durometer, and the third material has a third hardness durometer, wherein the first hardness durometer is greater than the second hardness durometer and the second hardness durometer is greater than the third hardness durometer.

In the exemplified embodiment, the first material of which the first component 6200 is constructed is a hard material. One suitable hard material is a hard plastic. Suitable hard plastics for formation of the first component 6200 include, without limitation, polyethylene, polyethylene terephthalate, polypropylene (PP), polyamide, polyester, cellulosics, SAN, acrylic, ABS, BR or any other of the hard plastics used in toothbrush manufacture. As used herein, the term "plastic" may include a blend of different plastics or copolymers.

In the exemplified embodiment, the second material of which the second component 6300 is constructed is a first elastomeric material, such as a thermoplastic elastomer (TPE). The first elastomeric material of the second component 6300, in certain embodiments, has a hardness durometer in a range of A13 to A50 Shore hardness, although materials outside this range may be used. In one specific embodiment, the hardness durometer of the first elastomeric material of the second component 6300 is A25 to A40 Shore hardness.

In the exemplified embodiment, the third material of which the third component 6400 is constructed is a second elastomeric material, such as a thermoplastic elastomer (TPE). In certain embodiments, the second elastomeric material of the third component may have a hardness durometer in a range of A11 to A15 Shore hardness. Of course, materials outside this hardness range could be used. As an example, one potential first elastomeric material for the third component 6400 can be styrene-ethylene/butylene-styrene (SEBS) manufactured by GLS Corporation. Nevertheless, other manufacturers can supply the SEBS material and other materials could be used.

In certain embodiments, the first component 6200 is constructed of a first hard plastic and the second component 6300 is constructed of a first elastomeric material that are chemically compatible with one another such that they form a chemical bond with each other during an injection molding process. Moreover, in certain embodiments, the third component 6400 is constructed of a second elastomeric material that is chemically compatible with the first hard plastic of the first component 6200 such that they also form a chemical bond with each other during an injection molding process.

In certain embodiments, the first material (such as the hard plastics discussed above) of which the first component 6200 is constructed is opaque while the second material of which the second component 6300 is constructed is transparent (or light transmissive). As used herein, the term "transparent" includes materials that are color tinted but still allow light to transmit therethrough. One suitable opaque hard plastic is opaque PP. However, opaque versions of the hard plastics listed above for the first component 6200 may also be used. One suitable transparent elastomeric materials includes a transparent TPE.

Referring now to FIGS. 59-62 and 66-70 concurrently, the first component 6200 and its structural cooperation with the second and third components 6300, 6400 will be described in greater detail. The first component 6200 generally comprises a body portion 6201 and a frame portion 6202. The frame portion 6202 comprises a first longitudinal rib 6203, a second longitudinal rib 6204, and a third longitudinal rib 6205. The first, second and third longitudinal ribs 6203-6205 extend from the body portion 6201 toward the proximal end 6101 of the handle 6110. As a result of the first, second and third longitudinal ribs 6203-6205: a first depression 6206 is formed into an outer surface 6209 of the first component 6200 between the first and third longitudinal ribs 6203, 6205; a second depression 6207 is formed into the outer surface 6209 of the first component 6200 between the first and second longitudinal ribs 6203, 6204; and a third depression 6208 is formed into the outer surface 6209 of the first component 6200 between the second and third longitudinal ribs 6204, 6205. The first longitudinal rib 6203 separates the first and second depressions 6206, 6207, the second longitudinal rib 6204 separates the second and third depressions 6207, 6208, and the third longitudinal rib 6205 separates the third and first depressions 6208, 6206.

Figure 68:
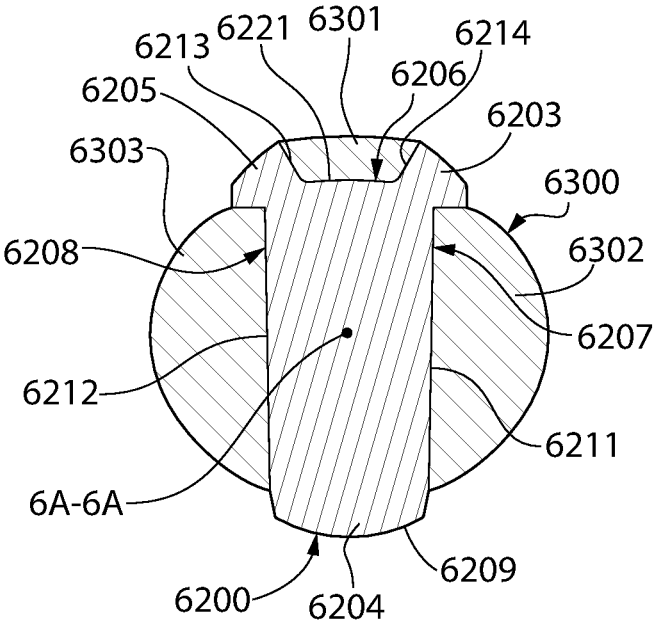
FIG. 68 is transverse cross-sectional view of the oral care implement of FIG. 54 taken along view LXVIII-LXVIII of FIG. 56.
Figure 69:
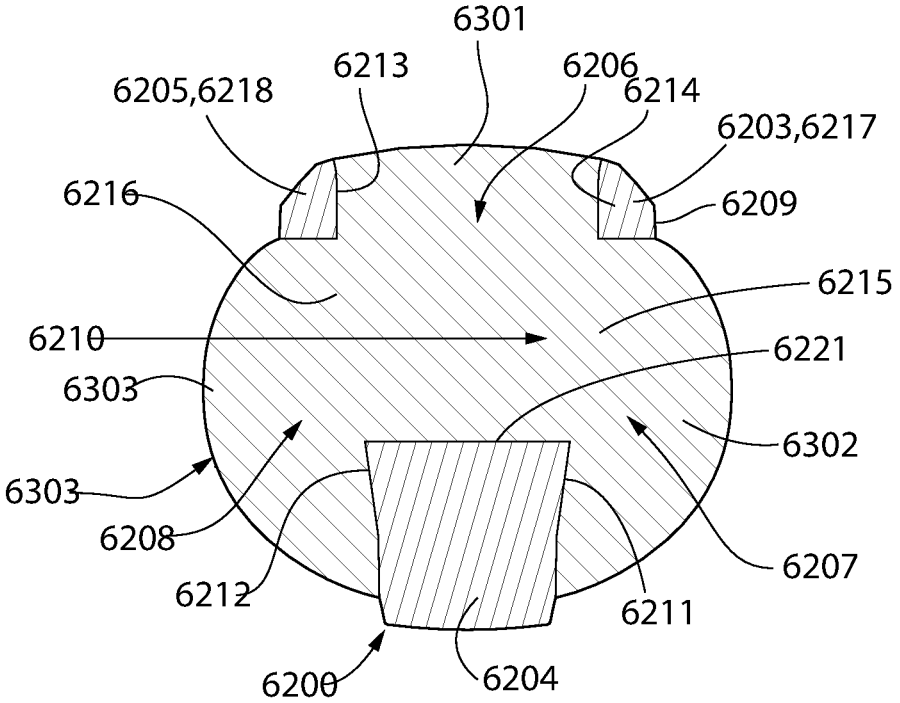
FIG. 69 is transverse cross-sectional view of the oral care implement of FIG. 54 taken along view LXIX-LXIX of FIG. 56.
Figure 70:
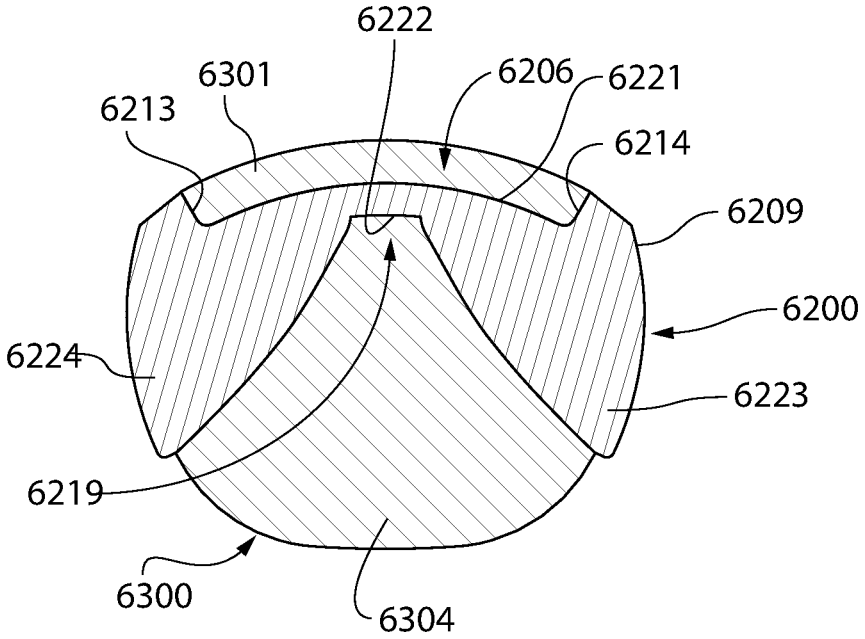
FIG. 70 is transverse cross-sectional view of the oral care implement of FIG. 54 taken along view LXX-LXX of FIG. 56.

The first, second and third depressions 6206-6208 are circumferentially spaced-apart from one another about the longitudinal axis 6A-6A (see FIG. 68). The first depression 6206 is located on the front side of the outer surface 6209 of the first component 6200. The second depression 6207 is located on the right side of the outer surface 6209 of the first component 6200. The third depression 6208 is located on the left side of the outer surface 6209 of the first component 6200. In certain other embodiments, the first, second and third depressions 6206-6208 may be located at different locations on the first component 6200.

In the exemplified embodiment, each of the first, second and third depressions 6206-6208 are longitudinally elongated. In other embodiments, the first, second and third depressions 6206-6208 can take on other shapes and/or configurations.

The first component 6200 further comprises a first through-hole 6210 extending from a floor 6211 of the second depression 6207 to a floor 6212 of the third depression 6208. The first through-hole 6210 extends through sidewalls 6213, 6214 of the first depression 6206, thereby spatially connecting the first, second and third depressions 6206-6208. The first through-hole 6210 forms a first gap 6215 in the sidewall 6214 of the first depression 6216, thereby creating a first bridge portion 6217 in the first longitudinal rib 6203. The first through-hole 6210 also forms a second gap 6216 in the sidewall 6213 of the first depression 6216, thereby creating a second bridge portion 6218 in the third longitudinal rib 6205. The first gap 6215 is located beneath the first bridge portion 6217 and the second gap 6216 is located beneath the second bridge portion 6218. Each of the first and second bridge portions 6217, 6218 are arched in the exemplified embodiment. In certain other embodiments, each of the first and second bridge portions 6217, 6218 may be linear.

In the exemplified embodiment, the first component 6200 further comprises a fourth depression 6219 formed into the outer surface 6209 of the first component 6200. As exemplified, the fourth depression 6219 is longitudinally elongated. In other embodiments, however, the fourth depressions 6219 may take on other shapes and/or configurations. The first and fourth depressions 6206, 6219 are located on opposite sides of the outer surface 6209 of the first component 6200, which in the exemplified embodiment are the front side and rear side respectively.

The first component 6200 also comprises a third through-hole 6220 that extends from a floor 6221 of the first depression 6206 to a floor 6222 of the fourth depression 6219. The third through-hole 6220 results in the first and fourth depressions 6206, 6219 being in spatial communication with one another. In the exemplified embodiment, the second longitudinal rib 6204 branches into a first rib section 6223 and a second rib section 6224. The first rib section 6223 converges with the first longitudinal rib 6203 and the second rib section 6224 converges with the third longitudinal rib 6205. The fourth depression 6219 is located between and formed by the first and second rib section 6223, 6224 of the second longitudinal rib 6204. As can also be seen, the first and third longitudinal ribs 6203, 25 also converge at the proximal end 6101 of the handle 6110. While the exemplified embodiment of the first component 6200 comprises the fourth depression 6219, the fourth depression 6219 may be omitted in certain other embodiments.

The first component 6200 further comprises a second through-hole 6225 extending through the body portion 6201 of the first component 6200. As discussed in greater detail below, the second through-hole 6225 is provided to receive the third component 6400 in embodiments where such a third component 6400 is desired. The second through-hole 6225 extends from the front side of the outer surface 6209 of the first component 6200 to the rear side of the outer surface 6209 of the first component 6200. In the exemplified embodiment, the second through-hole has a cross-sectional area that tapers with increasing depth from the opposing front and rear sides of the outer surface 6209 of the first component 6200. As a result an apex edge 6226 is formed that is embedded by the third component 6400 within the handle 6110. This structure assists with retaining the third component 6400 within the second through-hole 6225. In other embodiments, however, the cross-sectional area of the second through-hole 6225 may be substantially constant, may be stepped, or may increase and/or decrease in a repetitive manner.

As exemplified, the first through-hole 6210 extends transverse to the longitudinal axis 6A-6A in a first transverse direction. The second through-hole 6225 extends transverse to the longitudinal axis 6A-6A in a second transverse direction that is substantially perpendicular to the first transverse direction. The third through-hole 6220 extends longitudinally relative to the longitudinal axis 6A-6A. In certain other embodiments, the first, second and third through-holes 6210, 6225, 6220 may take on other orientations and/or arrangements.

Referring now to FIGS. 63-70 concurrently, the second component 6300 and its structural cooperation with the first component 6200 will be described in greater detail. The second component 6300 generally comprises a first portion 6301, a second portion 6302, a third portion 6303, and a fourth portion 6304. In the exemplified embodiment, each of the first, second, third and fourth portions 6301-6304 are elongated lobe portions. In certain other embodiments, the first, second, third and fourth portions 6301-6304 may take on other shapes and configurations, such as polygonal, irregular-shaped, strip-like, or combinations thereof. The shape of the first, second, third and fourth portions 6301-6304, in the exemplified embodiment, corresponds to the shape (and volume) of the first, second, third and fourth depression 6206-6208, 6219 respectively.

When the handle 6110 of the toothbrush 6100 is assembled, the first portion 6301 of the second component 6300 is disposed within the first depression 6206 of the first component 6200. The second portion 6302 of the second component 6300 is disposed within the second depression 6207 of the first component 6200. The third portion 6303 of the second component 6300 is disposed within the third depression 6208 of the first component 6200. The fourth portion 6304 of the second component 6300 is disposed within the fourth depression 6219 of the first component 6200. In the exemplified embodiment, each of the first, second, third and fourth portions 6301-6304 of the second component 6300 are connected together to form an integral mass of the second material of which the second component 6300 is constructed. The formation of such an integral mass is afforded by the existence of the first and third through-holes 6210, 6220 of the first component 6200 which, as discussed above, result in all of the first, second, third and fourth depressions 6206, 6207, 6208, 6219 being in spatial communication with one another. As a result, the second material of which the second component 6300 is constructed extends through the first and third through-holes 6210, 6220, thereby connecting each of the first, second, third and fourth portions 6301-6304 of the second component 6300 together to form said integral mass. The second component 6300 thus fills the first and third through-holes 6210, 6220 when the handle 6110 of the toothbrush 6100 is assembled (including the first and second gaps 6216, 6217.

Of note, the first portion 6301 of the second component 6300 comprises a collar section 6305 that wraps around a rim 6227 (FIG. 59) of the first component 6200 that circumscribes the second-through hole 6225. The rim 6227 separates the collar section 6305 of the second component 6300 from the third component 6400 when the handle 6110 of the toothbrush 6100 is assembled.

Turning now to FIGS. 54-55, 57-58 and 67 concurrently, the third component 6400 will be described in greater detail. The third component 6400 is a generally bulbous shaped body that bulges out of the second-through hole 6225 of the first component 6200. The third component 6400 fills the second through-hole 6225 of the first component 6200 and, thus, takes on the shape of the second through-hole 6225. The third component 6400 has a convex front surface 6471 and a convex rear surface 6472, which resemble an oval or elliptical shape. The bulbous shape of the third component 6400 enables the user to reliably roll and control the handle 6110 between the thumb and index fingers during use. The third component 6400 may also be non-bulging or have any number of shapes, such as circular, a true oval shape and the like.

In one preferred construction, the third component 6400 has a multiplicity of finger grip protrusions 6473 projecting from the front and rear surfaces 6471, 6472. The finger grip protrusions 6473 provide a tactile feature to increase the friction on the user's finger surfaces and thus enhance the user's ability to grip the handle 6110, particularly under wet conditions. The finger grip protrusions 6473 are preferably provided in a desired conical or frusto-conical shape for improved grip performance. In other embodiments, other roughened surfaces and geometries could be used.

Referring now to FIGS. 54-56, each of the first, second, third and fourth portions 6301-6304 of the second component 6300 have an outer surface 6306-6309 (respectively) that remain exposed when the handle 6110 of the toothbrush 6100 is fully assembled. In the exemplified embodiment, the outer surfaces 6306-6309 of the first, second, third and fourth portions 6301-6304 are isolated from one another by the outer surface 6209 of the first component 6200. This is achieved, at least in part, by each of the first, second and third longitudinal ribs 6203-6205 comprising a top surface 6230-6232 (which is a part of the outer surface 6209) that remains exposed when the handle 6110 is fully assembled. In other certain embodiments, the outer surfaces 6306-6309 of the first, second, third and fourth portions 6301-6304 may not be isolated from one another by the outer surface 6209.

A method of manufacturing the toothbrush 6100 according to one embodiment of the present invention will be described. The first component created in manufacturing the toothbrush 6100 is the first component 6200. To create the first component 6200, a first mold is provided having a first mold cavity and at least one port/nozzle for injecting the first hard plastic in a liquefied state into the first mold cavity. In one embodiment, a single port is used to inject the liquefied first hard plastic, which may be an opaque PP. The first mold cavity has a volume that is sized and shaped to correspond to the first component 6200 as described above and illustrated herein. The first mold may be two-part mold, as is known in the art. Once the first mold cavity is created/provided, liquefied first hard plastic is injected into the first mold so as to fill the first mold cavity. The liquefied first hard plastic is allowed to cool to an appropriate temperature so as to form the first component 6200, as described above and illustrated herein, for further handling.

Once the first component 6200 is created (and allowed to adequately cool for further handling), the first component 6200 is supported by one or more clamping members that engage one or more points of contact on first component 6200 with at least one set of arms.

Once the clamping member is properly supporting the first component 6200, the first component 6200 is positioned within a second mold cavity of a second mold. This positioning can be effectuated by either moving the first component 6200 into the second mold cavity or by creating the second mold cavity about the first component 6200 while supporting the first component 6200 in a stationary manner, which can be accomplished by translating and mating multiple pieces of the second mold into position so that the second mold cavity is formed about the first component 6200. The second mold cavity has a volume that is sized and shaped to correspond to the second component 6300. One or more ports are present in the second mold for injecting the second hard plastic in a liquefied state into the second mold cavity. In one embodiment, a single port is used to inject the liquefied first elastomeric material.

Once the first component 6200 is in proper position within the second mold cavity (and the second mold cavity is adequately sealed), the liquefied first elastomeric material (which may be a first TPE) is injected into the second mold cavity so as to fill the remaining volume of the second mold cavity that is not occupied by the first component 6200. The liquefied first elastomeric material forms the second component 6200 on (and within) the first component 6200 (as described above).

The liquefied first elastomeric material is then allowed to cool to an appropriate temperature, thereby forming the second component 6300 on (and within) the first component 6200, as described above. The first component 6200 and second component 6300 collectively form a handle assembly. If the first and second plastics are selected so as to be chemically compatible with one another, the first elastomeric material of the second component 6300 chemically bonds with the first hard plastic of the first component 6400 during the injection molding process.

Once the handle assembly is sufficiently cool for further handling, at least the middle section 6116 is positioned within a third mold cavity of a third mold. When in the third mold cavity, the second elastomeric material in a liquefied state is injected therein to fill the second through-hole 6225, which is enclosed by an appropriate mold, via a port. The second elastomeric material, in one embodiment, chemically bonds with the first hard plastic of the first component 6200 during this injection molding process.

In certain embodiments, the formation of the third component 6400 within the second through-hole 6225 of the first component 6200 may be accomplished in the second mold, thereby eliminating the need for a third mold.

The inventive aspects discussed above may be practiced for a manual toothbrush or a powered toothbrush. In operation, the previously described features, individually and/or in any combination, may improve the control, grip performance, aesthetics and cost point of oral implements. Other constructions of toothbrush are possible. For example, the head 6120 may be replaceable or interchangeable on the handle 6110. The head 6120 may include various oral surface engaging elements, such as inter-proximal picks, brushes, flossing element, plaque scrapper, tongue cleansers and soft tissue massages. While the various features of the toothbrush 6100 work together to achieve the advantages previously described, it is recognized that individual features and sub-combinations of these features can be used to obtain some of the aforementioned advantages without the necessity to adopt all of these features in an oral care implement.

Concept Seven

Figure 71:
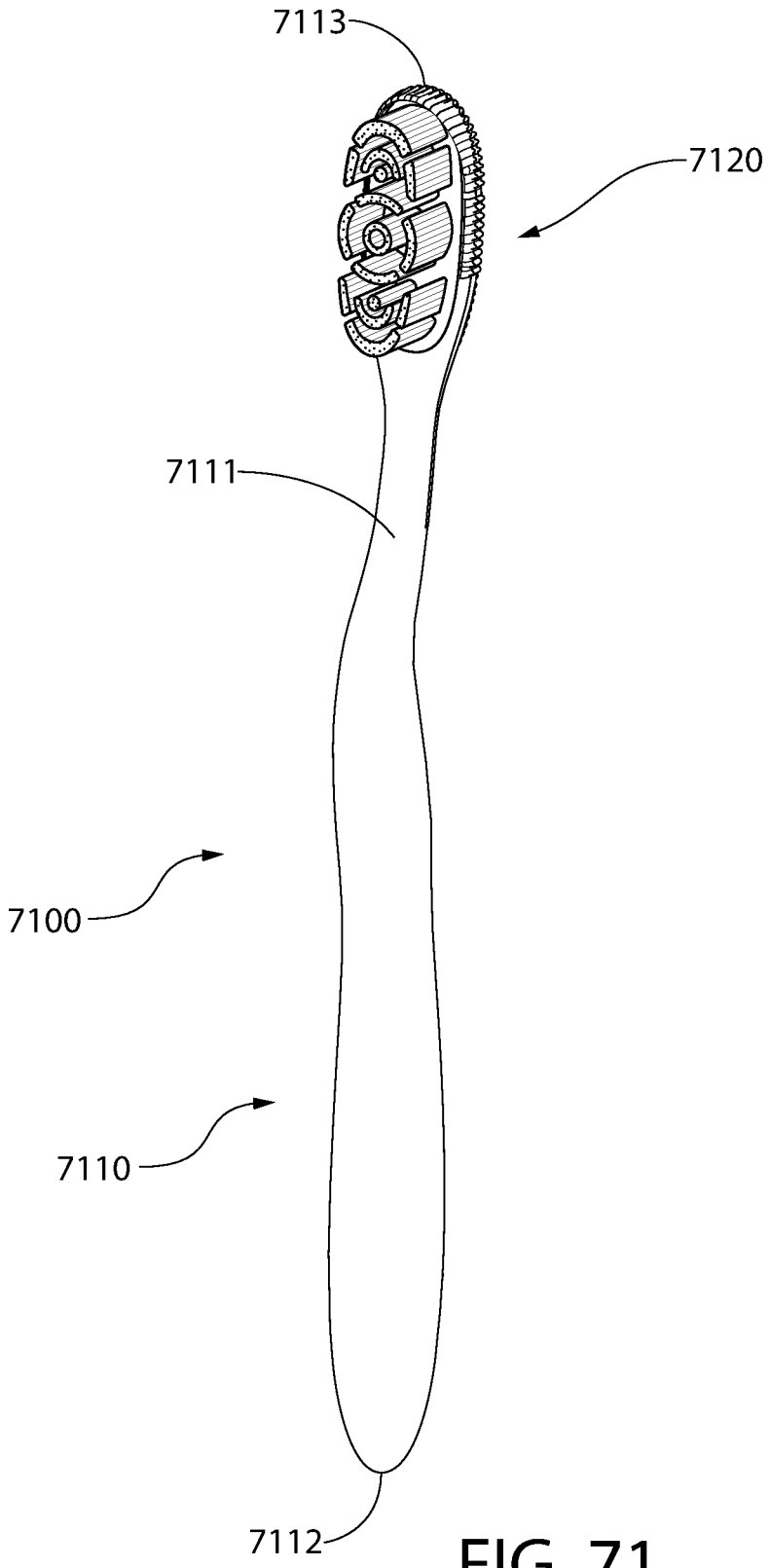
FIG. 71 is a front perspective view of an oral care implement according to an embodiment of the present invention.

Referring first to FIG. 71, an oral care implement 7100 is illustrated according to one embodiment of the present invention. The oral care implement 7100 generally comprises a handle 7110 and a head 7120. The handle 7110 provides the user with a mechanism by which he/she can readily grip and manipulate the oral care implement 7100. The handle 7110 is generically illustrated and may be formed of many different shapes, sizes, materials and by a variety of manufacturing methods that are well-known to those skilled in the art. For example, the handle 7110 can be constructed of elastomers, polypropylene, SAN, ABS, or even paper products such as a typical lollipop stick. If desired, the handle 7110 may include a suitable textured grip (not shown) made of a thermoplastic elastomer or can be a multi-part construction. The details of the handle 7110 are not limiting of the present invention and, thus, require no further discussion for purposes of the present invention.

The oral care implement 7100 extends from a proximal end 7112 to a distal end 7113. The head 7120 is operably connected to a distal end of the handle 7110. Generally, the head 7110 and the handle 7120 of the toothbrush are preferably formed as a single unitary structure using a molding, milling, machining or other suitable process. However, in other embodiments, the handle 7110 and head 7120 may be formed as separate components which are operably connected at a later stage of the manufacturing process by any suitable technique known in the art, including without limitation thermal welding, a tight-fit assembly, a coupling sleeve, adhesion, or fasteners. Whether the head 7120 and handle 7110 are of a unitary or multi-piece construction (including connection techniques) is not limiting of the present invention unless specifically stated in the claims.

Figure 72:
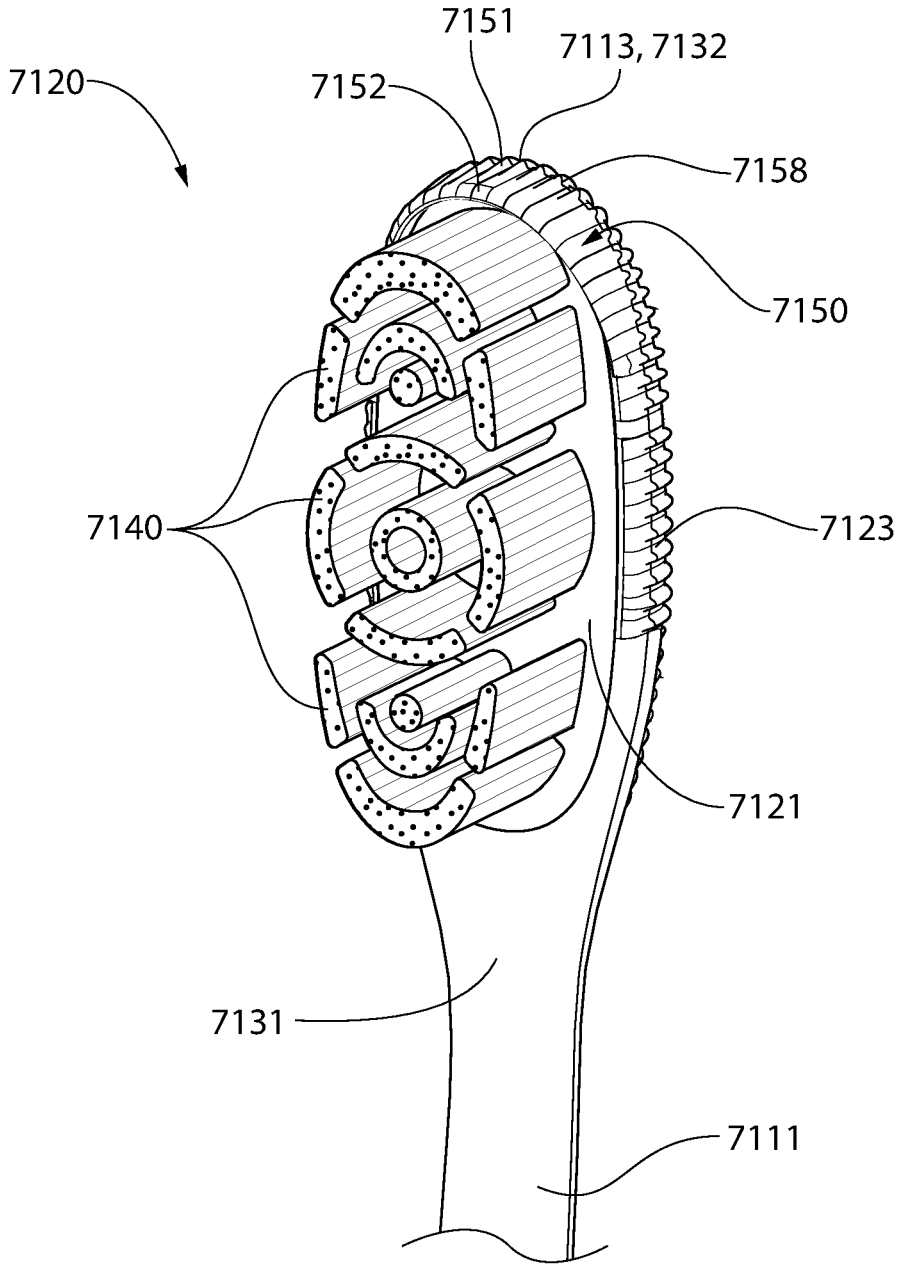
FIG. 72 is a close-up view of the head of the oral care implement of FIG. 71.
Figure 73:
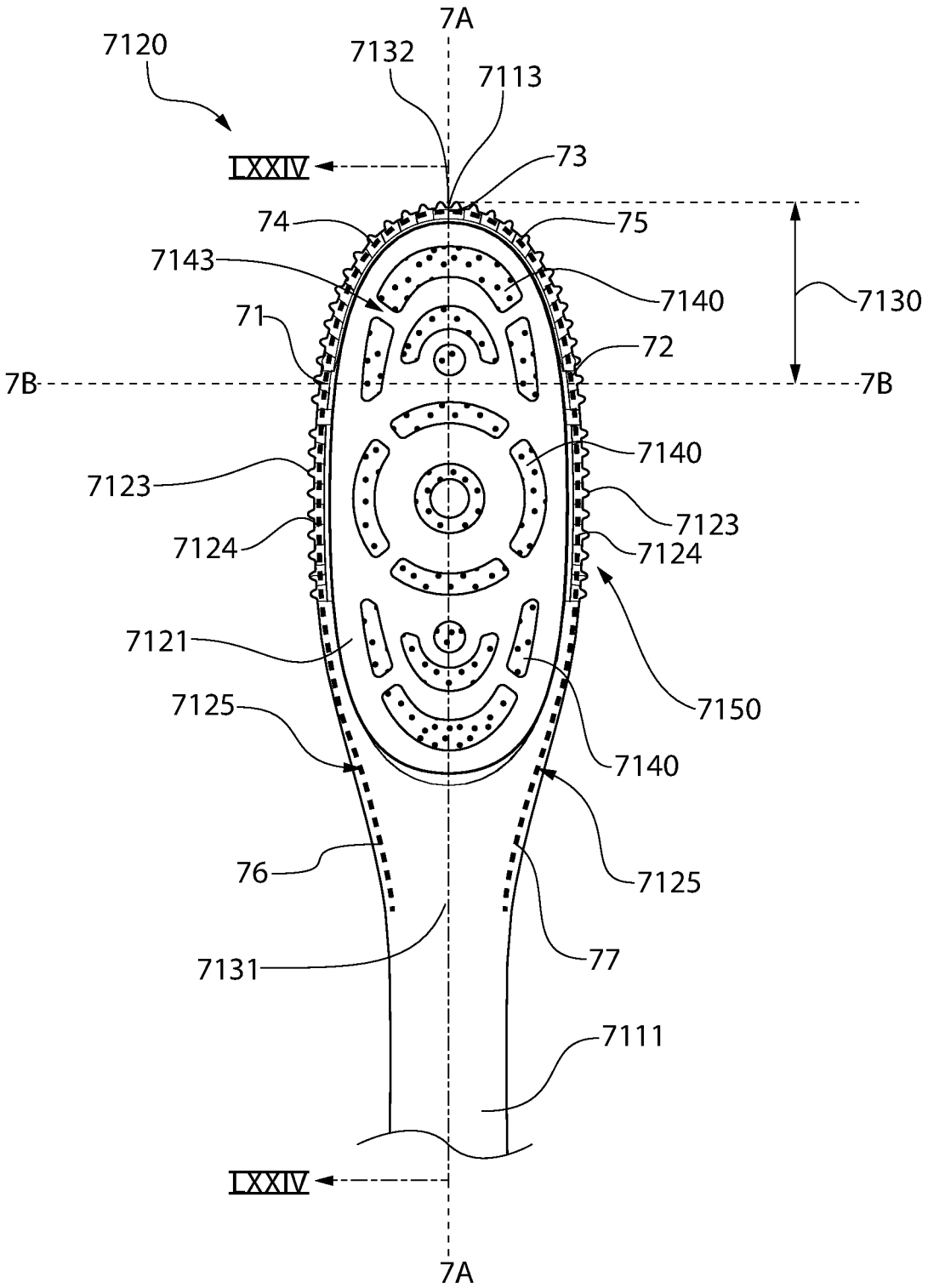
FIG. 73 is a front view of the head of the oral care implement of FIG. 71.
Figure 74:
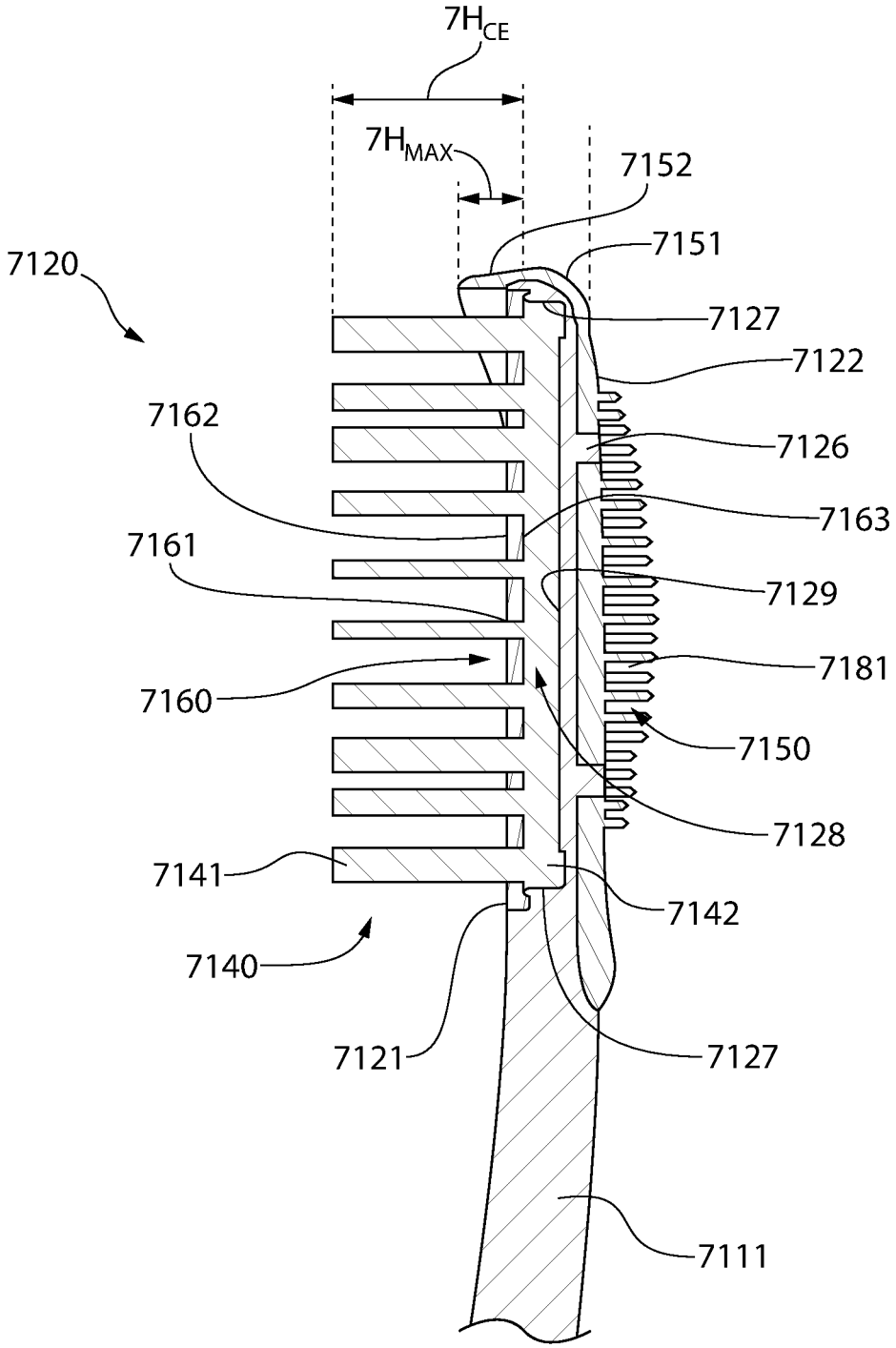
FIG. 74 is a longitudinal cross-sectional view of the head of the oral care implement of FIG. 71 along view LXXIV-LXXIV of FIG. 73.

It should be noted at this time that relative terms such as distal, middle, proximal, upper, lower, top, bottom, left, right etc. are merely used to delineate relative positions of the components of the oral care implement 7100 with respect to one another and are not intended to be in any further way limiting of the present invention Referring to FIGS. 72 and 73, the head 7120 extends along a longitudinal axis 7A-7A from a proximal end 7131 of the head 7120 to a distal end 7132 of the head 7120. The head 7120 generally comprises a front surface 7121, a rear surface 7122 that is opposite the front surface 7121 (as shown in FIG. 74) and a peripheral surface 7123. The peripheral surface 7123 extends between the front surface 7121 and the rear surface 7122, connecting the front and rear surfaces 7121, 7122 and defining a perimeter edge 7124 of the front surface 7121. The front surface 7121, the rear surface 7122, and the peripheral surface 7123 of the head 7120 can take on a wide variety of shapes and contours, none of which are limiting of the present invention. For example, the surfaces can be planar, contoured or combinations thereof. Furthermore, while the head 7120 is normally widened relative to the neck 7111 of the handle 7110, it could in some constructions simply be a continuous extension or narrowing of the handle 7110.

Referring to FIGS. 73-76 concurrently, the head 7120 further comprises an elastomeric component 7150, which may include a bumper portion 7151 that forms a distal-most section 7130 of the peripheral surface 7123 and a wall portion 7152 located along a distal-most section of the perimeter edge 7124. The wall portion 7152 protrudes above the front surface 7121. The wall portion 7152 extends along the perimeter edge 7124 in a continuous manner from a first point 71 of the perimeter edge 7124 to a second point 72 of the perimeter edge 7124. The first and second points 71, 72 are located on opposite sides of the longitudinal axis 7A-7A. The wall portion 7152 may comprise a first ramped portion 7153, a second ramped portion 7154, and an apex portion 7155 (best visible in FIG. 77). The apex portion 7155 is disposed between the first ramped position 7153 and the second ramped position 7154.

In one embodiment, the first ramped portion 7153 may extend from the first point 71 to a fourth point 74 of the perimeter edge 7124. The fourth point 74 is located between the first and third points 71, 73. The height of the first ramped portion 7153 of the wall portion 7152 increases from the first point 71 to the fourth point 74. The second ramped portion 7154 may extend from the second point 72 to a fifth point 75 of the perimeter edge 7124. The fifth point 75 is located between the second and third points 72, 73. The height of the second ramped portion 7154 of the wall portion 7152 increases from the second point 72 to the fourth point 75. The apex portion 7155 may extend from the fourth point 74 to the fifth point 75. The apex portion 7155, in the exemplified embodiment, has a substantially constant height from the fourth point 74 to the fifth point 75.

The wall portion 7152 has a maximum height $7H_{max}$ at the third point 73 of the perimeter edge 7124, which is located between the first and second points 71, 72. The third point 73 is located on the longitudinal axis LXXIV and on the apex portion 7155. The wall portion 7152 has a substantially zero height at the first and second points 71, 72.

In another embodiment, the first ramped portion 7153 may extend from the first point 71 to the third point 73, wherein the height of the first ramped portion 7153 of the wall portion 7152 may increase from the first point 71 to the third point 73. The second ramped portion 7154 may extend from the second point 72 to the third point 73, wherein the height of the second ramped portion 7154 of the wall portion 7152 may increase from the second point 72 to the third point 73. In such an embodiment, the apex portion 7155 may take the form of a single point, rather than a section.

Figure 75:
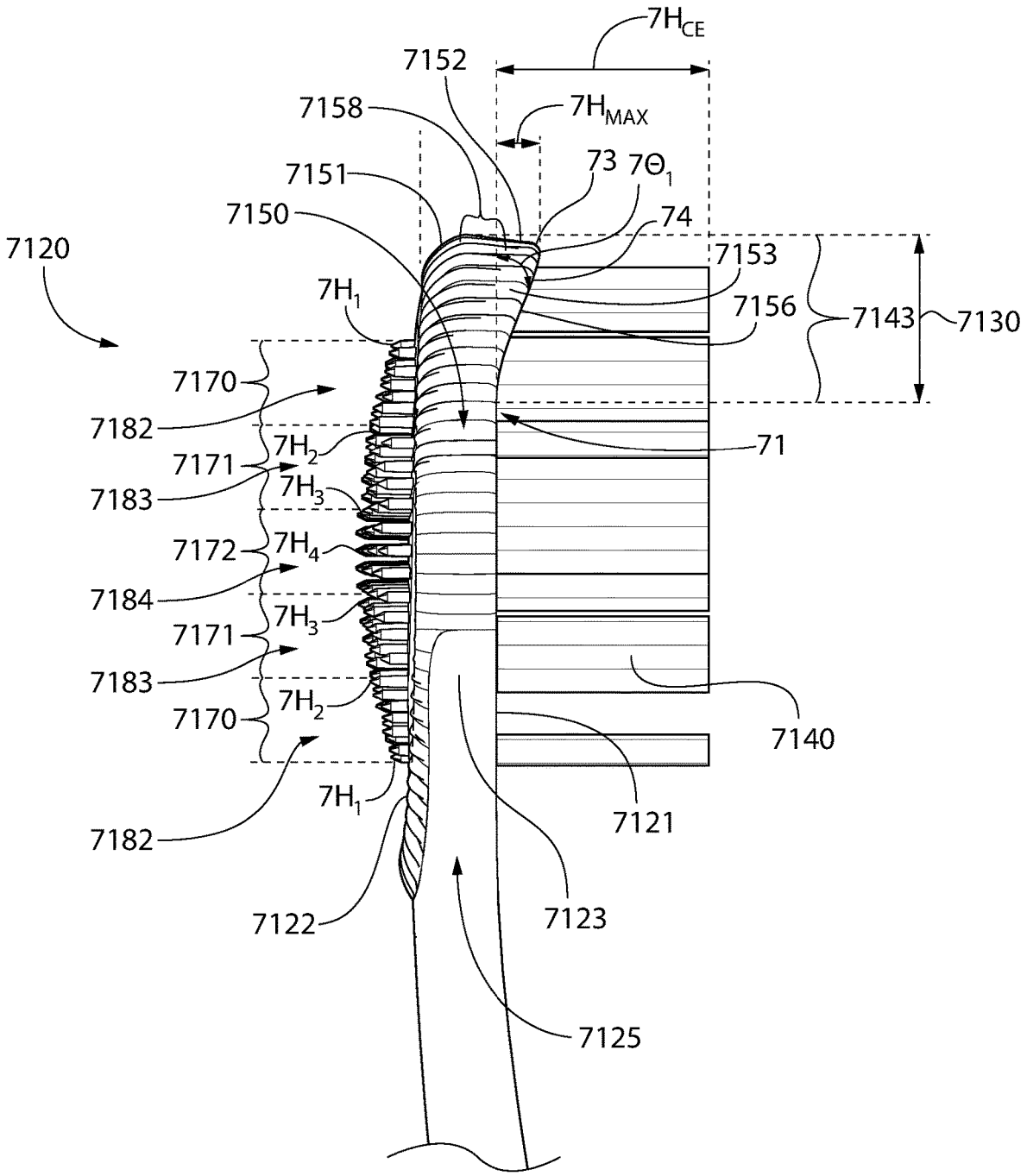
FIG. 75 is a right-side view of the head of the oral care implement of FIG. 71.

The first and second ramped portions 7153, 7154 may comprise an upper edge 7156, 7157 that appear as a linear slope when the head is viewed in side profile (see FIGS. 75 and 6). The first upper edge 7156 of the first ramped portion 7153 may extend upward from the front surface 7121 at an angle of $7Ø_1$ and the second upper edge 7157 of the second ramped portion 7154 may extend upward from the front surface 7121 at an angle of $7Ø_2$. The $7Ø_1$ and $7Ø_2$ may be the same or different and each $7Ø_1$ and $7Ø_2$ may be selected from an angle ranging from about 10° to about 60°; preferably from about 15° to about 45°; and more preferably about 25° to about 35°.

The wall portion 7152 and a transverse line 7B-7B extending between the first and second points 71, 72 of the perimeter edge 7124 collectively define a distal-most area 7130 of the front surface 7121 of the head 7120. A remaining portion of the perimeter edge 7125 may be free of the wall portion 7152. The remaining portion of the perimeter edge 7125 may extend from the first point 71 to a sixth point 76 alone the perimeter edge 7125. The remaining portion of the perimeter edge 7125 may also extend from the second point 72 to a seventh point 77 along the perimeter edge 7125. In some embodiments, the wall portion 7152 is arcuate and comprises a convex inner surface and a concave outer surface. The wall portion 7152 may be free of through-holes.

Figure 76:
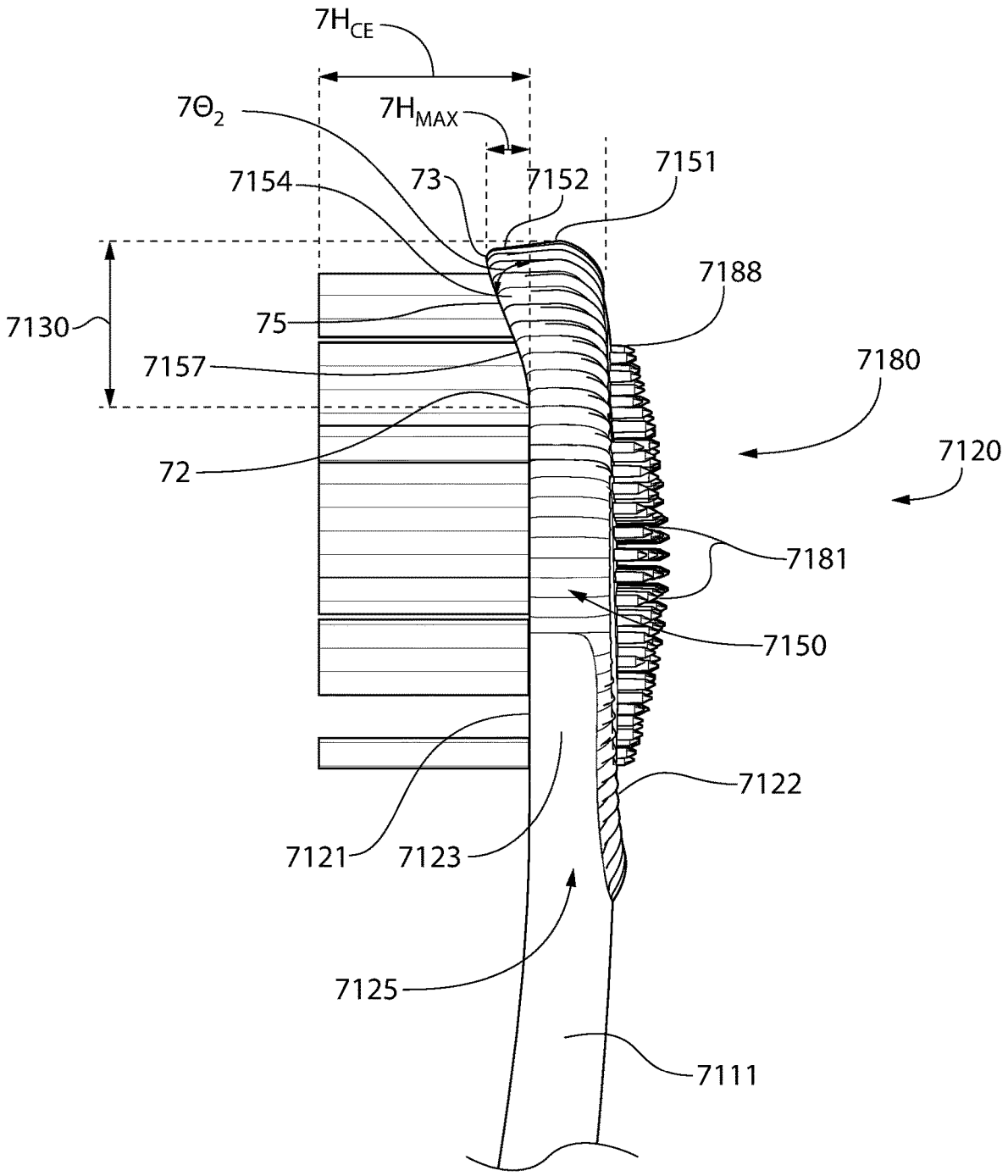
FIG. 76 is a left-side view of the head of the oral care implement of FIG. 71.

Referring to FIGS. 75 and 76, the elastomeric component 7150 may further comprise a plurality of spaced-apart ridges 7158 protruding from an outer surface of the bumper portion 7151 and an outer surface of the wall portion 7152. The elastomeric component 7150 may also comprise a plurality of spaced-apart ridges 7158 protruding from an outer surface along at least a portion of the peripheral surface 7123. The elastomeric component 7150 may further comprise a soft tissue cleanser 7180 on the rear surface 7122 of the head 7120, the soft tissue cleanser 7180 comprising a plurality of protuberances 7181. In some embodiments, the elastomeric component 7150 may be an integrally formed component and include the bumper portion 7151, the wall portion 7152, the plurality of spaced-apart ridges 7158, and the soft tissue cleanser 7180.

The soft tissue cleanser 7180 is preferably constructed of a biocompatible resilient material suitable for uses in an oral hygiene apparatus, such as a thermoplastic elastomer. As an example, one preferred elastomeric material is styrene-ethylene/butylene-styrene block copolymer (SEBS) manufactured by GLS Corporation. Nevertheless, SEBS material from other manufacturers or other materials. The soft tissue cleanser 7180 can be constructed of different types of resilient materials or the same resilient material with one or more different characteristics, such as color, hardness, density, flavor, and/or sensate.

As shown in FIG. 74, the head 7120 comprises a base portion 7126 formed of a rigid plastic, such as polypropylene. The elastomeric component 7150 may be injection molded to the base portion 7126. The base portion 7126 comprises a peripheral wall 7127 that forms a basin 7128, the head 7120 further comprises a head plate 7160 disposed within the basin 7128 and coupled to the base portion 7126.

The head plate 7160 comprises a plurality of through holes 7161. A plurality of cleaning elements 7140 are provided that extend through the through holes 7161 of the head plate. The plurality of cleaning elements 7140 extend from the front surface 7121 of the head 7120.

Each of the plurality of cleaning elements 7140 comprise a cleaning portion 7141 extending from an upper surface 7162 of the head plate 7160 for cleaning contact with an oral surface. Each of the plurality of cleaning elements 7140 also includes a melt portion 7142 located between a lower surface of the head plate 7163 and a floor of the basin 7129. The melt portions 7142 anchor the cleaning elements 7140 to the head. While the plurality of cleaning elements 7140 are particularly suited for brushing teeth, the plurality of cleaning elements 7140 can also be used to clean oral soft tissue, such as a tongue, gums, or cheeks instead of or in addition to teeth.

As used herein, the term "cleaning element" is used in a generic sense to refer to any structure that can be used to clean or massage an oral surface through relative surface contact. Common examples of "cleaning elements" include, without limitation, filament bristles, fiber bristles, nylon bristles, spiral bristles, rubber bristles, elastomeric protrusions, flexible polymer protrusions, combinations thereof and/or structures containing such materials or combinations.

Referring to FIGS. 74-77, the plurality of cleaning elements 7140 comprises a plurality of distal cleaning elements 7143 extending from the distal-most area 7130 of the front surface 7121. The maximum height $7H_{max}$ of the wall portion 7152 is less than or equal to one half of a height $7H_{CE}$ of a shortest one of the plurality of distal tooth cleaning elements 7143. In one embodiment, the maximum height $7H_{max}$ of the wall portion 7152 is less than or equal to one third of the height $7H_{CE}$ of a shortest one of the plurality of distal tooth cleaning elements 7143. In another embodiment, the maximum height $7H_{max}$ of the wall portion 7152 is less than or equal to one quarter of the height $7H_{CE}$ of a shortest one of the plurality of distal tooth cleaning elements 7143. The plurality of distal tooth cleaning elements 7143 may comprise tapered bristles.

In some embodiments the peripheral surface 7123 may comprise the elastomeric component 7150 and the rigid plastic used to form the base portion 7126 of the head 7120. In another embodiment, the peripheral surface 7123 may be entirely formed by the elastomeric component 7150.

With reference to FIGS. 75-79, the details of the elastomeric component 7150 includes the soft tissue cleanser 7180, which will now be discussed. The soft tissue cleanser 7180 is on the rear surface 7122 of the head 7120 and comprises a pad 7188 that forms at least a portion of the rear surface 7122 of the head 7120 of the oral care implement 7100. The pad 7188 is preferably injection molded directly to the head 7120 but can be molded separately and later fixed to the head 7120 if desired, for example by an adhesive or sonic welding. The pad 7188 extends from a distal end 7132 of the head 7120 to a proximal end 7131 of the head 7120 and may cover substantially the entire width of the head 7120, extending from a first lateral edge 7133 of the head 7120 towards a second lateral edge 7134 of the head 7120.

The elastomeric component 7150 may have one or more exposed underlying head portions 7189 extending therethrough exposing the base portion 7126. The exposed underlying head portions 7189 may be a variety of geometric shapes—such as circular or crescent shapes. In one embodiment, the exposed underlying head portions 7189 define a boundary for which a plurality of protuberances 7181 are positioned on the rear surface 7122 of the head 7120. In one embodiment, crescent shaped exposed underlying head portions 7189 define an annular shaped layout of the plurality of protuberances 7181 when looking at the rear surface 7122 of the head 7120.

The pad 7188 includes an exposed top surface 7190 on the rear surface 7122 of the head. The plurality of protuberances 7181 protrude from the rear surface 7122 of the head 7120 from the top surface 7190 of the pad 7188. The plurality of protuberances 7181 may include a first plurality of protuberances 7182 arranged in a first annular zone 7170 on the rear surface 7122. The first annular zone 7170 is the area defined between a first dotted line 7173 and a second dotted line 7174. Each of the first plurality of protuberances 7182 may have a height between a first predetermined height $7H_1$ and a second predetermined height $7H_2$, the second predetermined height $7H_2$ being greater than the first predetermined height $7H_1$.

The plurality of protuberances 7181 may further include a plurality of second protuberances 7183 protruding from the rear surface 7122 of the head 7120 and arranged in a second annular zone 7171 on the rear surface 7122. The first annular zone 7170 surrounds the second annular zone 7171. The second annular zone 7171 is the area defined between the second dotted line 7174 and a third dotted line 7175. Each of the second plurality of protuberances 7183 may have a height between the second predetermined height $7H_2$ and a third predetermined height $7H_3$, the third predetermined height $7H_3$ being greater than the second predetermined height $7H_2$.

The plurality of protuberances 7181 may further include a plurality of third protuberances 7184 protruding from the rear surface 7122 of the head 7120 and arranged in a third zone 7172 on the rear surface 7122. The second annular zone 7171 surrounds the third annular zone 7173. The third zone 7172 may be annular zone or it may be a central zone. The third annular zone 7172 is the area defined within the third dotted line 7175. Each of the third plurality of protuberances 7184 have a height between the third predetermined height $7H_3$ and a fourth predetermined height $7H_4$, the fourth predetermined height $7H_4$ being greater than the third predetermined height $7H_3$.

In some embodiments, the plurality of first protuberances 7182 may comprise protuberances having a plurality of different heights between the first and second predetermined heights $7H_1$, $7H_2$. The plurality of second protuberances 7183 may comprise protuberances having a plurality of different heights between the second and third predetermined heights $7H_2$, $7H_3$. The plurality of third protuberances 7184 may comprises protuberances having a plurality of different heights between the third and fourth predetermined heights $7H_3$, $7H_4$.

In certain embodiments, the plurality of first protuberances 7182 consist only of protuberances having a height between the first and second predetermined heights $7H_1$, $7H_2$. The plurality of second protuberances 7183 consist only of protuberances having a height between the second and third predetermined heights $7H_2$, $7H_3$. The plurality of third protuberances 7184 consist only of protuberances having a height between the third and fourth predetermined heights $7H_3$, $7H_4$.

The first predetermined height $7H_1$ may be in a range of 0.5 mm to 1.5 mm, the second predetermined height $7H_2$ may be in a range of 1.5 mm to 2.5 mm, the third predetermined height $7H_3$ may be in a range of 2.5 mm to 3.5 mm, and the fourth predetermined height $7H_4$ may be in a range of 3.5 mm to 6.0 mm.

In some embodiments, free ends of the first, second and third protuberances 7182, 7183, 7184 collectively form a convex side profile (see FIGS. 75 and 76). In some embodiments, the free ends of the first, second and third protuberances 7182, 7183, 7184 may also collectively form a convex top profile (see FIG. 7).

The plurality of first protuberances 7182 comprises first conical nubs, the plurality of second protuberances 7183 comprises second conical nubs, and the plurality of third protuberances 7184 comprises third conical nubs. In one embodiment, the plurality of first protuberances 7182 consists only of the first conical nubs, the plurality of second protuberances 7183 consists only of second conical nubs, and the plurality of third protuberances 7184 consists only of the third conical nubs. The plurality of conical nubs extends from the pad portion 7188.

As used herein a "nub" is generally meant to include a column-like protrusion (without limitation to the cross-sectional shape of the protrusion) which is upstanding from a base surface. In a general sense, the nub, in the preferred construction, has a height that is greater than the width at the base of the nub (as measured in the longest direction). Nevertheless, nubs could include projections wherein the widths and heights are roughly the same or wherein the heights are somewhat smaller than the base widths. Moreover, in some circumstances (e.g., where the nub tapers to a tip or includes a base portion that narrows to a smaller projection), the base width can be substantially larger than the height.

The first, second, and third plurality of nubs 7182-7184 are designed to engage the oral soft tissue to significantly reduce a major source of bad breath in people and improve hygiene. The first, second, and third plurality of nubs 7182-7184 enable removal of microflora and other debris from the tongue and other soft tissue surfaces within the mouth. The tongue, in particular, is prone to develop bacterial coatings that are known to harbor organisms and debris that can contribute to bad breath. This microflora can be found in the recesses between the papillae on most of the tongue's upper surface as well as along other soft tissue surfaces in the mouth. When engaged or otherwise pulled against a tongue surface, for example, the first, second, and third nubs provide for gentle engagement with the soft tissue while reaching downward into the recesses of adjacent papillae of the tongue. The elastomeric construction of the soft tissue cleanser 7180 also enables a top surface 7190 of the pad 7188 to follow the natural contours of the oral tissue surfaces, such as the tongue, cheeks, lips, and gums of a user. Moreover, the first, second, and third nubs are able to flex as needed to traverse and clean the soft tissue surfaces in the mouth along which it is moved.

In the illustrated embodiment, the first, second, and third nubs are preferably conically shaped. As used herein, "conically shaped" or "conical" is meant to include true cones, frusto-conically shaped elements, and other shapes that taper to a narrow end and thereby resemble a cone irrespective of whether they are uniform, continuous in their taper, or have rounded cross-sections. The base portion of each the conically shaped first, second, and third nubs 7182-7184 is larger than the corresponding tip portion.

Furthermore, the resilient material of the first, second, and/or third annular zones 7170, 7171, 7172 may also be imbued with a sensory material, which can be any suitable biocompatible medication or chemical for oral use. The sensory material is released inside the mouth, lips, or cheeks by way of several methods, including but not limited to abrasion, a temperature change, a change in pH or dissolution. In one embodiment, the sensory material is a sensate that provides a biochemical sensory response to the inside tissue and surfaces of the mouth. Such a sensory response is understood to result from stimulation of the trigeminal nerve of a human. A sensate generally produces a physiological effect without a taste, with such effect usually represented by the terms cooling, tingle, and hot (or heat). Sensates are usually derived from single compounds that are not volatile and that do not have a smell or taste per se. As one example, a chemical known as capsaicin, found naturally in chile peppers, can be used to provide a tingle, a hot or warm massage, or a heating or warm, soothing sensation to a user. Capsaicin is also known to provide pain relief and numbing sensations when topically applied. Some examples of sensates that produce cooling sensations include (−)-menthol and camphor. Most of the polyols, including maltitol syrup, sorbitol, mannitol, erythritol, isomalt and xylitol, also provide a cooling sensation. The coolest of the polyols, erythritol, provides a distinct cooling sensation. Both erythritol and xylitol cool the mouth and fight the sensation of dry mouth commonly associated with prescription drugs and dental hygiene products. Erythritol is a naturally occurring four-carbon structure. Xylitol is a five-carbon sugar found in fruits and vegetables and made in small amounts by the human system as a metabolic intermediate.

In another embodiment, the sensory material is provided as flavoring agent for causing an olfactory sensory response in a human. A flavor agent is commonly understood to include a mixture of compounds that are volatile and produce an aromatic effect and that stimulate the olfactory bulb. Flavors are generally transmitted through the nasal passages, and are often selected and used for their unique association with certain consumer benefits, such as lavender for stress relief or relaxation. Another flavor example is chamomile, which has a strong, aromatic smell and is often used medicinally against sore stomach and as a relaxant to help you fall asleep. Chamomile is also used as a mouthwash against oral mucositis (the swelling, irritation, and ulceration of the mucosal cells that line the digestive tract).

In one embodiment, the first, second, and/or third annular zone 7170, 7171, 7172 can be imbued with both a sensate component and a flavor component. The soft tissue cleanser 7180 may be an integrally formed singular component.

Figure 77:
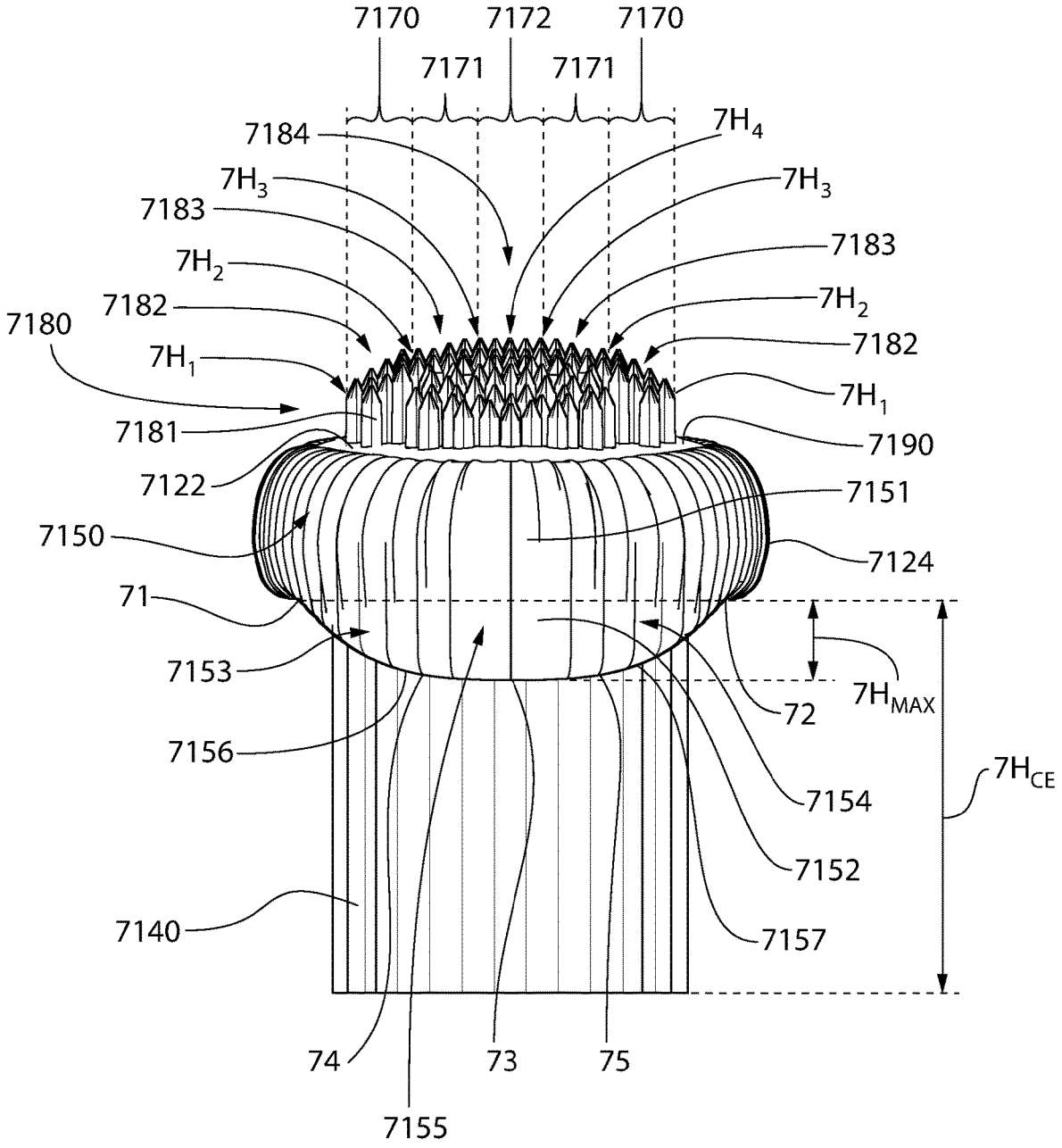
FIG. 77 is an enlarged top view of the head of the oral care implement of FIG. 71.
Figure 78:
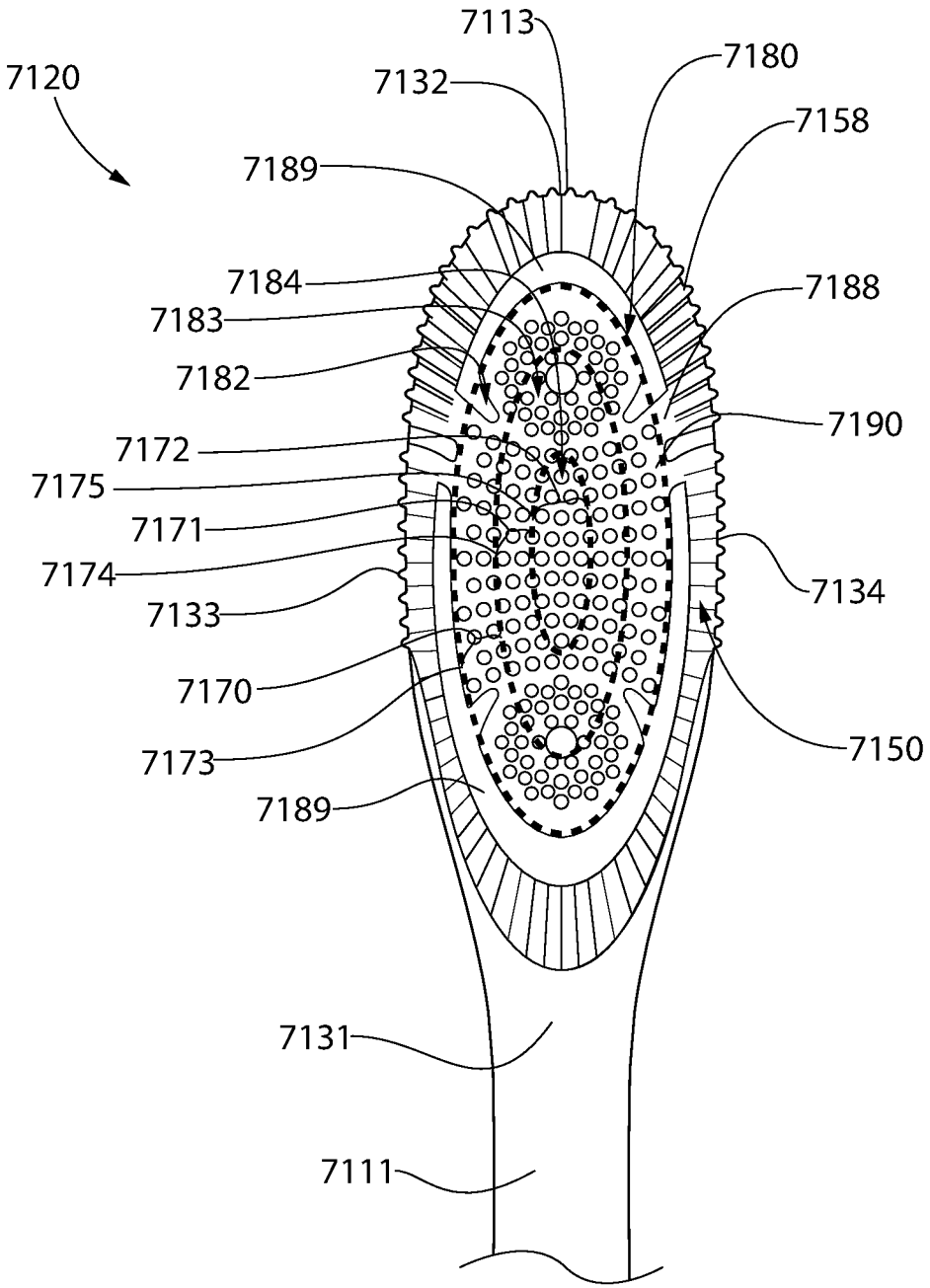
FIG. 78 is a rear view of the head of the oral care implement of FIG. 71.
Figure 79:
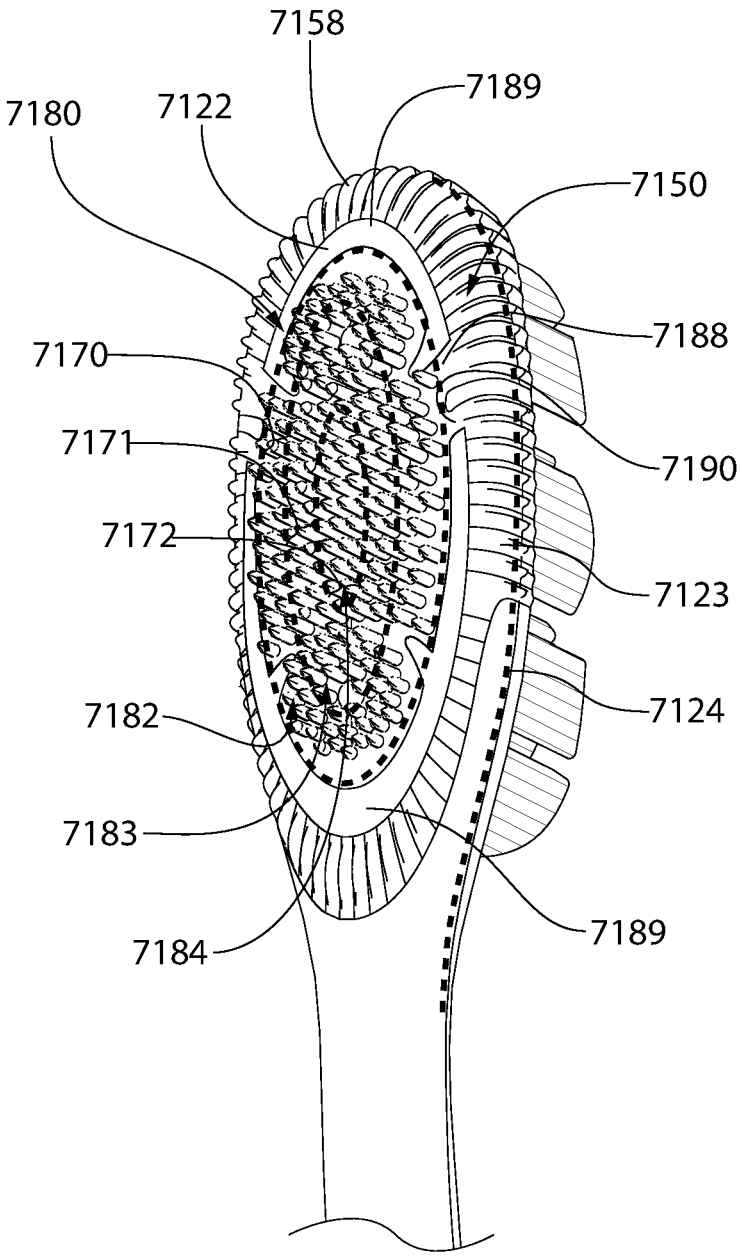
FIG. 79 is a rear perspective view of the head of the oral care implement of FIG. 71.

Referring now to FIGS. 76-78 concurrently, one preferred embodiment of manufacturing the head 7120 via an injection molding process will be described. First, the head 7120 is formed by injecting a liquefied hard plastic, such as PP or SAN, into a mold having the appropriately shaped fill cavity. Once the head 7120 is sufficiently cooled (the structure of which is described above), an outer mold is placed about the head 7120 for forming the elastomeric component 7150. The elastomeric component 7150 is formed by an overmolding process which involves injecting a single shot of a first type of liquefied thermoplastic elastomer about the head 7122 via a first port having a first size. The first type of liquefied thermoplastic elastomer surrounds the head 7120 and fills available gaps/grooves on the head 7120. As a result, the elastomeric component 7150 is formed as illustrated. The elastomeric component 7150 may also be made using separate shots, each using different types of thermoplastic elastomer, to form different components of the elastomeric component 7150—for example one shot for the pad 7188 and another shot for the plurality of protuberances 7181. This allows the pad 7188 and the plurality of protuberances 7181 to be formed of different types of elastomers, which may be useful for elastomeric components 7150 having differing colors, flavors, sensates or material properties, such as hardness or density.

Another embodiment of manufacturing the head 7120 includes the head plate 7160 which clusters of the plurality of cleaning elements 7140 are inserted through the through holes 7161. The rear ends of the plurality of cleaning elements 7140 are melted thereby affixing the plurality of cleaning elements 7140 to the head plate 7160. The melted portions form the melt portion 7142 that adheres to the head plate 7160 and bonds the plurality of cleaning elements 7140 to each other.

Concept Eight

Figure 80:
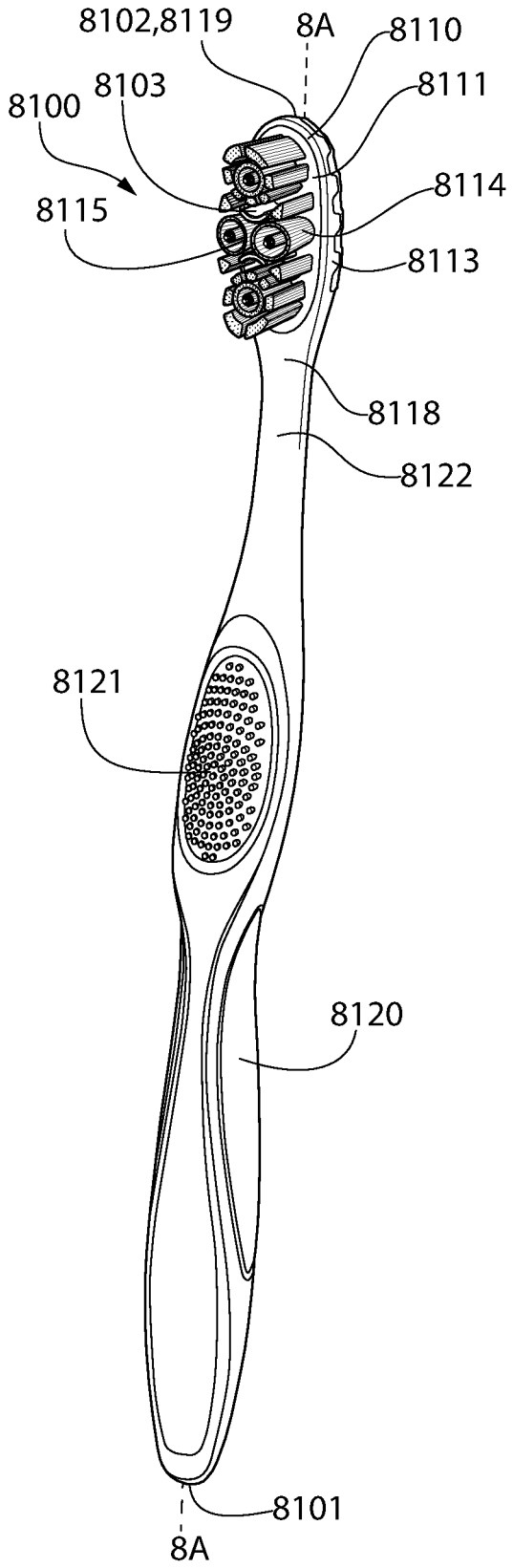
FIG. 80 is front perspective view of an oral care implement in accordance with an embodiment of the present invention.
Figure 81:
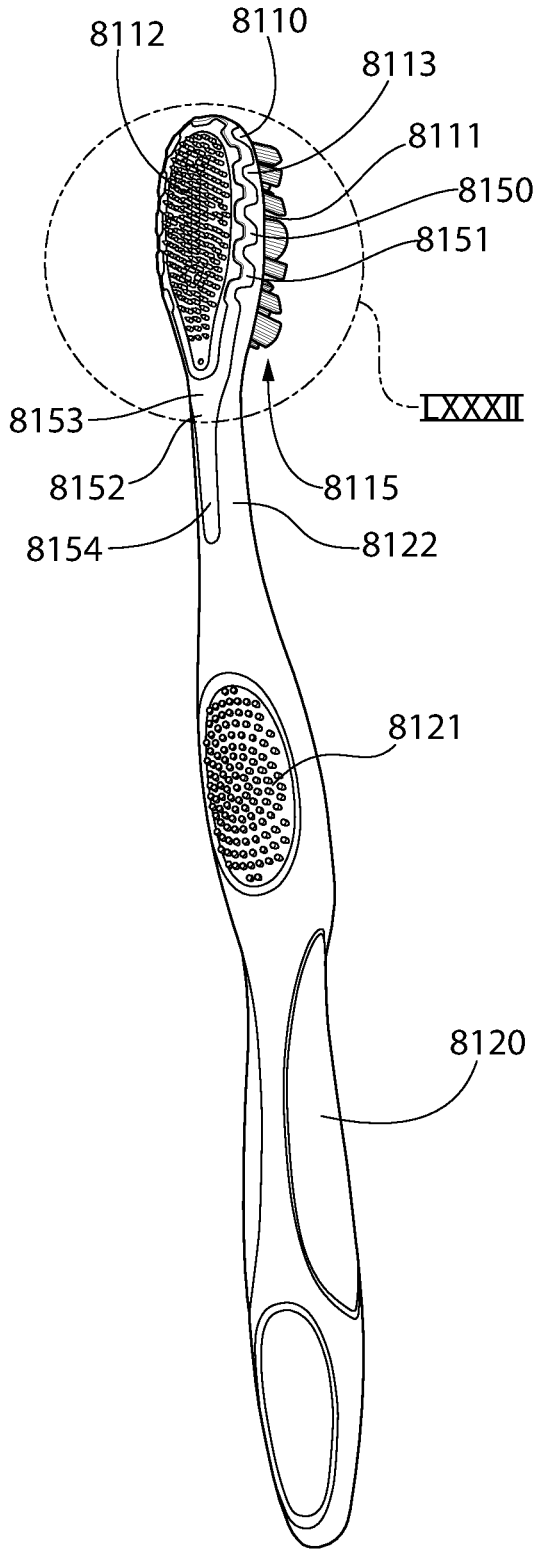
FIG. 81 is a rear perspective view of the oral care implement of FIG. 80.

Referring first to FIGS. 80 and 81 concurrently, an oral care implement 88100 is illustrated in accordance with one embodiment of the present invention. In the exemplified embodiment, the oral care implement 8100 is in the form of a manual toothbrush. However, in certain other embodiments the oral care implement 8100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Thus, it is to be understood that the inventive concepts discussed herein can be applied to any type of oral care implement unless a specific type of oral care implement is specified in the claims.

The oral care implement 8100, which generally comprises a head 8110 and a handle 8120, extends from a proximal end 8101 to a distal end 8102 along a longitudinal axis 8A-8A. The head 8110 extends from a proximal end 8118 to a distal end 8119 along a longitudinal axis that is coextensive with the longitudinal axis 8A-8A of the oral care implement 8100. Furthermore, in the exemplified embodiment the distal end 8102 of the oral care implement 8100 is the same as the distal end 8119 of the head 8110.

The handle 8120 is an elongated structure that provides the mechanism by which the user can hold and manipulate the oral care implement 8100 during use. In the exemplified embodiment, the handle 8120 is generically depicted having various contours for user comfort. Of course, the invention is not to be limited by the specific shape illustrated for the handle 8120 in all embodiments and in certain other embodiments the handle 8120 can take on a wide variety of shapes, contours, and configurations, none of which are limiting of the present invention unless so specified in the claims.

In the exemplified embodiment, the handle 8120 is formed of a hard or rigid plastic material, such as for example without limitation polymers and copolymers of ethylene, propylene, butadiene, vinyl compounds, and polyesters such as polyethylene terephthalate. The handle 8120 also includes a grip 8121 that is formed of a resilient/elastomeric material. In the exemplified embodiment the grip 8121 is molded over a portion of the handle 8120 that is typically gripped by a user's thumb and forefinger during use. Furthermore, it should be appreciated that additional regions of the handle 8120 can be overmolded with the resilient/elastomeric material to enhance the gripability of the handle 8120 during use. For example, portions of the handle 8120 that are typically gripped by a user's palm during use may be overmolded with a thermoplastic elastomer or other resilient material to further increase comfort to a user. Furthermore, materials other than those noted above can be used to form the handle 8120, including metal, wood, or any other desired material that has sufficient structural rigidity to permit a user to grip the handle 8120 and manipulate the oral care implement 8100 during toothbrushing.

The head 8110 of the oral care implement 8100 is coupled to the handle 8120 and comprises a front surface 8111 and an opposing rear surface 8112. Furthermore, the head 8110 comprises a peripheral surface 8113 extending between the rear surface 8112 and the front surface 8111. In the exemplified embodiment, the head 8110 is formed integrally with the handle 8120 as a single unitary structure using a molding, milling, machining, or other suitable process. However, in other embodiments the handle 8120 and the head 8110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus, the head 8110 may, in certain embodiments, be formed of any of the rigid plastic materials described above as being used for forming the handle 8120, although the invention is not to be so limited in all embodiments and other materials that are commonly used during toothbrush head manufacture may also be used.

The oral care implement 8100 also comprises a plurality of tooth cleaning elements 8115 extending from the front surface 8111 of the head 8110. The invention is not to be limited by the structure, pattern, orientation, and material of the tooth cleaning elements 8115 in all embodiments. Furthermore, where it does not conflict with the other disclosure provided herein or the claims, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, polybutylene terephthalate (PBT) bristles, spiral bristles, rubber bristles, elastomeric protrusions, flexible polymer protrusions, combinations thereof, and/or structures containing such materials or combinations. Thus, any combination of these tooth cleaning elements may be used within the tooth cleaning elements 8115 in some embodiments. Furthermore, where bristles are used for one or more of the tooth cleaning elements 8115, such bristles can be tapered, end-rounded, spiral, or the like.

In embodiments that use elastomeric materials to form one or more of the tooth cleaning elements 8115, suitable elastomeric materials may include any biocompatible resilient material suitable for uses in an oral hygiene apparatus. To provide optimum comfort as well as cleaning benefits, the elastomeric material of any such tooth cleaning element may have a hardness property in the range of A10 to A70 Shore hardness in one embodiment, or A8 to A25 Shore hardness in another embodiment. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Figure 83:
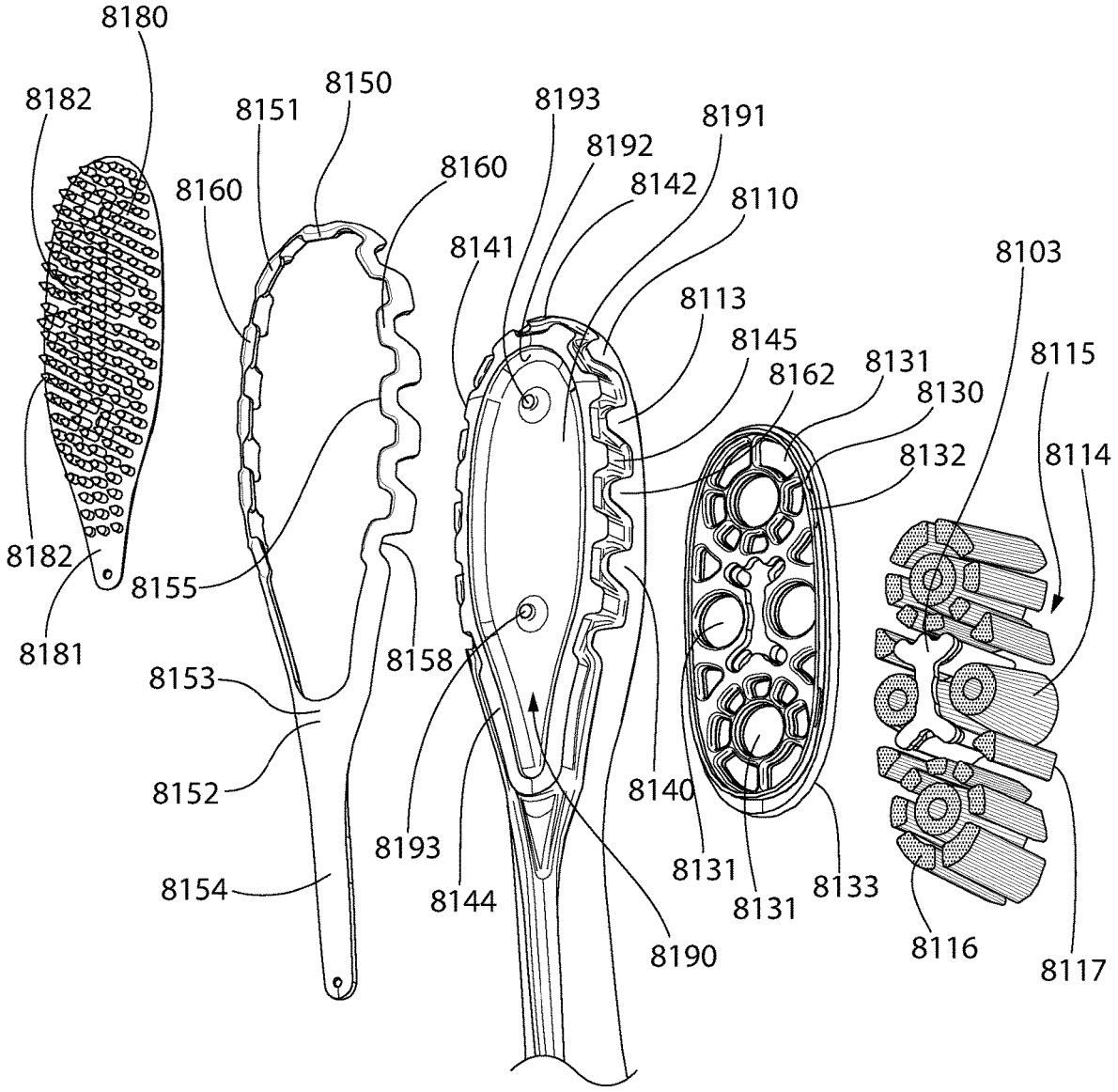
FIG. 83 is an exploded view of a head of the oral care implement of FIG. 80.
Figure 84:
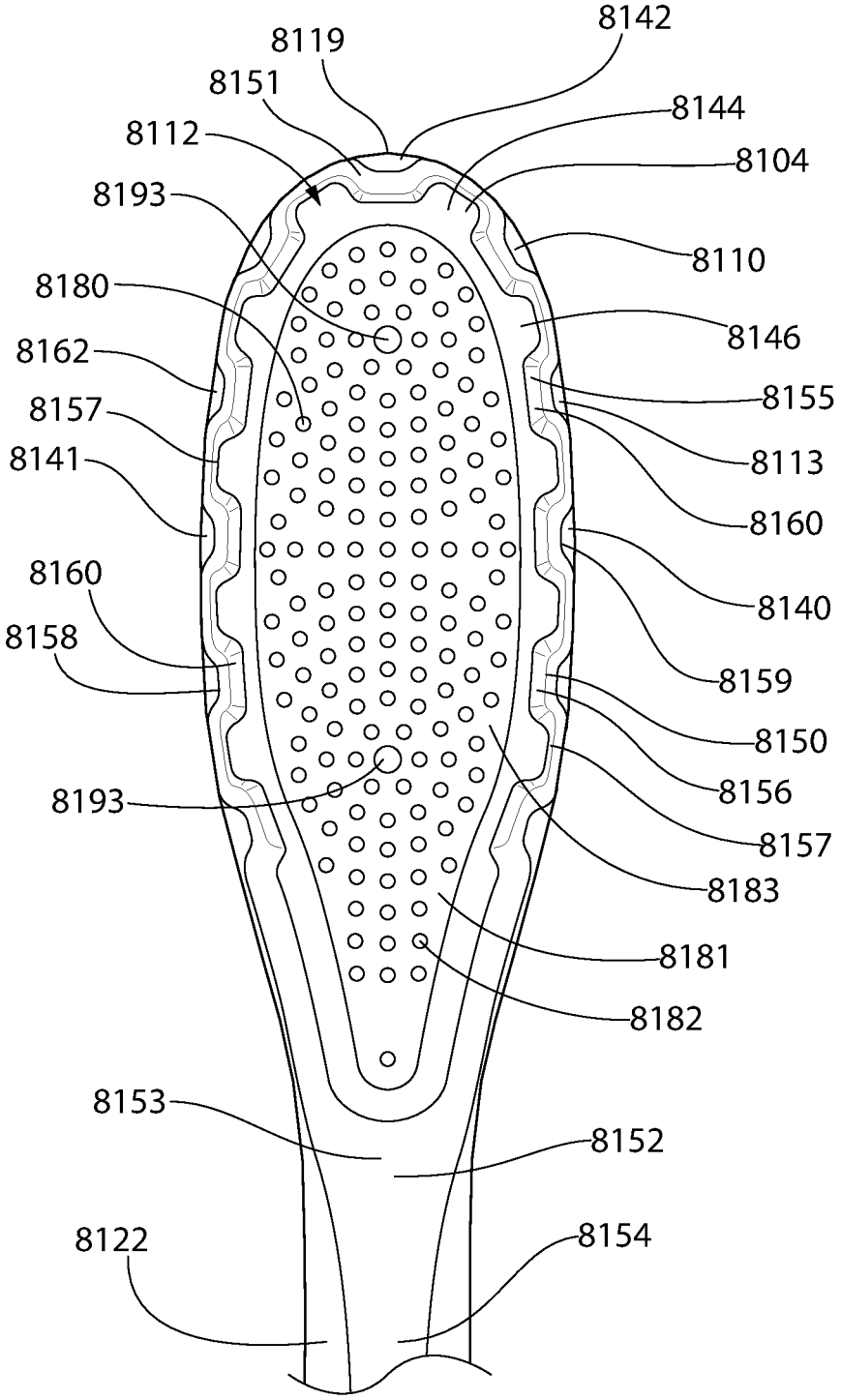
FIG. 84 is a rear view of the head of the oral care implement of FIG. 80.
Figure 86:
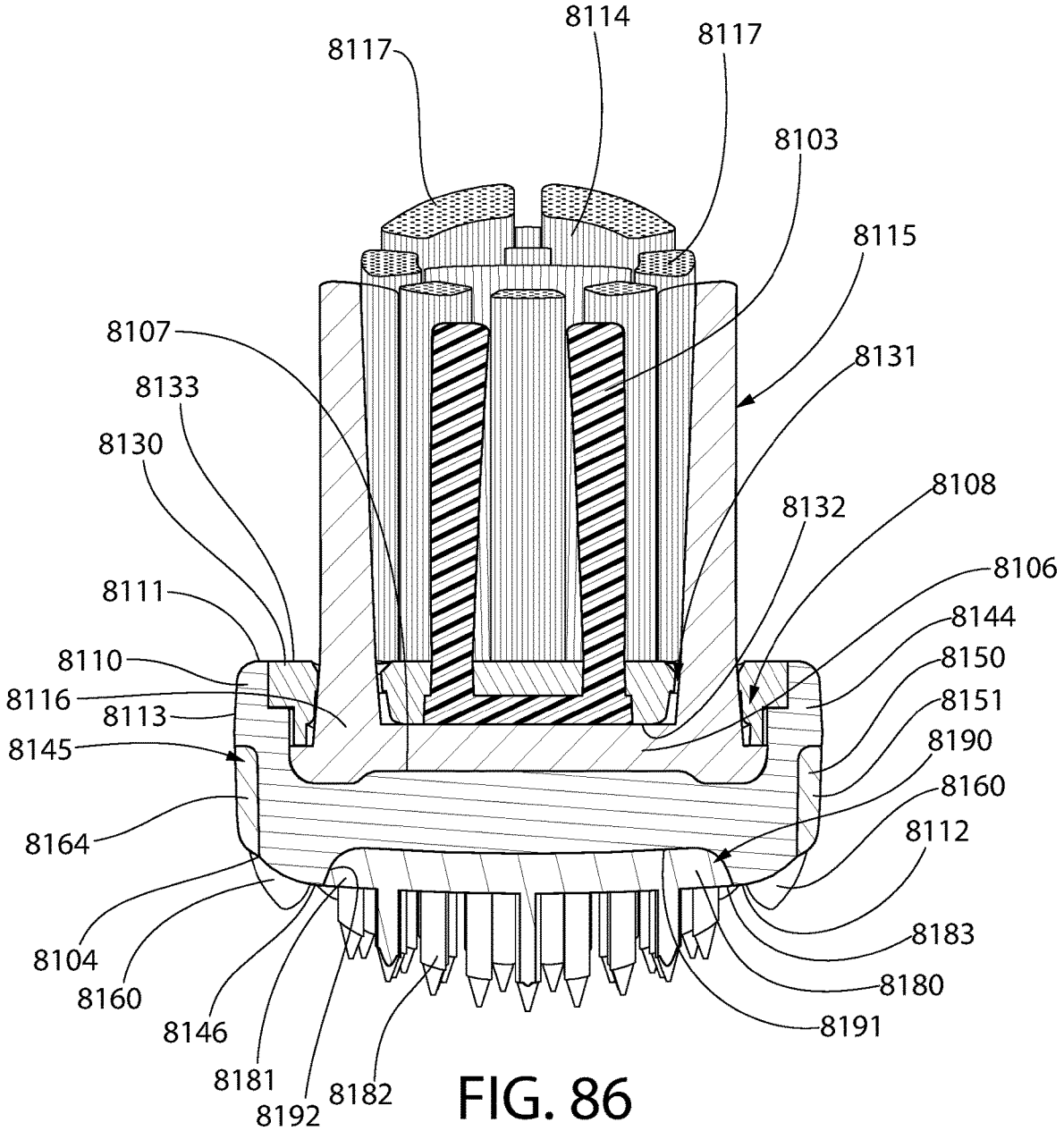
FIG. 86 is a cross-sectional view taken along line LXXXVI-LXXXVI of FIG. 85.
Figure 87:
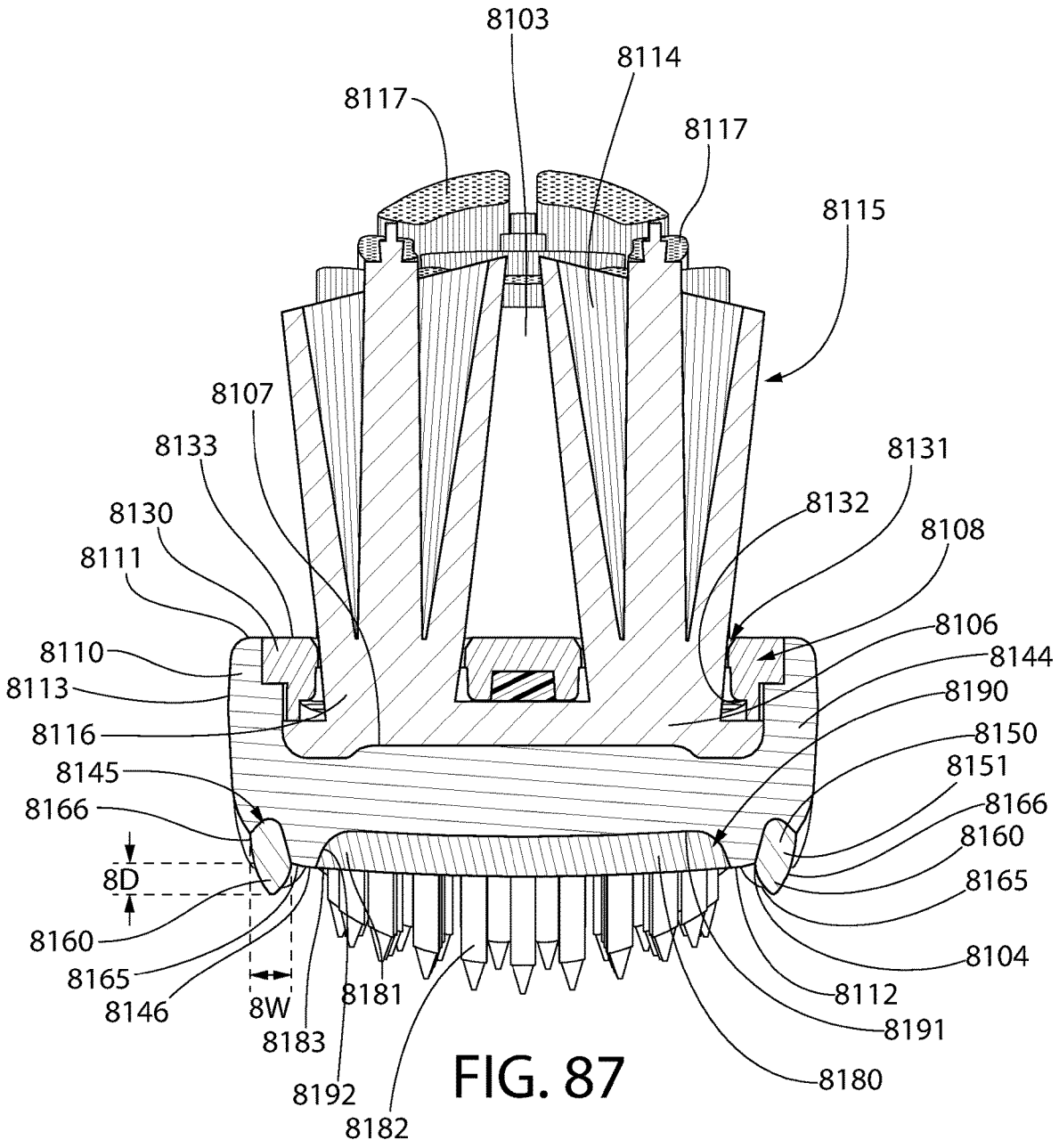
FIG. 87 is a cross-sectional view taken along line LXXXVII-LXXXVII of FIG. 85.

The tooth cleaning elements 8115 may be coupled to the head 8110 in any manner known in the art, including staples, in-mold tufting (IMT), anchor-free tufting (AFT), or a modified AFT known as AMR. Referring briefly to FIGS. 83, 86, and 87, one manner in which the tooth cleaning elements 8115 are secured to the head 8110 via AFT will be described. Specifically, in the embodiment exemplified the tooth cleaning elements 8115 are formed as a cleaning element assembly on a head plate 8130 such that one or more of the tooth cleaning elements 8115 are mounted onto the head plate 8130 and then the head plate 8130 is coupled to the head 8110. In such an embodiment, the head plate 8130 is a separate and distinct component from the head 8110 of the oral care implement 8100. However, the head plate 8130 is connected to the head 8110 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 8130 and the head 8110 are separately formed components that are secured together during manufacture of the oral care implement 8100.

In certain embodiments, the head plate 8130 may comprise an upper surface 8133 and a lower surface 8132. The upper surface 8133 of the head plate 8130 forms a portion of the front surface 8111 of the head 8110 when the head plate 8130 is coupled to the head 8110 as discussed herein. The head plate 8130 comprises a plurality of holes 8131 formed therethrough from the upper surface 8133 to the lower surface 8132, and the tooth cleaning elements 8115 may be mounted to the head plate 8130 within the holes 8131. Specifically, in AFT a plate or membrane (i.e., the head plate 8130) is created separately from the head 8110. The tooth cleaning elements 8115 (such as bristles, elastomeric elements, and combinations thereof) are positioned into the head plate 8130 so as to extend through the holes 8131 of the head plate 8130. The free ends 8117 of the tooth cleaning elements 8115 on one side of the head plate 8130 perform the cleaning function. The anchor portions 8116 of the tooth cleaning elements 8115 on the other side of the head plate 8130 are melted together by heat to be anchored in place. As the tooth cleaning elements 8115 are melted together, a melt matte 8106 is formed. The melt matte 8106 is a thin layer of plastic that is formed by melting the anchor portions 8116 of the bristles so that the anchor portions 8116 of the bristles transition into a liquid, at which point the liquid of the anchor portions 8116 of the bristles combine together into a single layer of liquid plastic that at least partially covers the lower surface 8132 of the head plate 8130. After the heat is no longer applied, the melted anchor portions 8116 of the bristles solidify/harden to form the melt matte 8106 or thin layer of plastic.

After the tooth cleaning elements 8115 are secured to the head plate 8130, the head plate 8130 is secured to the head 8110 such as by ultrasonic welding or mechanical techniques (i.e., snap-fit, interference fit, slot-and-tab, or the like) so that the upper surface 8133 of the head plate 8130 forms at least a portion of the front surface 8111 of the head 8110. When the head plate 8130 is coupled to the head 8110, the melt matte 8106 is located between the lower surface 8132 of the head plate 8130 and a floor 8107 of a basin 8108 of the head 8110 in which the head plate 8130 is disposed. The melt matte 8106, which is coupled directly to and in fact forms a part of the tooth cleaning elements 8115, prevents the tooth cleaning elements 8115 from being pulled through the holes 8131 in the head plate 8130 to ensure that the tooth cleaning elements 8115 remain attached to the head plate 8130 during use of the oral care implement 8100.

As noted above, in another embodiment the tooth cleaning elements may be connected to the head 8110 using a technique known in the art as AMR. In this technique, the handle is formed integrally with the head plate as a one-piece structure. After the handle and the head plate are formed, the bristles are inserted into holes in the head plate so that the free/cleaning ends of the bristles extend from the front surface of the head plate and the bottom ends of the bristles are adjacent to the rear surface of the head plate. After the bristles are inserted into the holes in the head plate, the bottom ends of the bristles are melted together by applying heat thereto, thereby forming a melt matte at the rear surface of the head plate. The melt matte is a thin layer of plastic that is formed by melting the bottom ends of the bristles so that the bottom ends of the bristles transition into a liquid, at which point the liquid of the bottom ends of the bristles combine together into a single layer of liquid plastic that at least partially covers the rear surface of the head plate. After the heat is no longer applied, the melted bottom ends of the bristles solidify/harden to form the melt matte/thin layer of plastic. In some embodiments, after formation of the melt matte, a tissue cleanser is injection molded onto the rear surface of the head plate, thereby trapping the melt matte between the tissue cleanser and the rear surface of the head plate. In other embodiments, other structures may be coupled to the rear surface of the head plate to trap the melt matte between the rear surface of the head plate and such structure without the structure necessarily being a tissue cleanser (the structure can just be a plastic material that is used to form a smooth rear surface of the head, or the like).

Of course, techniques other than AFT and AMR can be used for mounting the tooth cleaning elements 8115 to the head 8110, such as widely known and used stapling techniques or the like. In such embodiments the head plate 8130 may be omitted and the tooth cleaning elements 8115 may be coupled directly to the head 8110. Furthermore, in a further modified version of the AFT and AMR processes discussed above, the head plate 8130 may be formed by positioning the tooth cleaning elements 8115 within a mold, and then molding the head plate 8130 around the tooth cleaning elements 8115 via an injection molding process.

Referring again to FIGS. 80 and 81, in the exemplified embodiment the plurality of tooth cleaning elements 8115 includes a plurality of separate tufts of bristles 8114 and a plurality of elastomeric tooth cleaning elements 8103. Although illustrated herein as having a specific arrangement and shape, the arrangement of the tufts of bristles 8114 and elastomeric tooth cleaning elements 8103 as well as the shapes thereof can be modified from that which is depicted in the figures. Thus, the collective tooth cleaning elements 8115 can be any pattern or arrangement and each one of the tooth cleaning elements 8115 can have any desired shape.

Referring to FIGS. 82-87 concurrently, the head 8110 of the oral care implement 8100 will be described in more detail. As noted above, the head 8110 comprises the front surface 8111, the rear surface 8112 opposite the front surface 8111, and the peripheral surface 8113 extending between the front and rear surfaces 8111, 8112. The peripheral surface 8113 forms a periphery of the head 8110 and defines the outermost boundary of the head 8110. The peripheral surface 8113 of the head 8110 includes a first lateral side portion 8140, a second lateral side portion 8141 opposite the first lateral side portion 8140, and a distal portion 8142 extending between the first and second lateral side portions 8140, 8141. The distal portion 8142 of the peripheral surface 8113 includes the distal end 8119 of the head 8110.

The head 8110 of the oral care implement 8100 comprises a base 8144 that is formed of a hard plastic material, such as any of the materials noted above for forming the handle 8120 (including polypropylene and the like). Furthermore, the head 8110 comprises a first elastomeric soft tissue cleanser 8150 and a second elastomeric soft tissue cleanser 8180 that are coupled to the base 8144. Each of the first and second elastomeric soft tissue cleansers 8150, 8180 are formed of a resilient and flexible elastomeric material, such as a thermoplastic elastomer. The first and second elastomeric soft tissue cleansers 8150, 8180 serve to clean the user's tongue and soft tissue surfaces and to protect the user's gums. Specifically, the first elastomeric soft tissue cleanser 8150 is positioned on the peripheral surface 8113 of the head 8110 and thus reduces the impact of the hard plastic of the base 8144 against the user's gums during use of the toothbrush. The first elastomeric soft tissue cleanser 8150 also includes raised features that protrude beyond the rear surface 8112 of the head 8110 and can also be used for cleaning/scraping a user's tongue. The second elastomeric soft tissue cleanser 8180 is positioned on the rear surface 8112 of the head 8110 and can be used to clean and scrub a user's tongue and other soft tissue surfaces. The combination of the first and second elastomeric soft tissue cleansers 8150, 8180 also results in a highly desirable aesthetic appearance for the oral care implement 8100.

Figure 82:
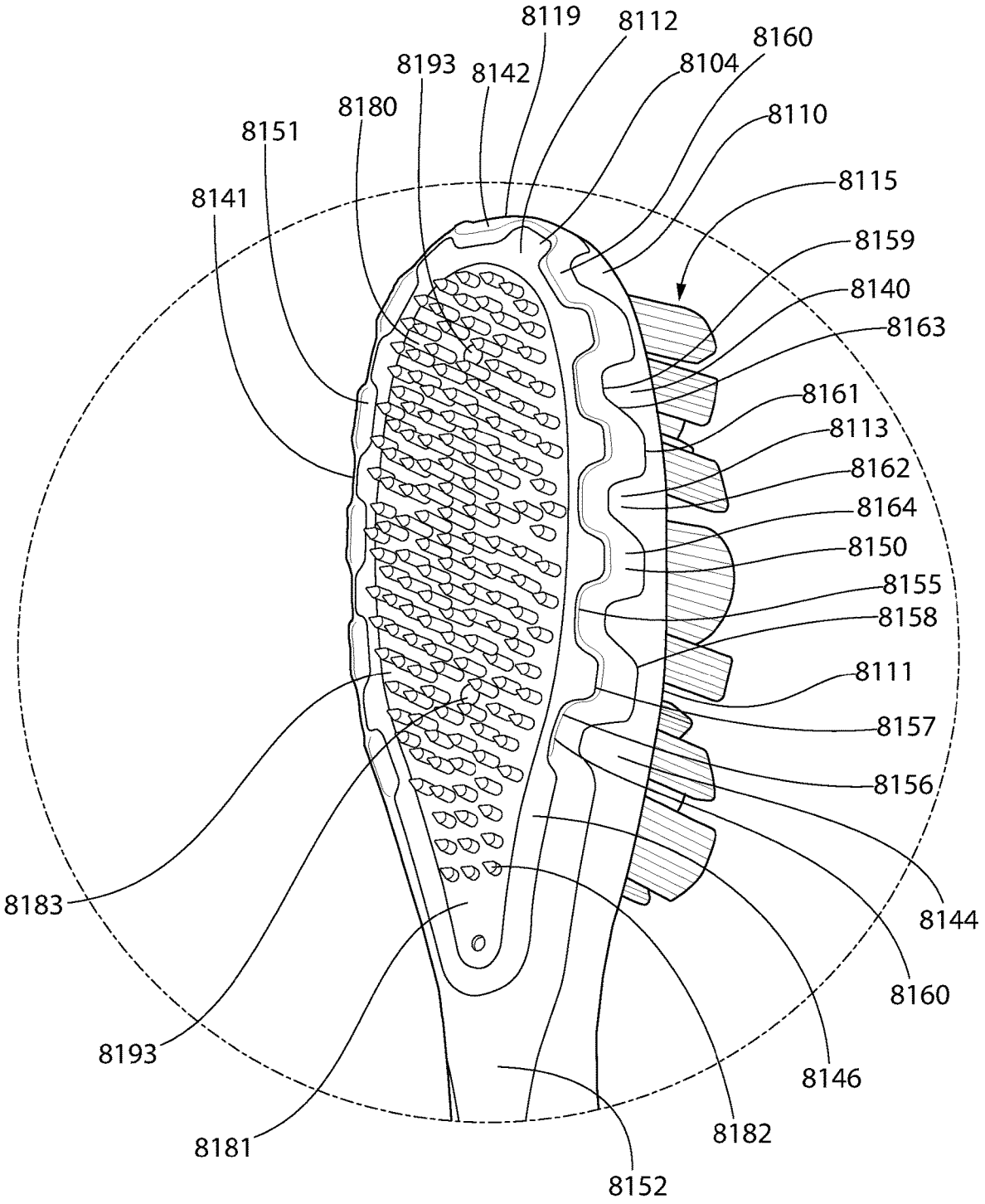
FIG. 82 is a close-up view of area III of FIG. 81.

As noted above, the second elastomeric soft tissue cleanser 8180 is coupled to the base 8144 of the head 8110 on the rear surface 8112 of the head 8110. The second elastomeric soft tissue cleanser 8180 comprises a pad 8181 and a plurality of protuberances 8182 that extend from the pad 8181. In the exemplified embodiment, each of the plurality of protuberances 8182 is in the form of a nub. As used herein a "nub" generally refers to a column-like protrusion (without limitation to the cross-sectional shape of the protrusion) which is upstanding from a base surface. In a general sense, the protuberances 8182 in the preferred construction have a height that is greater than the width at the base of the protuberance 8182 (as measured in the longest direction). Nevertheless, protuberances or nubs could include projections wherein the widths and heights are roughly the same or wherein the heights are somewhat smaller than the base widths. Moreover, in some circumstances (e.g., where the protuberances taper to a tip or include a base portion that narrows to a smaller projection), the base width can be substantially larger than the height. Furthermore, in the exemplified embodiment the plurality of protuberances 8182 have varying heights such that some of the protuberances 8182 are taller than other of the protuberances 8182 (as best seen in FIGS. 82, 86, and 87).

The base 8144 of the head 8110 comprises a basin 8190 formed therein. The basin 8190 is defined by a floor 8191 that is recessed relative to the rear surface 8112 of the head 8110 and a sidewall 8192 that extends from the floor 8191 to the rear surface 8112 of the head 8110. The second elastomeric soft tissue cleanser 8180 is positioned within the basin 8190. More specifically, the pad 8181 of the second elastomeric soft tissue cleanser 8180 is disposed within the basin 8190 so that an exposed surface 8183 of the pad 8181 is flush or substantially flush with the portion of the rear surface 8112 of the head 8110 that is formed by the base 8144 (substantially flush can be the exposed surface 8183 of the pad 8181 either extending beyond or being recessed relative to the rear surface 8112 of the base 8144 of the head 8110 by between approximately 0.1 mm and 1.0 mm). The exposed surface 8183 of the pad 8181 thus forms a part of the rear surface 8112 of the head 8110. Furthermore, the plurality of protuberances 8192 extend from the rear surface 8112 of the head 8110 for contact with a user's soft tissue surfaces. The second elastomeric soft tissue cleanser 8180 may be coupled to the head via an injection molding process (i.e., by injection molding an elastomeric material directly into the basin 8190 while the head 8110 is positioned within a mold). In certain embodiments the head 8110 may include one or more peg members 8193 that extend upwardly from the floor 8191 of the basin 8190 to assist in retaining the second elastomeric soft tissue cleanser 8180 within the basin 8190.

The first elastomeric soft tissue cleanser 8150 is a completely separate and distinct component relative to the second elastomeric soft tissue cleanser 8180. Thus, in the exemplified embodiment the first and second elastomeric soft tissue cleansers 8150, 8180 are completely isolated from one another and do not overlap or contact one another at any location. Rather, the first and second elastomeric soft tissue cleansers 8150, 8180 are isolated from one another by an exposed portion 8146 of the base 8144 of the head 8110. Thus, the first elastomeric soft tissue cleanser 8150 may be injection molded to the head 8110 in a separate process than the injection molding of the second elastomeric soft tissue cleanser 8180. The first elastomeric soft tissue cleanser 8150 is also formed of a soft, resilient, and flexible material, such as a thermoplastic elastomer. In certain embodiments the first and second elastomeric soft tissue cleansers 8150, 8180 may have the same Shore durometer/hardness. In other embodiments the first and second elastomeric soft tissue cleansers 8150, 8180 may have different Shore durometer/hardnesses (with either of the first and second elastomeric soft tissue cleansers 8150, 8180 being harder than the other to achieve a desired cleaning effect).

As noted above, the first elastomeric soft tissue cleanser 8150 is coupled to the head 8110 along the peripheral surface 8113 of the head 8110. More specifically, the first elastomeric soft tissue cleanser 8150 comprises a bumper portion 8151 that extends along the peripheral surface 8113 of the head 8110 and a connecting portion 8152 that is located on one or both of the rear surface 8112 of the head 8110 and a neck portion 8122 of the handle 8120. The bumper portion 8151 of the first elastomeric soft tissue cleanser 8150 extends in a continuous manner along each of the first lateral side portion 8140 of the peripheral surface 8113 of the head 8110, the distal portion 8142 of the peripheral surface 8113 of the head 8110, and the second lateral side portion 8141 of the peripheral surface 8113 of the head 8110. Due to the connecting portion 8152 of the first elastomeric soft tissue cleanser 8150 extending along the rear surface 8112 of the head 8110 or the neck portion of the handle 8120, the bumper portion 8151 and the connecting portion 8152 of the first elastomeric soft tissue cleanser 8150 collectively form an annular structure that surrounds the rear surface 8112 of the head 8110.

In the exemplified embodiment the connecting portion 8152 of the first elastomeric soft tissue cleanser 8150 comprises a first section 8153 that extends along the proximal portion of the rear surface 8112 of the head 8110. Thus, the first section 8153 of the connecting portion 8152 of the first elastomeric soft tissue cleanser 8150 extends between the first and second lateral side portions 8140, 8141 of the peripheral surface 8113 of the head 8110 and connects the portion of the bumper portion 8151 that is positioned on the first lateral side portion 8140 to the portion of the bumper portion 8151 that is positioned on the second lateral side portion 8141. The connecting portion 8152 of the first elastomeric soft tissue cleanser 8150 also comprises a second section 8154 that extends longitudinally along the rear surface of the neck 8122 of the handle 8120 (see FIG. 81).

As best seen in FIGS. 83, 86, and 87, the base 8144 of the head 8110 comprises a channel 8145 that extends along the first and second lateral side portions 8140, 8141 and the distal portion 8142 of the peripheral surface 8113. The channel 8145 is a continuous, indented surface feature formed into the base 8144 of the head 8110 that extends along each of the portions of the peripheral surface 8113 of the head 8110. The channel 8145 has a wave-like, undulating, or sinusoidal shape as it extends along the first and second lateral side portions 8140, 8141 and the distal portion 8142 of the peripheral surface 8113. The channel 8145 forms a closed-loop because in addition to extending along the first and second lateral side portions 8140, 8141 and the distal portion 8142 of the peripheral surface 8113, it also extends along the rear surface of the proximal end of the head 8110 or along the neck 8122. The first elastomeric soft tissue cleanser 8150 is at least partially disposed within the channel 8145. Stated another way and as will be better understood from the description below, a first portion of the first elastomeric soft tissue cleanser 8150 is disposed in the channel 8145 and a second portion of the first elastomeric soft tissue cleanser 8150 protrudes from the channel 8145.

Still referring to FIGS. 82-87 concurrently, in between the first and second elastomeric soft tissue cleansers 8150, 8180 the base 8144 of the head 8110 comprises an exposed annular surface 8146. The exposed annular surface 8146 of the base 8144 forms a portion of the rear surface 8112 of the head 8110 and it maintains the first and second elastomeric soft tissue cleansers 8150, 8180 completely separate from one another. In the exemplified embodiment, the exposed annular surface 8146 of the base 8144 and the exposed surface 8183 of the pad 8181 of the second elastomeric soft tissue cleanser 8180 collectively form the entire rear surface 8112 of the head 8110.

The exposed annular surface 8146 of the base 8144 is located adjacent to the peripheral surface 8113 of the head 8110 and circumscribes the second elastomeric soft tissue cleanser 8180. Thus, the first elastomeric soft tissue cleanser 8150 circumscribes the exposed annular surface 8146 of the base 8144 and the exposed annular surface 8146 of the base 8144 circumscribes the second elastomeric soft tissue cleanser 8180. Because the first elastomeric soft tissue cleanser 8150 is a continuous structure, the first elastomeric soft tissue cleanser 8150 substantially surrounds the exposed annular surface 8146 of the base 8144. Similarly, because the exposed annular surface 8146 of the base 8144 is a continuous surface, the exposed annular surface 8146 of the base 8144 substantially surrounds the second elastomeric soft tissue cleanser 8180. As can be seen in the figures, in the exemplified embodiment no portion of the first or second elastomeric soft tissue cleansers 8150, 8180 traverses or otherwise passes over or along the exposed annular surface 8146 of the base 8144. Thus, the exposed annular surface 8146 of the base 8144 is an annular region of the base 8144 that is completely devoid of an elastomeric material being coupled or adhered thereto.

As noted above, the bumper portion 8151 of the first elastomeric soft tissue cleanser 8150 extends continuously along the first and second lateral portions 8140, 8141 and the distal portion 8142 of the peripheral surface 8113 of the head 8110. The peripheral surface 8113 of the head 8110 and the rear surface 8112 of the head 8110 intersect to form a perimeter 8104 of the rear surface 8112 of the head 8110. The bumper portion 8151 of the first elastomeric soft tissue cleanser 8150 comprises a plurality of raised portions 8160 located along the perimeter 8104 that protrude above (or protrude beyond) the rear surface 8112 of the head 8110 and a plurality of lower portions 8164 that are located on the peripheral surface 8113. Thus, the bumper portion 8151 of the first elastomeric soft tissue cleanser 8150 extends continuously along the peripheral surface 8113 of the head 8110 without gaps or breaks and includes the raised portions 8160 that protrude beyond the rear surface 8112 of the head 8110 at the perimeter 8104 where the peripheral surface 8113 meets/intersects the rear surface 8112 and the lower portions 8164 that are located on the peripheral surface 8113 and do not protrude beyond the rear surface 8112 of the head 8110.

The bumper portion 8151 alternates between the raised portions 8160 and the lower portions 8164 as it extends along the periphery 8113 of the head 8110. Thus, the raised portions 8160 are spaced-apart along the perimeter 8103 of the head 8110 and the lower portions 8164 are spaced apart along the peripheral surface 8113 of the head 8110. A portion of the exposed annular surface 8146 of the base 8144 of the head 8110 is located between each pair of adjacent raised portions 8160. Thus, the perimeter 8104 alternates between the raised portions 8160 and the exposed annular surface 8146 along the entirety of the perimeter 8104 of the head 8110. An exposed side surface portion 8162 of the base 8144 is located between adjacent ones of the lower portions 8164 of the bumper portion 8151 of the first elastomeric soft tissue cleanser 8150. Thus, the peripheral surface 8113 alternates between the lower portions 8164 and the exposed side surface portion 8162 of the base 8144 along the entirety of the peripheral surface 8113 of the head 8110.

The plurality of raised portions 8160 protrude beyond the rear surface 8112 of the head 8110 such that a reference plane that is coextensive with or includes the rear surface 8112 of the head 8110 will intersect the raised portions 8160 of the bumper portion 8151 of the first elastomeric soft tissue cleanser 8150. The plurality of raised portions 8160 are arranged in a spaced-apart manner about the perimeter 8104 of the head 8110 so as to at least partially circumscribe the rear surface 8112 of the head 8110.

The bumper portion 8151 of the first elastomeric soft tissue cleanser 8150 comprises the raised portions 8160 on each of the first lateral side portion 8140, the second lateral side portion 8141, and the distal portion 8142. Furthermore, each of the raised portions 8160 on the first lateral side portion 8140 are transversely aligned with one of the raised portions 8160 on the second lateral side portion 8141 so that an axis that is perpendicular to the longitudinal axis 8A-8A that intersects one of the raised portion 8160 on the first lateral side portion 8140 will also intersect one of the raised portions 8160 on the second lateral side portion 8141. Similarly, each of the lower portions 8164 on the first lateral side portion 8140 are transversely aligned with one of the lower portions 8164 on the second lateral side portion 8141. Stated another way, the bumper portion 8151 of the first elastomeric soft tissue cleanser 8150 is substantially symmetric about the longitudinal axis 8A-8A.

In the exemplified embodiment, the plurality of raised portions 8160 of the bumper portion 8151 of the first elastomeric soft tissue cleanser 8150 are ridges having a length 8L measured along the perimeter 8104 and a width 8W measured orthogonal to the length 8L. The length 8L of each of the plurality of raised portions 8160 is greater than its width 8W. Furthermore, each of the plurality of raised portions 8160 protrudes only slightly beyond the rear surface 8112 of the head 8110, such as between approximately 0.5 mm and 2.0 mm, and more specifically between approximately 0.8 mm and 1.5 mm (indicated in FIG. 87 as protruding distance 8D). The length 8L of each of the plurality of raised portions 8160 is greater than its protruding distance 8D. Due to a combination of the length 8L, width 8W, and protruding distance 8D, the raised portions 8160 of the bumper portion 8151 are somewhat rigid while also being flexible due to being formed of an elastomeric material, which enables the raised portions 8160 to gently scrape debris from a user's tongue and other soft tissue surfaces during use.

The protruding distance 8D of the raised portions 8160 of the bumper portion 8151 of the first elastomeric soft tissue cleanser 8150 is less than the height of at least some (and potentially all) of the protuberances 8182 of the second elastomeric soft tissue cleanser 8180 (measured from the rear surface 8112 of the head 8110 to the terminal/distal ends of the protuberances 8182). Thus, while the protuberances 8182 of the second elastomeric soft tissue cleanser 8180 may readily flex and bend when contacted against a user's tongue and other soft tissue surfaces, the raised portions 8160 of the first elastomeric soft tissue cleanser 8150 will bend to a lesser degree due to the length 8L and protruding distance 8D, which enables the raised portions 8160 to be used for scraping and penetrating rather than just one or the other.

Of course, the invention is not limited to the raised portions 8160 being ridges in all embodiments. In certain other embodiments, the raised portions 8160 may be nubs having a protruding distance that is greater than the length and width of the raised portion 8160. In such an embodiment the raised portions 8160 will be more flexible because a taller, thinner elastomeric structure will have more flexibility than a shorter, thicker elastomeric structure. In certain embodiments it is desirable to have the protruding distance 8D be less than the length 8L to minimize the flexibility of the raised portions 8160 to increase their ability to scrape a user's tongue and other soft tissue surfaces. Thus, in certain embodiments it is preferred that 8L>8D and 8L>8W.

The raised portions 8160 of the bumper portion 8151 of the first elastomeric soft tissue cleanser 8150 comprise an inner surface 8165 facing the second elastomeric soft tissue cleanser 8180 and an opposite outer surface 8166. In the exemplified embodiment the inner surface 8165 is an arcuate surface that extends from a terminal end of the raised portions 8160 to the rear surface 8112 of the head 8110 (and more specifically to the exposed annular surface 8146 of the base 8144). More specifically, the inner surface 8165 is arcuate and convex. The outer surface 8166 of the raised portions 8160 is also an arcuate and convex surface. More specifically, the outer surface 8166 is a continually convex surface from the peripheral surface 8113 to the terminal end of the raised portions 8160 and the inner surface 8165 is a continually convex surface from the rear surface 8112 to the terminal end of the raised portions 8160. Thus, the inner and outer surfaces 8165, 8166 of the raised portions 8160 are both convex surfaces so that the raised portions 8160 have a generally egg-shaped cross-sectional profile (see FIG. 87).

The bumper portion 8151 of the first elastomeric soft tissue cleanser 8150 comprises an undulating upper edge 8155 and an undulating lower edge 8158. Each of the undulating upper and lower edges 8155, 8158 takes on a sinusoidal shape when viewed in side profile. Due to the undulating upper and lower edges 8155, 8158, the bumper portion 8151 of the first elastomeric soft tissue cleanser 8150 is also wavy and undulating and has a sinusoidal shape when viewed in side profile.

Figure 85:
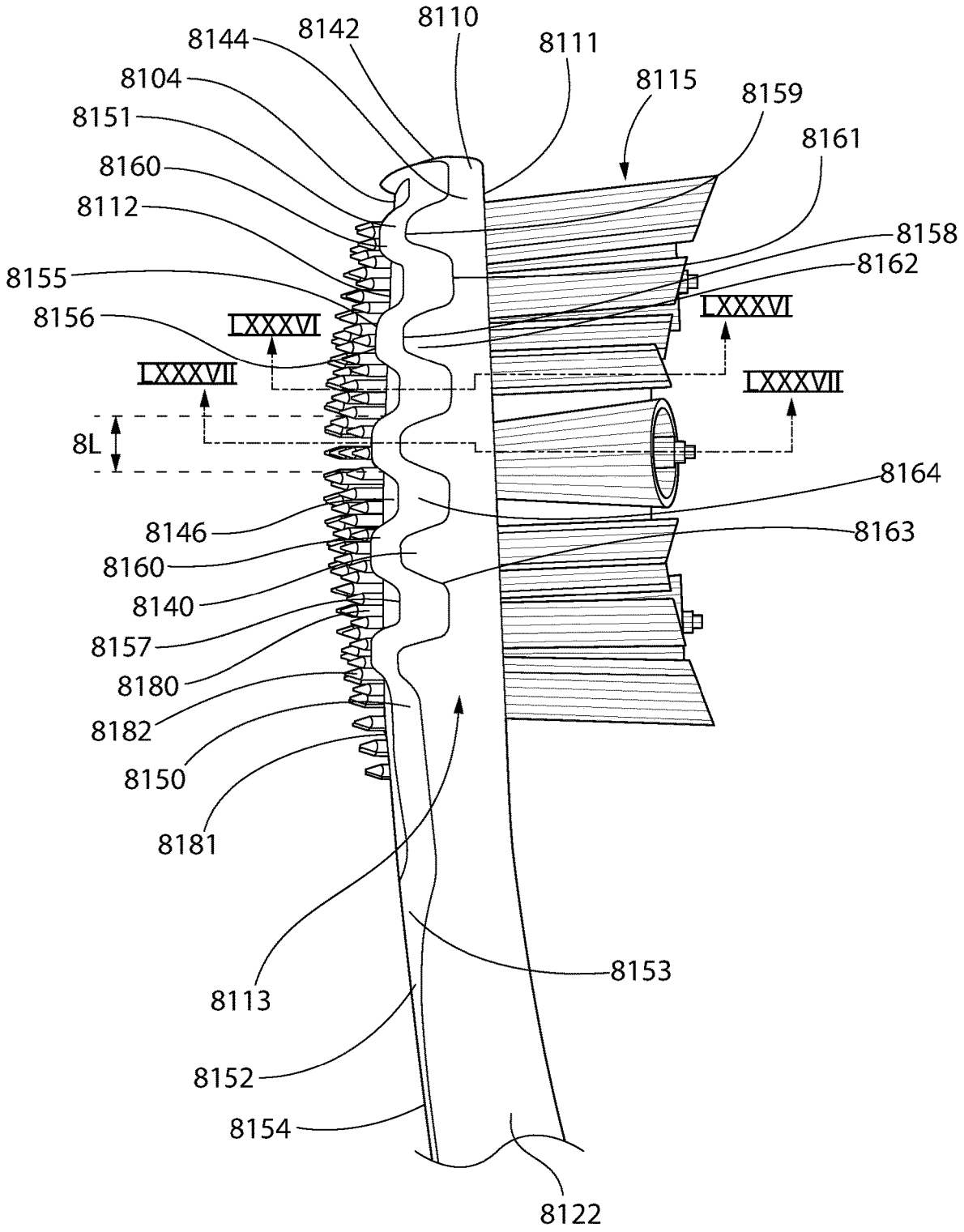
FIG. 85 is a side view of the head of the oral care implement of FIG. 80.

The undulating upper edge 8155 of the bumper portion 8151 of the first elastomeric soft tissue cleanser 8150 includes a plurality of high points 8156 that protrude above the rear surface 8112 of the head 8110 and a plurality of low points 8157 that are located at or below the rear surface 8112 of the head 8110. The protruding appearance of the plurality of high points 8156 is best seen in FIGS. 85 and 87. In the exemplified embodiment the plurality of low points 8157 of the undulating upper edge 8155 are located on the peripheral surface 8113 of the head 8110 and spaced a distance below the rear surface 8113 of the head 8110. However, the invention is not to be so limited in all embodiments and the low points 8157 of the undulating upper edge 8155 may protrude beyond the rear surface 8113 in some embodiments, or it may be located right at the perimeter 8104 in other embodiments.

The raised portions 8160 of the bumper portion 8151 of the first elastomeric soft tissue cleanser 8150 comprise the high points 8156 of the undulating upper edge 8155. In the exemplified embodiment the plurality of low points 8157 appear to be located below the rear surface 8112 of the head 8110 and entirely positioned on the peripheral surface 8113 of the head 8110, but the invention is not to be so limited in all embodiments and the plurality of low points 8157 may be located at the rear surface 8112 of the head 8110 (or directly at the perimeter 8104 formed by the intersection of the peripheral surface 8113 and the rear surface 8112) in other embodiments. The undulating upper edge 8155 of the bumper portion 8151 of the first elastomeric soft tissue cleanser 8150 alternates repetitively between the high points 8156 and the low points 8157 along the peripheral surface 8113 of the head 8110.

The undulating lower edge 8158 comprises a plurality of high points 8159 located on the peripheral surface 8113 and a plurality of low points 8161 that are also located on the peripheral surface 8113. Furthermore, as noted above the base 8144 comprises the plurality of exposed side surface portions 8162 on the peripheral surface 8113. The exposed side surface portions 8162 of the base 8144 and the lower portions 8164 of the bumper portion 8151 of the first elastomeric soft tissue cleanser 8150 collectively form the peripheral surface 8113 of the head 8110. Specifically, the undulating lower edge 8158 of the bumper portion 8151 of the first elastomeric soft tissue cleanser 8150 comprises a plurality of valleys 8163 that include the low points 8161 of the undulating lower edge 8158. The exposed side surface portions 8162 of the base 8144 are located between adjacent ones of the valleys 8163 of the undulating lower edge 8158.

The high points 8156 of the undulating upper edge 8155 are aligned with the high points 8159 of the undulating lower edge 8158. The low points 8157 of the undulating upper edge 8155 are aligned with the low points 8161 of the undulating lower edge 8158. In this sense, aligned means that a reference plane that is perpendicular to the longitudinal axis 8A-8A and that extends through the front and rear surfaces 8111, 8112 of the head 8110 will intersect one of the high points 8156 of the undulating upper edge 8155 and one of the high points 8159 of the undulating lower edge 8158 or one of the low points 8157 of the undulating upper edge 8155 and one of the low points 8161 of the undulating lower edge 8158.

Furthermore, the raised portions 8160 of the bumper portion 8151 of the first elastomeric soft tissue cleanser 8150 are located between the high points 8156 of the undulating upper edge 8155 and the correspondingly aligned high points 8159 of the undulating lower edge 8158. The lower portions 8164 of the bumper portion 8151 of the first elastomeric soft tissue cleanser 8150 are positioned on the peripheral surface 8113 and in the exemplified embodiment do not protrude beyond the rear surface 8112 of the head 8110 (although they could in alternative embodiments). The lower portions 8164 of the bumper portion 8151 of the first elastomeric soft tissue cleanser 8150 are located between the low points 8157 of the undulating upper edge 8155 and the correspondingly aligned low points 8161 of the undulating lower edge 8158.

Concept Nine

Figure 88:
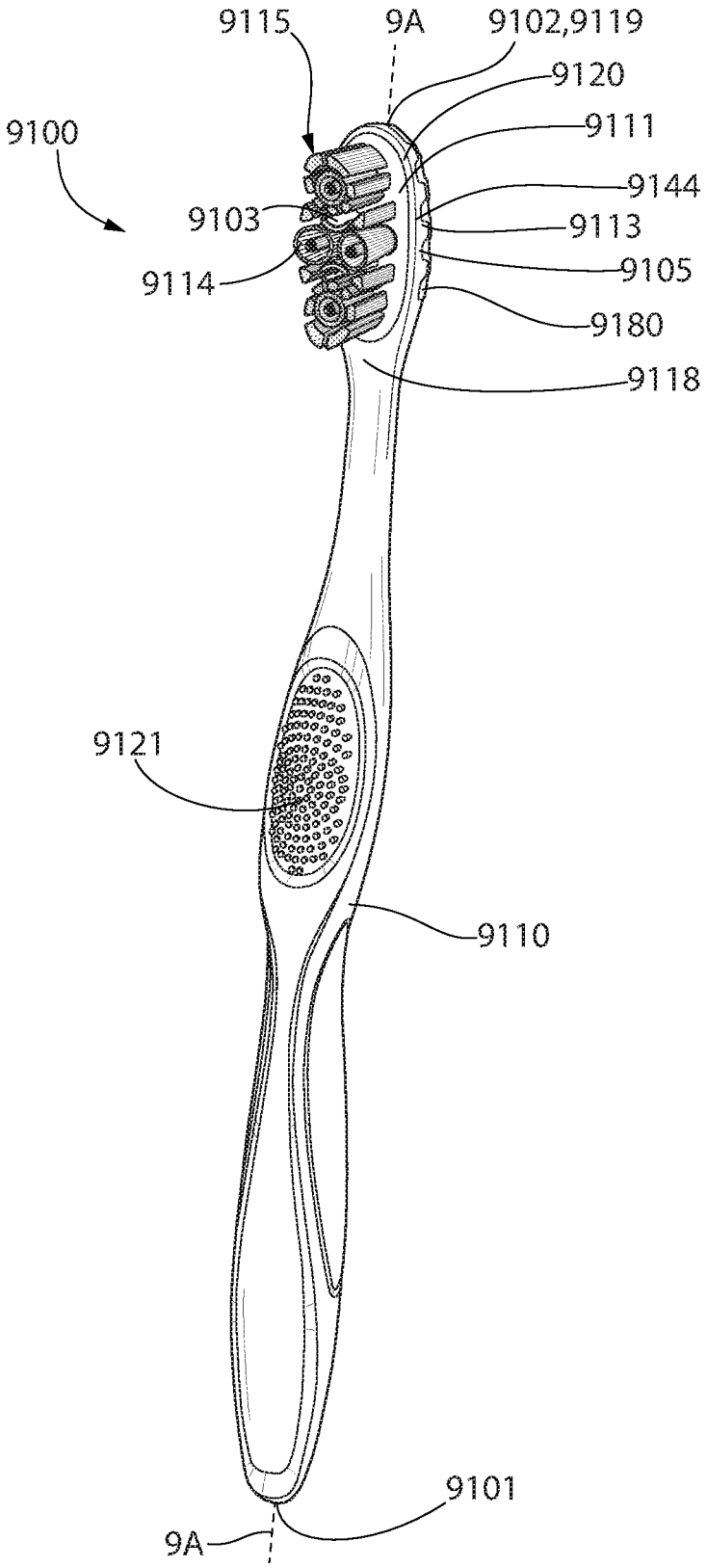
FIG. 88 is front perspective view of an oral care implement in accordance with an embodiment of the present invention.
Figure 89:
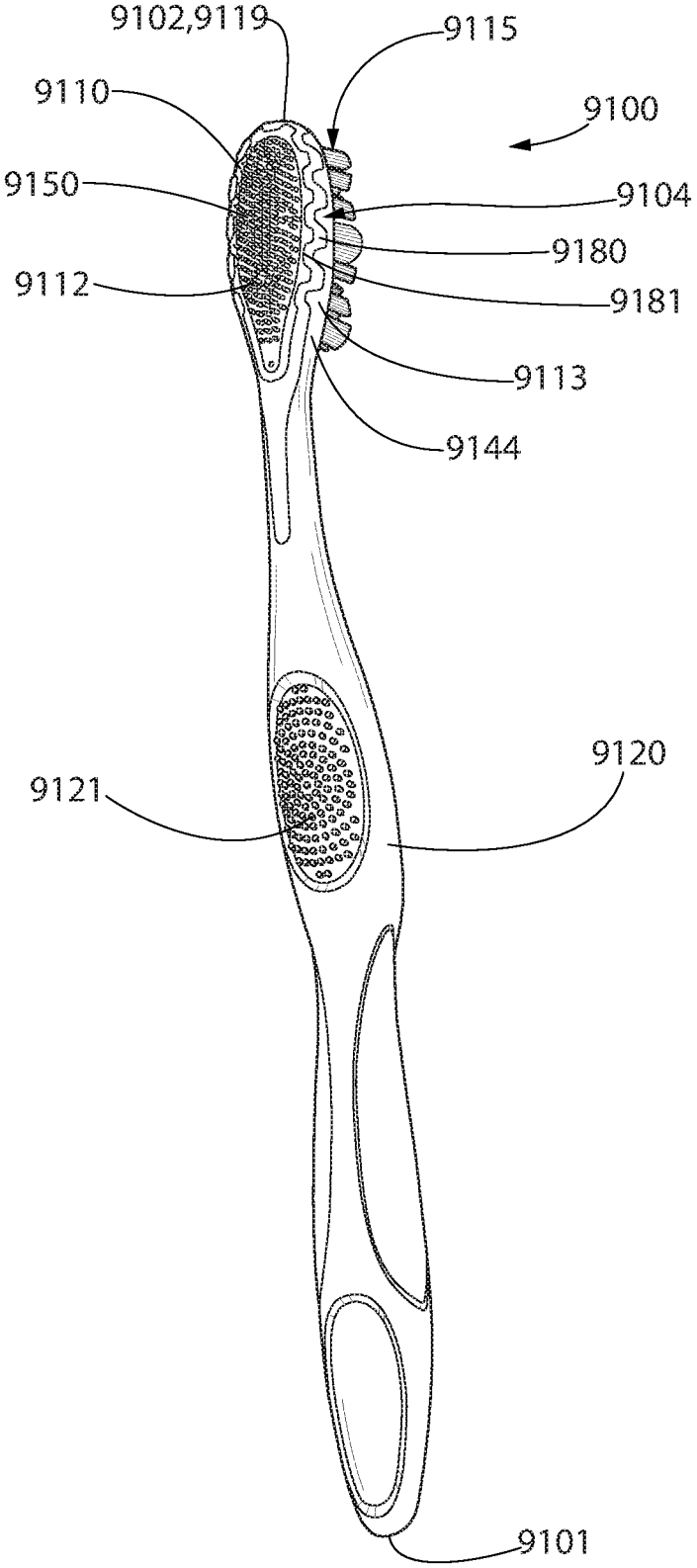
FIG. 89 is a rear perspective view of the oral care implement of FIG. 88.
Figure 90:
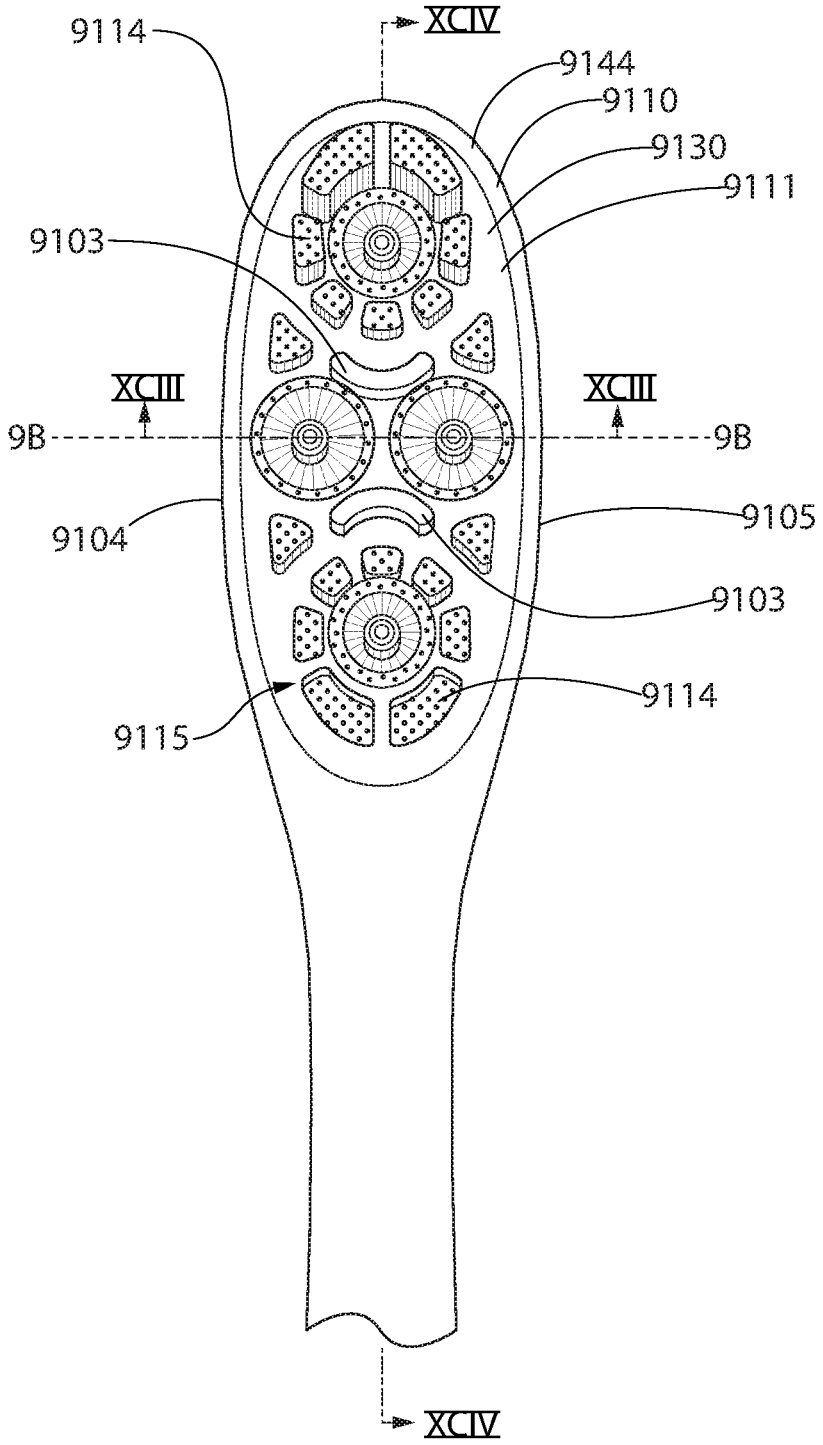
FIG. 90 is a close-up front view of a head of the oral care implement of FIG. 88.
Figure 91:
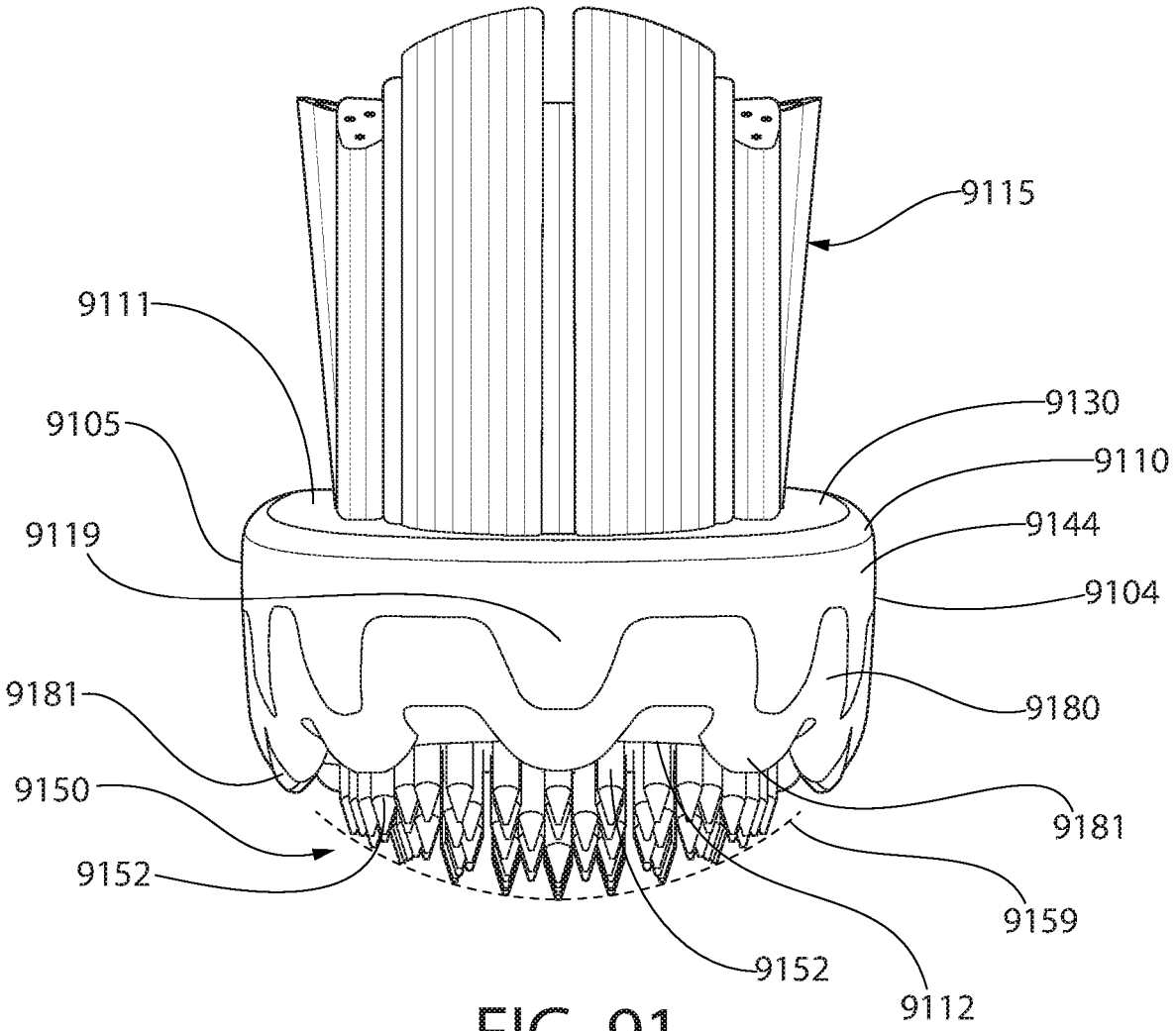
FIG. 91 is a top view of the head of the oral care implement of FIG. 88.

Referring first to FIGS. 88 and 89 concurrently, an oral care implement 9100 is illustrated in accordance with one embodiment of the present invention. In the exemplified embodiment, the oral care implement 9100 is in the form of a manual toothbrush. However, in certain other embodiments the oral care implement 9100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Thus, it is to be understood that the inventive concepts discussed herein can be applied to any type of oral care implement unless a specific type of oral care implement is specified in the claims.

The oral care implement 9100, which generally comprises a head 9110 and a handle 9120, extends from a proximal end 9101 to a distal end 9102 along a longitudinal axis 9A-9A. The head 9110 extends from a proximal end 9118 to a distal end 9119 along a longitudinal axis that is coextensive with the longitudinal axis 9A-9A of the oral care implement 9100. Furthermore, in the exemplified embodiment the distal end 9102 of the oral care implement 9100 is the same as the distal end 9119 of the head 9110.

The handle 9120 is an elongated structure that provides the mechanism by which the user can hold and manipulate the oral care implement 9100 during use. In the exemplified embodiment, the handle 9120 is generically depicted having various contours for user comfort. Of course, the invention is not to be limited by the specific shape illustrated for the handle 9120 in all embodiments and in certain other embodiments the handle 9120 can take on a wide variety of shapes, contours, and configurations, none of which are limiting of the present invention unless so specified in the claims.

In the exemplified embodiment, the handle 9120 is formed of a hard or rigid plastic material, such as for example without limitation polymers and copolymers of ethylene, propylene, butadiene, vinyl compounds, and polyesters such as polyethylene terephthalate. The handle 9120 also includes a grip 9121 that is formed of a resilient/elastomeric material. In the exemplified embodiment the grip 9121 is molded over a portion of the handle 9120 that is typically gripped by a user's thumb and forefinger during use. Furthermore, it should be appreciated that additional regions of the handle 9120 can be overmolded with the resilient/elastomeric material to enhance the gripability of the handle 9120 during use. For example, portions of the handle 9120 that are typically gripped by a user's palm during use may be overmolded with a thermoplastic elastomer or other resilient material to further increase comfort to a user. Furthermore, materials other than those noted above can be used to form the handle 9120, including metal, wood, or any other desired material that has sufficient structural rigidity to permit a user to grip the handle 9120 and manipulate the oral care implement 9100 during toothbrushing.

The head 9110 of the oral care implement 9100 is coupled to the handle 9120 and comprises a front surface 9111 and an opposing rear surface 9112. In the exemplified embodiment the front surface 9111 is a continuous and planar surface of the head 9110. Furthermore, the head 9110 comprises a peripheral surface 9113 extending between the rear surface 9112 and the front surface 9111. The peripheral surface 9113 of the head 9110 includes a first lateral side 9104 and a second lateral side 9105. In the exemplified embodiment, the head 9110 is formed integrally with the handle 9120 as a single unitary structure using a molding, milling, machining, or other suitable process. However, in other embodiments the handle 9120 and the head 9110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus, the head 9110 may, in certain embodiments, be formed of any of the rigid plastic materials described above as being used for forming the handle 9120, although the invention is not to be so limited in all embodiments and other materials that are commonly used during toothbrush head manufacture may also be used.

The oral care implement 9100 also comprises a plurality of tooth cleaning elements 9115 extending from the front surface 9111 of the head 9110. The invention is not to be limited by the structure, pattern, orientation, and material of the tooth cleaning elements 9115 in all embodiments. Furthermore, where it does not conflict with the other disclosure provided herein or the claims, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, polybutylene terephthalate (PBT) bristles, spiral bristles, rubber bristles, elastomeric protrusions, flexible polymer protrusions, combinations thereof, and/or structures containing such materials or combinations. Thus, any combination of these tooth cleaning elements may be used within the tooth cleaning element field in some embodiments. Furthermore, where bristles are used for one or more of the tooth cleaning elements 9115, such bristles can be tapered, end-rounded, spiral, or the like.

In embodiments that use elastomeric materials to form one or more of the tooth cleaning elements 9115, suitable elastomeric materials may include any biocompatible resilient material suitable for uses in an oral hygiene apparatus. To provide optimum comfort as well as cleaning benefits, the elastomeric material of any such tooth cleaning element may have a hardness property in the range of A10 to A70 Shore hardness in one embodiment, or A8 to A25 Shore hardness in another embodiment. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Figure 93:
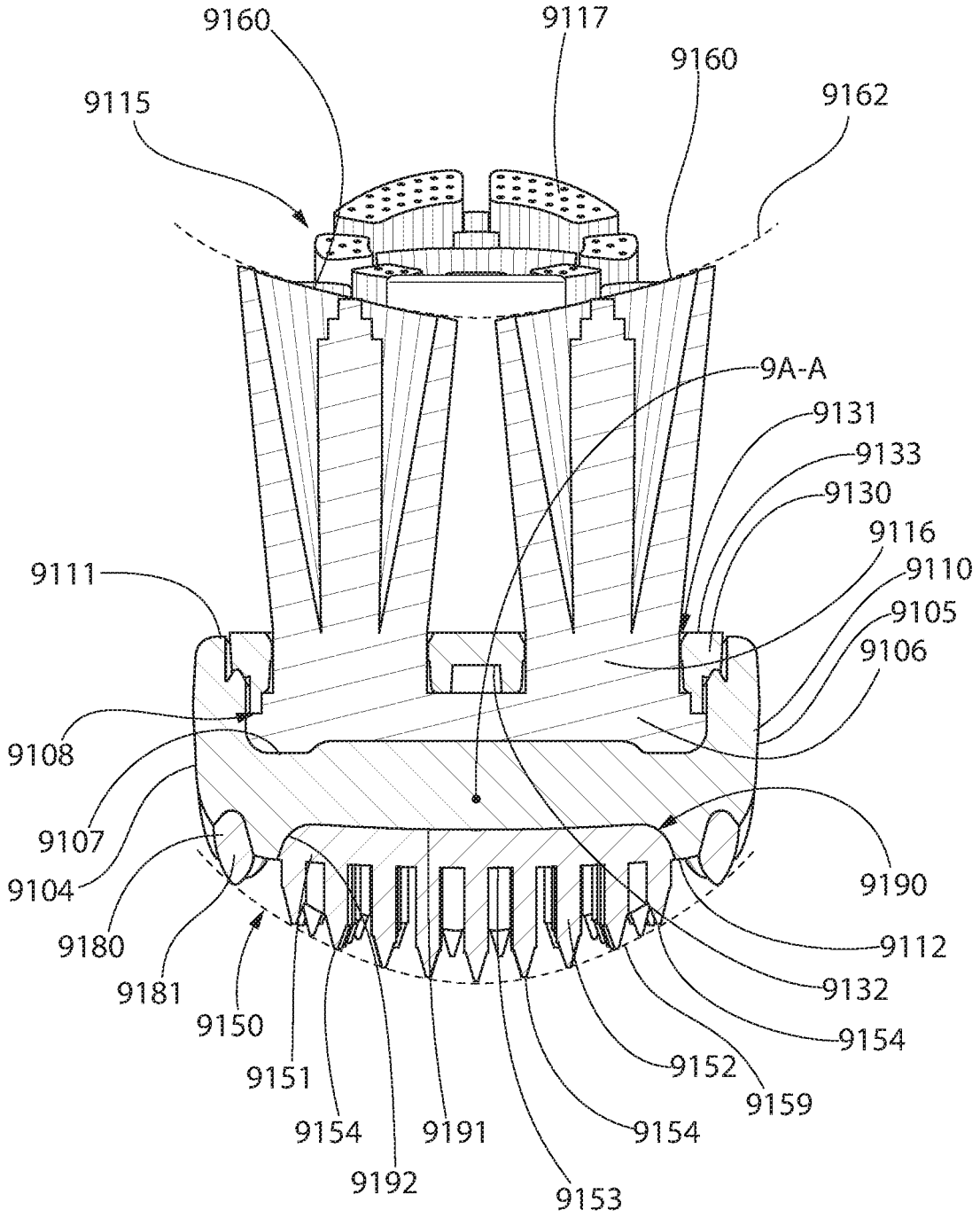
FIG. 93 is a cross-section taken along line XCIII-XCIII of FIG. 90.
Figure 94:
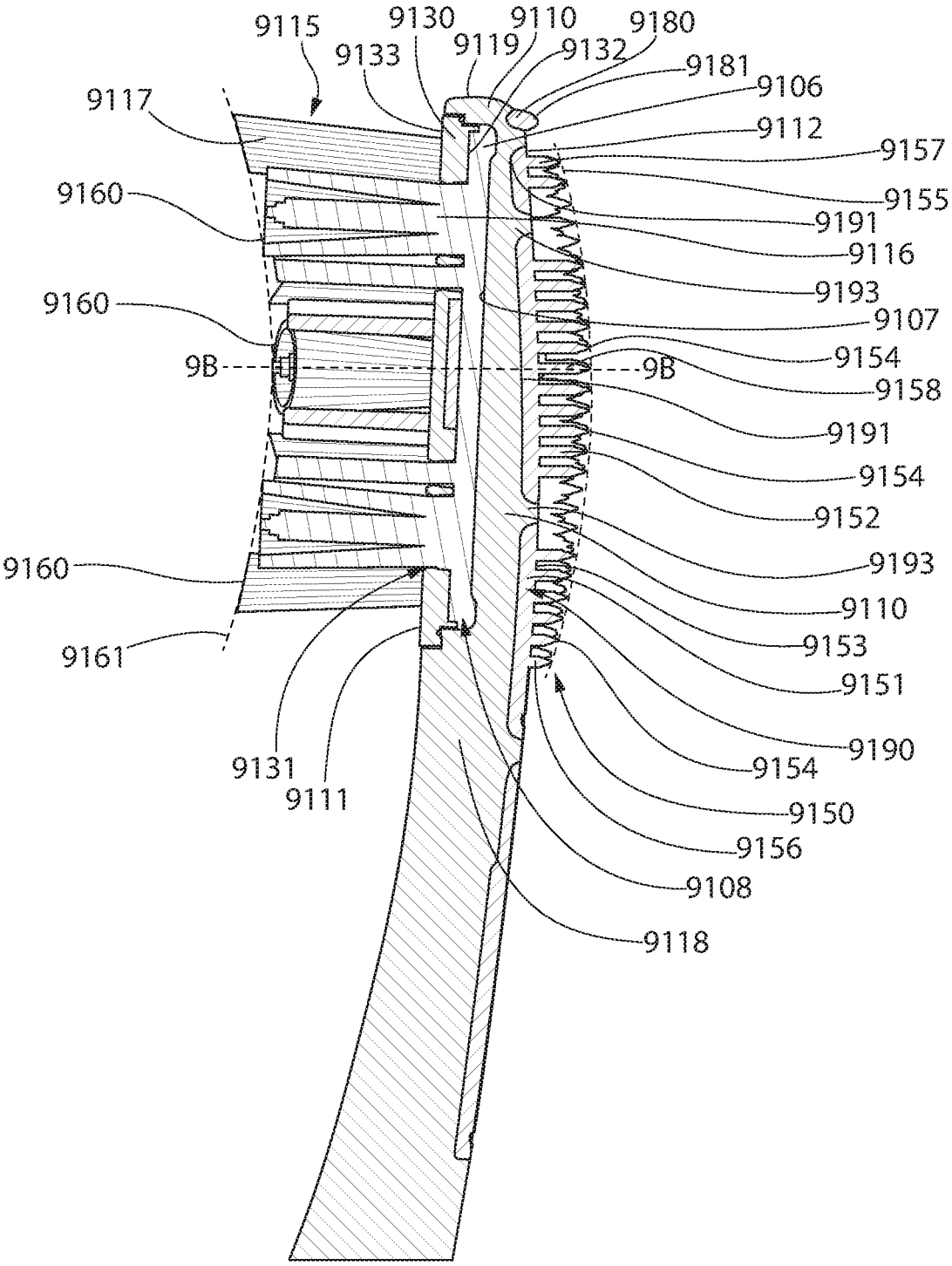
FIG. 94 is a cross-section taken along line XCIV-XCIV of FIG. 90.

The tooth cleaning elements 9115 may be coupled to the head 9110 in any manner known in the art, including staples, in-mold tufting (IMT), anchor-free tufting (AFT), or a modified AFT known as AMR. Referring briefly to FIGS. 93 and 94, one manner in which the tooth cleaning elements 9115 are secured to the head 9110 via AFT will be described. Specifically, in the exemplified embodiment the tooth cleaning elements 9115 are formed as a cleaning element assembly on a head plate 9130 such that one or more of the tooth cleaning elements 9115 are mounted onto the head plate 9130 and then the head plate 9130 is coupled to the head 9110. In such an embodiment, the head plate 9130 is a separate and distinct component from the head 9110 of the oral care implement 9100. However, the head plate 9130 is connected to the head 9110 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 9130 and the head 9110 are separately formed components that are secured together during manufacture of the oral care implement 9100.

In certain embodiments, the head plate 9130 may comprise an upper surface 9133 and a lower surface 9132. The upper surface 9133 of the head plate 9130 forms a portion of the front surface 9111 of the head 9110 when the head plate 9130 is coupled to the head 9110 as discussed herein. The head plate 9130 comprises a plurality of holes 9131 formed therethrough from the upper surface 9133 to the lower surface 9132, and the tooth cleaning elements 9115 may be mounted to the head plate 9130 within the holes 9131. Specifically, in AFT a plate or membrane (i.e., the head plate 9130) is created separately from the head 9110. The tooth cleaning elements 9115 (such as bristles, elastomeric elements, and combinations thereof) are positioned into the head plate 9130 so as to extend through the holes 9131 of the head plate 9130. Free ends 9117 of the tooth cleaning elements 9115 on one side of the head plate 9130 perform the cleaning function. Anchor portions 9116 of the tooth cleaning elements 9115 on the other side of the head plate 9130 are melted together by heat to be anchored in place. As the tooth cleaning elements 9115 are melted together, a melt matte 9106 is formed. The melt matte 9106 is a thin layer of plastic that is formed by melting the anchor portions 9116 of the tooth cleaning elements 9115 so that the anchor portions 9116 of the tooth cleaning elements transition into a liquid, at which point the liquid of the anchor portions 9116 of the tooth cleaning elements combine together into a single layer of liquid plastic that at least partially covers the lower surface 9132 of the head plate 9130. After the heat is no longer applied, the melted anchor portions 9116 of the bristles solidify/harden to form the melt matte 9106 or thin layer of plastic.

After the tooth cleaning elements 9115 are secured to the head plate 9130, the head plate 9130 is secured to the head 9110 such as by ultrasonic welding or mechanical techniques (i.e., snap-fit, interference fit, slot-and-tab, or the like) so that the upper surface 9133 of the head plate 9130 forms at least a portion of the front surface 9111 of the head 9110. When the head plate 9130 is coupled to the head 9110, the melt matte 9106 is located between the lower surface 9132 of the head plate 9130 and a floor 9107 of a basin 9108 of the head 9110 in which the head plate 9130 is disposed. The melt matte 9106, which is coupled directly to and in fact forms a part of the tooth cleaning elements 9115, prevents the tooth cleaning elements 9115 from being pulled through the holes 9131 in the head plate 9130 to ensure that the tooth cleaning elements 9115 remain attached to the head plate 9130 during use of the oral care implement 9100.

As noted above, in another embodiment the tooth cleaning elements may be connected to the head 9110 using a technique known in the art as AMR. In this technique, the handle is formed integrally with the head plate as a one-piece structure. After the handle and the head plate are formed, the bristles are inserted into holes in the head plate so that the free/cleaning ends of the bristles extend from the front surface of the head plate and the bottom ends of the bristles are adjacent to the rear surface of the head plate. After the bristles are inserted into the holes in the head plate, the bottom ends of the bristles are melted together by applying heat thereto, thereby forming a melt matte at the rear surface of the head plate. The melt matte is a thin layer of plastic that is formed by melting the bottom ends of the bristles so that the bottom ends of the bristles transition into a liquid, at which point the liquid of the bottom ends of the bristles combine together into a single layer of liquid plastic that at least partially covers the rear surface of the head plate. After the heat is no longer applied, the melted bottom ends of the bristles solidify/harden to form the melt matte/thin layer of plastic. In some embodiments, after formation of the melt matte, a tissue cleanser is injection molded onto the rear surface of the head plate, thereby trapping the melt matte between the tissue cleanser and the rear surface of the head plate. In other embodiments, other structures may be coupled to the rear surface of the head plate to trap the melt matte between the rear surface of the head plate and such structure without the structure necessarily being a tissue cleanser (the structure can just be a plastic material that is used to form a smooth rear surface of the head, or the like).

Of course, techniques other than AFT and AMR can be used for mounting the tooth cleaning elements 9115 to the head 9110, such as widely known and used stapling techniques or the like. In such embodiments the head plate 9130 may be omitted and the tooth cleaning elements 9115 may be coupled directly to the head 9110. Furthermore, in a further modified version of the AFT and AMR processes discussed above, the head plate 9130 may be formed by positioning the tooth cleaning elements 9115 within a mold, and then molding the head plate 9130 around the tooth cleaning elements 9115 via an injection molding process.

Referring now to FIGS. 88-92 concurrently, in the exemplified embodiment the plurality of tooth cleaning elements 9115 includes a plurality of separate tufts of bristles 9114 and a plurality of elastomeric tooth cleaning elements 9103. Although illustrated herein as having a specific arrangement and shape, in certain embodiments the arrangement of the tufts of bristles 9114 and elastomeric tooth cleaning elements 9103 as well as the shapes thereof can be modified from that which is depicted in the figures within the bounds of the disclosure set forth herein. Specifically, the pattern, orientation, and positioning of the tufts of bristles 9114 and the elastomeric tooth cleaning elements 9103 may be modified from that which is depicted in the figures so long as the various concave and convex profiles formed by the tooth cleaning elements as described herein below remain.

The head 9110 of the oral care implement 9100 comprises a base 9144 that is formed of a hard plastic material, such as any of the materials noted above for forming the handle 9120 (including polypropylene and the like). Furthermore, the head 9110 comprises an elastomeric soft tissue cleanser 9150 and a bumper 9180 that are coupled to the base 9144. Each of the elastomeric soft tissue cleanser 9150 and the bumper 9180 are formed of a resilient and flexible elastomeric material, such as a thermoplastic elastomer. The elastomeric soft tissue cleanser 9150 and the bumper 9180 serve to clean the user's tongue and soft tissue surfaces and to protect the user's gums during toothbrushing. Specifically, the bumper 9180 is positioned on the peripheral surface 9113 of the head 9110 and thus reduces the impact of the hard plastic of the base 9144 against the user's gums during use of the toothbrush. The bumper 9180 also includes raised features 9181 that protrude beyond the rear surface 9112 of the head 9110 and can also be used for cleaning/scraping a user's tongue. The elastomeric soft tissue cleanser 9150 is positioned on the rear surface 9112 (and in fact forms a part of the rear surface) of the head 9110 and can be used to clean and scrub a user's tongue and other soft tissue surfaces. The combination of the bumper and the elastomeric soft tissue cleanser 9150, 9180 also results in a highly desirable aesthetic appearance for the oral care implement 9100.

Referring briefly to FIGS. 91-94, the elastomeric soft tissue cleanser 9150 generally comprises a pad 9151 and a plurality of protuberances 9152 that extend from the pad 9151. In the exemplified embodiment, each of the plurality of protuberances 9152 is in the form of a nub. As used herein a "nub" generally refers to a column-like protrusion (without limitation to the cross-sectional shape of the protrusion) which is upstanding from a base surface. In the exemplified embodiment, the protuberances 9152 are nubs comprising a cylindrical body portion and a tapered tip portion. In a general sense, the protuberances 9152 in the preferred construction have a height that is greater than the width at the base of the protuberance 9152 (as measured in the longest direction). Nevertheless, protuberances or nubs could include projections wherein the widths and heights are roughly the same or wherein the heights are somewhat smaller than the base widths. Moreover, in some circumstances (e.g., where the protuberances taper to a tip or include a base portion that narrows to a smaller projection), the base width can be substantially larger than the height. Furthermore, in the exemplified embodiment the plurality of protuberances 9152 have varying heights such that some of the protuberances 9152 are taller than other of the protuberances 9152. The varying heights of the protuberances 9152 results in the protuberances 9152 forming convex profiles depending on the viewing angle as described in more detail below.

The base 9144 of the head 9110 comprises a basin 9190 formed therein. The basin 9190 is defined by a floor 9191 that is recessed relative to the rear surface 9112 of the head 9110 and a sidewall 9192 that extends from the floor 9191 to the rear surface 9112 of the head 9110. The elastomeric soft tissue cleanser 9150 is positioned within the basin 9190. More specifically, the pad 9151 of the elastomeric soft tissue cleanser 9150 is disposed within the basin 9190 so that an exposed surface 9153 of the pad 9151 is flush or substantially flush with the portion of the rear surface 9112 of the head 9110 that is formed by the base 9144 (substantially flush can be the exposed surface 9153 of the pad 9151 either extending beyond or being recessed relative to the rear surface 9112 of the base 9144 of the head 9110 by between approximately 0.1 mm and 1.0 mm). The exposed surface 9153 of the pad 9151 thus forms a part of the rear surface 9112 of the head 9110. Furthermore, the plurality of protuberances 9152 extend from the rear surface 9112 of the head 9110 for contact with a user's soft tissue surfaces. The elastomeric soft tissue cleanser 9150 may be coupled to the head via an injection molding process (i.e., by injection molding an elastomeric material directly into the basin 9190 while the head 9110 is positioned within a mold). In certain embodiments the head 9110 may include one or more peg members 9193 that extend upwardly from the floor 9191 of the basin 9190 to assist in retaining the elastomeric soft tissue cleanser 9150 within the basin 9190.

Figure 95:
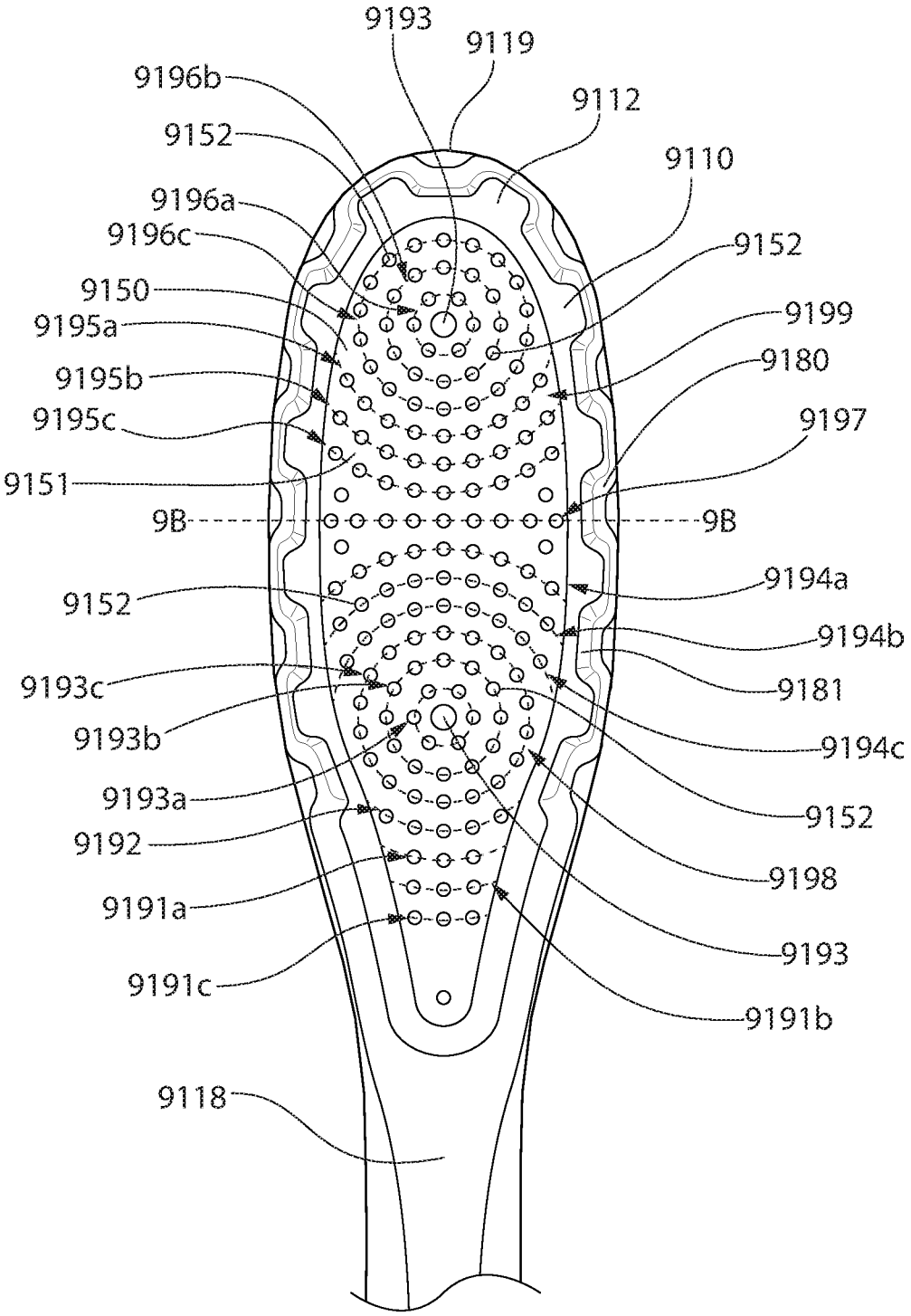
FIG. 95 is a rear view of the head of the oral care implement of FIG. 88.

Referring briefly to FIG. 95, in the exemplified embodiment the protuberances 9152 of the elastomeric soft tissue cleanser 9150 are arranged in a particular pattern on the rear surface 9112 of the head 9110. Specifically, the protuberances 9152 are arranged to form a first set of concentric rings 9199 and a second set of concentric rings 9198. The first set of concentric rings 9199 are positioned on the upper half of the rear surface 9112 of the head 9110 and the second set of concentric rings 9198 are positioned on the lower half of the rear surface 9112 of the head 9110. The upper and lower halves of the rear surface 9112 of the head 9110 (and the first and second sets of concentric rings 9199, 9198) are separated by a single transverse row 9197 of the protuberances 9152 (although more than one transverse row may be included in alternative embodiments). The first set of concentric rings 9199 comprises a first ring **9196*a* that surrounds one of the peg members 9193, a second ring 9196*b* that surrounds the first ring 9196*a*, and a third ring 9196*c* that surrounds the second ring 9196*b*. The second set of concentric rings 9198 comprises a first ring 9193*a* that surrounds one of the peg members 9193**, a second ring

9193*b* that surrounds the first ring 9193*a*, and a third ring 9193*c* that surrounds the second ring 9193*b*.

Furthermore, the protuberances 9154 form three arcuate rows 9195*a-c* positioned between the first set of concentric rings 9199 and the transverse row 9197. Each of three arcuate rows 9195*a-c* has a concave surface facing the first set of concentric rings 9199 and a convex surface facing the transverse row 9197. The protuberances 9154 also form three arcuate rows 9194*a-c* positioned between the transverse row 9197 and the second set of concentric rings 9199. Each of the three arcuate rows 9194*a-c* has a concave surface facing the second set of concentric rings 9198 and a convex surface facing the transverse row 9197. Finally, the protuberances 9154 form a fourth arcuate row 9192 adjacent to the third ring 9193*c* and three substantially transverse rows 9191*a-c* between the fourth arcuate row 9192 and the proximal end 9118 of the head 9110. Each of the various rings, arcuate rows, and transverse rows described above are formed by a plurality of the protuberances 9152 that are arranged in a spaced-apart manner. Each of the various rings, arcuate rows, and transverse rows is delineated with a dotted line for ease of understanding of the description herein above.

The elastomeric soft tissue cleanser 9150 is symmetric about a plane that intersects and extends along the transverse row 9197 from the third ring 9196*c* of the first set of concentric rings 9199 to the third ring 9193*c* of the second set of concentric rings 9198. The elastomeric soft tissue cleanser 9150 in its entirety is asymmetric about the plane that intersects and extends along the transverse row 9197 due to the additional rows 9192, 9191*a-c* located between the third ring 9193*c* of the second set of concentric rings 9198 and the proximal end 9118 of the head 9110.

Figure 92:
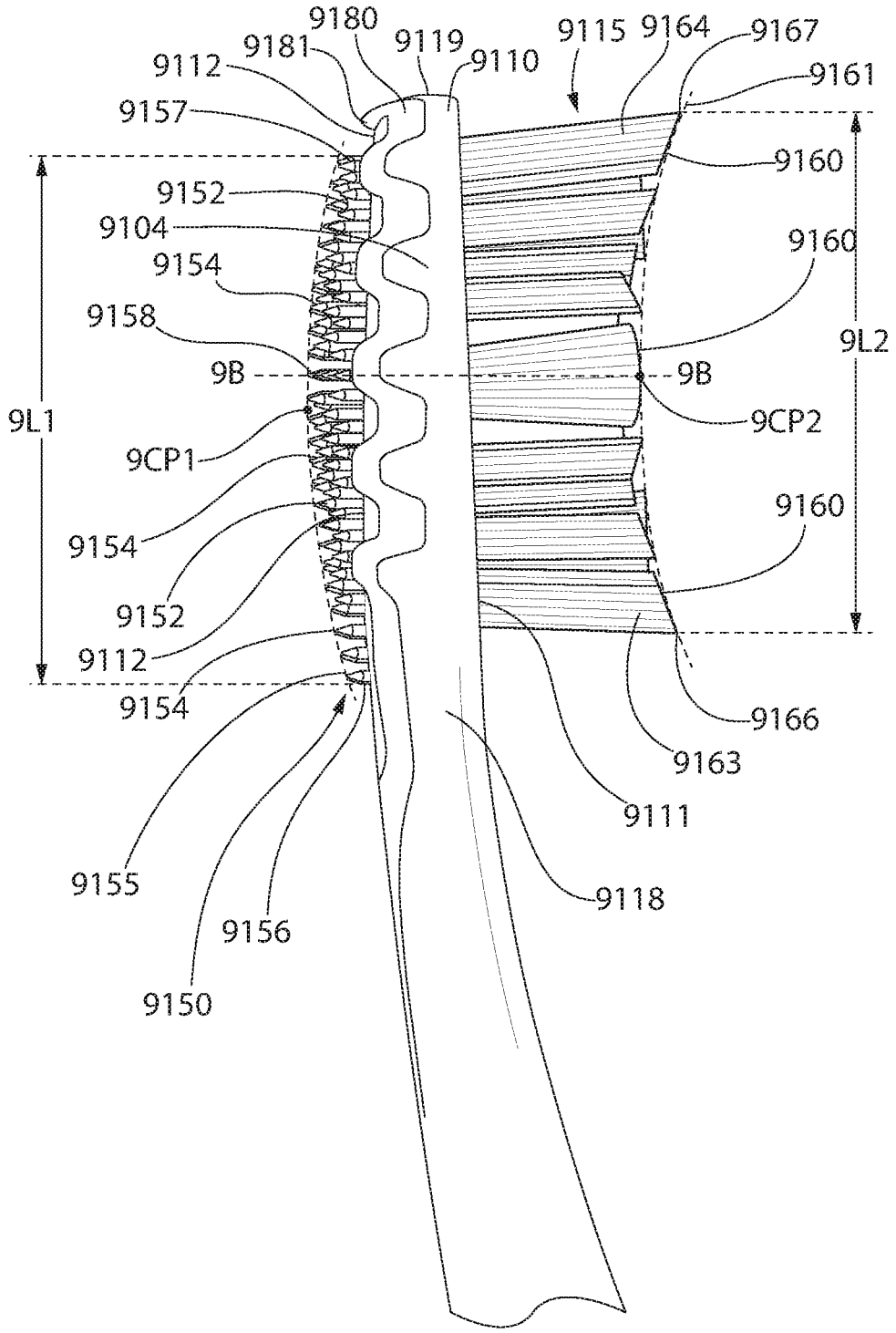
FIG. 92 is a side view of the head of the oral care implement of FIG. 88.

Referring now to FIGS. 92-94, the oral care implement 9100 will be further described. As noted above, the elastomeric soft tissue cleanser 9150 comprises the plurality of protuberances 9152 that extend from the rear surface 9112 of the head 9110. Each of the protuberances 9152 of the elastomeric soft tissue cleanser 9150 terminates in a free end 9154. The free ends 9154 of the protuberances 9152 collectively define a convex longitudinal side profile 9155. Thus, when viewed from the side of the head 9110 as depicted in FIG. 92, the convex longitudinal side profile 9155 is formed by the free ends 9154 of the protuberances 9152. The convex longitudinal side profile 9155 is delineated with a dashed line for ease of understanding.

The convex longitudinal side profile 9155 defined by the free ends 9154 of the protuberances 9152 is achieved due to a variation in the heights of the protuberances 9152 as measured from the rear surface 9112 of the head 9110 to the free ends 9154 of the protuberances 9152. More specifically, each of the protuberances 9152 has a height measured from the rear surface 9112 of the head 9110 to its free end 9154. The relative heights of the protuberances 9152 increases in a direction of the longitudinal axis A-A from a proximal-most one 9156 of the protuberances 9152 to a tallest one 9158 of the protuberances 9152 and then decreases in the direction of the longitudinal axis 9A-9A from the tallest one 9158 of the protuberances 9152 to a distal-most one 9157 of the protuberances 9152. The protuberances 9152 can be broken down into longitudinal columns (each column being formed by substantially aligned protuberances that extend from the proximal end 9118 of the head 9110 to the distal end 9119 of the head 9110 along the longitudinal axis 9A-9A or along an axis that is parallel to the longitudinal axis 9A-9A). The protuberances 9152 in each longitudinal column increase in height from the protuberance within that column that is located nearest to the proximal end 9118 of the head 9110 to a central transverse plane 9B-9B (or some other transverse plane located at the peak height of the protuberances 9152). The protuberances 9152 in each longitudinal column also increase in height from the protuberance within that column that is located nearest to the distal end 9119 of the head 9110 to the central transverse plane 9B-9B (or some other transverse plane located at the peak height of the protuberances 9152).

In the exemplified embodiment, the head 9110 comprises the central transverse plane 9B-9B, which is a plane that extends orthogonally to and intersects the longitudinal axis 9A-9A and which is located approximately centrally on the head 9110 between the proximal and distal ends 9118, 9119 of the head 9110. In certain embodiments, the tallest one (or ones) 9158 of the protuberances 9154 is positioned so as to be intersected by the central transverse plane 9B-9B. In such embodiments the heights of the protuberances 9152 decrease with longitudinal distance from the central transverse plane 9B-9B towards the proximal and distal ends 9118, 9119 of the head 9110. The decrease in height may be gradual and continuous in some embodiments, or stepped in other embodiments.

In addition to the convex longitudinal side profile 9155, the free ends 9154 of the protuberances 9152 also comprise at least one convex transverse top profile 9159. Thus, when viewed along at least one transverse plane that intersects and is substantially orthogonal to the longitudinal axis 9A-9A (such as the view provided in FIG. 93, for example), the free ends 9154 of the protuberances 9152 form a convex profile. The convex transverse top profile 9159 is delineated in dotted lines in FIGS. 91 and 93 for ease of understanding. The term top profile is intended to mean the profile that is seen by a viewer who is viewing the toothbrush from the distal end 9119 of the head 9110 or from a transverse plane that is substantially orthogonal to and intersects the longitudinal axis 9A-9A and that is taken through the head 9110 from the first lateral side 9104 to the second lateral side 9105.

FIG. 93 illustrates a cross-sectional view of the head taken along one such transverse plane. As can be seen, the convex transverse top profile 9159 of the free ends 9154 of the protuberances 9152 is formed along the transverse plane due to a variation in the heights of the protuberances 9152 along the transverse plane. Thus, in the exemplified embodiment the heights of the protuberances 9154 decrease along the transverse plane with distance from the longitudinal axis 9A-9A towards the first and second lateral sides 9104, 9105 of the head 9110. Stated another way, along the transverse plane the protuberances 9152 nearest to the first and second lateral sides 9104, 9105 of the head 9110 are shortest, and the heights of the protuberances 9154 gradually increase from the protuberances 9152 nearest to the first and second lateral sides 9104, 9105 of the head 9110 to the protuberance 9152 that is aligned with the longitudinal axis 9A-9A.

Thus, the free ends 9154 of the protuberances 9152 collectively define the convex longitudinal side profile 9155 (see FIG. 92) and the free ends 9154 of the protuberances 9152 comprise at least one convex top profile 9159 (see FIG. 93). Although the convex top profile 9159 is only depicted along one transverse plane that intersects and is substantially orthogonal to the longitudinal axis 9A-9A, the free ends 9154 of the protuberances 9152 may comprise multiple convex top profiles taken at multiple different transverse planes that intersect and are substantially orthogonal to the longitudinal axis 9A-9A.

Still referring to FIGS. 92-94, in addition to the free ends 9154 of the protuberances 9152 forming the convex longitudinal side profile 9155 and comprising the at least one convex transverse top profile 9159, the tooth cleaning elements 9115 form concave profiles. More specifically, the plurality of tooth cleaning elements 9115 terminate in free ends 9160. The free ends 9160 of the tooth cleaning elements 9115 collectively define a concave longitudinal side profile 9161 (delineated in dashed lines). In the exemplified embodiment, the concave longitudinal side profile 9161 is formed due to a variation in height of the tooth cleaning elements 9115 as measured from the front surface 9111 of the head 9110 to the free ends 9160 of the tooth cleaning elements 9115. The height of the tooth cleaning elements 9115 (and also of the concave longitudinal side profile 9161) gradually and continuously increases from the central transverse plane 9B-9B to proximal-most 9163 and distal-most 9164 ones of the tooth cleaning elements 9115 (i.e., towards the proximal and distal ends 9118, 9119 of the head 9110). Although described herein as forming a convex longitudinal side profile, it should be understood that in certain embodiments although the terminal ends 9160 of the tooth cleaning elements 9115 generally form a concave shape, there may be some tooth cleaning elements that extend beyond or above the general concave shaped-profile. Thus, every single tooth cleaning element 9115 need not follow the contours of the concave profile. Rather, some of the tooth cleaning elements 9115 may extend beyond the concave profile while the terminal ends 9160 of the tooth cleaning elements 9115 still form a readily visible concave longitudinal side profile 9161.

In addition, the free ends 9160 of the tooth cleaning elements 9115 comprise at least one concave transverse top profile 9162 (delineated in dashed lines for reference). Thus, when viewed along at least one transverse plane that intersects and is substantially orthogonal to the longitudinal axis 9A-9A (such as the view provided in FIG. 93, for example), the free ends 9160 of the tooth cleaning elements 9115 form a concave profile. In the exemplified embodiment the at least one transverse plane is the central transverse plane 9B-9B. However, there may be other transverse planes at which the free ends 9160 of the tooth cleaning elements 9115 form a concave transverse top profile. As can be seen in FIG. 93, the concave transverse top profile 9162 is formed due to the heights of the tooth cleaning elements 9115 increasing with distance from the longitudinal axis 9A-9A towards the lateral sides 9104, 9105 of the head 9110 along the transverse plane. Although described herein as forming the concave transverse top profile 9162, it should be understood that in certain embodiments although the terminal ends 9160 of the tooth cleaning elements 9115 generally form the concave shape of the concave transverse top profile 9162, there may be some tooth cleaning elements that extend beyond or above the general concave shaped profile. Thus, every single tooth cleaning element 9115 need not follow the contours of the concave transverse top profile 9162. Rather, some of the tooth cleaning elements 9115 may extend beyond the concave transverse top profile 9162 while the terminal ends 9160 of the tooth cleaning elements 9115 still form a readily visible concave transverse top profile 9161.

As seen in FIG. 93, in the exemplified embodiment the free ends 9160 of the tooth cleaning elements 9115 comprise the concave transverse top profile 9161 and the free ends 9154 of the protuberances 9152 comprise the convex transverse top profile 9159 along the same transverse plane (i.e., the central transverse plane 9B-9B). Thus, in the exemplified embodiment when the toothbrush is viewed at the location of the central transverse plane 9B-9B, the free ends 9160 of the tooth cleaning elements 9115 form the concave transverse top profile 9161 and the free ends 9154 of the protuberances 9152 form the convex transverse top profile 9159.

However, in certain embodiments the convex transverse top profile 9159 of the protuberances 9152 may be formed along a first transverse plane that intersects and is substantially orthogonal to the longitudinal axis 9A-9A and the concave transverse top profile 9162 of the tooth cleaning elements 9115 may be formed along a second transverse plane that intersects and is substantially orthogonal to the longitudinal axis 9A-9A. In some embodiments the first and second transverse planes may be the same as noted herein above (i.e., the central transverse plane 9B-9B). In other embodiments the first and second transverse planes may be different. In one particular embodiment, the first transverse plane may be positioned closer to the distal end 9119 of the head 9110 than the second transverse plane 9118. In another particular embodiment the first transverse plane may be positioned closer to the proximal end 9118 of the head 9110 than the second transverse plane 9118. In still other embodiments convex transverse top profiles may be formed by the protuberances 9152 along transverse planes located on opposite sides of the transverse plane along which the concave transverse top profile is formed by the tooth cleaning elements 9115.

Furthermore, in some embodiments the convex longitudinal side profile 9155 formed by the free ends 9154 of the protuberances 9152 has a maximum height at the central transverse plane 9B-9B and the concave longitudinal side profile 9161 formed by the free ends 9160 of the tooth cleaning elements 9115 has a minimum height at the central transverse plane 9B-9B. However, in the exemplified embodiment, the convex longitudinal side profile 9155 formed by the free ends 9154 of the protuberances 9152 has a maximum height that is offset from a minimum height of the concave longitudinal side profile 9161 formed by the free ends 9160 of the tooth cleaning elements 9115. More specifically, the maximum height of the convex longitudinal side profile 9155 (formed by the tallest protuberance 9158) is located closer to the distal end 9119 of the head 9110 than the minimum height of the concave longitudinal side profile 9161 (see FIG. 92).

Furthermore, in the exemplified embodiment the longitudinal side profile 9155 formed by the free ends 9154 of the protuberances 9152 has a longitudinal center point 9CP1 that is longitudinally offset (i.e., spaced apart in the longitudinal direction) from the central transverse plane 9B-9B. More specifically, the longitudinal center point 9CP1 of the convex longitudinal side profile 9155 is located between the central transverse plane 9B-9B and the proximal end 9118 of the head 9110. Thus, the convex longitudinal side profile 9155 formed by the free ends 9154 of the protuberances 9152 is asymmetric about the central transverse plane 9B-9B. The concave longitudinal side profile 9161 formed by the free ends 9160 of the tooth cleaning elements 9115 has a longitudinal center point 9CP2 that is located on the central transverse plane 9B-9B. Thus, the concave longitudinal side profile 9161 formed by the free ends 9160 of the tooth cleaning elements 9115 is symmetric about the central transverse plane 9B-9B.

Thus, the tooth cleaning elements 9115 collectively form the concave longitudinal side profile 9161 and comprise the at least one concave transverse top profile 9162 and the protuberances 9152 collectively form the convex longitudinal side profile 9155 and comprise the at least one convex transverse top profile 9159. In certain embodiments, the radius of curvature of the concave longitudinal side profile 9161 and the convex longitudinal side profile 9155 may be the same to enhance the aesthetic, although this is not required in all embodiments. Furthermore, in certain embodiments the radius of curvature of the at least one concave transverse top profile 9162 and the at least one convex transverse top profile 9159 may be the same, although this is not required in all embodiments.

In the exemplified embodiment, the elastomeric soft tissue cleanser 9150 has a first length 9L1 measured from the free end 9154 of the distal-most one 9157 of the protuberances 9152 to the free end 9154 of the proximal-most one 9158 of the protuberances 9152. Furthermore, the tooth cleaning elements 9115 form a tooth cleaning element field having a second length 9L2 measured from a distal-most portion 9167 of the distal-most one 9164 of the tooth cleaning elements 9115 to a proximal-most portion 9166 of the proximal-most one 9163 of the tooth cleaning elements 9115. In the exemplified embodiment, the first length 9L1 is greater than the second length 9L2. However, the invention is not to be so limited in all embodiments and in certain other embodiments the first and second lengths 9L1, 9L2 may be equal, and in still other embodiments the second length 9L2 may be greater than the first length 9L1.

Furthermore, in the exemplified embodiment the free end 9154 of the distal-most one 9157 of the protuberances 9152 is longitudinally offset from the distal-most portion 9167 of the distal-most one 9164 of the tooth cleaning elements 9115. More specifically, the distal-most portion 9167 of the distal-most one 9164 of the tooth cleaning elements 9115 is positioned closer to the distal end 9119 of the head 9110 than the distal-most one 9157 of the protuberances 9152. Additionally, the proximal-most portion 9166 of the free end 9160 of the proximal-most one 9163 of the tooth cleaning elements 9115 is longitudinally offset from the free end 9154 of the proximal-most one 9156 of the protuberances 9152. Most specifically, the free end 9154 of the proximal-most one 9156 of the protuberances 9152 is positioned closer to the proximal end 9118 of the head 9110 than the proximal-most portion 9166 of the proximal-most one 9163 of the tooth cleaning elements 9115.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle;

a head coupled to the handle, the head comprising a front surface;

a plurality of tooth cleaning elements extending from the front surface of the head;

the plurality of tooth cleaning elements comprising a multi-height bristle tuft extending from a single tuft hole along a tuft axis, the multi-height bristle tuft comprising a first bristle tuft section formed by taller bristles and a second bristle tuft section formed by shorter bristles, the second bristle tuft section having a U-shaped transverse cross-section that partially surrounds a transverse cross-section of the first bristle tuft section, and the first bristle tuft section axially protrudes from an upper surface of the second bristle tuft section;

wherein the first bristle tuft section has first and second major surfaces and first and second minor surfaces, the first minor surface and portions of the first and second major surfaces being exposed and not surrounded by the second bristle tuft section when the front surface of the head is viewed in plan view.

2. The oral care implement according to claim 1 wherein the transverse cross-section of the first bristle tuft section comprises: a first portion nested within the U-shaped transverse cross-section of the second bristle tuft section; and a second portion transversely protruding from the U-shaped transverse cross-section of the second bristle tuft section.

3. The oral care implement according to claim 1 wherein the plurality of tooth cleaning element comprises a first set of the multi-height bristle tufts and a second set of the multi-height bristle tufts; wherein the head comprises a longitudinal axis extending from a proximal end of the head to a distal end of the head; and wherein the first set of the multi-height bristle tufts are arranged along a first lateral edge of the head and the second set of the multi-height bristle tufts are arranged along a second lateral edge of the head.

4. The oral care implement according to claim 3 wherein for each of the multi-height bristle tufts of the first and second sets, the second bristle tuft section is closer to the longitudinal axis of the head than the first bristle tuft section.

5. An oral care implement comprising:

a handle;

a head coupled to the handle, the head comprising a front surface and a longitudinal axis extending from a proximal end of the head to a distal end of the head;

a plurality of tooth cleaning elements extending from the front surface of the head;

the plurality of tooth cleaning elements comprising a first conical tuft comprising a first bristle wall having an inner surface defining a first cavity along a first cavity axis, the first cavity having a first transverse cross-sectional area that increases with distance from the front surface of the head, the first conical tuft terminating in a first annular top surface;

the plurality of tooth cleaning elements comprising a second conical tuft comprising a second bristle wall having an inner surface defining a second cavity along a second cavity axis, the second cavity having a second transverse cross-sectional area that increases with distance from the front surface of the head, the second conical tuft terminating in a second annular top surface; and the first annular top surface having a first diameter and the second annular top surface having a second diameter, the first and second diameters being different;

wherein the first bristle wall has an outer surface that forms a first acute angle with the front surface of the head and the second bristle wall has an outer surface that forms a second acute angle with the front surface of the head, the second acute angle being a larger angle than the first acute angle.

6. The oral care implement according to claim 5 wherein the first annular top surface is a first height above the front surface of the head and the second annular top surface is a second height above the front surface of the head, the first height being greater than the second height.

7. The oral care implement according to claim 5 wherein the first annular top surface is a first height above the front surface of the head and the second annular top surface is a second height above the front surface of the head, the first and second heights being substantially the same.

8. An oral care implement comprising:

a handle;

a head coupled to the handle, the head comprising a front surface and a longitudinal axis extending from a proximal end of the head to a distal end of the head;

a plurality of tooth cleaning elements extending from the front surface of the head;

the plurality of tooth cleaning elements comprising a first conical tuft comprising a first bristle wall having an inner surface defining a first cavity along a first cavity axis, the first cavity having a first transverse cross-sectional area that increases with distance from the front surface of the head, the first conical tuft terminating in a first annular top surface;

the plurality of tooth cleaning elements comprising a second conical tuft comprising a second bristle wall having an inner surface defining a second cavity along a second cavity axis, the second cavity having a second transverse cross-sectional area that increases with distance from the front surface of the head, the second conical tuft terminating in a second annular top surface; and the first annular top surface being a first height from the front surface of the head and the second annular top surface being a second height from the front surface of the head, the first and second heights being different;

wherein the first bristle wall has an outer surface that forms a first acute angle with the front surface of the head and the second bristle wall has an outer surface that forms a second acute angle with the front surface of the head, the second acute angle being a larger angle than the first acute angle.

9. The oral care implement according to claim 1 wherein approximately one half of the transverse cross-section is positioned within the U-shaped transverse cross-section.

10. The oral care implement according to claim 1 wherein at least a portion of the first and second minor surfaces is linear.

11. The oral care implement according to claim 1 wherein at least a portion of the first and second major surfaces is linear.

12. The oral care implement according to claim 1 wherein the first and second major surfaces are longer than the first and second minor surfaces.

* * * * *